US007175976B2

(12) United States Patent
Yoneyama et al.

(10) Patent No.: US 7,175,976 B2
(45) Date of Patent: Feb. 13, 2007

(54) SILVER HALIDE PHOTOGRAPHIC LIGHT-SENSITIVE MATERIAL

(75) Inventors: Hiroyuki Yoneyama, Minami-ashigara (JP); Yasuaki Deguchi, Minami-ashigara (JP); Naoto Ohshima, Minami-ashigara (JP); Kiyoshi Takeuchi, Minami-ashigara (JP); Akira Ikeda, Minami-ashigara (JP); Naoto Matsuda, Minami-ashigara (JP)

(73) Assignee: Fuji Photo Film Co., Ltd., Kanagawa-ken (JP)

( * ) Notice: Subject to any disclaimer, the term of this patent is extended or adjusted under 35 U.S.C. 154(b) by 0 days.

(21) Appl. No.: 10/969,031

(22) Filed: Oct. 21, 2004

(65) Prior Publication Data

US 2005/0123868 A1 Jun. 9, 2005

Related U.S. Application Data

(63) Continuation of application No. 10/373,653, filed on Feb. 26, 2003, now abandoned.

(30) Foreign Application Priority Data

| | | |
|---|---|---|
| Mar. 1, 2002 | (JP) | 2002-056655 |
| Mar. 28, 2002 | (JP) | 2002-092878 |
| Mar. 28, 2002 | (JP) | 2002-092912 |
| Mar. 29, 2002 | (JP) | 2002-095836 |
| Mar. 29, 2002 | (JP) | 2002-095865 |

(51) Int. Cl.

| | |
|---|---|
| ***G03C 1/08*** | (2006.01) |
| ***G03C 7/26*** | (2006.01) |
| ***G03C 7/32*** | (2006.01) |
| ***G03C 1/005*** | (2006.01) |
| ***G03C 1/494*** | (2006.01) |

(52) U.S. Cl. ..... 430/543; 430/558; 430/557; 430/388; 430/389; 430/503; 430/523; 430/556

(58) Field of Classification Search ..... 430/543, 430/558, 388, 389, 503, 523, 556, 557
See application file for complete search history.

(56) References Cited

U.S. PATENT DOCUMENTS

| | | | | |
|---|---|---|---|---|
| 3,841,880 | A | 10/1974 | Kertel | |
| 5,021,330 | A | 6/1991 | Bergthaller et al. | |
| 5,066,576 | A | 11/1991 | Ichijima et al. | |
| 5,455,149 | A | 10/1995 | Bergthaller | |
| 6,677,110 | B2 | 1/2004 | Takuechi et al. | |
| 6,727,053 | B2 * | 4/2004 | Takeuchi et al. | 430/558 |
| 2003/0073047 | A1 | 4/2003 | Takuechi et al. | |
| 2004/0058284 | A1 | 3/2004 | Yoneyama | |

FOREIGN PATENT DOCUMENTS

| | | |
|---|---|---|
| DE | 43 29 418 A1 | 3/1995 |
| EP | 0 336 411 A2 | 10/1989 |
| EP | 1 246 006 A2 | 10/2002 |
| JP | 52-82423 | 7/1977 |
| JP | 62-67536 | 3/1987 |
| JP | 2-28645 | 1/1990 |

(Continued)

OTHER PUBLICATIONS

Partial European Search Report for EP 03 00 4340 dated May 28, 2003.

*Primary Examiner*—Geraldine Letscher
(74) *Attorney, Agent, or Firm*—Sughrue Mion, PLLC

(57) ABSTRACT

A silver halide color photographic light-sensitive material comprising at least one yellow color developable light-sensitive silver halide emulsion layer, at least one magenta color developable light-sensitive silver halide emulsion layer, and at least one cyan color developable light-sensitive silver halide emulsion layer, each of which is provided on a support: which comprises at least one yellow coupler of formula (I) and at least one cyan coupler of formula (A);

formula (I)

wherein Q represents a group of non-metal atoms that form a 5- to 7-membered ring in combination with —N═C—N(R1)-, each of R1 and R2 represents a substituent, m represents an integer of 0 to 5, and X represents a hydrogen atom or a group capable of being split-off upon a coupling reaction;

formula (A)

wherein $R_{11}$ and $R_{12}$ each represent an alkyl group or an aryl group, J represents an alkylene group, and X represents a hydrogen atom or a group that can split off upon a coupling reaction.

21 Claims, No Drawings

FOREIGN PATENT DOCUMENTS

| | | |
|---|---|---|
| JP | 3-39958 | 2/1991 |
| JP | 3-98049 | 4/1991 |
| JP | 3-200961 | 9/1991 |
| JP | 4-133052 | 5/1992 |
| JP | 5-27389 | 2/1993 |
| JP | 6-266075 | 9/1994 |
| JP | 7-152130 | 6/1995 |
| JP | 9-50100 | 2/1997 |
| JP | 9-222707 | 8/1997 |
| JP | 10-97039 | 4/1998 |
| JP | 2001-188311 | 7/2001 |

* cited by examiner

SILVER HALIDE PHOTOGRAPHIC LIGHT-SENSITIVE MATERIAL

CROSS-REFERENCE TO RELATED APPLICATION

This application is a continuation of U.S. application Ser. No. 10/373,653 now abandoned filed Feb. 26, 2003, the disclosure of which is incorporated herein by reference.

FIELD OF THE INVENTION

The present invention relates to a silver halide color photographic light-sensitive material, and especially it relates to a silver halide color photographic light-sensitive material that is excellent in both color reproduction and rapid processing suitability.

More specifically, the present invention relates to a silver halide color photographic light-sensitive material that is excellent in both color reproduction and image storage stability, and moreover that is suitable for an ultra-rapid processing, whereby an improvement in productivity can be realized. Particularly, it relates to a silver halide color printing material.

More specifically, the present invention relates to a silver halide color photographic light-sensitive material showing a high sensitivity and having an ultra-rapid processing suitability with a low cost. Particularly, it relates to a silver halide color photographic light-sensitive material that is suitable for a color print.

BACKGROUND OF THE INVENTION

As a material that provides a high quality image with image stability at a low price, a silver halide photographic light-sensitive material has been widely used until today. Demands for advances in image quality, stability of quality and productivity by users have been remarkably increasing in recent years. As to the demands for advances in image quality, it is wanted to improve pure whiteness, color reproduction, sharpness, etc. As to the demands for advances in quality stability, it is necessary to improve production stability of a light-sensitive material, storage stability in the unexposed state and performance stability during developing processing. As to the improvement in productivity, advances in processing speed are wanted.

In photographic light-sensitive materials for direct view such as a color paper and a color reversal, color reproduction is particularly important. For improvement of color reproduction, first of all it is essential that dyes formed by a coupling reaction between a dye-forming coupler (hereinafter sometimes referred to simply as "a coupler") and an oxidized product of a developing agent have substantially no unwanted absorption and they are excellent in absorption characteristics. In addition, it is important to reduce a residual color owing to remaining sensitizing dyes and/or dyes for prevention of irradiation (irradiation-neutralizing dyes) and also fogging.

Further, in order to form a dye exhibiting a satisfactory color reproduction, performance stability during developing processing is important. Particularly from the viewpoint of advances in productivity, there is a demand for technology realizing reduction in both an amount of silver halide emulsion that is used in the silver halide color photographic light-sensitive material and a layer-thickness of a light-sensitive material, resulting in a thinner layer light-sensitive material.

As the coupler that forms a cyan dye having a low secondary absorption, phenol-based cyan couplers described in U.S. Pat. Nos. 5,686,235 and 5,888,716 are known. However, because the cyan couplers described in these patents are low in activity, they need a large amount of a high boiling point organic solvent, and it is necessary to use a large amount of a silver halide emulsion for compensation of a colored density. Further, because said cyan dye has a low secondary absorption, it is necessary for compensation of a gray density to use larger amounts of a yellow dye-forming coupler and a magenta dye-forming coupler than those required when other types of cyan dye-forming coupler are used. Under such circumstances, there is a demand for technologies that enable to improve both color reproduction and a rapid processing suitability.

In a silver halide photographic light-sensitive material (hereinafter, sometimes referred to simply as "a light-sensitive material") for subtractive color photography, a color image is formed by dyes of three primary colors of yellow, magenta and cyan. In the color photography that uses the current p-phenylenediamine color-developing agent, acylacetoanilide-based compounds are conventionally used as a yellow coupler to form yellow-image.

The yellow coupler that is used in a light-sensitive material for direct view such as a color paper is set importance on hue and fastness property of a dye obtained from the coupler. From this reason, mainly pivaloyl acetoanilide-based couplers have been used until today. However, a hue obtained from these color-forming couplers (hereinafter, sometimes referred to simply as "coupler") extends to an undesirable longer wavelength region, which renders it difficult to obtain a yellow color that is high in color purity. Further, owing to a lower molar absorbance of said yellow dyes than those of magenta dyes or cyan dyes, it is necessary for obtaining a desired density to use larger mounts of both the yellow coupler and the silver halide emulsion than the case of using a magenta coupler or a cyan coupler. Further, the current yellow dyes are not satisfactory to the image storage stability under the conditions of high temperature and high humidity, or the conditions of light irradiation.

In order to solve such the problems, the acyl group and the anilido group were improved. Recently, as improved couplers of the conventional acylacetoanilide-series, there are proposed, for example, 1-alkylcyclopropanecarbonyl acetoanilide-series compounds, described in JP-A-4-218042 ("JP-A" means unexamined published Japanese patent application); cyclomalonic acid diamide-type couplers, described in JP-A-5-11416; pyrrole-2- or 3-yl- or indole-2- or 3-yl-carbonylacetoanilide-series couplers, described in, for example, European Patent Nos. 953870A1, 953871A1, 953872A1, 953873A1, 953874A1 and 953875A1. The dyes formed from these couplers were improved in terms of both hue and molar extinction coefficient, compared with the conventional ones. However, they are still deficient in image stability. Further, owing to their complicated chemical structure, the synthesis route became longer, and consequently cost of the couplers became higher, causing a practical problem.

In addition, U.S. Pat. No. 3,841,880, JP-A-52-82423 and JP-A-2-28645 propose acetate ester-series and acetoanilide-series couplers to which 1,2,4-benzothiadiazine-1,1-dioxide is bonded. However, these couplers are low in color-forming property, they are insufficient in extinction coefficient of a resultant dye, and they are inferior in sharpness at the foot portion of a peak in interest of the absorption curve at the longer wavelength side. Therefore, improvement of these problems is desired.

On the other hand, in the field of color print in recent years, there are demands for advances in efficiency of shortening a time ranging from print exposure to color development processing, mainly from the purpose of enhancing productivity at labo. Examples of the means for improving performance obtained by a color photographic light-sensitive material with a color development processing include:

(1) Reduction in a coating amount of organic materials by means of, for example, employing a coupler that forms a dye having a large molar extinction coefficient,
(2) Reduction in a coating amount of a silver halide emulsion attendant upon (1),
(3) Reduction in both a coating amount of a hydrophilic binder and a thickness of the entire photographic constitutional layers attendant upon (1),
(4) Employment of a coupler having a high activity, and
(5) Employment of a silver halide emulsion that can be processed at a high developing speed.

In order to enhance a suitability of a light-sensitive material to advances in ultra-rapid processing of color development and desilvering, efforts to reduce a coating silver amount of the light-sensitive material have been made in the field of the art by means of, for example, employment of a coupler that can form a dye having a high molar extinction coefficient. However, the dyes obtained from the current yellow couplers used in a blue-sensitive emulsion layer are still unsatisfactory to the points of not only a molar extinction coefficient but also a coupling activity. Accordingly, in order to enhance productivity in a development processing such as rapidity and processing stability, it is desired to develop a new yellow coupler that forms a dye image exhibiting a superior absorption characteristic and high absorbance, and at the same time good fastness properties to light and heat.

Further, recently digitalization has been remarkably widespread in the field of a color print using a color photographic printing paper. For example, a digital exposure system in which laser scanning exposure is used, has been rapidly spreading in comparison with an ordinary analog exposure system in which printing is directly conducted from a processed color negative film with a color printer. Such digital exposure system is characterized in that a high image quality is obtained by image processing, and greatly contributes to improving qualities of color print using a color photographic printing paper. Further, according to the rapid spreading of digital cameras, it is also an important factor that a color print with a high image quality is easily obtained from these electronic recording media. It is believed that solving these problems will rapidly spread further.

On the other hand, technologies of another color print process such as an ink jet process, a sublimation process and a color xerography are advanced. Now, each of them enjoys a reputation for a photographic image quality, and they are obtaining acknowledgement as a popular color print process.

Among these color print processes, a digital color print process using a color photographic paper is characterized in a high image quality, a high productivity and a high fastness property of the image. Moreover, demands for further advances in the above-mentioned characteristics, whereby a photograph showing a higher image quality can be more simply produced with a low cost, have been increasing from customers. In particular, if it is realized that a recording medium for a digital camera is received from a customer at the shop and a print with a higher image quality is finished within about several minutes, then and there the print with the recording medium is returned to the customer, a superiority of the color print process using a color photographic paper to other color print processes will still more increase. From these points, it is extremely important that the color photographic paper is provided with a low cost, higher productivity and better rapid processing suitability than before.

Researches in wide aspects including improvement of a coupler and a silver halide emulsion to be used have been made to give a high productivity and an ultra-rapid processing suitability with a low cost to the color photographic paper. As the yellow couplers, acyl acetic acid anilide compounds have been used until today. However, because these couplers are low in chromophoric activity and dyes from these couplers are low in molar extinction coefficient, it is necessary to use a large amount of a coupler and a silver halide emulsion so that a desired developed color density can be obtained.

As the silver halide emulsion for use in a color photographic paper, a silver halide emulsion having a high silver chloride content has been used from a demand for a rapid processing. It is believed that such a high silver chloride emulsion shows a high development progressive speed and a good stability to a variation of the processing factors, because a development-inhibiting material such as Br ions and I ions is neither released from the emulsion at the development processing nor accumulates in a developing solution. Accordingly, it was difficult from a general knowledge to expect that stability would be improved by the incorporation of Br and I in a specific state (mode) in a silver halide emulsion.

It is disclosed in JP-A-58-95736, JP-A-58-108533, JP-A-60-222844, JP-A-60-222845, JP-A-62-253143, JP-A-62-253144, JP-A-62-253166, JP-A-62-254139, JP-A-63-46440, JP-A-63-46441, JP-A-63-89840, U.S. Pat. Nos. 4,820,624, 4,865,962, 5,399,475, and 5,284,743 that a high sensitivity can be obtained by the incorporation of a localized phase formed by the silver halide grains having a high silver bromide content in the various states (modes) in an emulsion composed of silver halide grains having a high silver chloride content.

U.S. Pat. Nos. 5,726,005 and 5,736,310 each disclose that high sensitivity and reduction of high illumination intensity reciprocity law failure are attained by an emulsion composed of high silver chloride grains having a I concentration maximum at the near surface of the grains.

It is disclosed in Example of European Patent 0,928,988A that an emulsion having improved reciprocity law failure, dependence on temperature at the time of exposure and fluctuation in photographic performance by pressure can be obtained by the incorporation of a specific compound in grains having a side length of 0.218 μm, and an equivalent-sphere diameter of about 0.27 μm, said grains containing a I band formed at the time where 93% of grains have been formed.

Doping of iridium is known as a means of improving a high illumination intensity reciprocity law failure of the high silver chloride emulsion, resulting in hard gradation even under a high illumination. For example, JP-B-7-34103 discloses that a problem of the latent-image sensitization can be solved by the providing of a localized phase having a high silver bromide content and iridium doped therein. U.S. Pat. No. 5,691,119 discloses a means of hard gradation enhancement of the high illumination intensity gradation in a preparation method of an emulsion composed of silver halide grains containing a localized phase having a high silver bromide content.

However, none of these publications teaches that the above-mentioned silver halide emulsions are able to solve a problem of the fluctuation in yellow density due to the variation of processing factors that is caused when a color photographic light-sensitive material containing a particular yellow dye-forming coupler is subjected to an ultra-rapid processing.

SUMMARY OF THE INVENTION

The present invention provides a silver halide color photographic light-sensitive material comprising a support having thereon at least one yellow color developable light-sensitive silver halide emulsion layer, at least one magenta color developable light-sensitive silver halide emulsion layer, and at least one cyan color developable light-sensitive silver halide emulsion layer: said material comprising at least one yellow dye-forming coupler represented by formula (I) set forth below;

formula (I)

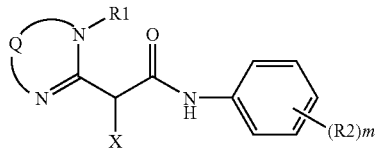

wherein Q represents a non-metallic atom-group forming a 5- to 7-membered ring with —N═C—N(R1)-, R1 represents a substituent, R2 represents a substituent, m represents a integer selected from 0 (zero) to 5, when m is 2 or more, plural R2s may be same as or different from each other, or may form a cycle by bonding thereof each other, and X represents a releasable group by a coupling reaction with a hydrogen atom or an oxidized product of a developing agent.

At first, the present invention provides a silver halide color photographic light-sensitive material comprising at least one yellow dye-forming coupler represented by formula (I) and at least one cyan dye-forming coupler represented by formula (A) each set forth below:

formula (I)

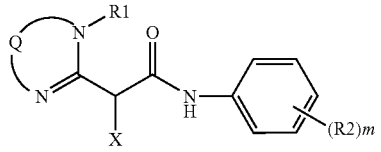

wherein Q represents a non-metallic atom-group forming a 5- to 7-membered ring with —N═C—N(R1)-; R1 represents a substituent; R2 represents a substituent; m represents a integer selected from 0 (zero) to 5; when m is 2 or more, plural R2s may be same as or different from each other, or may form a cycle by bonding thereof each other; and X represents a releasable group by a coupling reaction with a hydrogen atom or an oxidized product of a developing agent; and formula (A)

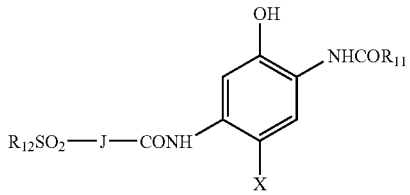

wherein $R_{11}$ and $R_{12}$ each independently represent an alkyl group, or an aryl group; J represents an alkylene group; X represents a hydrogen atom, or a group that can split off upon a reaction with an oxidized color-developing agent.

The present invention further provides a silver halide color photographic light-sensitive material comprising a support having thereon at least one yellow color developable light-sensitive silver halide emulsion layer, at least one magenta color developable light-sensitive silver halide emulsion layer, and at least one cyan color developable light-sensitive silver halide emulsion layer: said material comprising at least one yellow dye-forming coupler represented by formula (I) and at least one magenta dye-forming coupler represented by formula (MC-I) each set forth below;

formula (I)

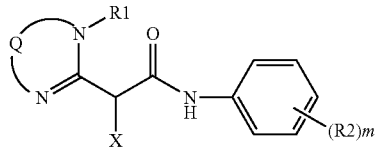

wherein Q represents a non-metallic atom-group forming a 5- to 7-membered ring with —N═C—N(R1)-, preferably a group represented by —C(—R11)=C(—R12)-$SO_2$—, in which R11 and R12 bond with each other to form a 5- to 7-membered ring together with the —C═C— moiety or each of R11 and R12 represents a hydrogen atom or a substituent independently, R1 represents a substituent, R2 represents a substituent, m represents an integer of 0 to 5, when m is 2 or more, plural R2s may be the same or different or R2s may bond each other to form a ring, and X represents a hydrogen atom or a group capable of being split-off upon a coupling reaction with an oxidized product of a developing agent; and formula (MC-1)

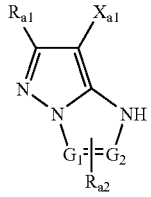

wherein $R_{a1}$ represents a hydrogen atom or a substituent; one of $G_1$ and $G_2$ represents a carbon atom and the other one thereof represents a nitrogen atom; $R_{a2}$ represents a substituent and bonds to the carbon atom represented by $G_1$ or $G_2$; the substituent of $R_{a1}$ or $R_{a2}$ may further have a substituent; a polymer of the unit derived from formula (MC-I)

may be formed via $R_{a1}$ or $R_{a2}$; alternatively, the unit derived from formula (MC-I) may bond to a high molecular chain via $R_{a1}$ or $R_{a2}$; $X_{a1}$ represents a hydrogen atom or a group that can split off through a coupling reaction with the oxidized product of an aromatic primary amine color-developing agent.

The present invention provides a silver halide color photographic light-sensitive material comprising a support having thereon at least one blue-sensitive silver halide emulsion layer containing a yellow dye-forming coupler, at least one green-sensitive silver halide emulsion layer containing a magenta dye-forming coupler, and at least one red-sensitive silver halide emulsion layer containing a cyan dye-forming coupler, in which at least one of said silver halide emulsion layers contains silver halide emulsion whose silver chloride content is 95 mole % or more, and in which at least one of said yellow dye-forming coupler is represented by formula (I), and a coating amount of said yellow dye-forming coupler represented by formula (I) is in the range of 0.1 to 1.0 m mole per m of the light-sensitive material:

formula (I)

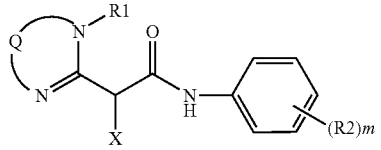

wherein Q represents a non-metallic atom-group forming a 5- to 7-membered ring with —N═C—N(R1)-; R1 represents a substituent; R2 represents a substituent; m represents a integer selected from 0 (zero) to 5; when m is 2 or more, plural R2s may be same as or different from each other, or may form a cycle by bonding thereof each other; and X represents a releasable group by a coupling reaction with a hydrogen atom or an oxidized product of a developing agent.

Further, the present invention provides a silver halide color photographic light-sensitive material comprising a support having thereon at least one yellow color developable blue-sensitive silver halide emulsion layer, at least one magenta color developable green-sensitive silver halide emulsion layer, and at least one cyan color developable red-sensitive silver halide emulsion layer, in which said yellow color developable blue-sensitive silver halide emulsion layer comprises at least one yellow dye-forming coupler represented by formula (I) and a blue-sensitive silver halide emulsion comprising silver halide grains having a silver chloride content of 90 mole % or more and a silver bromide content of from 0.1 mole % to 7 mole %, and in which said blue-sensitive silver halide emulsion comprises silver halide grains having a layered silver bromide-containing phase:

formula (I)

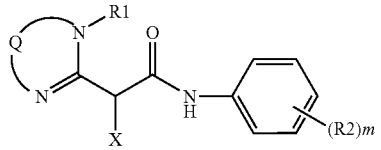

wherein Q represents a non-metallic atom-group forming a 5- to 7-membered ring with —N═C—N(R1)-; R1 represents a substituent; R2 represents a substituent; m represents a integer selected from 0 (zero) to 5; when m is 2 or more, plural R2s may be same as or different from each other, or may form a cycle by bonding thereof each other; and X represents a releasable group by a coupling reaction with a hydrogen atom or an oxidized product of a developing agent.

The present invention furthermore provides a silver halide color photographic light-sensitive material comprising a support having thereon at least one yellow color developable blue-sensitive silver halide emulsion layer, at least one magenta color developable green-sensitive silver halide emulsion layer, and at least one cyan color developable red-sensitive silver halide emulsion layer, in which said yellow color developable blue-sensitive silver halide emulsion layer comprises at least one yellow dye-forming coupler represented by formula (I) and a blue-sensitive silver halide emulsion comprising silver halide grains having a silver chloride content of 90 mole % or more and a silver iodide content of from 0.02 mole % to 1 mole %, and in which said blue-sensitive silver halide emulsion comprises silver halide grains having a layered silver iodide-containing phase:

formula (I)

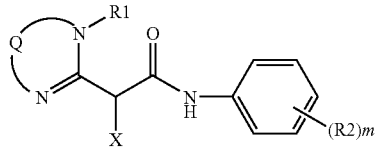

wherein Q represents a non-metallic atom-group forming a 5- to 7-membered ring with —N═C—N(R1)-; R1 represents a substituent; R2 represents a substituent; m represents a integer selected from 0 (zero) to 5; when m is 2 or more, plural R2s may be same as or different from each other, or may form a cycle by bonding thereof each other; and X represents a releasable group by a coupling reaction with a hydrogen atom or an oxidized product of a developing agent.

The present invention also provides a silver halide color photographic light-sensitive material comprising a support having thereon at least one yellow color developable blue-sensitive silver halide emulsion layer, at least one magenta color developable green-sensitive silver halide emulsion layer, and at least one cyan color developable red-sensitive silver halide emulsion layer, in which said yellow color developable blue-sensitive silver halide emulsion layer comprises at least one yellow dye-forming coupler represented by formula (I) and a blue-sensitive silver halide emulsion comprising silver halide grains having a silver chloride content of 90 mole % or more, and in which said blue-sensitive silver halide emulsion comprises silver halide grains containing a six-coordinate complex having Ir as a central metal:

formula (I)

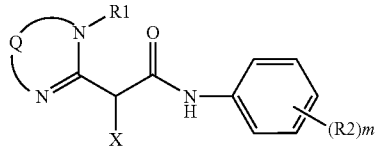

wherein Q represents a non-metallic atom-group forming a 5- to 7-membered ring with —N═C—N(R1)-; R1 represents a substituent; R2 represents a substituent; m represents a integer selected from 0 (zero) to 5; when m is 2 or more, plural R2s may be same as or different from each other, or may form a cycle by bonding thereof each other; and X represents a releasable group by a coupling reaction with a hydrogen atom or an oxidized product of a developing agent.

Other and further features and advantages of the invention will appear more fully from the following description.

DETAILED DESCRIPTION OF THE INVENTION

According to the present invention, the following means are provided:

(1) A silver halide color photographic light-sensitive material comprising at least one yellow color developable light-sensitive silver halide emulsion layer, at least one magenta color developable light-sensitive silver halide emulsion layer, and at least one cyan color developable light-sensitive silver halide emulsion layer, each of which is provided on a support: which comprises at least one yellow dye-forming coupler represented by formula (I) and at least one cyan dye-forming coupler represented by formula (A);

formula (I)

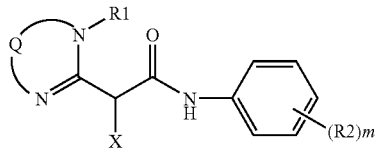

wherein Q represents a group of non-metal atoms that form a 5- to 7-membered ring in combination with —N═C—N(R1)-, R1 represents a substituent, R2 represents a substituent, m represents an integer of 0 to 5, when m is 2 or more, plural R2s may be the same or different, or may bond each other to form a ring, and X represents a hydrogen atom or a group capable of being split-off upon a coupling reaction with an oxidized product of a developing agent;

formula (A)

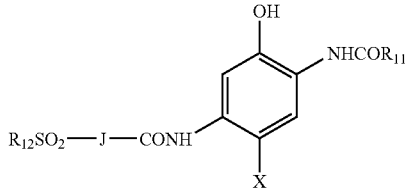

wherein $R_{11}$ and $R_{12}$ each independently represent an alkyl group or an aryl group, J represents an alkylene group, and X represents a hydrogen atom or a group that can split off upon a reaction with an oxidized color-developing agent.

(2) The silver halide color photographic light-sensitive material according to the preceding item (1), wherein Q in the above-described formula (I) represents a group represented by —C(—R11)=C(—R12)-$SO_2$— or —C(—R11)=C(—R12)-CO— (R11 and R12 bond with each other to form a 5- to 7-membered ring together with the —C═C— moiety; or are independently a hydrogen atom or a substituent, respectively).

(3) The silver halide color photographic light-sensitive material according to the preceding item (1), wherein Q in the above-described formula (I) is a group represented by —C(—R11)=C(—R12)-$SO_2$— in which R11 and R12 bond with each other to form a 5- to 7-membered ring together with —C═C—, or they each represent independently a hydrogen atom or a substituent.

(4) The silver halide color photographic light-sensitive material according to the preceding item (1), wherein the yellow dye-forming coupler represented by formula (I) is a yellow dye-forming coupler represented by formula (II) described below:

formula (II)

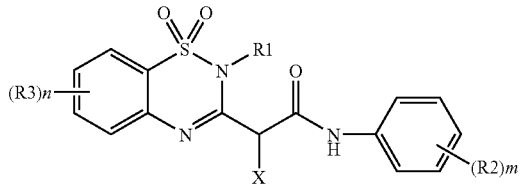

wherein R1 represents a substituent; R2 represents a substituent; m represents an integer of 0 or more and 5 or less; when m is 2 or more, a plurality of R2 may be the same or different, or they may combine together with each other to form a ring; R3 represents a substituent; n represents an integer of 0 (zero) or more and 4 or less; when n is 2 or more, a plurality of R3 may be the same or different, or they may combine together with each other to form a ring; X represents a hydrogen atom or a group that can split off through a coupling reaction between the yellow dye-forming coupler and the oxidized product of a color-developing agent.

(5) The silver halide color photographic light-sensitive material according to the proceeding item (4), wherein R1 in the yellow dye-forming coupler represented by the above-mentioned formula (II) is a substituted or unsubstituted alkyl group.

Hereinafter, a first embodiment of the present invention means to include the silver halide color photographic light-sensitive materials as described in the items (1) to (5) above.

(6) A silver halide color photographic light-sensitive material comprising a support having thereon at least one yellow color developable light-sensitive silver halide emulsion layer, at least one magenta color developable light-sensitive silver halide emulsion layer, and at least one cyan color developable light-sensitive silver halide emulsion layer, said material comprising at least one yellow dye-forming coupler represented by formula (I) and at least one magenta dye-forming coupler represented by formula (MC-I) each set forth below:

formula (I)

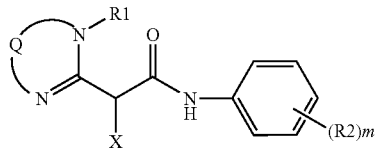

wherein, in formula (I), Q represents a group of non-metal atoms that form a 5- to 7-membered ring in combination with —N═C—N(R1)-; R1 represents a substituent; R2 represents a substituent; m represents an integer of 0 (zero) to 5; when m is 2 or more, R2s may be the same or different, or R2s may bond each other to form a ring; and X represents a hydrogen atom, or a group capable of being split-off upon a coupling reaction with an oxidized product of a developing agent;

formula (MC-1)

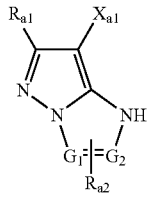

wherein, in formula (MC-I), $R_{a1}$ represents a hydrogen atom or a substituent; one of $G_1$ and $G_2$ represents a carbon atom and the other one thereof represents a nitrogen atom; $R_{a2}$ represents a substituent and bonds to the carbon atom represented by $G_1$ or $G_2$; the substituent of $R_{a1}$ or $R_{a2}$ may further have a substituent; a polymer of the unit derived from formula (MC-I) may be formed via $R_{a1}$ or $R_{a2}$; alternatively, the unit derived from formula (MC-I) may bond to a high molecular chain via $R_{a1}$ or $R_{a2}$; $X_{a1}$ represents a hydrogen atom or a group that can split off through a coupling reaction between the magenta dye-forming coupler and the oxidized product of an aromatic primary amine color-developing agent.

(7) The silver halide color photographic light-sensitive material according to the preceding item (6), wherein Q in the above-described formula (I) is a group represented by —C(—R11)=C(—R12)-$SO_2$— in which R11 and R12 bond with each other to form a 5- to 7-membered ring together with —C═C—, or they each represent a hydrogen atom or a substituent.

(8) The silver halide color photographic light-sensitive material according to the proceeding item (6), wherein the yellow dye-forming coupler represented by the above-mentioned formula (I) is a yellow dye-forming coupler represented by the following formula (II):

formula (II)

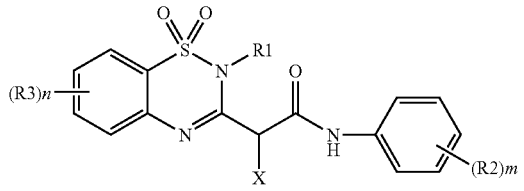

wherein, in formula (II), R1 represents a substituent; R2 represents a substituent; m represents an integer of 0 (zero) or more and 5 or less; when m is 2 or more, a plurality of R2 may be the same or different, or they may combine together with each other to form a ring; R3 represents a substituent; n represents an integer of 0 (zero) or more and 4 or less; when n is 2 or more, a plurality of R3 may be the same or different, or they may combine together with each other to form a ring; X represents a hydrogen atom or a group that can split off through a coupling reaction with the oxidized product of a color-developing agent.

(9) The silver halide color photographic light-sensitive material according to the proceeding item (8), wherein R1 in the yellow dye-forming coupler represented by the above-mentioned formula (II) is a substituted or unsubstituted alkyl group.

Hereinafter, a second embodiment of the present invention means to include the silver halide color photographic light-sensitive materials, as described in the items (6) to (9) above.

(10) A silver halide color photographic light-sensitive material comprising a support having thereon at least one blue-sensitive silver halide emulsion layer containing a yellow dye-forming coupler, at least one green-sensitive silver halide emulsion layer containing a magenta dye-forming coupler, and at least one red-sensitive silver halide emulsion layer containing a cyan dye-forming coupler, in which at least one of said silver halide emulsion layers contains silver halide emulsion whose silver chloride content is 95 mole % or more, and in which at least one of said yellow dye-forming coupler is represented by formula (I), and a coating amount of said yellow dye-forming coupler represented by formula (I) is in the range of 0.1 to 1.0 m mole per $m^2$ of the light-sensitive material:

formula (I)

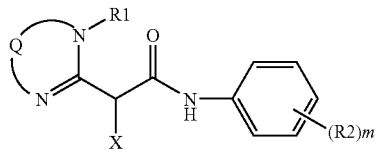

wherein, in formula (I), Q represents a non-metallic atom-group forming a 5- to 7-membered ring with —N═C—N(R1)-; R1 represents a substituent; R2 represents a substituent; m represents an integer of 0 (zero) to 5; when m is 2 or more, plural R2s may be the same or different, or R2s may bond each other to form a ring; and X represents a hydrogen atom, or a group capable of being split-off upon a coupling reaction with an oxidized product of a developing agent.

(11) The silver halide color photographic light-sensitive material according to the preceding item (10), wherein the coating amount of the yellow dye-forming coupler is represented by formula (I) is in the range of 0.3 to 0.6 m mole per $m^2$ of the light-sensitive material.

(12) The silver halide color photographic light-sensitive material according to the preceding item (10), wherein the coating amount of the silver halide used in a blue-sensitive silver halide emulsion layer is in the range of 0.12 to 0.22 g (amount in terms of silver) per $m^2$ of the light-sensitive material.

(13) The silver halide color photographic light-sensitive material according to the preceding any one of items (10) to (12), wherein Q in the above-described formula (I) is a group represented by —C(—R11)=C(—R12)-$SO_2$— or —C(—R11)=C(—R12)-CO— in which R11 and R12 bond with each other to form a 5- to 7-membered ring together with —C═C—, or they each represent a hydrogen atom or a substituent, independetly.

(14) The silver halide color photographic light-sensitive material according to the preceding any one of items (10) to (12), wherein Q in the above-described formula (I) is a group represented by —C(—R11)=C(—R12)-$SO_2$— in which R11 and R12 bond with each other to form a 5- to 7-membered ring together with —C═C—, or they each represent a hydrogen atom or a substituent, independently.

(15) The silver halide color photographic light-sensitive material according to the proceeding any one of items

(10) to (12) or (14), wherein the yellow dye-forming coupler represented by the above-mentioned formula (I) is a yellow dye-forming coupler represented by the following formula (II):

formula (II)

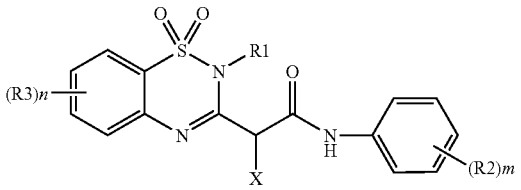

wherein, in formula (II), R1 represents a substituent; R2 represents a substituent; m represents an integer of 0 (zero) or more and 5 or less; when m is 2 or more, a plurality of R2 may be the same or different, or they may combine together with each other to form a ring; R3 represents a substituent; n represents an integer of 0 (zero) or more and 4 or less; when n is 2 or more, a plurality of R3 may be the same or different, or they may combine together with each other to form a ring; X represents a hydrogen atom or a group that can split off through a coupling reaction between the yellow dye-forming coupler and the oxidized product of a color-developing agent.

(16) The silver halide color photographic light-sensitive material according to the proceeding item (15), wherein R1 in the yellow dye-forming coupler represented by the above-mentioned formula (II) is a substituted or unsubstituted alkyl group.

Hereinafter, a third embodiment of the present invention means to include the silver halide color photographic light-sensitive materials, as described in the items (10) to (16) above.

(17) A silver halide color photographic light-sensitive material comprising a support having thereon at least one yellow color developable blue-sensitive silver halide emulsion layer, at least one magenta color developable green-sensitive silver halide emulsion layer, and at least one cyan color developable red-sensitive silver halide emulsion layer, in which said yellow color developable blue-sensitive silver halide emulsion layer comprises at least one yellow dye-forming coupler represented by formula (I) and a blue-sensitive silver halide emulsion comprising silver halide grains having a silver chloride content of 90 mole % or more and a silver bromide content of from 0.1 mole % to 7 mole %, and in which said blue-sensitive silver halide emulsion comprises silver halide grains having a layered silver bromide-containing phase:

formula (I)

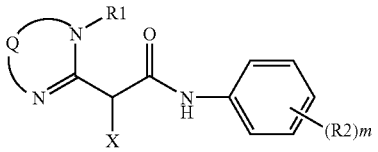

wherein, in formula (I), Q represents a non-metallic atom-group forming a 5- to 7-membered ring with —N═C—N(R1)-; R1 represents a substituent; R2 represents a substituent; m represents an integer of 0 (zero) to 5; when m is 2 or more, plural R2s may be the same or different, or may bond each other to form a ring; and X represents a hydrogen atom or a group capable of being split-off upon a coupling reaction with an oxidized product of a developing agent.

(18) A silver halide color photographic light-sensitive material comprising a support having thereon at least one yellow color developable blue-sensitive silver halide emulsion layer, at least one magenta color developable green-sensitive silver halide emulsion layer, and at least one cyan color developable red-sensitive silver halide emulsion layer, in which said yellow color developable blue-sensitive silver halide emulsion layer comprises at least one yellow dye-forming coupler represented by formula (I) and a blue-sensitive silver halide emulsion comprising silver halide grains having a silver chloride content of 90 mole % or more and a silver iodide content of from 0.02 mole % to 1 mole %, and in which said blue-sensitive silver halide emulsion comprises silver halide grains having a layered silver iodide-containing phase:

formula (I)

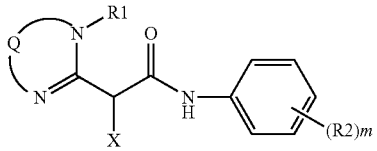

wherein, in formula (I), Q represents a non-metallic atom-group forming a 5- to 7-membered ring with —N═C—N(R1)-; R1 represents a substituent; R2 represents a substituent; m represents an integer of 0 (zero) to 5; when m is 2 or more, plural R2s may be the same or different, or may bond each other to form a ring; and X represents a hydrogen atom or a group capable of being split-off upon a coupling reaction with an oxidized product of a developing agent.

(19) A silver halide color photographic light-sensitive material comprising a support having thereon at least one yellow color developable blue-sensitive silver halide emulsion layer, at least one magenta color developable green-sensitive silver halide emulsion layer, and at least one cyan color developable red-sensitive silver halide emulsion layer, in which said yellow color developable blue-sensitive silver halide emulsion layer comprises at least one yellow dye-forming coupler represented by formula (I) and a blue-sensitive silver halide emulsion comprising silver halide grains having a silver chloride content of 90 mole % or more, and in which said blue-sensitive silver halide emulsion comprises silver halide grains containing a six-coordinate complex having Ir as a central metal:

formula (I)

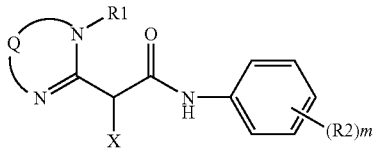

wherein, in formula (I), Q represents a non-metallic atom-group forming a 5- to 7-membered ring with —N═C—N(R1)-; R1 represents a substituent; R2 represents a substituent; m represents an integer of 0 to 5; when m is 2 or more, plural R2s may be the same or different, or may bond each other to form a ring; and X represents a hydrogen atom or a group capable of being split-off upon a coupling reaction with an oxidized product of a developing agent.

(20) The silver halide color photographic light-sensitive material according to any one of the preceding items (17) to (19), wherein said blue-sensitive silver halide emulsion comprises silver halide grains having a silver chloride content of 90 mole % or more, a silver bromide content of from 0.1 mole % to 7 mole % and a silver iodide content of from 0.02 mole % to 1 mole % and said silver halide grains in the blue-sensitive silver halide emulsion each have a layered silver bromide-containing phase and a layered silver iodide-containing phase.

(21) The silver halide color photographic light-sensitive material according to the preceding item (20), wherein said layered silver bromide-containing phase, which is a localized phase having a high content of silver bromide, of the silver halide grains in the blue-sensitive silver halide emulsion is formed more internally in the grain than the layered silver iodide-containing phase.

(22) The silver halide color photographic light-sensitive material according to any one of the preceding items (17) to (21), wherein said silver halide grains in the blue-sensitive silver halide emulsion are cubic or tetradecahedral (tetrakaidecahedral) grains.

(23) The silver halide color photographic light-sensitive material according to any one of the preceding items (17) to (21), wherein said silver halide grains in the blue-sensitive silver halide emulsion are tabular grains having an average aspect ratio of 3 or more.

(24) The silver halide color photographic light-sensitive material according to any one of the preceding items (17) to (23), wherein said silver halide grains in the blue-sensitive silver halide emulsion contains a six-coordinate complex having iridium as a central metal, which further has Cl, Br or I as a ligand.

(25) The silver halide color photographic light-sensitive material according to any one of the preceding items (17) to (24), wherein said silver halide grains in the blue-sensitive silver halide emulsion contains a six-coordinate complex having iridium as a central metal, which further has at least one ligand except for halogen or cyan.

(26) The silver halide color photographic light-sensitive material according to any one of the preceding items (17) to (25), wherein said blue-sensitive silver halide emulsion is gold-sensitized with a colloidal gold sulfide or a gold sensitizer having a complex stability constant log $\beta_2$ of gold within the range of from 21 to 35.

(27) The silver halide color photographic light-sensitive material according to any one of the above items (17) to (26), wherein Q in the above-mentioned formula (I) is a group represented by —C(—R11)=C(—R12)-$SO_2$— or —C(—R11)=C(—R12)-CO—, in which R11 and R12 are groups that bond with each other to form a 5- to 7-membered ring together with —C═C—, or they each independently represent a hydrogen atom or a substituent.

(28) The silver halide color photographic light-sensitive material according to any one of the above items (17) to (27), wherein Q in the above-mentioned formula (I) is a group represented by —C(—R11)=C(—R12)-$SO_2$—, in which R11 and R12 are groups that bond with each other to form a 5- to 7-membered ring together with —C═C—, or they each independently represent a hydrogen atom or a substituent.

(29) The silver halide color photographic light-sensitive material according to any one of the above items (17) to (28), wherein the yellow dye-forming coupler represented by formula (I) is a yellow dye-forming coupler represented by formula (II):

formula (II)

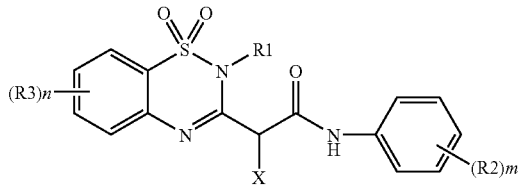

wherein, in formula (II), R1 represents a substituent; R2 represents a substituent; m represents an integer of 0 (zero) to 5; when m is 2 or more, the multiple R2s may be the same or different, and the R2s may bond each other to form a ring; R3 represents a substituent; n represents an integer of 0 (zero) to 4; when n is 2 or more, the multiple R3s may be the same or different, and the R3s may bond each other to form a ring; and X represents a hydrogen atom or a group capable of being split-off upon a coupling reaction with an oxidized product of a developing agent.

(30) The silver halide color photographic light-sensitive material according to the above item (29), wherein, in the dye-forming coupler represented by the above-mentioned formula (II), R1 is a substituted or unsubstituted alkyl group.

Hereinafter, a fourth embodiment of the present invention means to include the silver halide color photographic light-sensitive materials, as described in the above items (17) to (30).

(31) A silver halide color photographic light-sensitive material, having at least one blue-sensitive emulsion layer containing a yellow coupler, at least one green-sensitive emulsion layer containing a magenta coupler, and at least one red-sensitive emulsion layer containing a cyan coupler, on a support;

wherein said blue-sensitive emulsion layer contains at least one coupler represented by formula (I); and wherein the silver halide color photographic light-sensitive material satisfies the following expression a-1) and/or b-1):

formula (I)

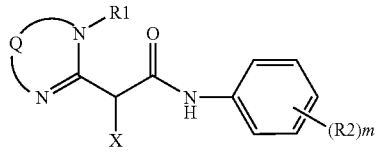

wherein, in formula (I), Q represents a group of non-metal atoms necessary to form a 5- to 7-membered ring together with —N═C—N(R1)-; R1 represents a substituent; R2 represents a substituent; m represents 0 (zero) or an integer of 1 to 5; when m is 2 or more, plural R2s may be the same or different from each other, or R2s may bond together with each other to form a ring; and X represents a hydrogen atom or a group capable of being split-off upon a coupling reaction with an oxidized product of a developing agent;

$$0.5 \leqq D\max(UV)/D\min(UV) \leqq 1.1 \qquad \text{a-1)}$$

wherein Dmax(UV)/Dmin(UV) is the smallest value, in values of (yellow maximum developed density at a certain wavelength) divided by (density at the non-exposed area), in other words, in a range of wavelength UV, in which UV is a wavelength within the range of 340 nm or more and 450 nm or less, among values represented by (an absorbance at a wavelength UV, for a portion having the yellow maximum color density)/(an absorbance at the wavelength UV, for a portion having the yellow minimum color density);

$$1300 \leqq (B-C)/A \leqq 20000 \qquad \text{b-1)}$$

wherein B represents the maximum color density of yellow, C represents the minimum color density of yellow, each of which means a transmission density when the support is a transmission support, or a reflection density when the support is a reflection support; A is an amount of the coupler represented by formula (I) to be used (mol/m$^2$).

Hereinafter, a fifth embodiment of the present invention means to include the silver halide color photographic light-sensitive material, as described in the above item (31).

Otherwise specially noticed, the present invention includes (implies) all of the first to fifth embodiments mentioned above.

Then, in the description for the above formulae, the formulae having same reference letters may represent the different chemical significance. (This is applied to the below description.) That is, the descriptions of reference letters for an item have the precedence to that for another item.

However, in this matter, the descriptions of reference letters for an item may have the same chemical significance of that for another item.

In the present invention, each of the first to fifth embodiments may be carried out individually, but embodiments selected arbitrary two, three or four therefrom and in all of the five embodiments are preferably combined and carried out.

The present inventors made researches in couplers having a high chromophoric activity and a high coloring property, more specifically the way to obtain a necessary developed color density in a minimum coating amount of both a coupler and a silver halide emulsion. Eventually, it has been found that a yellow dye-forming coupler represented by formula (I) has an extremely high chromophoric activity and the dyes obtained from the couplers are high in developed color density:

formula (I)

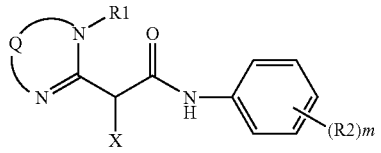

wherein, in formula (I), Q represents a group of non-metal atoms that form a 5- to 7-membered ring in combination with —N═C—N(R1)-; R1 represents a substituent; R2 represents a substituent; m represents an integer of 0 (zero) to 5; when m is 2 or more, the multiple R2s may be the same or different, and the R2s may bond each other to form a ring; and X represents a hydrogen atom or a group capable of being split-off upon a coupling reaction with an oxidized product of a developing agent.

It has been found that use of the above-mentioned yellow dye-forming coupler enables to obtain a necessary developed color density in an about half of the current coating amounts of a coupler and a silver halide emulsion, and a high productivity can be obtained because of its high sensitivity, and moreover an ultra-rapid processing can be carried out because of its high activity. However, the color photographic paper using the above-mentioned yellow dye-forming coupler, when subjected to an ultra-rapid processing, is inclined to cause a fluctuation in yellow density particularly at the middle density portion due to the variation of processing factors such as a slight change of processing time. Therefore, it is difficult to find a satisfaction in the point of stability on the result of a finished print.

As a result of intensive studies, the present inventors have found that the above-mentioned means can always provide a stable photographic property even when subjected to an ultra-rapid processing. The present invention has been made on the basis of these findings.

The present invention is explained in more detail below.

(Dye-forming Coupler)

A compound represented by the above-mentioned formula (I) according to the present invention is explained in detail. Herein, the compound is also referred to as a yellow dye-forming coupler.

formula (I)

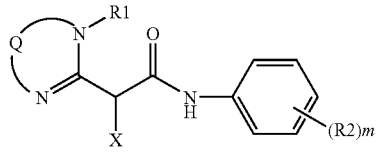

In formula (I), R1 represents a substituent excepting a hydrogen atom. Examples of the substituent include halogen atoms, alkyl (including cycloalkyl and bicycloalkyl), alkenyl (including cycloalkenyl and bicycloalkenyl), alkynyl, aryl, heterocyclic, cyano, hydroxyl, nitro, carboxyl, alkoxy, aryloxy, silyloxy, heterocyclic oxy, acyloxy, carbamoyloxy, alkoxycarbonyloxy, aryloxycarbonyloxy, amino (including alkylamino and anilino), acylamino, aminocarbonylamino, alkoxycarbonylamino, aryloxycarbonylamino, sulfamoylamino, sulfonamide (including alkyl- or aryl-sulfonylamino), mercapto, alkylthio, arylthio, heterocyclic thio, sulfamoyl, sulfo, alkyl- or aryl-sulfinyl, alkyl- or aryl-sulfonyl, acyl, aryloxycarbonyl, alkoxycarbonyl, carbamoyl, arylazo or heterocyclicazo, imido, phosphio, phosphinyl, phosphinyloxy, phosphinylamino, and silyl groups.

The above-mentioned substituent may be further substituted with another substituent. Examples of this another substituent are the same as described as the examples of the above-mentioned substituent.

R1 is preferably a substituted or unsubstituted alkyl group. The total carbon atom of R1 is preferably in the range of 1 to 60, more preferably in the range of 6 to 50, furthermore preferably in the range of 11 to 40, and most preferably in the range of 16 to 30. In the case that R1 is a substituted alkyl group, examples of the substituent of the alkyl group include those atoms and groups exemplified as the substituent of the above-mentioned R1.

Then, in the first, third and fourth embodiments, an alkyl group of itself in R1 has preferably 1 to 40 carbon atoms, more preferably 3 to 36 carbon atoms, further preferably 8 to 30 carbon atoms. This preferable order is especially independent on Q, but Q shown below is preferably —C(—R11)=C(—R12)-CO—, in particular.

R1 is preferably an unsubstituted alkyl group having 11 or more carbon atoms, or an alkyl group substituted with an alkoxy group or an aryloxy group at the 2-, 3- or 4-position, more preferably an unsubstituted alkyl group having 16 or more carbon atoms, or an alkyl group substituted with an alkoxy group or an aryloxy group at the 3-position, and most preferably a $C_{16}H_{33}$ group, a $C_{18}H_{37}$ group, a 3-lauryloxypropyl group, or 3-(2,4-di-t-amylphenoxy)propyl group.

In formula (I), Q represents non-metallic atom-group forming a 5- to 7-membered ring with —N═C—N(R1)-. Preferably, the 5- to 7-membered ring to be formed is a substituted or unsubstituted mono- or condensed-heteroring. More preferably, an atom forming the ring is selected from a carbon atom, a nitrogen atom and a sulfur atom. Further preferably, Q represents a group shown by —C(—R11)=C(—R12)-$SO_2$— or —C(R11)=C(R12)-CO— (in the present invention, this expression of the foregoing group should not be construed as limited to the direction of the bonds belonging to the group as represented by this expression). Thereamong, Q is preferably expressed as —C(—R11)=C(—R12)-$SO_2$—. R11 and R12 collectively represent a group which forms a 5- to 7-membered ring, together with the —C═C— moiety, when R11 and R12 bond with each other, or alternatively R11 and R12 each independently represent a hydrogen atom or a substituent. The 5- to 7-membered ring thus formed may be saturated or unsaturated, and the ring may be an alicyclic, aromatic or heterocyclic ring. Examples of these rings include benzene, furan, thiophene, cyclopentene, and cyclohexane rings. Further, examples of the substituent represented by R11 and R12 are those enumerated as the substituent of the above-described R1.

The ring formed by bonding each substituent and plural substituents thereamong may be further substituted by the other substituent (which is exemplified by the groups as substituents for R1).

In formula (I), R2 represents a substituent other than a hydrogen atom. Examples of the substituent include those atoms and groups exemplified as the substituent of the above-mentioned R1. R2 is preferably a halogen atom (i.e., fluorine, chlorine, bromine), an alkyl group (e.g., methyl, isopropyl), an aryl group (e.g., phenyl, naphthyl), an alkoxy group (e.g., methoxy, isopropyloxy), an aryloxy group (e.g., phenoxy), an acyloxy group (e.g., acetyloxy), an amino group (e.g., dimethylamino, morpholino), an acylamino group (e.g., acetoamido), a sulfonamido group (e.g., methanesulfonamido, benzenesulfonamido), an alkoxycarbonyl group (e.g., methoxycarbonyl), an aryloxycarbonyl group (e.g., phenoxycarbonyl), a carbamoyl group (e.g., N-methylcarbamoyl, N,N-diethylcarbamoyl), a sulfamoyl group (e.g., N-methylsulamoyl, N,N-diethylsulfamoyl), an alkylsulfonyl group (e.g., methane sulfonyl), an arylsulfonyl group (e.g., benzene sulfonyl), an alkylthio group (e.g., methylthio, dodecylthio), an arylthio group (e.g., phenylthio, naphthylthio), a cyano group, a carboxyl group and a sulfo group. R2 that is at the ortho position to the —CONH— group is preferably a halogen atom, an alkoxy group, an aryloxy group, an alkyl group, an alkylthio group and an arylthio group.

In the present invention, it is preferable that at least one R2 is at the ortho position to the —CONH— group.

In formula (I), m represents an integer of 0 or more and 5 or less. When m is 2 or more, a plurality of R2 may be the same or different, or they may combine together to form a ring.

m is an integer preferably in the range of 0 (zero) to 3, more preferably in the range of 0 (zero) to 2, furthermore preferably 1 or 2, and most preferably 2.

In formula (I), X represents a hydrogen atom or a group that can be split-off upon a coupling reaction with an oxidized product of a developing agent. Examples of the above-described group capable of being split-off upon a coupling reaction with an oxidized product of a developing agent include a group capable of being split-off with a nitrogen, oxygen, or sulfur atom (a splitting-off atom), and a halogen atom (e.g., chlorine, bromine).

Examples of the group that splits off with a nitrogen atom include a heterocyclic group (preferably 5- to 7-membered substituted or unsubstituted saturated or unsaturated aromatic (herein the term "aromatic" is used to embrace a substance that has (4n+2) cyclic conjugated electrons) or non-aromatic, monocyclic or condensed heterocyclic groups, more preferably 5- or 6-membered heterocyclic groups, in which the ring-forming atoms are selected from carbon, nitrogen and sulfur atoms and in addition at least one of hetero atoms selected from nitrogen, oxygen and sulfur atoms is incorporated, with specific examples of the heterocyclic ring including succinimide, maleinimide, phthalimide, diglycolimide, pyrrole, pyrazole, imidazole, 1,2,4-triazole, tetrazole, indole, benzopyrazole, benzimidazole, benzotriazole, imidazoline-2,4-dione, oxazolidine-2,4-dione, thiazolidine-2-one, benzimidazoline-2-one, benzoxazoline-2-one, benzothiazoline-2-one, 2-pyrroline-5-one, 2-imidazoline-5-one, indoline-2,3-dione, 2,6-dioxypurine, parabanic acid, 1,2,4-triazolidine-3,5-dione, 2-pyridone, 4-pyridone, 2-pyrimidone, 6-pyridazone, 2-pyrazone, 2-amino-1,3,4-thiazolidine-4-one), a carbonamido group (e.g., acetamido, trifluoroacetamido), a sulfonamido group (e.g., methanesulfonamido, benzenesulfonamido), an arylazo group (e.g., phenylazo, naphthylazo), and a carbamoylamino group (e.g., N-methyl carbamoylamino).

Preferred of the group that splits off with a nitrogen atom are heterocyclic groups, more preferably aromatic heterocyclic groups having 1, 2, 3 or 4 ring-forming nitrogen atoms or heterocyclic groups represented by the following formula (L):

formula (L)

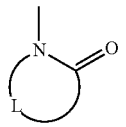

wherein L represents a moiety that forms a 5- to 6-membered nitrogen-containing heterocycle with —NC(═O)—.

Examples of the moieties are enumerated in the explanation of the above-mentioned heterocyclic group, and such moieties as enumerated above are more preferred.

Particularly preferably L is a moiety that forms a 5-membered nitrogen-containing heterocyclic ring.

Examples of the group that splits off with an oxygen atom include an aryloxy group (e.g., phenoxy, 1-naphthoxy), a heterocyclic oxy group (e.g., pyridyloxy, pyrazolyloxy), an acyloxy group (e.g., acetoxy, benzoyloxy), an alkoxy group (e.g., methoxy, dodecyloxy), a carbamoyloxy group (e.g., N,N-diethylcarbamoyloxy, morpholinocarbamoyloxy), an aryloxycarbonyloxy group (e.g., phenoxycarbonyloxy), an alkoxycarbonyloxy group (e.g., methoxycarbonyloxy, ethoxycarbonyloxy), an alkylsulfonyloxy group (e.g., methanesulfonyloxy), and an aryl sulfonyloxy group (e.g., benzenesulfonyloxy, toluenesulfonyloxy).

Preferred of these groups capable of being spilt-off at the moiety of oxygen atom are an aryloxy group, an acyloxy group and a heterocyclic oxy group.

Examples of the group that splits off with a sulfur atom include an arylthio group (e.g., phenylthio, naphthylthio), a heterocyclic thio group (e.g., tetrazolylthio, 1,3,4-thiadiazolylthio, 1,3,4-oxazolylthio, benzimidazolyl thio), an alkylthio group (e.g., methylthio, octylthio, hexadecylthio), an alkylsulfinyl group (e.g., methane sulfinyl), an arylsulfinyl group (e.g., benzenesulfinyl), an arylsulfonyl group (e.g., benzenesulfonyl), and an alkylsulfonyl group (e.g., methansulfonyl).

Preferred of the group that splits off with a sulfur atom are an arylthio group and a heterocyclic thio group. A heterocyclic thio group is more preferred.

X may be substituted with a substituent. Examples of the substituent include those atoms and groups exemplified as the substituent of the above-mentioned R1.

X is preferably a group that can split off through a coupling reaction with the oxidized product of a color-developing agent. Among these splitting-off groups, preferred are groups that can split off with a nitrogen atom, an oxygen atom or a sulfur atom. More preferably the splitting-off group is a group that can split off with a nitrogen atom. Furthermore, the splitting-off group is preferred in the same preferable order as mentioned about the group that can split off with a nitrogen atom.

Preferable groups of X are explained in more detail below.

Among groups that can split off with a nitrogen atom, an aromatic heterocyclic group having at least two nitrogen atoms (preferably 2) (preferably a 5-membered aromatic heterocyclic group such as a pyrazole group optionally having a substituent) and a group represented by the above-mentioned formula (L) are especially preferable.

X may be a photographically useful group. Examples of the photographically useful group include a development inhibitor, a desilvering accelerator, a redox compounds, a dye, a coupler and precursors of these compounds.

In the present invention, it is preferable that X does not act as the above-mentioned photographically useful group.

In order to render the coupler inmobile in a light-sensitive material, at least one of Q, R1, X and R2 has preferably 8 to 50 carbon atoms, more preferably 10 to 40 carbon atoms, in total respectively, including carbon atoms of a substituent(s) that they may have thereon.

Among compounds represented by formula (I) according to the present invention, preferable compounds are represented by formula (II).

The compounds represented by formula (II) according to the present invention are explained in detail below. Herein, the compounds are also referred to as a dye-forming coupler.

formula (II)

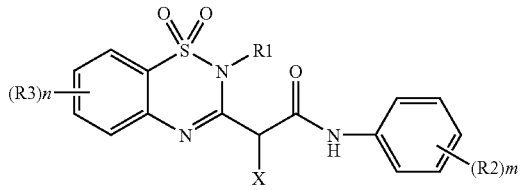

In formula (II), R1, R2, m and X each have the same meanings as mentioned in formula (I). Preferable ranges of these symbols are also the same as in formula (I).

In formula (II), R3 represents a substituent. Examples of the substituent include those atoms and groups exemplified as the substituent of the above-mentioned R1. R3 is preferably a halogen atom (i.e., fluorine, chlorine, bromine), an alkyl group (e.g., methyl, isopropyl), an aryl group (e.g., phenyl, naphthyl), an alkoxy group (e.g., methoxy, isopropyloxy), an aryloxy group (e.g., phenoxy), an acyloxy group (e.g., acetyloxy), an amino group (e.g., dimethylamino, morpholino), an acylamino group (e.g., acetoamido), a sulfonamido group (e.g., methanesulfonamido, benzenesulfonamido), an alkoxycarbonyl group (e.g., methoxycarbonyl), an aryloxycarbonyl group (e.g., phenoxycarbonyl), a carbamoyl group (e.g., N-methylcarbamoyl, N,N-diethylcarbamoyl), a sulfamoyl group (e.g., N-methylsulamoyl, N,N-diethylsulfamoyl), an alkylsulfonyl group (e.g., methane sulfonyl), an arylsulfonyl group (e.g., benzene sulfonyl), a cyano group, a carboxyl group and a sulfo group.

In formula (II), n represents an integer of 0 (zero) or more and 4 or less. When n is 2 or more, a plurality of R3 may be the same or different, or they may combine together to form a ring.

Preferable specific examples of the couplers represented by formula (I) or (II) according to the present invention are shown below. However, the present invention is not limited to these compounds. Herein, the present invention also embraces tautomers having a hydrogen atom transferred from the coupling site (a hydrogen atom on the carbon atom bonding with X) to the nitrogen atom of the C═N portion bonding to the coupling site. Above-said nitrogen atom refers to a ring-constituting nitrogen atom that is not bonded with R1.

(1)

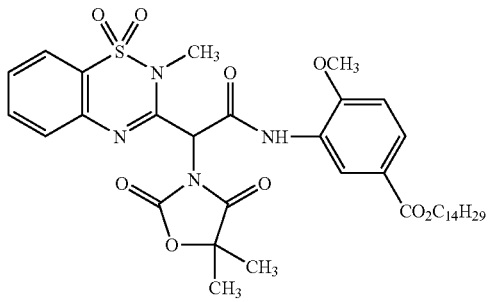

(2)

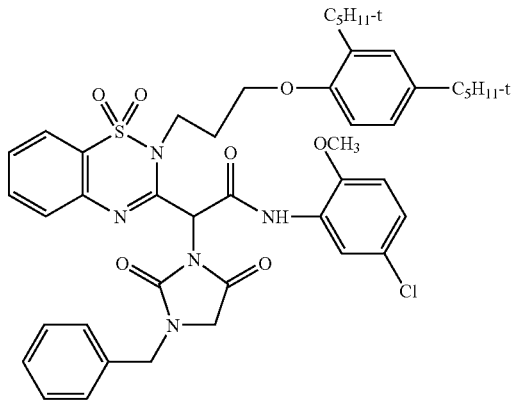

-continued
(3)
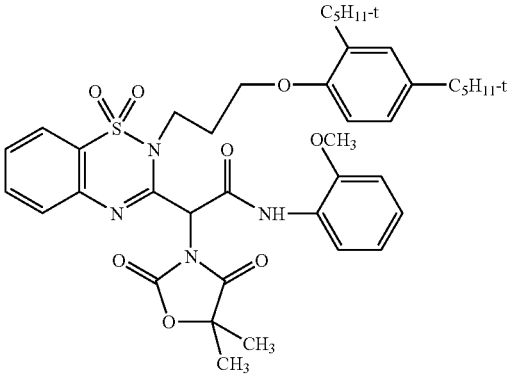
(4)
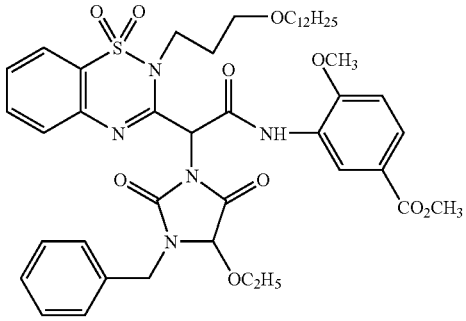
(5)
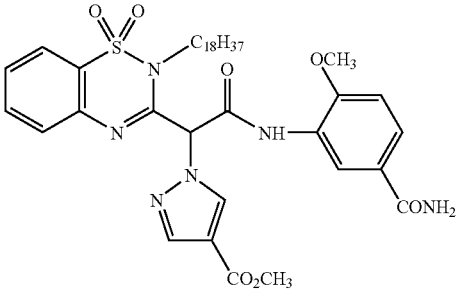
(6)
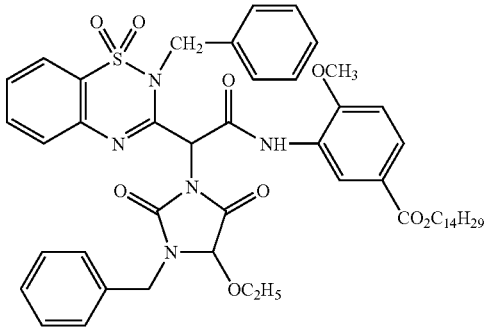
(7)
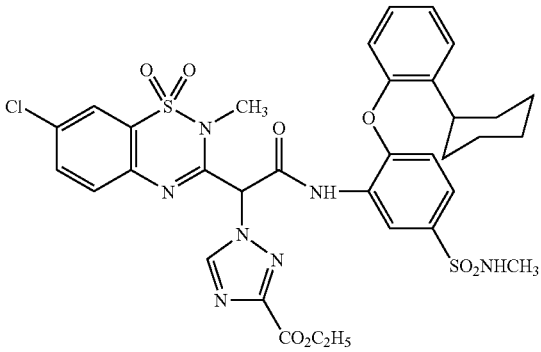
(8)
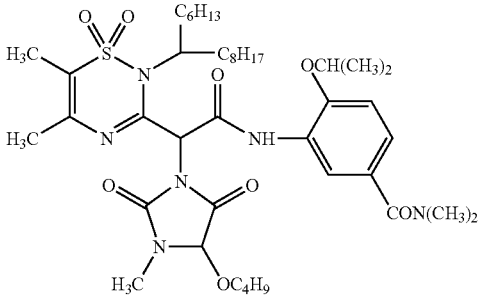
(9)
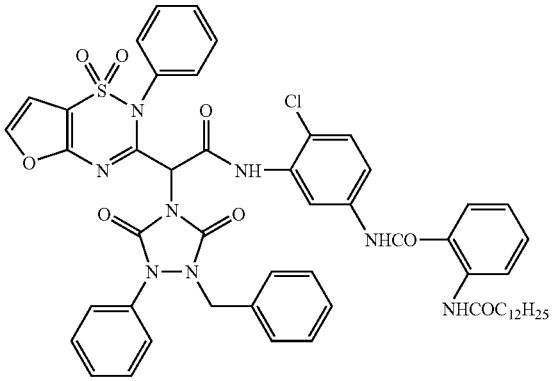
(10)
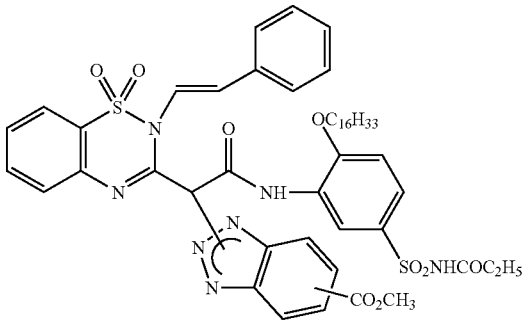

-continued
(11)
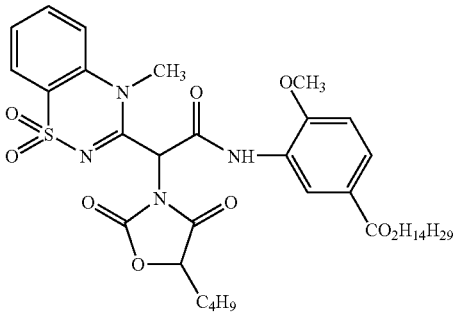
(12)
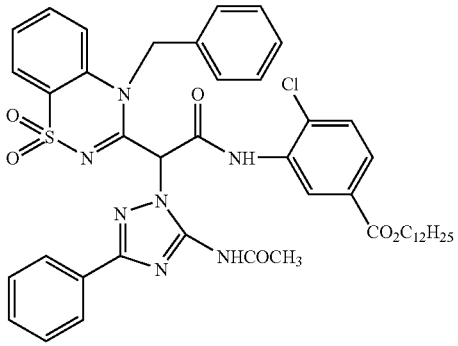
(13)
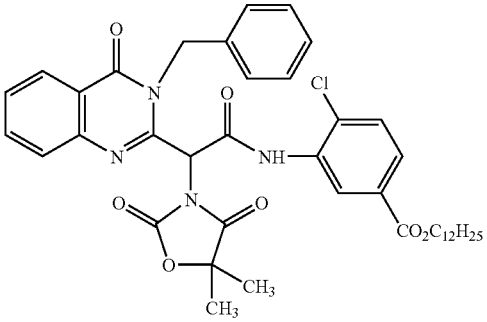
(14)
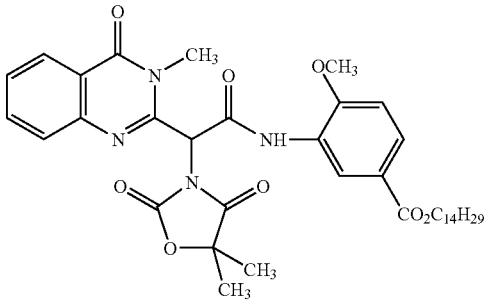
(15)
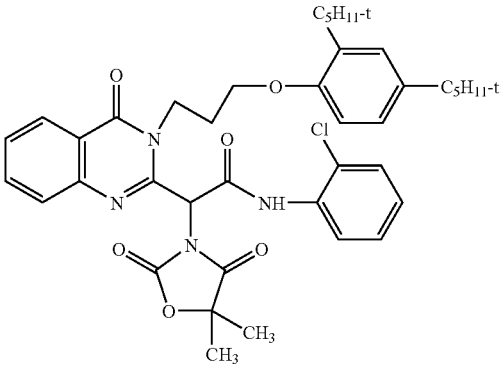
(16)
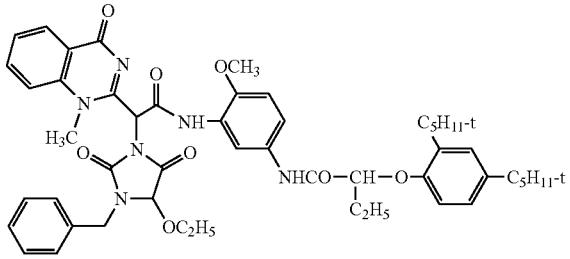
(17)
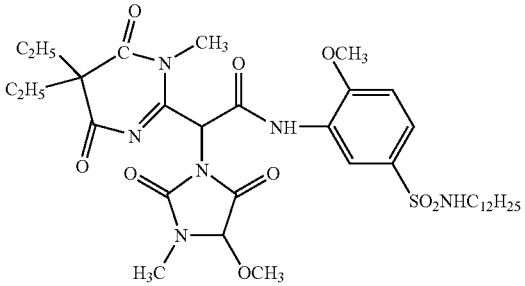
(18)
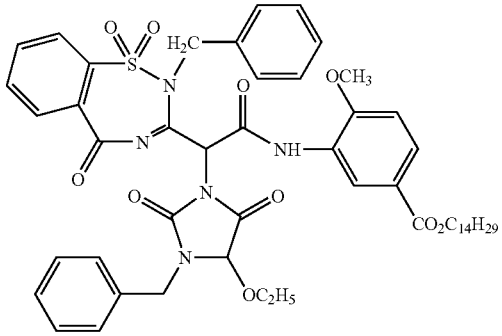

-continued
(19)
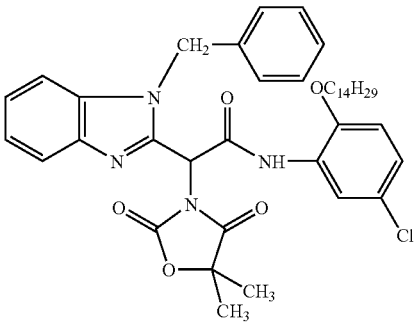
(20)
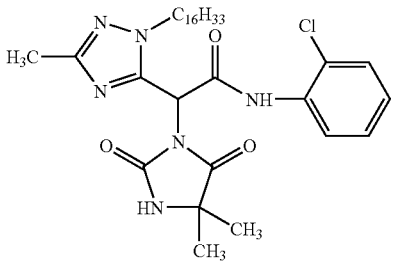
(21)
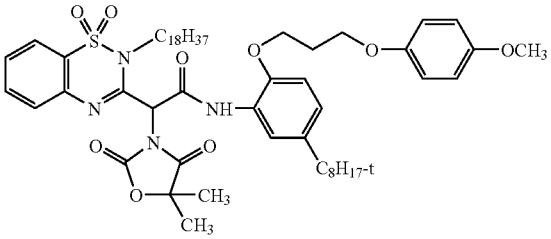
(22)
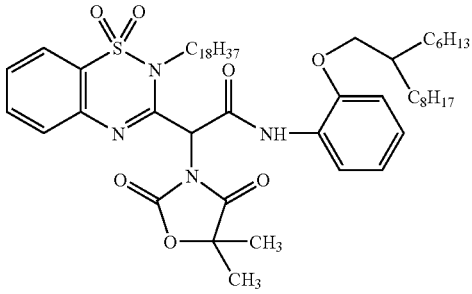
(23)
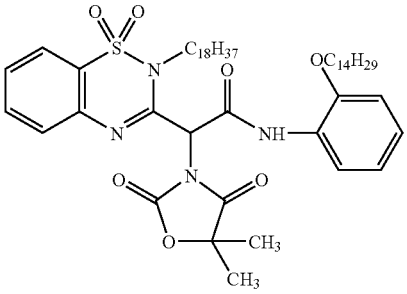
(24)
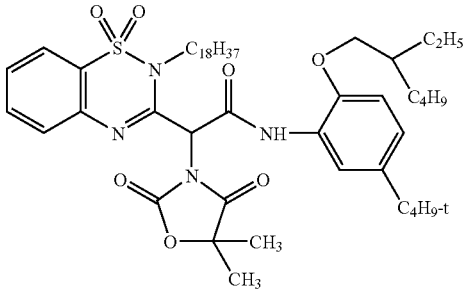
(25)
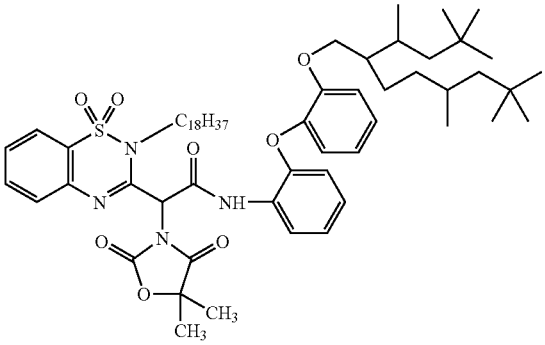
(26)
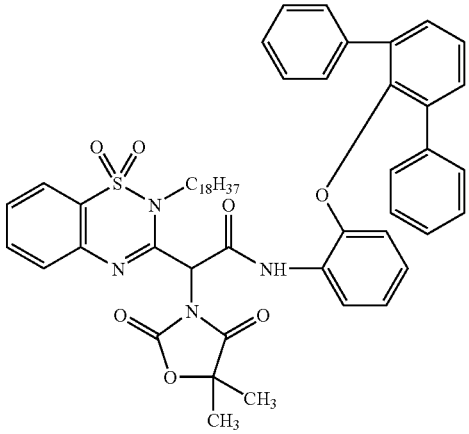

-continued
(27)
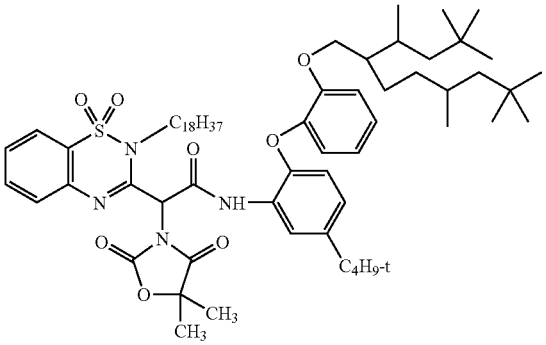
(28)
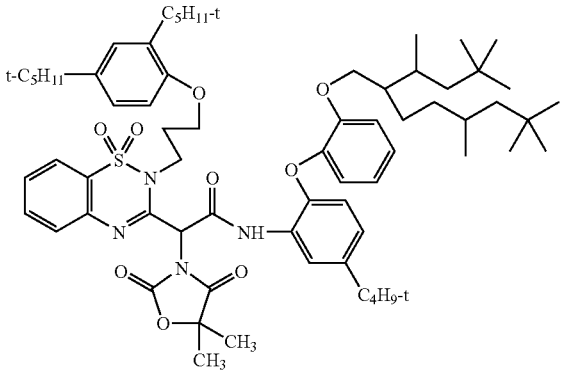
(29)
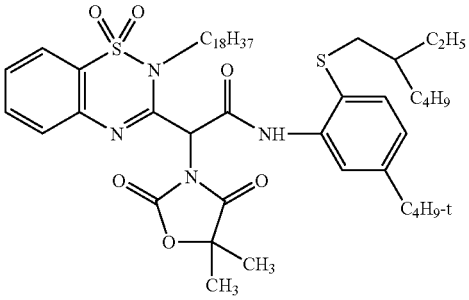
(30)
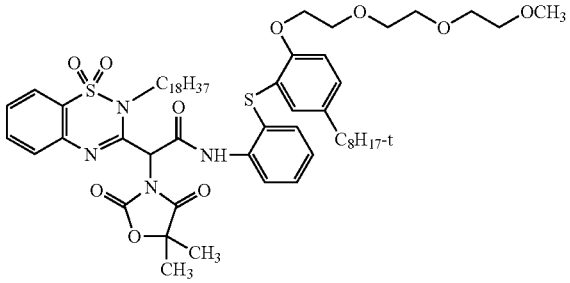
(31)
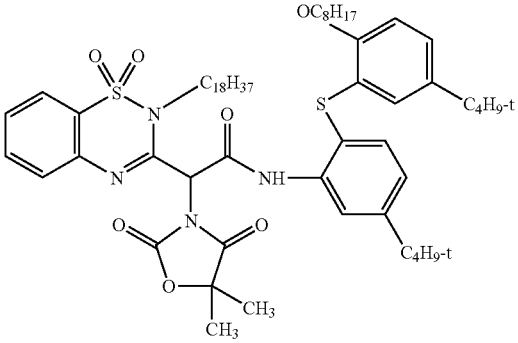
(32)
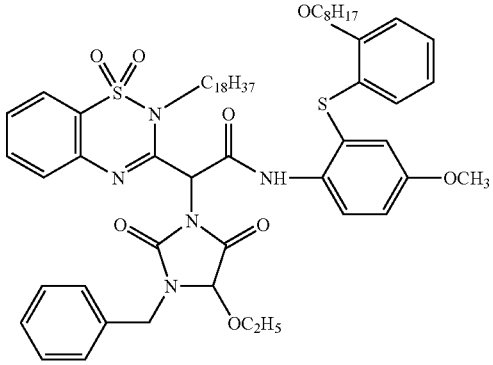
(33)
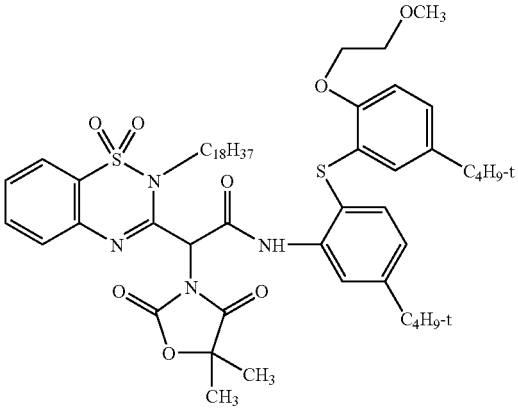
(34)
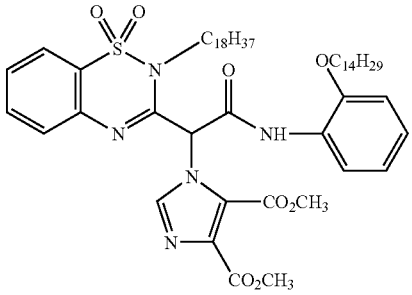

-continued
(35)
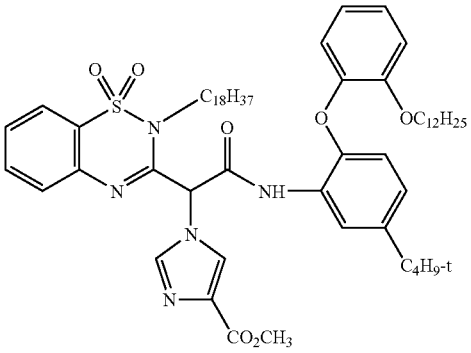
(36)
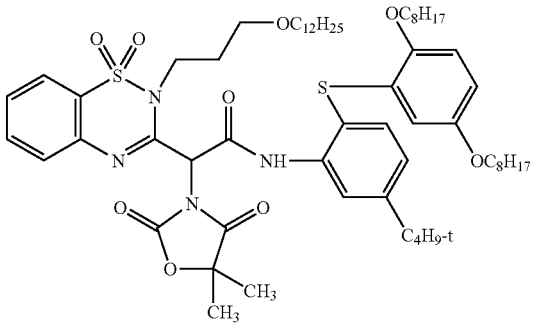
(37)
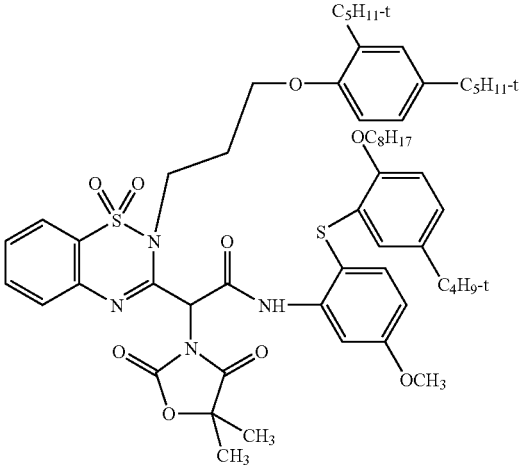
(38)
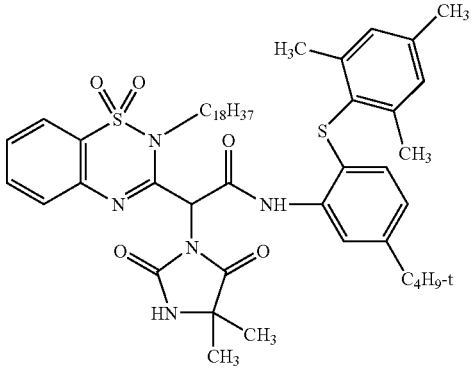
(39)
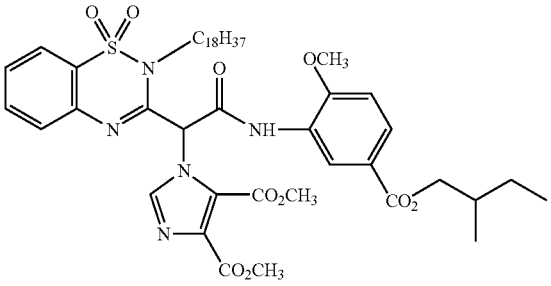
(40)
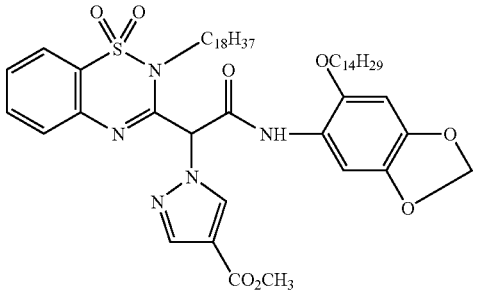
(41)
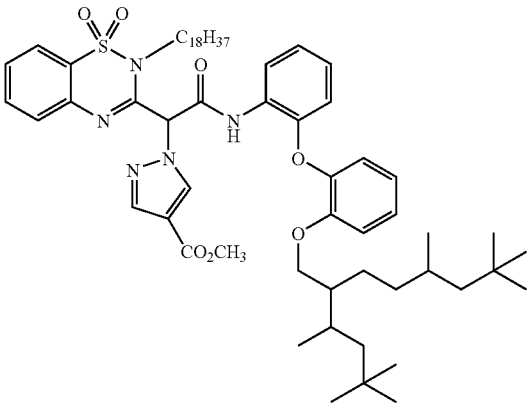
(42)
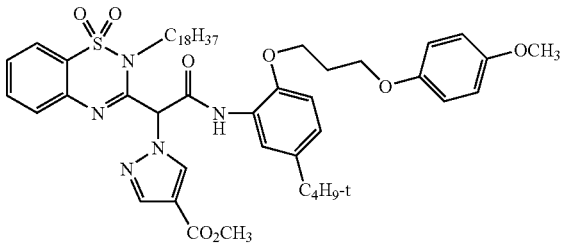

-continued
(43)
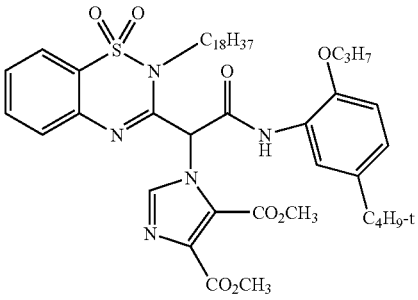
(44)
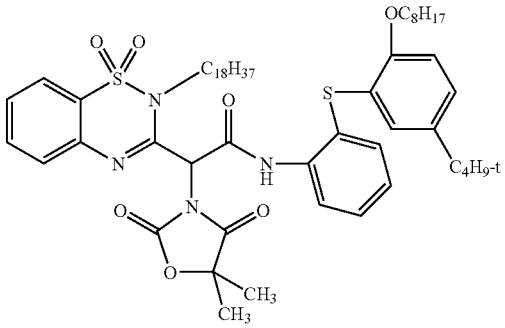
(45)
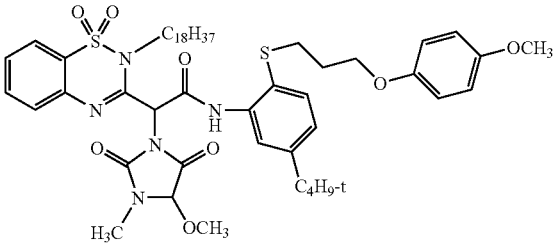
(46)
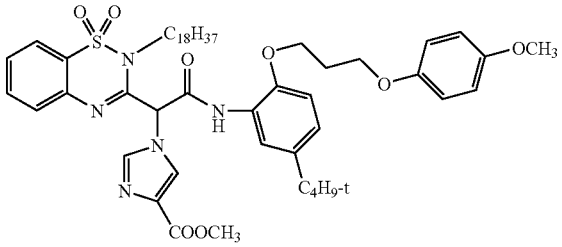
(47)
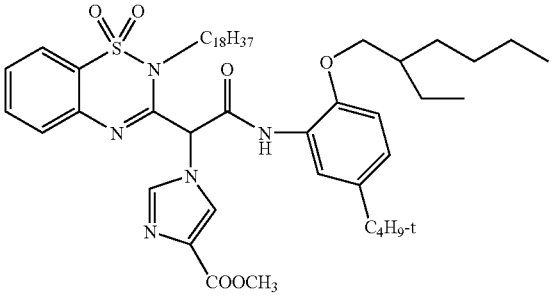
(48)
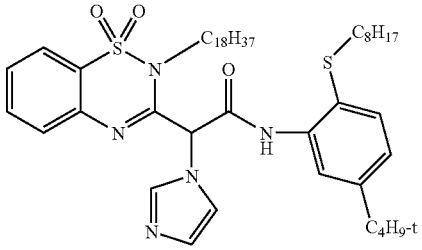
(49)
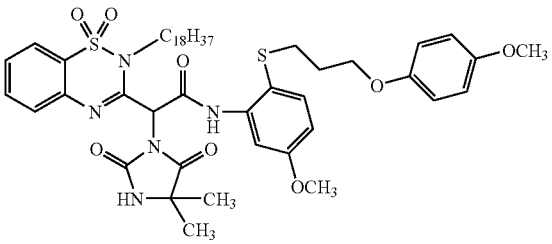
(50)
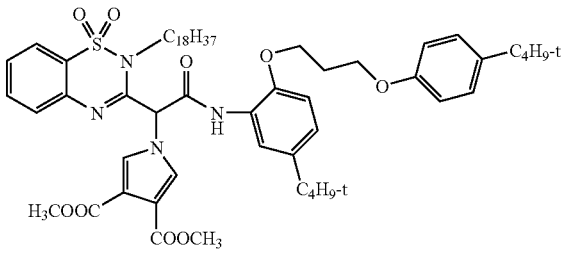
(101)
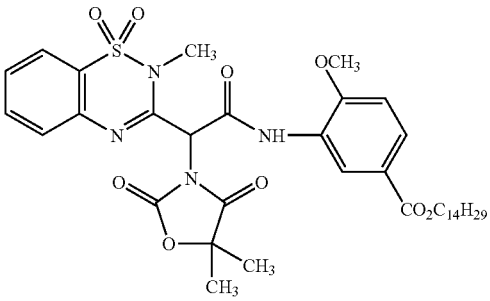

-continued
(102)
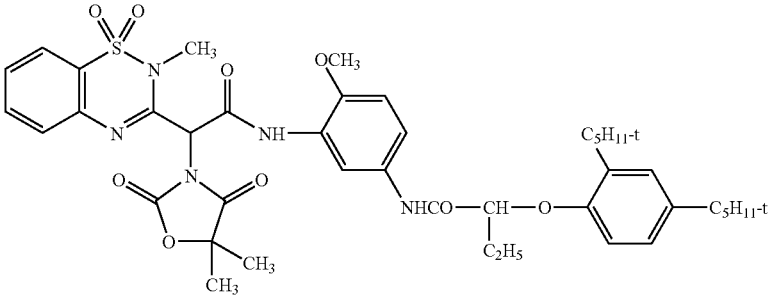
(103)
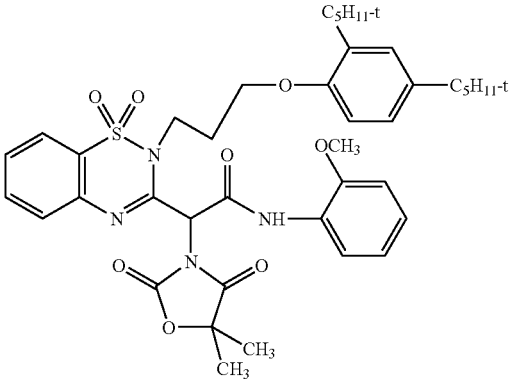
(104)
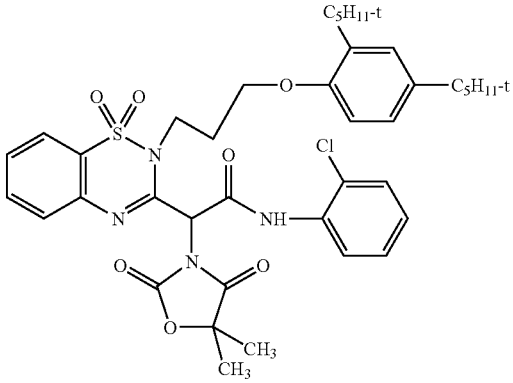
(105)
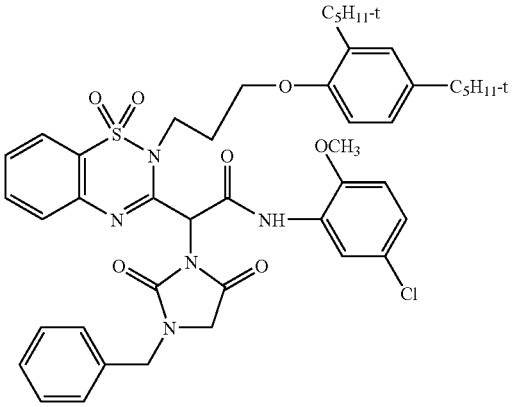
(106)
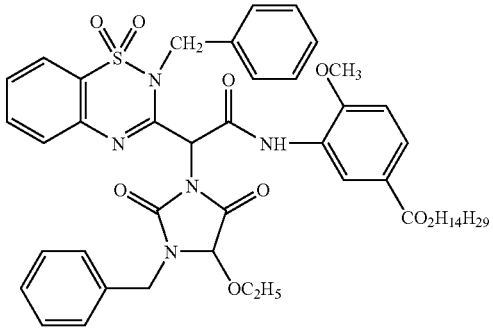
(107)
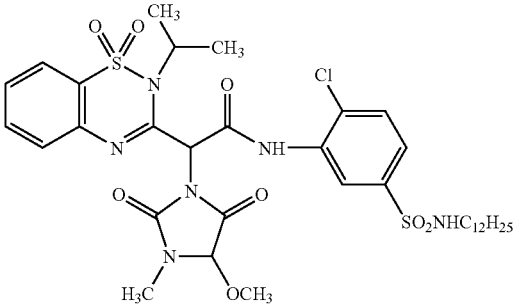
(108)
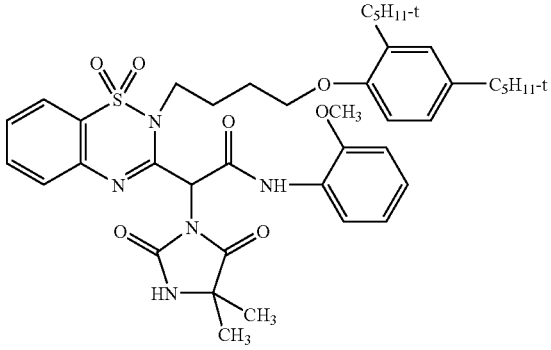

-continued
(109)
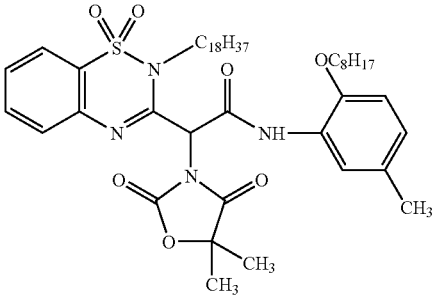
(110)
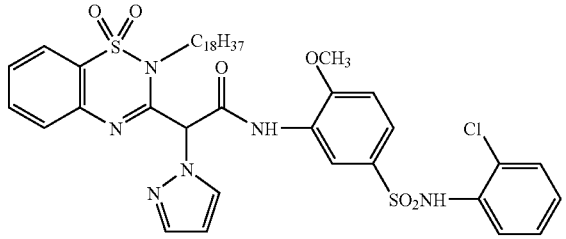
(111)
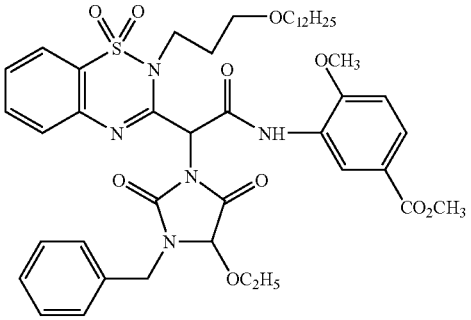
(112)
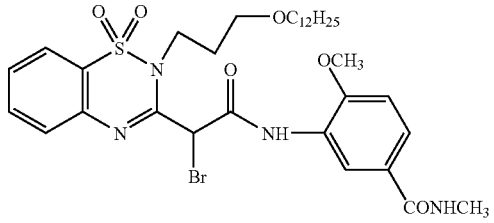
(113)
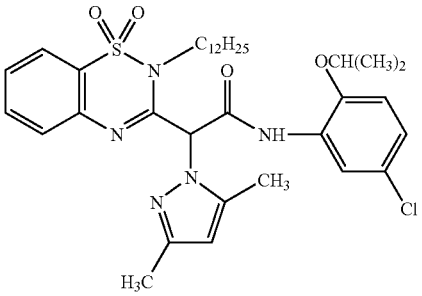
(114)
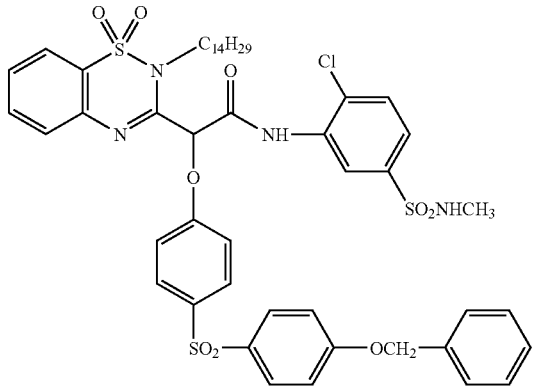
(115)
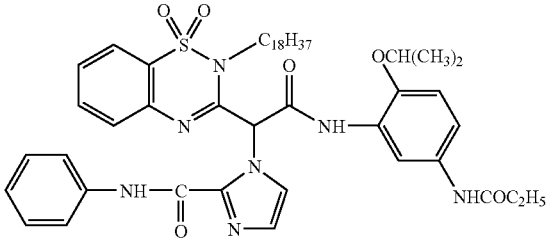
(116)
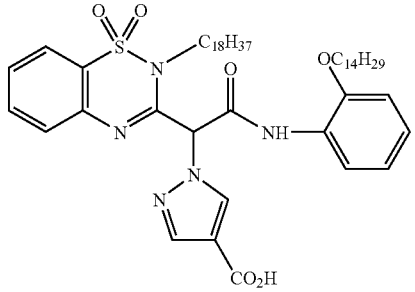

-continued
(117)
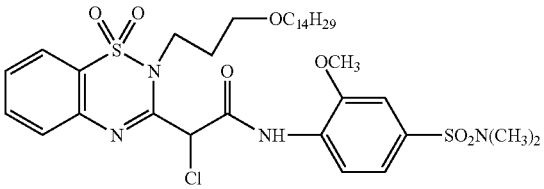
(118)
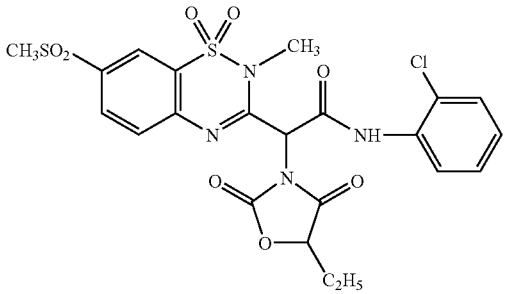
(119)
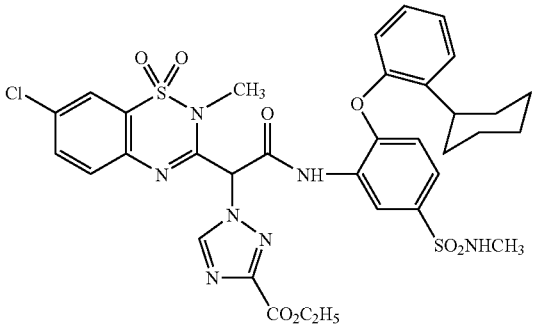
(120)
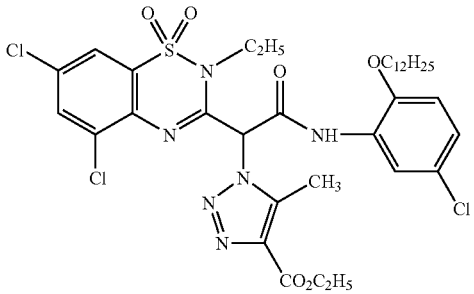
(121)
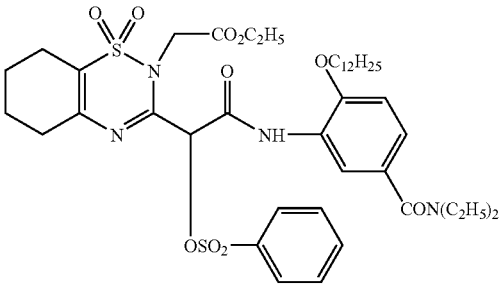
(122)
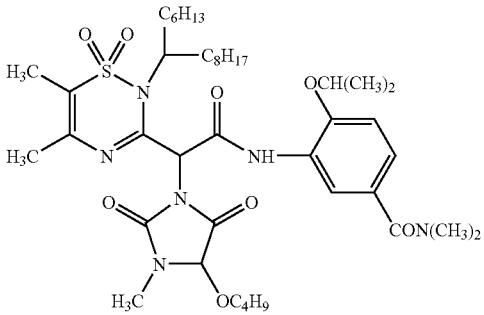
(123)
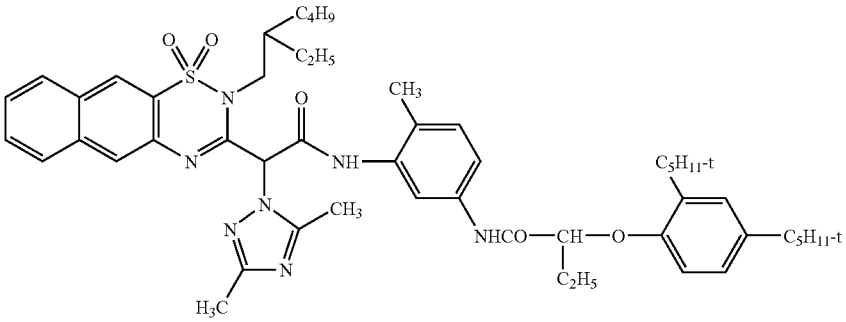
(124)
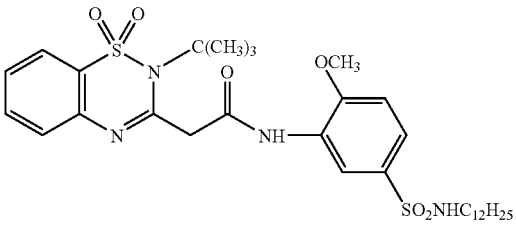

-continued
(125)
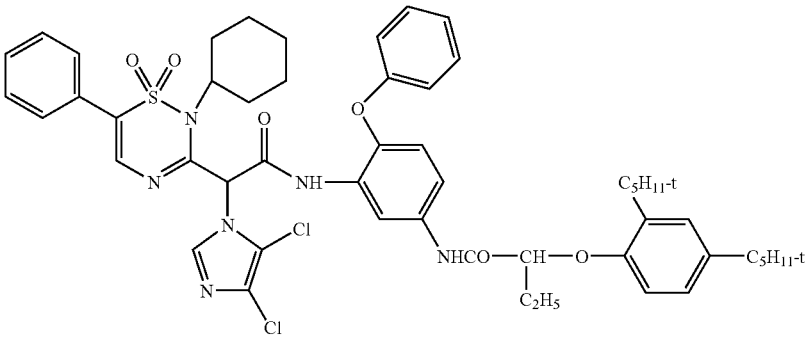
(126)
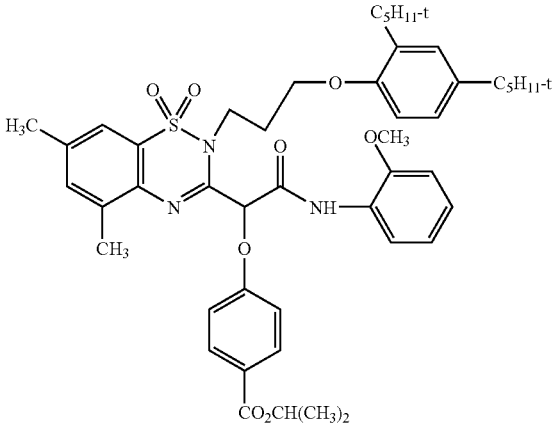
(127)
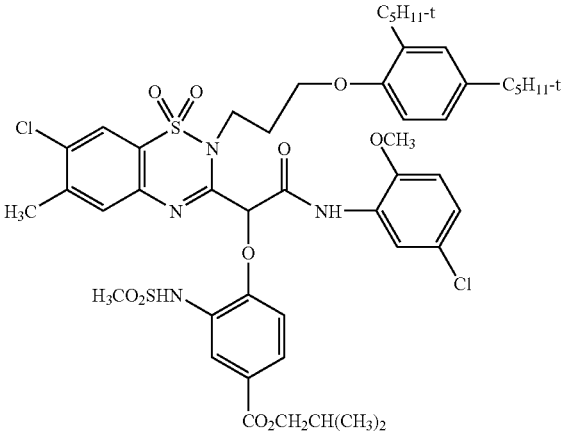
(128)
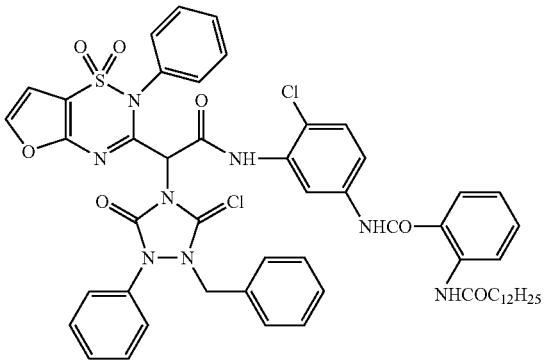
(129)
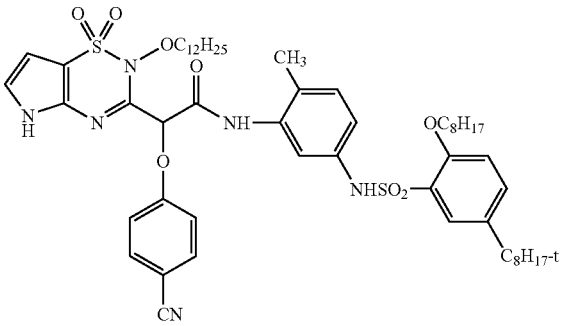
(130)
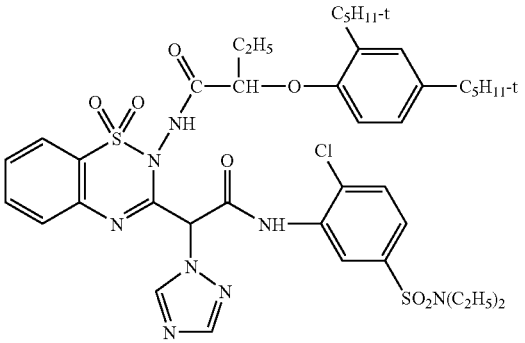
(131)
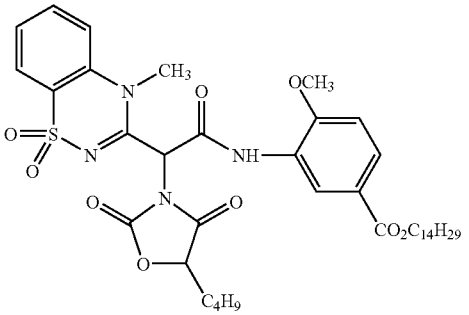

-continued
(132)
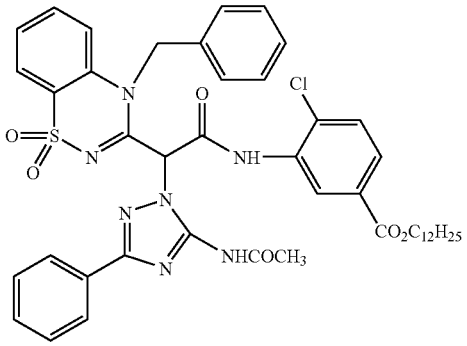
(133)
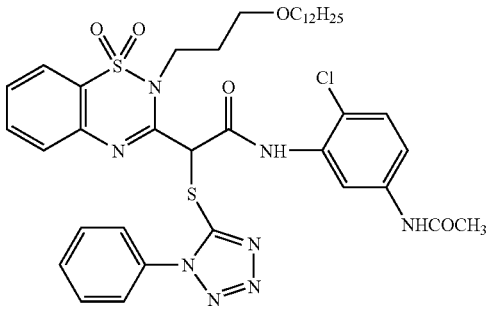
(134)
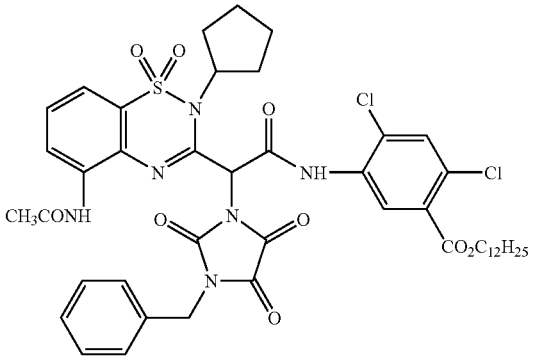
(135)
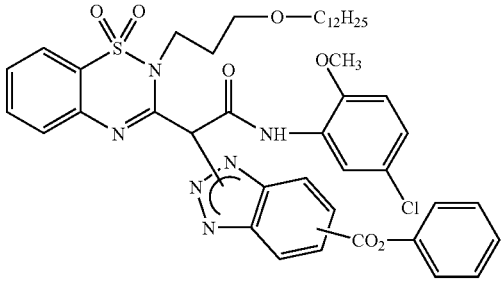
(136)
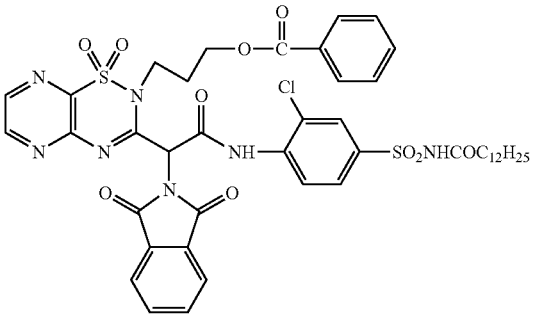
(137)
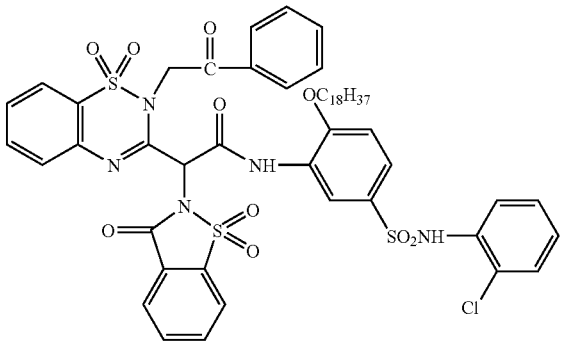
(138)
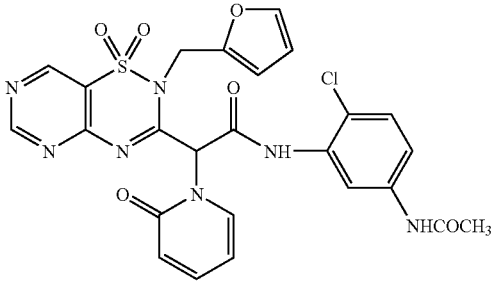
(139)
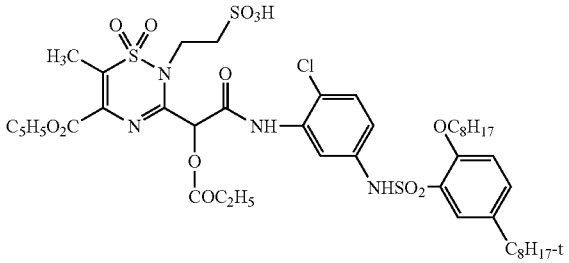

-continued
(140)
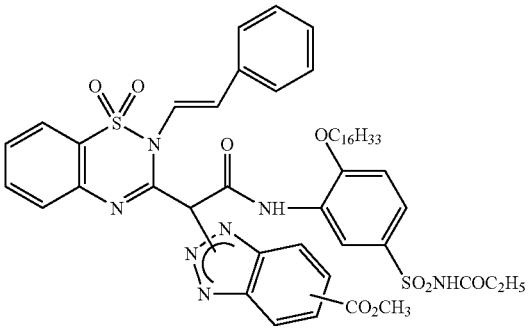
(141)
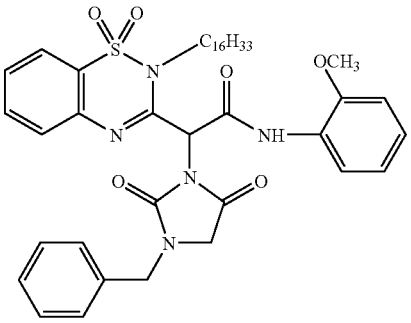
(142)
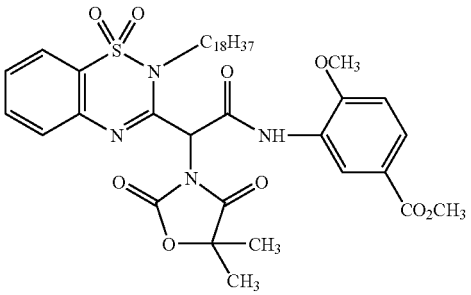
(143)
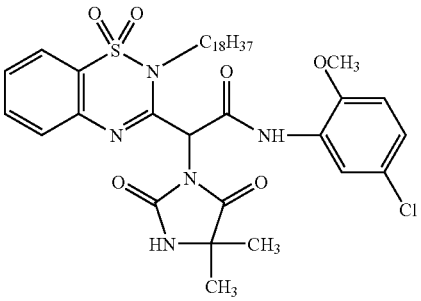
(144)
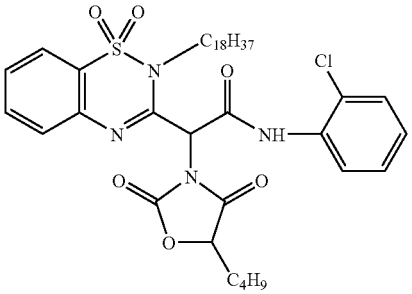
(145)
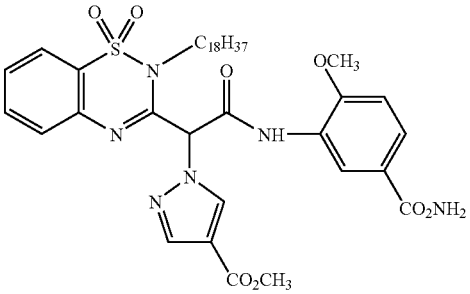
(146)
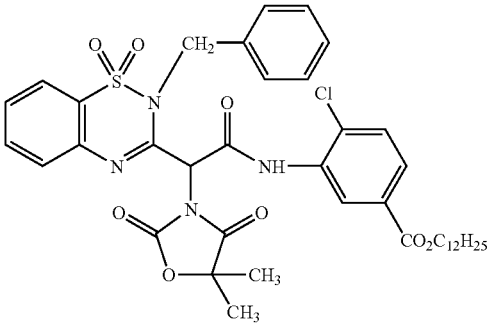
(147)
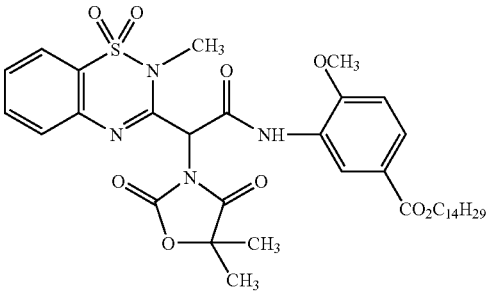

-continued
(148)
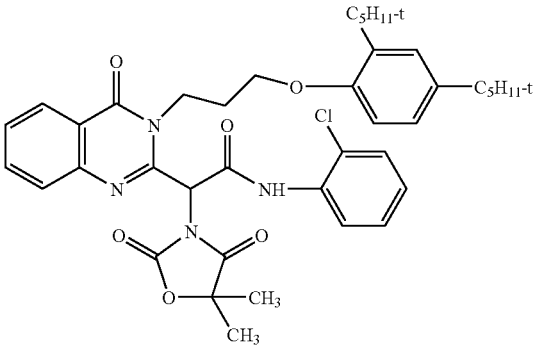
(149)
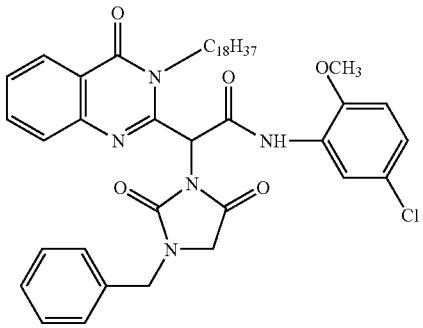
(150)
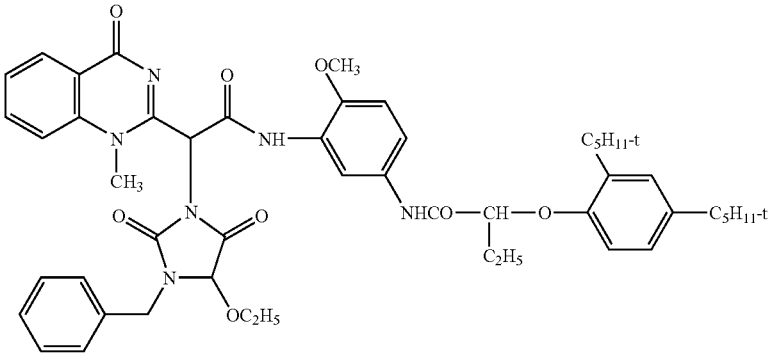
(151)
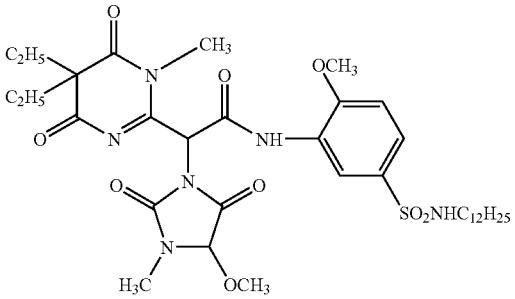
(152)
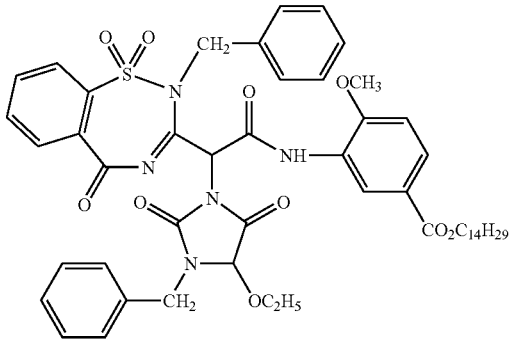
(153)
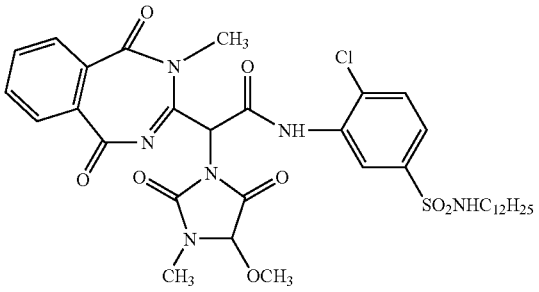
(154)
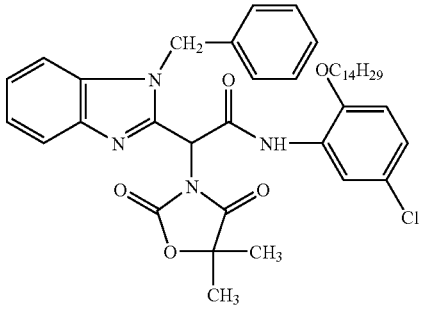

-continued
(155)
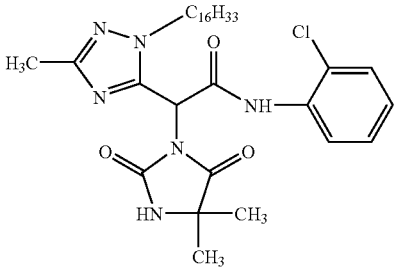
(156)
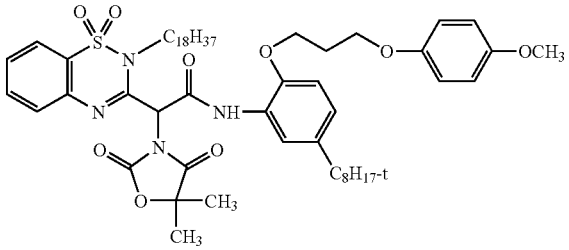
(157)
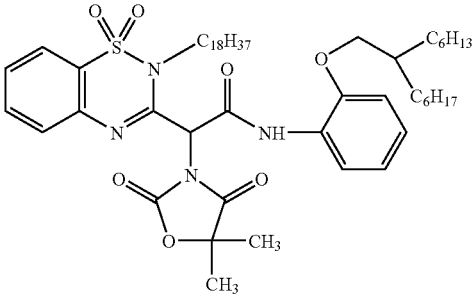
(158)
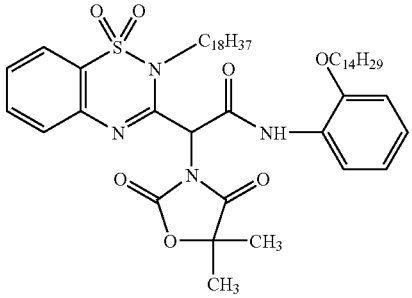
(159)
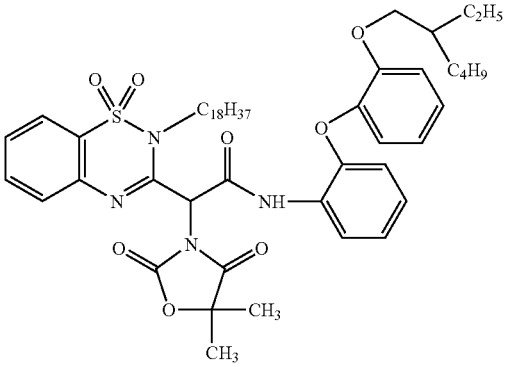
(160)
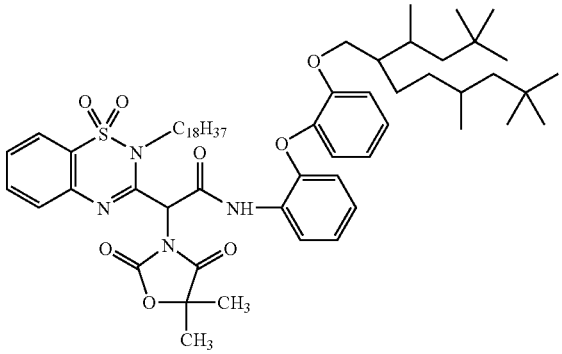
(161)
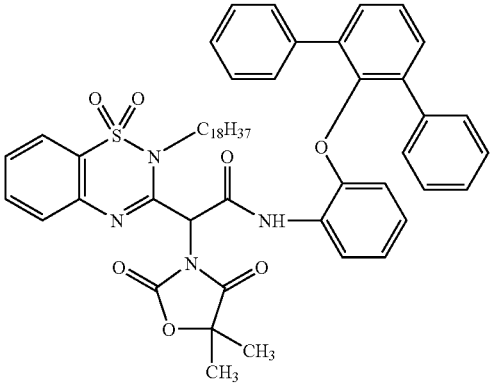
(162)
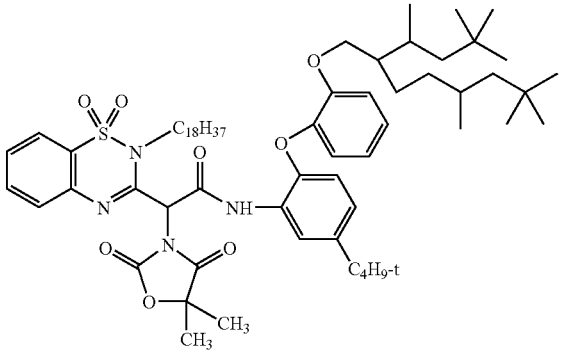

-continued
(163)
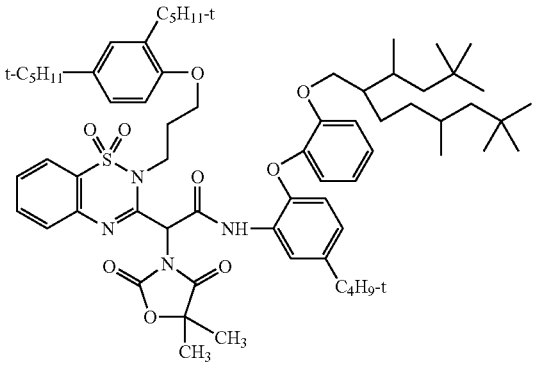
(164)
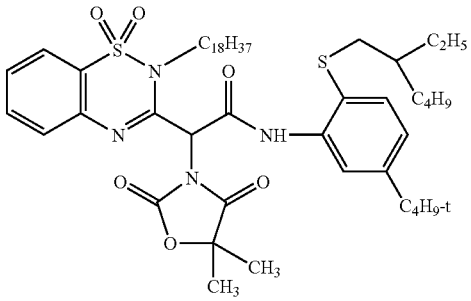
(165)
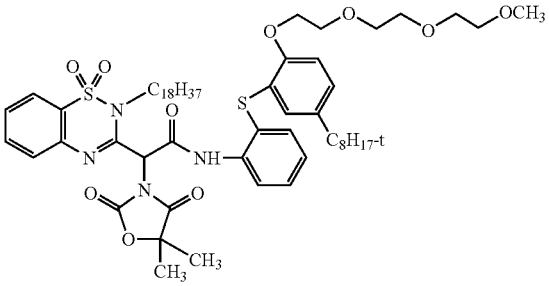
(166)
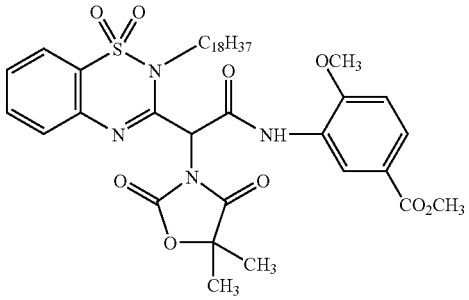
(167)
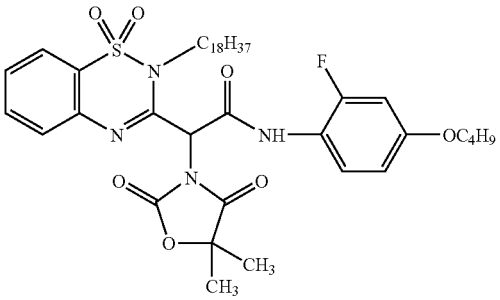
(168)
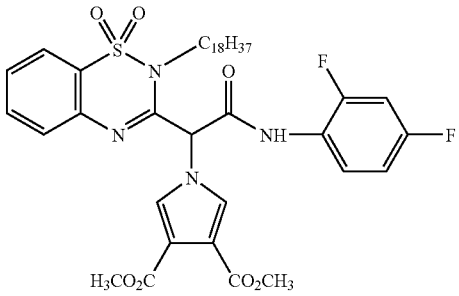
(169)
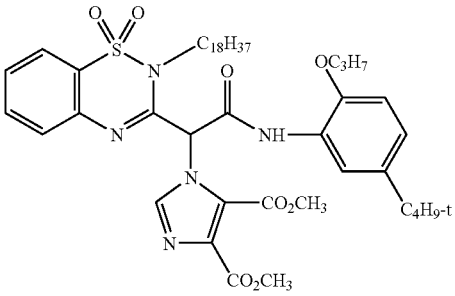
(170)
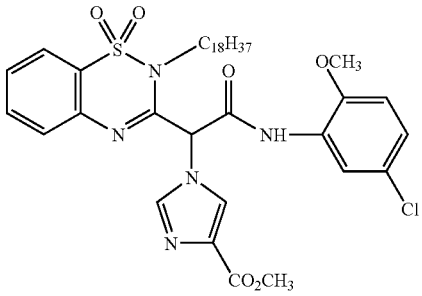
(171)
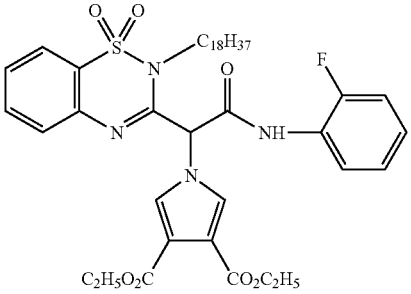
(172)
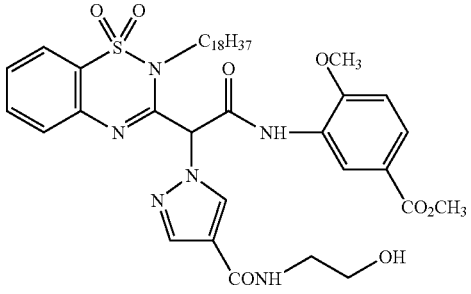

-continued
(173)
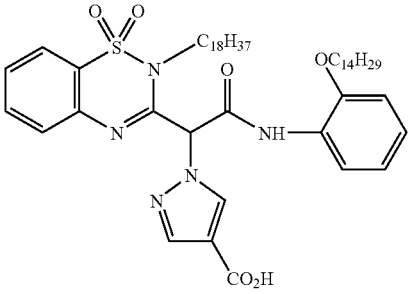
(174)
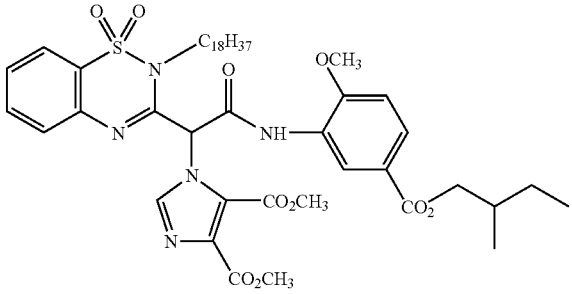
(175)
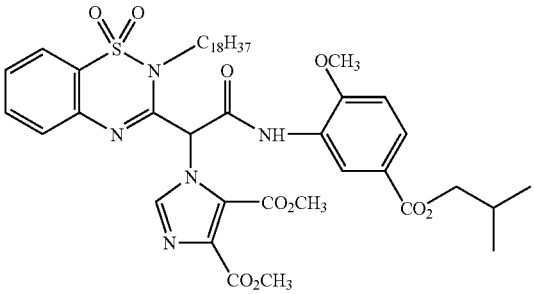
(176)
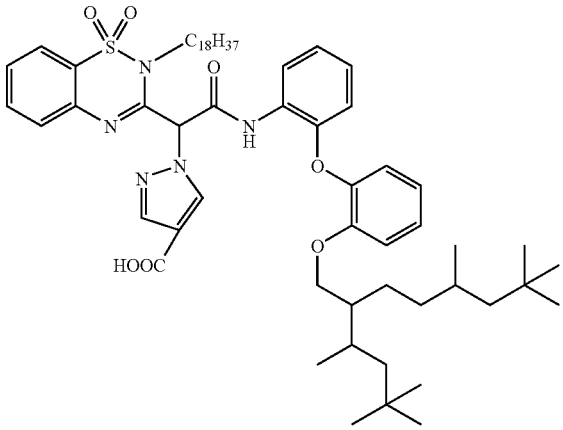
(177)
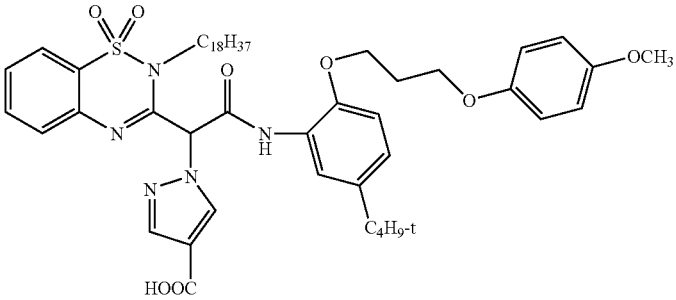
(178)
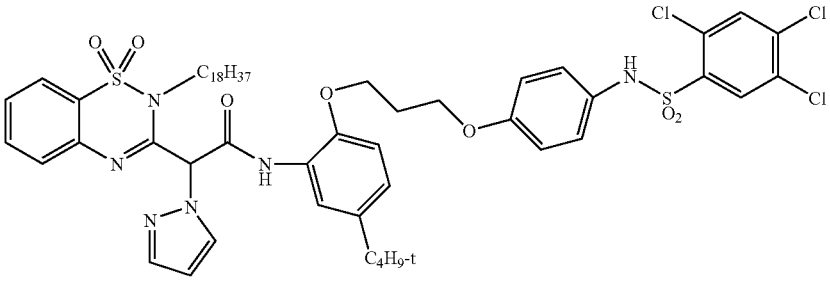

-continued (179)

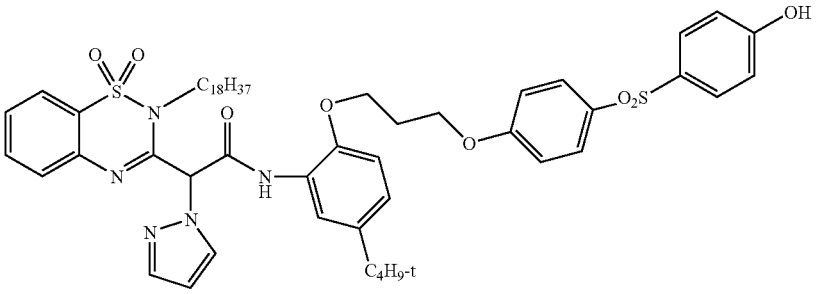

(180)

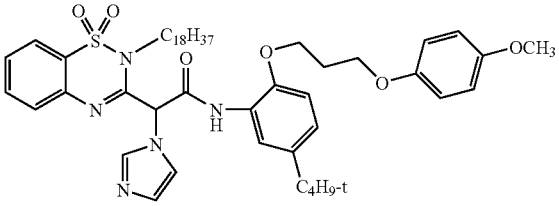

(181)

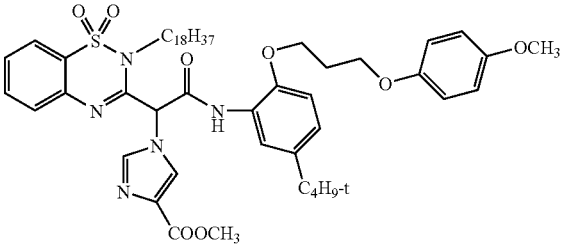

(182)

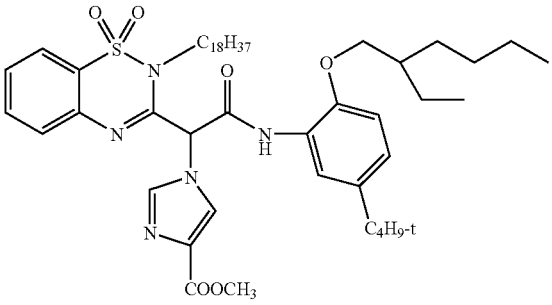

(183)

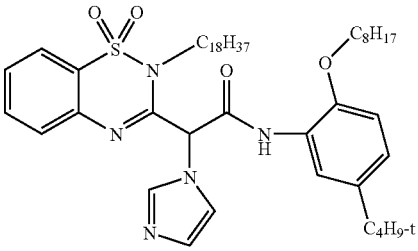

(184)

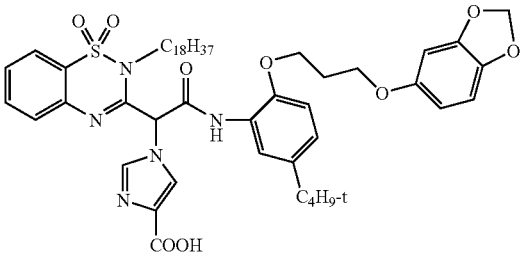

(185)

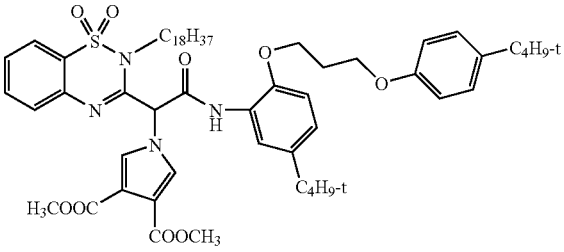

In the following explanation, when the exemplified compounds (herein also referred to as a dye-forming coupler) shown above are referred to, the number x in the parenthesis, i.e., (x), is labeled to each of the exemplified compounds, and they are expressed as "coupler (x)".

Specific Synthetic Examples of the compounds represented by the foregoing formula (I) and (II) are described below.

SYNTHETIC EXAMPLE 1

Synthesis of Coupler (1)

Coupler (1) was synthesized according to the following synthesis route:

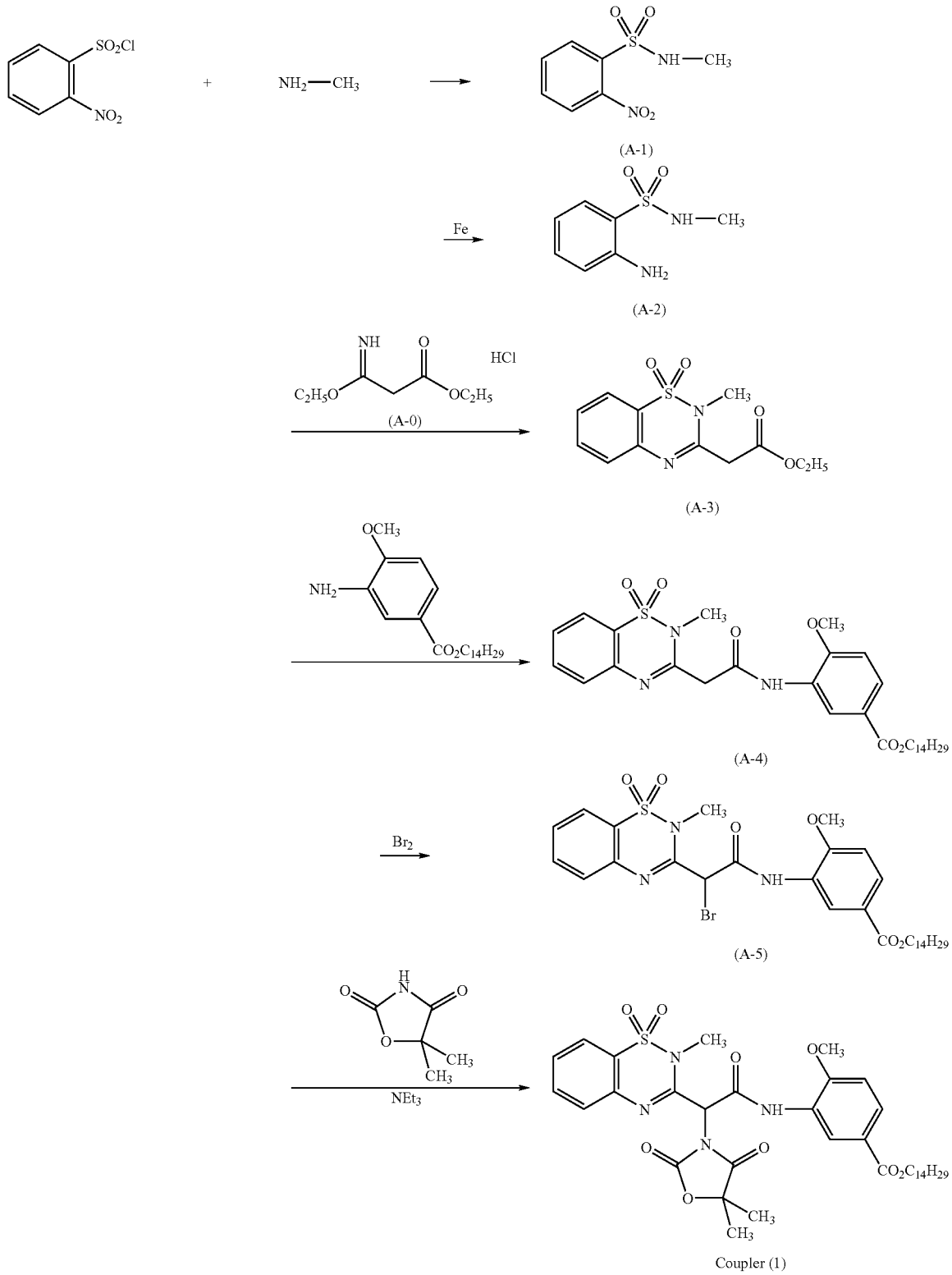

44.3 g of o-nitrobenzenesulfonyl chloride was gradually added, with stirring, to a mixture solution of 38.8 g of an aqueous 40% methylamine solution and 200 ml of acetonitrile, on an ice bath. The resulting reaction mixture was heated up to room temperature and stirred for another 1 hour. Thereafter, ethyl acetate and water were added to separate an organic layer from an aqueous layer. The organic layer was washed with dilute hydrochloric acid and then a saturated brine. After the organic layer was dried with magnesium sulfate without water, the solvent was removed by vacuum distillation. Crystallization from a mixed solvent of ethyl acetate and hexane gave 28.6 g of Compound (A-1).

44.8 g of reduced iron and 4.5 g of ammonium chloride were dispersed in a mixture of 270 ml of isopropanol and 45 ml of water, and stirred for 1 hour with heating under refluxing. To the resulting mixture, 25.9 g of Compound (A-1) was gradually added with stirring. After heating in refluxing for another 1 hour, insoluble matters were removed by a suction filter through Celite. Ethyl acetate and water were added to the filtrate to separate an organic layer from an aqueous layer. The organic layer was washed with a saturated brine, and then dried with magnesium sulfate without water. The solvent was removed by vacuum distillation, to yield 21.5 g of Compound (A-2) as an oily product.

A mixture of 18.9 g of Compound (A-2), 39.1 g of hydrochloride of iminoether (A-0) and 200 ml of ethyl alcohol was stirred with heating in refluxing for 1 day. Additionally 19.2 g of hydrochloride of iminoether was added and stirred with heating in refluxing for another 1 day. Ethyl acetate and water were added to separate an organic layer from an aqueous layer. The organic layer was washed with dilute hydrochloric acid and a saturated brine, and then dried with magnesium sulfate having no water. The solvent was removed by vacuum distillation. Crystallization from a mixed solvent of ethyl acetate and hexane gave 21.0 g of Compound (A-3).

A solution of 5.6 g of Compound (A-3), 7.2 g of 2-methoxy-5-tetradecyloxycarbonylaniline and 20 ml of m-dichlorobenzene was stirred with heating in refluxing for 6 hours. After cooling, crystallization by adding hexane gave 8.8 g of Compound (A-4).

To 110 ml of methylene chloride solution containing 5.4 g of Compound (A-4), 10 ml of methylene chloride solution containing 0.45 ml of bromine was added drop-wise on an ice bath. After the resultant mixture was stirred for 30 minute at room temperature, methylene chloride and water were added to separate an organic layer from an aqueous layer. The organic layer was washed with a saturated brine, and then dried with magnesium sulfate anhydride. The solvent was removed by vacuum distillation, to obtain a crude product of Compound (A-5).

To a solution which was prepared by dissolving 3.5 g of 5,5-dimethyloxazolidine-2,4-dione and 3.8 ml of triethylamine in 110 ml of N,N-dimethyl acetoamide, a solution containing all the previously synthesized crude product of Compound (A-5) dissolved in 25 ml of acetonitrile was added drop-wise over 10 minutes at room temperature, and then stirred for 2 hours at room temperature. Ethyl acetate and water were added to separate an organic layer from an aqueous layer. The organic layer was washed with 0.1 normal (N) aqueous potassium hydroxide solution, dilute hydrochloric acid and a saturated brine, and then dried with magnesium sulfate anhydride. The solvent was removed by vacuum distillation. The residue was purified on silica gel column chromatography using a mixed solvent of acetone and hexane as an eluate, and then recrystallized from a mixed solvent of ethyl acetate/hexane, to give 4.7 g of Coupler (1).

SYNTHETIC EXAMPLE 2

Synthesis of Coupler (3)

Coupler (3) was synthesized according to the following synthesis route:

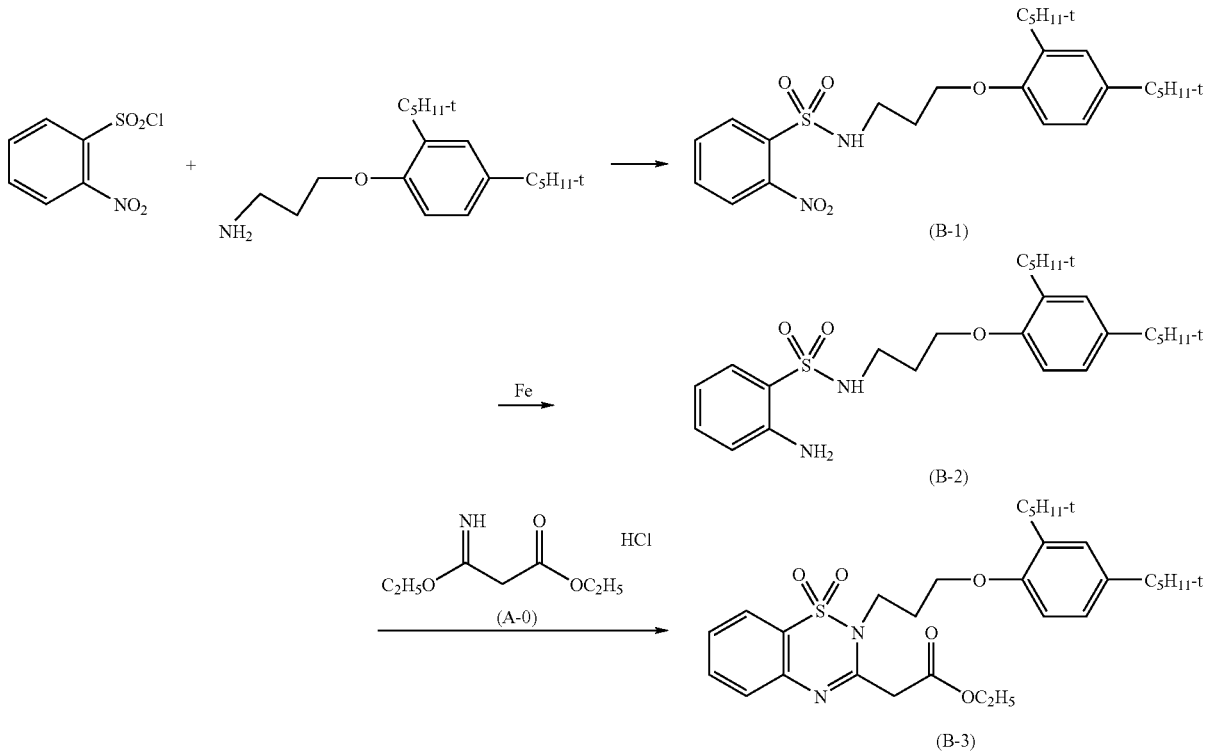

-continued

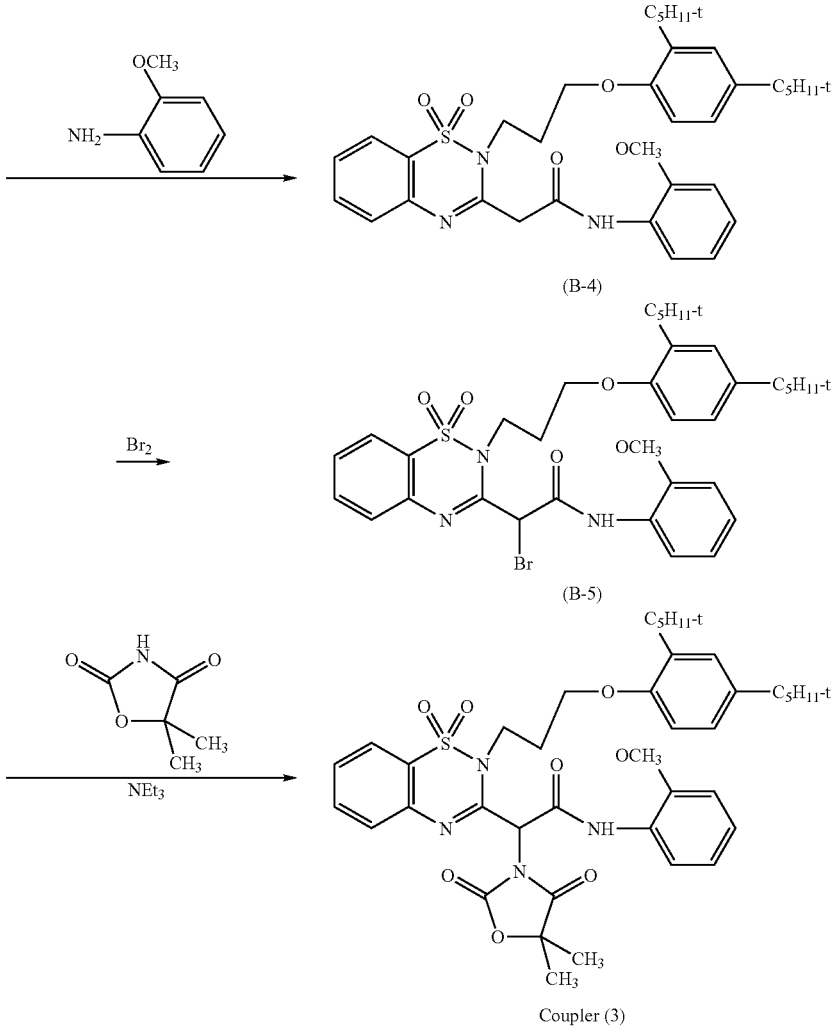

To a solution containing 438 g of 3-(2,4-di-t-amylphenoxy) propylamine, 210 ml of triethylamine and 1 liter of acetonitrile, 333 g of o-nitrobenzenesulfonyl chloride was gradually added with stirring on an ice bath. The resulting reaction mixture was heated up to room temperature and further stirred for 1 hour. Thereafter, ethyl acetate and water were added to separate an organic layer from an aqueous layer. The organic layer was washed with dilute hydrochloric acid and a saturated brine. After the organic layer was dried with magnesium sulfate anhydride, the solvent was removed by vacuum distillation. Crystallization from a mixed solvent of ethyl acetate and hexane gave 588 g of Compound (B-1).

84.0 g of reduced iron and 8.4 g of ammonium chloride were dispersed in a mixture of 540 ml of isopropanol and 90 ml of water, and heated in refluxing for 1 hour. To the resulting dispersion, 119 g of Compound (B-1) was gradually added with stirring. After heating in refluxing for another 2 hours, the reaction mixture was filtrated by a suction filter through Celite. Ethyl acetate and water were added to the filtrate to separate an organic layer from an aqueous layer. The organic layer was washed with a saturated brine, and then dried with magnesium sulfate anhydride. The solvent was removed by vacuum distillation, to yield 111 g of Compound (B-2) as an oily product.

A solution of 111 g of Compound (B-2), 68.4 g of hydrochloride of iminoether (A-0) and 150 ml of ethyl alcohol was stirred with heating in refluxing for 1 hour. Additionally 4.9 g of hydrochloride of iminoether was added and stirred with heating in refluxing for 30 minutes. After cooling the reaction mixture, it was filtered under suction, 100 ml of p-xylene was added to the filtrate and then heated in refluxing for 4 hours while removing ethyl alcohol by distillation. The reaction solution was purified by a silica gel column chromatography using a mixed solvent of ethyl acetate and hexane as the eluate. Crystallization from methanol gave 93.1 g of Compound (B-3).

A solution of 40.7 g of Compound (B-3), 18.5 g of 2-methoxyaniline and 10 ml of p-xylene was stirred with heating in refluxing for 6 hour. Ethyl acetate and water were added to separate an organic layer from an aqueous layer. The organic layer was washed with dilute hydrochloric acid and a saturated brine, and then dried with magnesium sulfate anhydride. The solvent was removed by vacuum distillation. Purification of the residue by a silica gel column chromatography using a mixed solvent of ethyl acetate and hexane as the eluate gave 37.7 g of Compound (B-4) as an oily product.

To a solution of 24.8 g of Compound (B-4) in 400 ml of methylene chloride, 35 ml of methylene chloride solution containing 2.1 ml of bromine was added drop-wise on an ice bath. After the mixture was stirred for 30 minute on an ice bath, methylene chloride and water were added to separate an organic layer from an aqueous layer. The organic layer was washed with a saturated brine, and then dried with magnesium sulfate anhydride. The solvent was removed by vacuum distillation, to obtain Compound (B-5) as a crude product.

To a solution of 15.5 g of 5,5-dimethyl oxazolidine-2,4-dione and 16.8 ml of triethylamine in 200 ml of N,N-dimethyl acetoamide, a solution containing all the previously synthesized crude product of Compound (B-5) dissolved in 40 ml of acetonitrile was added drop-wise over 10 minutes at room temperature. The resultant mixture was heated up to 40° C. and then stirred for 30 minutes. Ethyl acetate and water were added to separate an organic layer from an aqueous layer. The organic layer was washed with 0.1 normal aqueous potassium hydroxide solution, dilute hydrochloric acid and a saturated brine, and then dried with magnesium sulfate anhydride. The solvent was removed by vacuum distillation. The residue was purified by a silica gel column chromatography using a mixed solvent of acetone and hexane as the eluate. Crystallization from a mixed solvent of ethyl acetate and hexane gave 23.4 g of Coupler (3).

SYNTHETIC EXAMPLE 3

Synthesis of Coupler (6)

Coupler (6) was synthesized according to the following synthesis route:

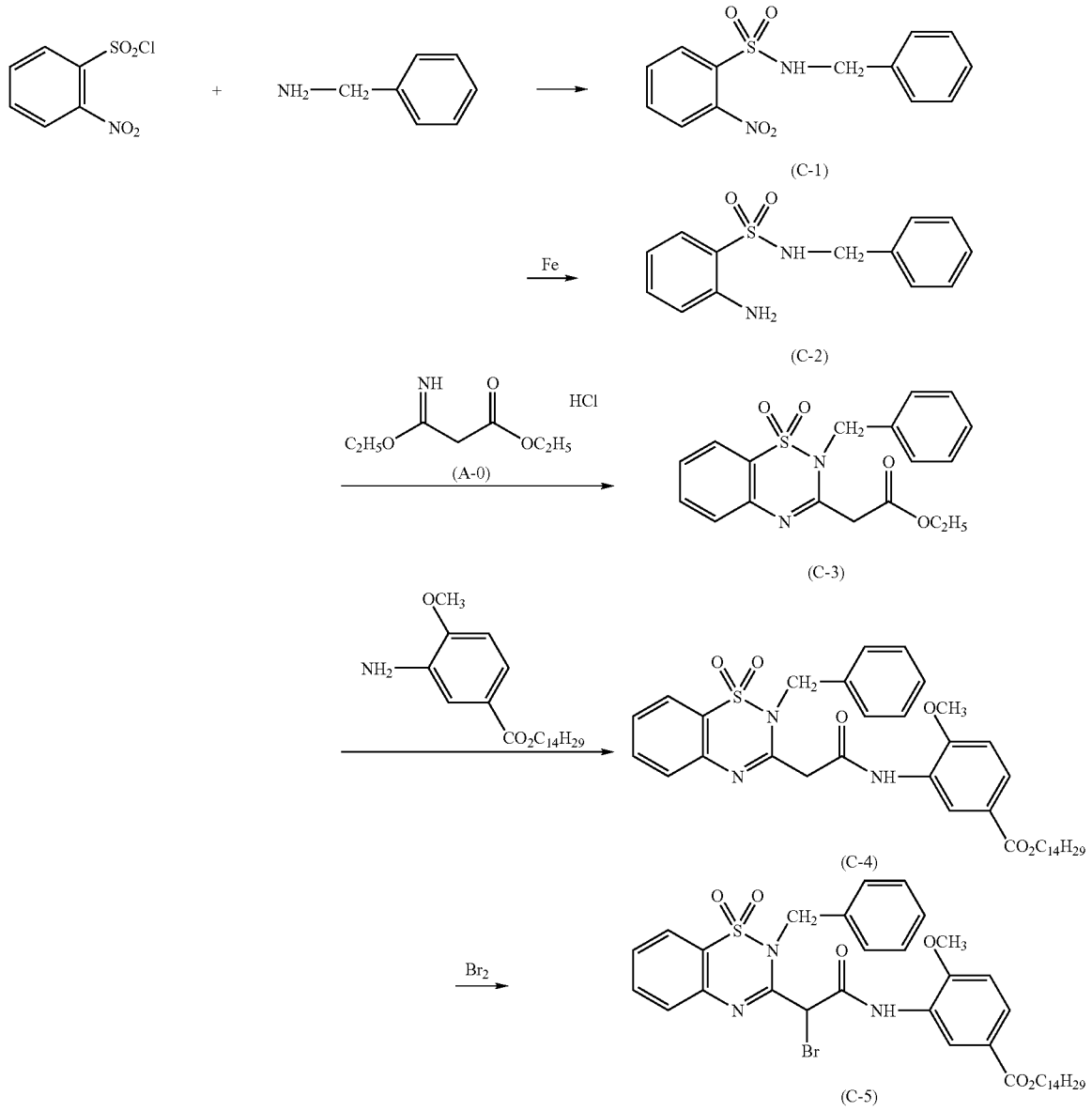

-continued

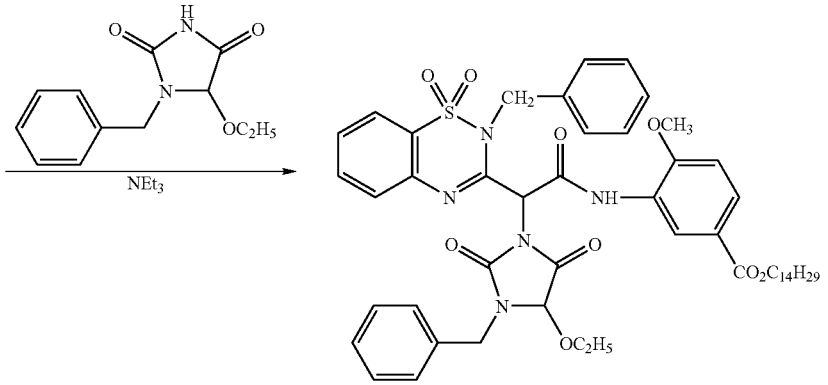

Coupler (6)

To a solution of 21.4 g benzylamine in 200 ml of acetonitrile, 39.9 g of o-nitrobenzenesulfonyl chloride was gradually added with stirring on an ice bath. The resulting reaction mixture was heated up to room temperature. Further, 30 ml of triethylamine was added drop-wise and stirred for 1 hour. Thereafter, ethyl acetate and water were added to separate an organic layer from an aqueous layer. The organic layer was washed with dilute hydrochloric acid and then a saturated brine. After the organic layer was dried with magnesium sulfate anhydride, the solvent was removed by vacuum distillation. Crystallization from a mixed solvent of ethyl acetate and hexane gave 31.2 g of Compound (C-1).

In the following description, an example of the compounds represented by the formula (A) is described as the coupler C-1. However, the coupler C-1 may or may not be same as in the compound (C-1) used in this synthetic example. (This rule is acceptable to the compounds (C-2) to (C-5) hereinafter.)

44.8 g of reduced iron and 4.5 g of ammonium chloride were dispersed in a mixture of 270 ml of isopropanol and 45 ml of water, and stirred for 1 hour with heating in refluxing. To the resulting mixture, 29.2 g of Compound (C-1) was gradually added with stirring. After heating in refluxing for another 1 hour, the reaction mixture was filtrated by a suction filter through Celite. Ethyl acetate and water were added to the filtrate to separate an organic layer from an aqueous layer. The organic layer was washed with a saturated brine, and then dried with magnesium sulfate anhydride. The solvent was removed by vacuum distillation, to yield 25.5 g of Compound (C-2) as an oily product.

A solution of 19.7 g of Compound (C-2) and 22.0 g of hydrochloride of iminoether (A-0) in 200 ml of ethyl alcohol was stirred with heating in refluxing for 4 hours. Further, 19.7 g of hydrochloride of the iminoether was added and stirred with heating under reflux for 4 hours. Additionally 13 g of p-toluene sulfonic acid monohydrate was added and stirred with heating in refluxing for 1 hour. Ethyl acetate and water were added to separate an organic layer from an aqueous layer. The organic layer was washed with dilute hydrochloric acid and a saturated brine, and then dried with magnesium sulfate anhydride. The solvent was removed by vacuum distillation. Crystallization from a mixed solvent of ethyl acetate and hexane gave 3.2 g of Compound (C-3).

A solution of 2.9 g of Compound (C-3), 2.9 g of 2-methoxy-5-tetradecyloxycarbonylaniline in 20 ml of o-dichlorobenzene was stirred for 6 hours with heating in refluxing. Ethyl acetate and water were added to separate an organic layer from an aqueous layer. The organic layer was washed with dilute hydrochloric acid and a saturated brine, and then dried with magnesium sulfate anhydride. The solvent was removed by vacuum distillation. The residue was purified by a silica gel column chromatography using a mixed solvent of ethyl acetate and hexane as the eluate. Crystallization from a mixed solvent of ethyl acetate and hexane gave 3.8 g of Compound (C-4).

To a solution containing 3.4 g of Compound (C-4) in 100 ml of methylene chloride, 10 ml of methylene chloride solution containing 0.26 ml of bromine was added drop-wise on an ice bath. After the mixture was stirred for 30 minute at room temperature, methylene chloride and water were added to separate an organic layer from an aqueous layer. The organic layer was washed with a saturated brine, and then dried with magnesium sulfate anhydride. The solvent was removed by vacuum distillation, to obtain a crude product of Compound (C-5).

To a solution of 3.5 g of 1-benzyl-5-ethoxyhydantoin and 2.1 ml of triethylamine in 100 ml of N,N-dimethyl acetoamide, a solution containing all the previously synthesized crude product of Compound (C-5) dissolved in 20 ml of acetonitrile was added drop-wise over 30 minutes at room temperature, and then stirred at 40° C. for 2 hours. Ethyl acetate and water were added to separate an organic layer from an aqueous layer. The organic layer was washed with 0.1 normal aqueous potassium hydroxide solution, dilute hydrochloric acid and a saturated brine, and then dried with magnesium sulfate anhydride. The solvent was removed by vacuum distillation. The residue was purified by a silica gel column chromatography using a mixed solvent of ethyl acetate and hexane as the eluate. Crystallization from a mixed solvent of ethyl acetate and hexane gave 3.0 g of Coupler (6).

SYNTHETIC EXAMPLE 4

Synthesis of Coupler (131)

Coupler (131) was synthesized according to the following synthesis route:

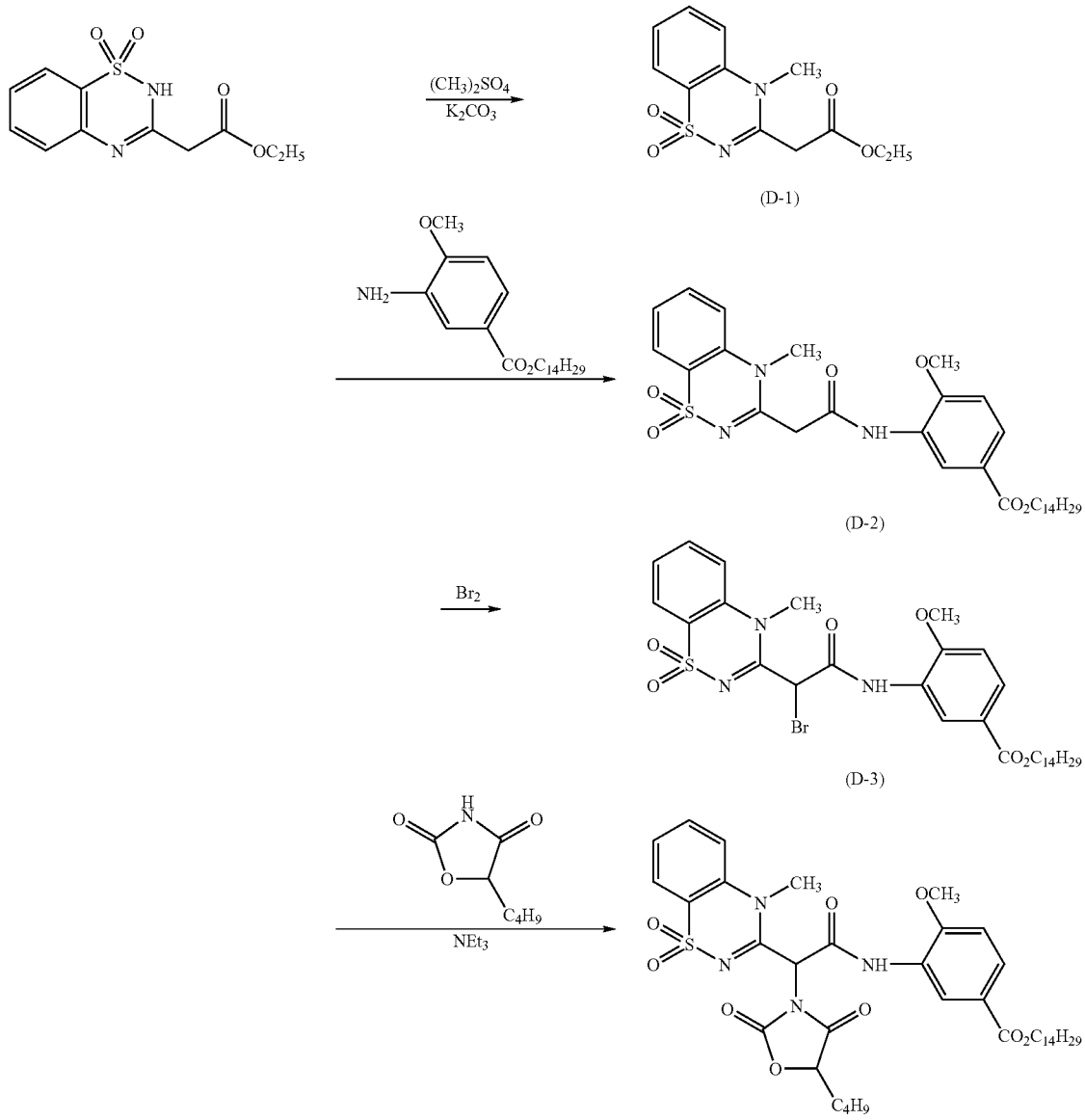

To a solution of 26.8 g of Compound (D-0) (Coupler-I described in U.S. Pat. No. 3,841,880) and 16.6 g of potassium carbonate in 300 ml of acetone, 13.9 g of dimethyl sulfate was added drop-wise and stirred for 2 hours with heating in ref luxing. Ethyl acetate and water were added to separate an organic layer from an aqueous layer. The organic layer was washed with dilute hydrochloric acid and a saturated brine, and then dried with magnesium sulfate anhydride. The solvent was removed by vacuum distillation. The residue was purified by a silica gel column chromatography using a mixed solvent of acetone and hexane as the eluate. Crystallization from a mixed solvent of ethyl acetate and hexane gave 5.6 g of Compound (D-1). At the same time, 10.9 g of Compound (A-3) was obtained as a by-product. Coupler (101) may be produced from Compound (A-3) thus prepared.

A solution of 5.4 g of Compound (D-1) and 7.3 g of 2-methoxy-5-tetradecyloxycarbonylaniline in 50 ml of o-dichlorobenzene was stirred for 6 hours with heating in refluxing. Ethyl acetate and water were added to separate an organic layer from an aqueous layer. The organic layer was washed with dilute hydrochloric acid and a saturated brine, and then dried with magnesium sulfate anhydride. The solvent was removed by vacuum distillation. Crystallization from a mixed solvent of ethyl acetate and methanol gave 9.1 g of Compound (D-2).

To a solution of 4.8 g of Compound (D-2) in 100 ml of methylene chloride, 10 ml of a methylene chloride solution containing 0.4 ml of bromine was added drop-wise on an ice bath. The reaction mixture was stirred for 30 minutes on an ice bath. Thereafter, methylene chloride and water were added to separate an organic layer from an aqueous layer. The organic layer was washed with a saturated brine, and then dried with magnesium sulfate anhydride. The solvent was removed by vacuum distillation, to obtain a crude product of Compound (D-3).

To a solution of 3.8 g of 5-butyloxazolidine-2,4-dione and 3.4 ml of triethylamine dissolved in 100 ml of N,N-dimethyl acetamide, a solution containing all the previously synthesized crude product of Compound (D-3) dissolved in 50 ml of N,N-dimethylacetamide was added drop-wise at room temperature over 30 minutes, and the resultant mixture was stirred for 1 hour at room temperature. Ethyl acetate and water were added to separate an organic layer from an aqueous layer. The organic layer was washed with 0.1 normal aqueous potassium hydroxide solution, dilute hydrochloric acid and a saturated brine, and then dried with magnesium sulfate anhydride. The solvent was removed by vacuum distillation. The residue was purified by a silica gel column chromatography using a mixed solvent of acetone, tetrahydrofuran and hexane as the eluate. Crystallization from a mixed solvent of ethyl acetate and hexane gave 2.1 g of Coupler (131).

SYNTHETIC EXAMPLE 5

Synthesis of Coupler (146)

Coupler (146) was synthesized in the synthesis route shown below.

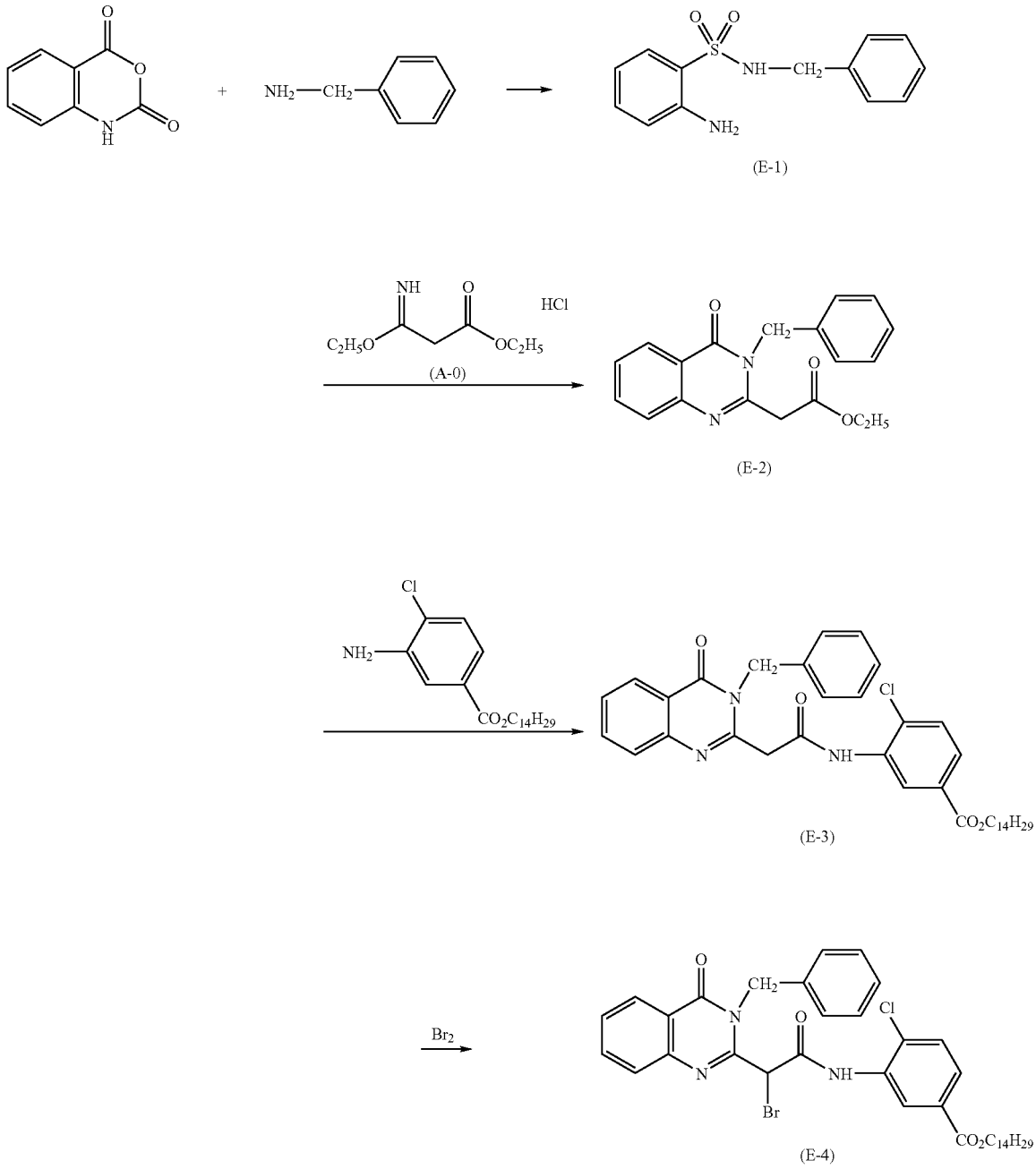

-continued

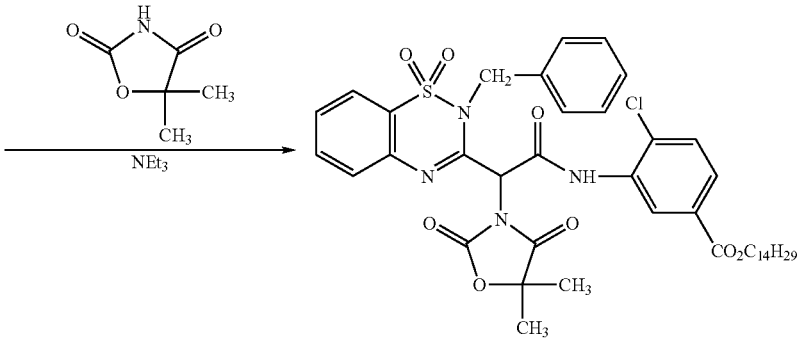

Coupler (146)

32.2 g of benzylamine was added, drop-wise, with stirring, to 200 ml of an acetonitrile solution containing 48.9 g of isatoic acid anhydride. The resulting mixture was heated up to 60° C. and further stirred for 10 minutes. Thereafter, ethyl acetate and water were added thereto, to separate an organic layer from an aqueous layer. The organic layer was dried with magnesium sulfate anhydride, and then the solvent was removed by vacuum distillation. Crystallization from a mixed solvent of ether and hexane gave 54.6 g of Compound (E-1).

200 ml of an ethyl alcohol solution containing 24.9 g of Compound (E-1), 21.6 g of hydrochloride of iminoether (A-0) and 10.5 g of p-toluenesulfonic acid monohydrate was stirred for 3 hours with heating under reflux. After cooling, 21.6 g of hydrochloride of iminoether was added and further stirred with heating under reflux for 1 hour. Ethyl acetate and water were added to separate an organic layer from an aqueous layer. The organic layer was dried with magnesium sulfate anhydride. The solvent was removed by vacuum distillation. Crystallization from a mixed solvent of ether and hexane gave 33.6 g of Compound (E-2).

50 ml of p-xylene solution containing 6.5 g of Compound (E-2) and 6.5 g of 2-chloro-5-dodecyloxycarbonylaniline was stirred for 2 hours with heating under reflux. Further, 0.2 g of p-toluenesulfonic acid monohydrate was added and stirred for 4 hours with heating under reflux. Ethyl acetate and water were added to separate an organic layer from an aqueous layer. The organic layer was washed with 1-normal aqueous solution of hydrochloric acid and saturated brine, and then dried with magnesium sulfate anhydride. The solvent was removed by vacuum distillation. Crystallization from a mixed solvent of ethyl acetate and hexane gave 6.7 g of Compound (E-3).

To 70 ml of a methylene chloride solution containing 5.5 g of Compound (E-3), 15 ml of a methylene chloride solution containing 0.48 ml of bromine was added drop-wise under cooling with ice. After the mixture was stirred at room temperature for 30 minutes, methylene chloride and water were added to separate an organic layer from an aqueous layer. The organic layer was washed with saturated brine, and then dried with magnesium sulfate anhydride. The solvent was removed by vacuum distillation to obtain a crude product of Compound (E-4).

To a solution which was prepared by dissolving 3.5 g of 5,5-dimethyl oxazolidine-2,4-dione and 3.8 ml of triethylamine in 50 ml of N,N-dimethyl acetoamide, a solution containing all the previously synthesized crude product of Compound (E-4) dissolved in 50 ml of N,N-dimethyl acetoamide was added drop-wise over 10 minutes at room temperature, and then stirred for 1 hour at room temperature. Ethyl acetate and water were added to separate an organic layer from an aqueous layer. The organic layer was washed with 1 normal aqueous solution of potassium carbonate, 1 normal aqueous solution of hydrochloric acid and saturated brine, and then dried with magnesium sulfate anhydride. The solvent was removed by vacuum distillation. Purification of the residue by silica gel column chromatography using a mixed solvent of ethyl acetate and hexane as the eluate gave 4.0 g of Coupler (146) as an amorphous product.

In the silver halide photographic light-sensitive material of the first, second and fourth embodiments of the present invention, the coupler represented by formula (I) or (II) is added in an amount preferably $1\times10^{-3}$ to 1 mole and more preferably $2\times10^{-3}$ to $3\times10^{-1}$ mole, per mol of silver halide.

In the silver halide photographic light-sensitive material of the third embodiment of the present invention, the coupling amount of the coupler represented by formula (I) or (II) shown above will be mentioned below.

The cyan couplers represented by formula (A) that are used in the first embodiment of the present invention are explained below.

formula (A)

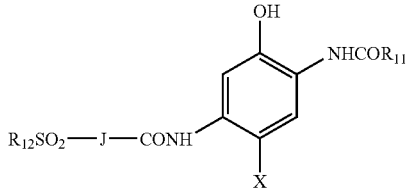

In formula (A), $R_{11}$ and $R_{12}$ each independently represent an alkyl group or an aryl group. J represents an alkylene group. X represents a hydrogen atom, or a group that can split off upon a coupling reaction between the cyan dye-forming coupler and an oxidized color-developing agent.

In formula (A), examples of the alkyl group represented by $R_{11}$ and $R_{12}$ include a methyl group, an ethyl group, and a propyl group. Examples of the aryl group represented by $R_{11}$ and $R_{12}$ include an optionally subtituted phenyl and naphthyl groups, each of which may have, for example, from 1 to 4 substituents. Examples of the substituent include a halogen atom, a cyano group, a carbonyl group, a carbonamido group, a sulfonamido group, a carboxyl group, a sulfo group, an alkyl group, an aryl group, an alkyloxy group, an aryloxy group, an alkylthio group, an arylthio group, an alkylsulfonyl group, and an arylsulfonyl group.

In formula (A), among the alkyl group and the aryl group represented by $R_{11}$ preferred are a heptafluoropropyl group, a 4-chlorophenyl group, 3,4-dichlorophenyl group, a 4-cyanophenyl group, a 3-chloro-4-cyanophenyl group, a pentafluorophenyl group, a 4-carbonamidophenyl group, a 4-sulfonamidophenyl group, and an alkylsulfonylphenyl group.

In formula (A), among the alkyl group and the aryl group represented by $R_{12}$ preferred is an aryl group. Particularly, a phenyl group having a substituent is preferable.

Examples of the above-mentioned substituent on the aryl group include an alkyl group (e.g., methyl, t-butyl, dodecyl, pentadecyl, octadecyl), an alkoxy group (e.g., methoxy, t-butoxy, tetradecyloxy,), an aryloxy group (e.g., phenoxy, 4-t-butylphenoxy, 4-dodecylphenoxy), an alkyl or arylacyloxy group (e.g., acetoxy, dodecanoyloxy), an alkyl or arylacylamino group (e.g., acetoamido or benzamido, hexadecaneamido), an alkyl or arylsulfonyloxy group (e.g., methylsulfonyloxy, dodecylsulfonyloxy, 4-methylphenyl sulfonyloxy), an alkyl or arylsulfamoylamino group (e.g., N-butyl sulfamoylamino, N-4-buthylphenylsulfamoylamino), an alkyl or arylsulfonamido group (e.g., methane sulfonamido, 4-chlorophenyl sulfonamido, hexadecanesulfonamido), an ureido group (e.g., methylureido, phenylureido), an alkoxycarbonyl or aryloxycarbonylamino group (e.g., methoxycarbonylamino, phenoxycarbonyl amino), a carbamoyl group (e.g., N-butylcarbamoyl, N-methy-N-dodeylcarbamoyl), and a perfluoroalkyl group (e.g., trifluoromethyl, heptafluoropropyl).

Among these substituents preferred are an alkyl group and an alkoxy group, each of which has 1 to 30 carbon atoms, more preferably 8 to 20 carbon atoms.

In formula (A), examples of the alkylene group represented by J include a straight chain or branched chain alkylene group having 1 to 10 carbon atoms, such as a methylene group, an ethylene group, a propylene group and a buthylene group. Alkylene groups having 2 to 4 carbon atoms are particularly preferable.

In formula (A), examples of the splitting-off group represented by X, because of a reaction with an oxidized developing agent, include a halogen atom, an alkoxy group, an aryloxy group, a heterocyclic oxy, a sulfonyloxy group, an acyloxy group, an acyl group, a heterocyclic group, a sulfonamido group, a heterocyclic thio group, a benzothiazolyl group, a phosphonyloxy group, an alkyl thio group, aryl thio group and an arylazo group. Among these splitting-off groups preferred are a halogen atom, an alkoxy group and an aryloxy group. A halogen atom is most preferable.

Specific examples of the cyan couplers represented by formula (A) are shown below. However, the present invention should not be construed as being limited to these compounds.

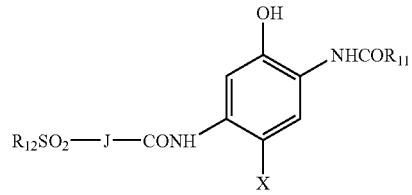

| Coupler | $R_{11}$ | $R_{12}$ | J | X |
|---|---|---|---|---|
| C-1 | 1 | 18 | 32 | H |
| C-2 | 2 | 20 | 31 | Cl |
| C-3 | 3 | 17 | 33 | H |
| C-4 | 4 | 16 | 32 | Cl |
| C-5 | 5 | 19 | 35 | Cl |
| C-6 | 6 | 22 | 34 | Cl |
| C-7 | 7 | 18 | 29 | Cl |
| C-8 | 8 | 21 | 30 | H |
| C-9 | 9 | 16 | 36 | Cl |
| C-10 | 10 | 19 | 28 | Cl |
| C11 | 11 | 24 | 38 | H |
| C-12 | 12 | 16 | 32 | Cl |
| C-13 | 13 | 23 | 37 | H |
| C-14 | 14 | 19 | 39 | Cl |
| C-15 | 15 | 17 | 33 | H |
| C-16 | 25 | 20 | 31 | Cl |
| C-17 | 26 | 16 | 32 | Cl |
| C-18 | 27 | 23 | 35 | Cl |
| C-19 | 4 | 17 | 32 | Cl |
| C-20 | 4 | 18 | 32 | Cl |
| C-21 | 4 | 19 | 32 | Cl |
| C-22 | 4 | 20 | 32 | Cl |
| C-23 | 4 | 21 | 32 | Cl |
| C-24 | 4 | 22 | 32 | Cl |
| C-25 | 4 | 23 | 32 | Cl |
| C-26 | 4 | 24 | 32 | Cl |
| C-27 | 4 | 16 | 33 | Cl |
| C-28 | 8 | 21 | 30 | Cl |
| C-29 | 9 | 16 | 36 | Cl |
| C-30 | 10 | 16 | 28 | Cl |
| C-31 | 11 | 16 | 38 | Cl |
| C-32 | 13 | 20 | 32 | Cl |
| C-33 | 14 | 18 | 32 | Cl |
| C-34 | 7 | 23 | 32 | Cl |
| C-35 | 2 | 19 | 32 | Cl |
| C-36 | 12 | 17 | 32 | Cl |
| C-37 | 8 | 24 | 32 | Cl |
| C-38 | 15 | 18 | 32 | Cl |
| C-39 | 3 | 22 | 32 | Cl |
| C-40 | 6 | 19 | 32 | Cl |
| C-41 | 9 | 17 | 32 | Cl |
| C-42 | 1 | 21 | 32 | Cl |
| C-43 | 10 | 19 | 32 | Cl |
| C-44 | 5 | 20 | 32 | Cl |
| C-45 | 14 | 24 | 32 | Cl |
| C-46 | 4 | 16 | 32 | 40 |
| C-47 | 4 | 16 | 32 | 41 |
| C-48 | 4 | 16 | 32 | 42 |
| C-49 | 5 | 19 | 35 | 43 |
| C-50 | 6 | 22 | 34 | 44 |
| C-51 | 7 | 18 | 29 | 45 |
| C-52 | 12 | 16 | 32 | 40 |
| C-53 | 13 | 23 | 37 | 42 |
| C-54 | 14 | 19 | 39 | 44 |
| C-55 | 4 | 46 | 32 | Cl |

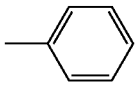

1

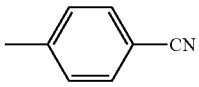

2

-continued
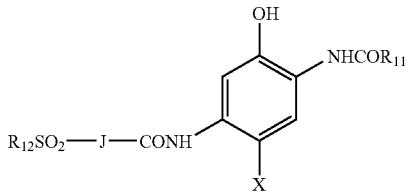
| Coupler | $R_{11}$ | $R_{12}$ | J | X |
|---|---|---|---|---|
| 3 | 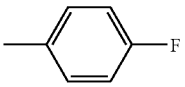 | | | |
| 4 | 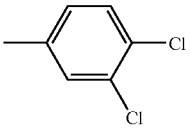 | | | |
| 5 | 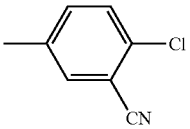 | | | |
| 6 | 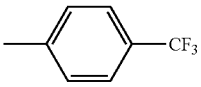 | | | |
| 7 | 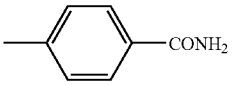 | | | |
| 8 | 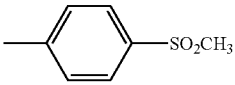 | | | |
| 9 | 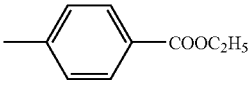 | | | |
| 10 | 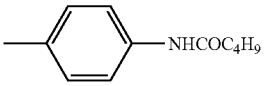 | | | |
| 11 | 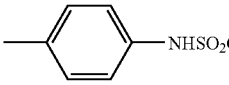 | | | |
| 12 | 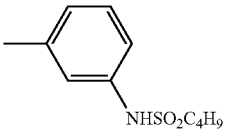 | | | |
| 13 | 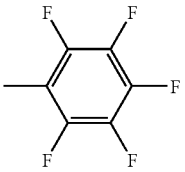 | | | |
-continued
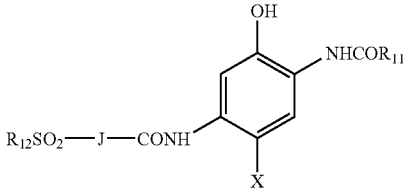
| Coupler | $R_{11}$ | $R_{12}$ | J | X |
|---|---|---|---|---|
| 14 | 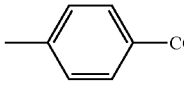 | | | |
| 15 | 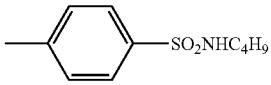 | | | |
| 16 | 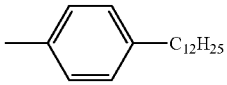 | | | |
| 17 | 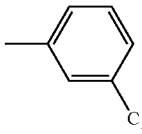 | | | |
| 18 | 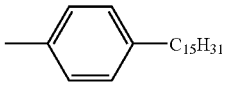 | | | |
| 19 | 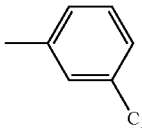 | | | |
| 20 | 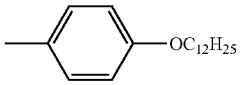 | | | |
| 21 | 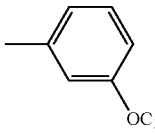 | | | |
| 22 | 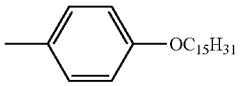 | | | |
| 23 | 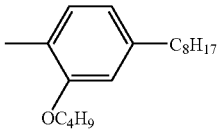 | | | |
| 24 | 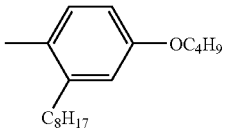 | | | |
| 25 | $—C_3H_7$ | | | |
| 26 | $—C_4F_9$ | | | |

-continued

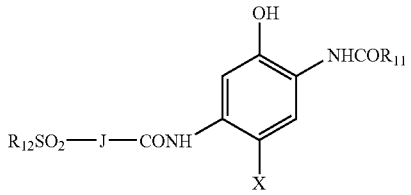

| Coupler | $R_{11}$ | $R_{12}$ | J | X |
|---|---|---|---|---|
| $—C_5F_{11}$ | | | | |
| $—CH_2—$ | | | | |
| $—CH_2CH_2—$ | | | | |
| $—CH_2CH_2CH_2—$ | | | | |
| $—CH(CH_3)—$ | | | | |
| $—CH(C_2H_5)—$ | | | | |
| $—CH(C_3H_7)—$ | | | | |
| $—CH(C_4H_9)—$ | | | | |
| $—CH_2CH(C_2H_5)—$ | | | | |
| $—CH_2CH(C_3H_7)—$ | | | | |
| $—CH_2CH(CH_3)CH_2—$ | | | | |
| $—C(CH_3)_2—$ | | | | |
| $—CH(CH_3)—CH(CH_3)—$ | | | | |
| $—OCH_2COOC_2H_5$ | | | | |
| $—O—C_6H_4—OCH_3$ | | | | |
| $—OCH_2CONHC_2H_5$ | | | | |
| $—SCH_2COOCH_3$ | | | | |
| $—OOCCH_3$ | | | | |
| $—COCF_3$ | | | | |
| $—C_6H_4—OC_{16}H_{33}$ | | | | |

The coupler represented by formula (A) is added in an amount preferably $1\times10^{-3}$ mole to 1 mole, and more preferably $2\times10^{-3}$ to $3\times10^{-1}$ mole, per mol of silver halide.

The compounds represented by formula (MC-1) according to the second embodiment of the present invention are explained in detail below. Herein, the compounds are also referred to as a dye-forming coupler.

formula (MC-1)

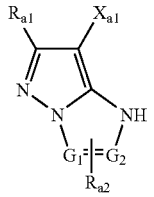

In formula (MC-1), $R_{a1}$ represents a hydrogen atom or a substituent. Said substituent is preferably selected among alkyl, aralkyl, aryl, alkoxy, aryloxy, amino, acylamino, arylthio, alkylthio, ureido, alkoxycarbonylamino, carbamoyloxy and heterocyclic thio groups. Further, these groups may have a substituent.

Examples of $R_{a1}$ include an alkyl group (e.g., methyl, ethyl, isopropyl, t-butyl, t-amyl, adamantly, 1-methylcyclopropyl, t-octyl, cyclohexyl, 2-methanesulfonylethyl, 3-(3-pentadecylphenoxy)propyl, 3-{4-{2-[4-(4-hydroxyphenylsulfonyl)phenoxy]dodecaneamido}phenyl}propyl, 2-ethoxytridecyl, trifluoromethyl, cyclopentyl, 3-(2,4-di-t-amylphenoxy) propyl), an aralkyl group (e.g., benzyl, 4-methoxybenzyl, 2-methoxy benzyl), an aryl group (e.g., phenyl, 4-t-butylphenyl, 2,4-di-t-amylphenyl, 4-tetradecaneamidophenyl), an alkoxy group (e.g., methoxy, ethoxy, 2-methoxyethoxy, 2-dodecylethoxy, 2-methanesulfonylethoxy, 2-phenoxy ethoxy), an aryloxy group (e.g., phenoxy, 2-methylphenoxy, 4-t-butylphenoxy, 3-nitrophenoxy, 3-t-butyloxycarbamoylphenoxy, 3-methoxycarbamoyl phenoxy), an amino group including an anilino group (e.g., methylamino, ethylamino, anilino, dimethylamino, diethylamino, t-butylamino, 2-methoxy anilino, 3-acetylaminoanilino, cyclohexylamino), an acylamino group (e.g., actoamido, benzamido, tetradecaneamido, 2-(2,4-di-t-amylphenoxy)butane amido, 4-(3-t-butyl-4-hydroxyphenoxy)butaneamido, 2-{4-(4-hydroxyphenyl sulfonyl)phenoxy}decaneamido), an ureido group (e.g., phenylureido, methylureido and N,N-dibutylureido), an alkylthio group (e.g., methylthio, octylthio, tetradecylthio, 2-phenoxyethylthio, 3-phenoxypropylthio, 3-(4-t-butylphenoxy)propylthio), an arylthio group (e.g., phenylthio, 2-butoxy-5-t-octylphenylthio, 3-pentadecylphenylthio, 2-carboxyphenylthio, 4-tetradecaneamidophenylthio), an alkoxycarbonylamino group (e.g., methoxy carbonylamino, tetradecyloxycarbonylamino), a carbamoyloxy group (e.g., N-methylcarbamoyloxy, N-phenylcarbamoyloxy), and a heterocyclic thio group (e.g., 2-benzothiazolylthio, 2,4-diphenoxy-1,3,5-triazole-6-thio and 2-pyridylthio).

Among these groups, an alkyl group, an aralkyl group, an aryl group, an aryloxy group and an amino group are preferable. Secondary or tertiary alkyl groups having 3 to 15 total carbon atoms are more preferable. Tertiary alkyl groups having 4 to 10 carbon atoms are most preferable.

$X_{a1}$ represents a hydrogen atom or a splitting-off group that can split off through a coupling reaction with the oxidized product of an aromatic primary amine color-developing agent. Such splitting-off groups are explained in detail below.

Examples of the splitting-off group include a halogen atom, an alkoxy group, an aryloxy group, an acyloxy group, an alkyl or arylsulfonyloxy group, an acylamino group, an alkyl or arylsulfoneamido group, an alkoxycarbonyloxy group, an aryloxycarbonyloxy group, an alkyl, aryl or heterocyclic thio group, a carbamoylamino group, a carbamoyloxy group, a 5- or 6-membered nitrogen-containing heterocyclic group, an imido group and an arylazo group. These groups may be further substituted with those atoms and groups exemplified as the substituent of $R_{a2}$ which will be explained.

More specific examples of the splitting-off group include a halogen atom (e.g., fluorine, chlorine, bromine), an alkoxy group (e.g., ethoxy, dodecyloxy, methoxyethylcarbamoylmethoxy, carboxypropyloxy, methysulfonylethoxy, ethoxycarbonylmethoxy), an aryloxy group (e.g., 4-methylphenoxy, 4-chlorophenoxy, 4-methoxyphenoxy, 4-carboxyphenoxy, 4-methoxycarboxy phenoxy, 4-carbamoylphenoxy, 3-ethoxycarboxyphenoxy, 3-acetylamino phenoxy, 2-carboxyphenoxy), an acyloxy group (e.g., acetoxy, tetradecanoyloxy, benzoyloxy), an alkyl or arylsulfonyloxy group (e.g., methane sulfonyloxy, toluene sulfonyloxy), an acylamino group (e.g., dichloroacetylamino, heptafluorobutylamino), an alkyl or arylsulfonamido group (e.g., methane sulfonamino, trifluoromethane sulfonamino, p-toluene sulfonamino), an alkoxycarbonyloxy group (e.g., ethoxy carbonyloxy, benzyloxycarbonyloxy), an aryloxycarbonyloxy group (e.g., phenoxycarbonyloxy), an alkyl, aryl or heterocyclic thio group (e.g., dodecylthio, 1-carboxydodecylthio, phenylthio, 2-butoxy-5-t-octyl phenylthio, tetrazoylthio), a carbamoylamino group (e.g., N-methyl carbamoylamino, N-phenylcarbamoylamino), a carbamoyloxy group (e.g., N,N-dimethylcarbamoyloxy, N-phenylcarbamoyloxy, morpholinylcarbamoyl oxy, pyrrolidinylcarbamoyloxy), a 5- or 6-membered nitrogen-containing heterocyclic group (e.g., imidazolyl, pyrazolyl, triazolyl, tetrazolyl, 1,2-dihydro-2-oxo-1-pyridyl), an imido group (e.g., succinimido, hydantoinyl) and an arylazo group (e.g., phenylazo, 4-methoxyphenylazo). In addition to these groups, $X_{a1}$ may form a configuration of the bis-type coupler that can be obtained by condensation of 4-equivalent couplers with aldehydes or ketones that eventually act as a splitting-off group bonding to the coupler via a carbon atom.

$X_{a1}$ is preferably a hydrogen atom, a halogen atom, an alkoxy group, an aryloxy group, an alkyl or aryl thio group, a 5- or 6-membered nitrogen-containing heterocyclic group that bonds to the coupling active site via the nitrogen atom of the heterocycle. Among these splitting-off groups, a hydrogen atom, a chlorine atom and a phenoxy group that may be substituted are especially preferable.

Any one of $G_1$ and $G_2$ represents a nitrogen atom and the other represents a carbon atom that bonds with $R_{a2}$ in formula (MC-I).

$R_{a2}$ represents a substituent. Examples of the substituent include a halogen atom, an alkyl group, an aryl group, a heterocyclic group, a cyano group, a hydroxyl group, a nitro group, a carboxyl group, an amino group, an alkoxy group, an aryloxy group, an acylamino group, an alkylamino group, an anilino group, an ureido group, a sulfamoylamino group, an alkylthio group, an arylthio group, an alkoxycarbonylamino group, a sulfonamido group, a carbamoyl group, a sulfamoyl group, a sulfonyl group, an alkoxy carbonyl group, a heterocyclic oxy group, an azo group, an acyloxy group, a carbamoyloxy group, a silyloxy group, an aryloxycarbonylamino group, an imido group, a heterocyclic thio group, a sulfinyl group, a phosphonyl group, an aryloxycarbonyl group, an acyl group, and an azolyl group. These groups may have a substituent.

More specific examples of the substituent represented by $R_{a2}$ include a halogen atom (e.g., chlorine, bromine), an alkyl group (for example, a straight chain or branched chain alkyl group having 1 to 32 carbon atoms and a cycloalkyl group, e.g., methyl, ethyl, propyl, isopropyl, t-butyl, tridecyl, 2-methanesulfonylethyl, 3-(3-pentadecylphenoxy)propyl, 3-{4-{2-[4-(4-hydroxyphenylsulfonyl)phenoxy]dodecaneamido}phenyl}propyl, 2-ethoxytridecyl, trifluoromethyl, cyclopentyl, 3-(2,4-di-t-amylphenoxy)propyl, an aryl group (e.g., phenyl, 4-t-butylphenyl, 2,4-di-t-amylphenyl, 4-tetradecaneamidophenyl), a heterocyclic group (e.g., 2-furyl, 2-thienyl, 2-pyrimidinyl, 2-benzothiazonyl), a cyano group, a hydroxyl group, a nitro group, a carboxyl group, an amino group, an alkoxy group (e.g., methoxy, ethoxy, butoxy, 2-methoxyethoxy, 2-dodecylethoxy, 2-methanesulfonylexyloxy), an aryloxy group (e.g., phenoxy, or 2-methylphenoxy, 4-t-butylphenoxy, 3-nitrophenoxy, 3-t-butyloxycarbamoyl phenoxy, 3-methoxycarbamoylphenoxy), an acylamino group (e.g., acetoamido or benzamido, tetradecaneamido, 2-(2,4-di-t-amylphenoxy)butaneamido, 4-(3-t-butyl-4-hydroxyphenoxy)butaneamido, 2-{4-(4-hydroxyphenyl sulfonyl)phenoxy}decaneamido), an alkylamino group (e.g., methylamino, butylamino, dodecylamino, diethylamino, methylbutylamino), an anilino group (e.g., phenylamino, 2-chloroanilino, 2-chloro-5-tetradecaneamino anilino, 2-chloro-5-dodecyloxycarbonylanilino, N-acetylanilino, 2-chloro-5-{α-(3-t-butyl-4-hydroxyphenoxy)dodecaneamido}anilino), an ureido group (e.g., phenylureido, methylureido, N,N-dibutylureido), a sulfamoylamino group (e.g., N,N-dipropylsulfamoylamino, N-methyl-N-decyl sulfamoylamino), an alkylthio group (e.g., methylthio, octylthio, tetradecylthio, 2-phenoxyethylthio, 3-phenoxypropylthio, 3-(4-t-butylphenoxy)propylthio), an arylthio group (e.g., phenylthio, 2-butoxy-5-t-octylphenylthio, 3-pentadecylphenylthio, 2-carboxyphenylthio, 4-tetradecaneamido phenylthio), an alkoxycarbonylamino group (e.g., methoxycarbonylamino, tetradecyloxycarbonylamino), a sulfonamido group (e.g., methane sulfonamido, hexadecanelsulfonamido, benzenesulfonamido, p-toluene sulfonamido, octadecanelsulfonamido, 2-methyloxy-5-t-butylbenzene sulfonamido), a carbamoyl group (e.g., N-ethylcarbamoyl, N,N-dibutylcarbamoyl, N-(2-dodecyloxyethyl)carbamoyl, N-methy-N-dodeylcarbamoyl, N-(3-(2,4-di-t-amyl phenoxy)propyl)carbamoyl), a sulfamoyl group (e.g., N-ethylsulfamoyl, N,N-dipropylsulfamoyl, N-(2-dodecyloxyethyl)sulfamoyl, N-ethyl-N-dodecyl sulfamoyl, N,N-diethylsulfamoyl), a sulfonyl group (e.g., methanesulfonyl, octanesulfonyl, benzenesulfonyl, toluenesulfonyl), an alkoxycarbonyl group (e.g., methoxycarbonyl, butyloxycarbonyl, dodecyloxycarbonyl, octadecyloxycarbonyl), a heterocyclic oxy group (e.g., 1-phenyltetrazole-5-oxy, 2-tetrahydropyranyloxy), an azo group (e.g., phenylazo, 4-methoxy phenylazo, 4-pivaloylaminophenylazo, 2-hydroxy-4-propanoylphenylazo), an acyloxy group (e.g., acetoxy), a carbamoyloxy group (e.g., N-methylcarbamoyloxy, N-phenylcarbamoyloxy), a silyloxy group (e.g., trimethyl silyloxy, dibutyl methyl silyloxy), an aryloxycarbonylamino group (e.g., phenoxycarbonyl amino), an imido group (e.g., N-succinimido, N-phthalimido, 3-octadecenyl succinimido), a heterocyclic thio group (e.g., 2-benzothiazolylthio, 2,4-diphenoxy-1,3,5-triazole-6-thio, 2-pyridylthio), a sulfinyl group (e.g., dodecanesulfinyl, 3-pentadecylphenylsulfinyl, 3-phenoxypropylsulfinyl), a phosphonyl group (e.g., phenoxyphosphonyl, octyloxyphosphonyl, phenyl phosphonyl), an aryloxycarbonyl group (e.g., phenoxycarbonyl), an acyl group (e.g., acetyl, 3-phenylpropanoyl, benzoyl, 4-dodecyloxybenzoyl), and azolyl group (e.g., imidazolyl, pyrazolyl, 3-chloro-pyrazole-1-yl, triazolyl).

If the group represented by $R_{a2}$ can be further substituted with a substituent, said substituent may be a halogen atom or an organic substituent bonding to the above-said group via a carbon, oxygen, nitrogen or sulfur atom.

$R_{a2}$ is preferably an alkyl group, an aryl group, an alkoxy group, an aryloxy group, an alkylthio group, an ureido group, an alkoxycarbonylamino group, and an acylamino group. $R_{a2}$ is more preferably an alkyl group having 6 to 70 carbon atoms, or a group having 6 to 70 total carbon atoms and containing an aryl group as a partial structure, thereby immobilizing the coupler represented by formula (MC-I).

Further, the coupler may bond to a polymer chain via $R_{a1}$ or $R_{a2}$.

The term "bond to a polymer chain via $R_{a1}$ or $R_{a2}$" means that $R_{a1}$ or $R_{a2}$ acts as a divalent group and bonds to a polymer including a dimer and a polymer, or a chain of a high molecular compound to form a homopolymer or copolymer. Typical examples of the homopolymer or copolymer that is formed by the coupler bonded to a polymer chain include an addition polymer having a moiety of the magenta coupler represented by formula (MC-I), and a homo- or co-polymer of an ethylenically unsaturated compound having a moiety of the magenta coupler represented by formula (MC-I).

In this case, one or more kinds of magenta color developable recurring unit having a moiety of the magenta coupler represented by formula (MC-I) may be incorporated in a polymer. The polymer may be a copolymer in which one or more non-color developable ethylenical monomers are incorporated as a copolymer component (comonomer). The magenta color developable recurring unit having a moiety of the magenta coupler represented by formula (MC-I) is preferably represented by the following formula (P).

(P)

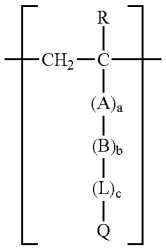

In formula (P), R represents a hydrogen atom, an alkyl group having 1 to 4 carbon atoms, or a chlorine atom. A represents a —CONH— group, a —COO— group, or a substituted or unsubstituted phenylene group. B represents a substituted or unsubstituted alkylene, phenylene or aralkylene group. L represents a —CONH— group, a —NHCONH— group, a —NHCOO— group, a —NHCO— group, a —OCONH— group, a —NH— group, a —COO— group, a —OCO— group, a —CO— group, a —O— group, a —S— group, a —$SO_2$— group, a —$NHSO_2$— group, or a —$SO_2NH$— group. a, b and c represent 0 or 1. Q represents a moiety of the magenta coupler represented by formula (MC-I) except that a hydrogen atom is already split off from $R_{a1}$ or $R_{a2}$. Among the polymers preferred are copolymers of a magenta color developable monomer represented by a coupler unit of formula (MC-I) and a non-color developable ethylenical monomer that does not couple with an oxidized product of an aromatic primary amine color-developing agent.

Examples of the non-color developable ethylenical monomer that does not couple with an oxidized product of an aromatic primary amine color-developing agent include acrylic acid, α-chloroacrylic acid, an α-alkylacrylic acid (e.g., methacrylic acid), amides or esters derived from these acrylic acids (e.g., acrylamide, methacrylamide, n-butylacrylamide, t-butylacrylamide, diacetoneacrylamide, methylacrylate, ethylacrylate, n-propylacrylate, n-butylacrylate, t-butylacrylate, iso-butylacrylate, 2-ethylhexyl acrylate, n-octylacrylate, laurylacrylate, methylmethacrylate, ethylmethacrylate, n-butylmethacrylate, and β-hydroxymethacrylate), vinyl esters (e.g., vinyl acetate, vinyl propionate, vinyl laurate), acrylonitrile, methacrylonitrile, aromtic vinyl compounds (for example, stylene and derivatives thereof, e.g., vinyl toluene, divinyl benzene, vinyl acetophenone, sulfostylene), itaconic acid, citraconic acid, crotonic acid, vinylidene chloride, vinyl alkyl ether (e.g., vinyl ethyl ether), maleic acid esters, N-vinyl-2-pyrrolidone, N-vinylpyridine and 2- or 4-vinylpyridine.

Among these monomers, acrylic acid esters, methacrylic acid esters, and maleic acid esters are especially preferable. Two or more non-color developable ethylenical monomer may be used together. For example, methylacrylate and butylacrylate, butylacrylate and stylene, butylmethacrylate and methacrylic acid, methylacrylate and diacetoneacrylamide are used together respectively.

As is well known in the field of a polymer coupler, ethylenically unsaturated monomers that are used for copolymerization with a vinyl monomer corresponding to the above-described formula (MC-I) can be selected so that a favorable influence is exerted on physical properties and/or chemical properties of the formed copolymer, such as solubility, compatibility with a binder (e.g., gelatin) for a photographic colloid composition, its flexibility and thermal stability.

Among compounds represented by formula (MC-I), those having a substituent represented by formula (BL-1) or (BL-2) as $R_{a2}$ are furthermore preferable.

formula (BL-1)

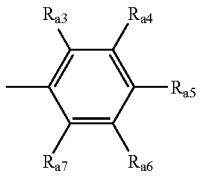

formula (BL-2)

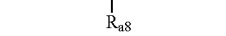

In formula (BL-1), $R_{a3}$, $R_{a4}$, $R_{a5}$, $R_{a6}$ and $R_{a7}$ each independently represent a hydrogen atom or a substituent, with the proviso that at least one of these $R_{a3}$ to $R_{a7}$ represents a substituent containing, as a partial structure, a substituted or unsubstituted alkyl moiety, and having total carbon atoms of 4 to 70, or a substituent containing, as a partial structure, a substituted or unsubstituted aryl moiety, and having total carbon atoms of 6 to 70.

The groups represented by formula (BL-1) are explained below.

$R_{a3}$, $R_{a4}$, $R_{a5}$, $R_{a6}$ and $R_{a7}$ each independently represent a hydrogen atom or a substituent. Examples of the substituent include the same atoms and groups exemplified as the substituent of the above-mentioned $R_{a2}$. At least one of these $R_{a3}$ to $R_{a7}$ represents a substituent containing, as a partial structure, a substituted or unsubstituted alkyl moiety, and having total carbon atoms of 4 to 70, or a substituent containing, as a partial structure, a substituted or unsubstituted aryl moiety, and having total carbon atoms of 6 to 70. As these substituents having total carbon atoms of 4 to 70 (6 to 70 in the case of containing an aryl group), preferred are an alkoxy group, an aryloxy group, an acylamino group, an ureido group, a carbamoyl group, an alkoxy carbonylamino group, a sulfonyl group, a sulfonamido group, a sulfamoyl group, a sulfamoylamino group, and an alkoxy carbonyl group, each of which contains, as a partial structure, a substituted or unsubstituted alkyl or aryl moiety, as well as an alkyl group and an aryl group. Among these groups preferred are an alkyl group having total carbon atoms of 4 to 70, and an alkoxy group, an acylamino group and a sulfonamido group, each of which contains, as a partial structure, an alkyl moiety having total carbon atoms of 4 to 70.

It is especially preferable that $R_{a31}$ or both $R_{a4}$ and $R_{a6}$ are a substituent containing, as a partial structure, a substituted or unsubstituted alkyl or aryl moiety, and having total carbon atoms of 4 to 70 (6 to 70 in the case of containing an aryl moiety).

In formula (BL-2), $G_3$ represents a substituted or unsubstituted methylene group. a represents an integer of 1 to 3. b represents 0 or 1. $R_{a8}$ represents a hydrogen atom, an alkyl group, or an aryl group. $G_4$ represents —CO—, —OCO— or —$SO_2$—. Rag represents a substituent containing, as a partial structure, a substituted or unsubstituted alkyl or aryl moiety, and having total carbon atoms of 6 to 70. In the case of $R_{a9}$ further having a substituent, examples of the substituent include the same atoms and groups exemplified as the substituent of the above-mentioned $R_{a2}$' When a is 2 or more, a plurality of $G_3$ may be the same or different.

Preferably, the substituent represented by $(G_3)a$ has a basic skeleton selected from among —$CH_2$—, —$C_2H_4$—, —$C(CH_3)H$—$CH_2$—, —$C(CH_3)_2$—$CH_2$—, —$C(CH_3)_2$—$C(CH_3)H$—, —$C(CH_3)H$—$C(CH_3)H$—, —$C(CH_3)_2$—$C(CH_3)_2$—, and —$CH_2$—$CH_2$—$CH_2$—, each of which may further have a substituent. $R_{a8}$ is preferably a hydrogen atom. $G_4$ is preferably —CO— or —$SO_2$—. $R_{a9}$ is preferably a substituted or unsubstituted alkyl or aryl group having total carbon atoms of 10 to 70.

Among compounds represented by formula (MC-I), in which $G_1$ is a nitrogen atom, $G_2$ is a carbon atom and $X_{a1}$ is a hydrogen atom, it is preferable that $R_{a1}$ is a tertiary alkyl group and $R_{a2}$ is a substituent represented by formula (BL-1), and also the following item 1) or 2) is met.

1) $R_{a5}$ is selected from among an acylamino group, a sulfonamido group, an ureido group, an alkoxy carbonylamino group, a sulfonyl group, a carbamoyl group, a sulfamoyl group, a sulfamoylamino group, and an alkoxycarbonyl group, each of which is substituted with a substituted or unsubstituted alkyl group having not less than 4 total carbon atoms, or with a substituted or unsubstituted aryl group having not less than 6 total carbon atoms.

2) $R_{a4}$ and $R_{a6}$ are groups selected from among an acylamino group, a sulfonamido group, an ureido group, an alkoxy carbonylamino group, a sulfonyl group, a carbamoyl group, a sulfamoyl group, a sulfamoylamino group, and an alkoxycarbonyl group, each of which is substituted with a substituted or unsubstituted alkyl group having not less than 4 total carbon atoms, or with a substituted or unsubstituted aryl group having not less than 6 total carbon atoms.

Among compounds represented by formula (MC-I), in which $G_1$ is a carbon atom, $G_2$ is a nitrogen atom and $X_{a1}$ is a hydrogen atom, it is preferable that $R_{a1}$ is a tertiary alkyl group and $R_{a2}$ is a group represented by formula (BL-1) or (BL-2), and $R_{a2}$ is particularly preferably represented by formula (BL-2).

Among compounds represented by formula (MC-I), in which $G_1$ is a nitrogen atom, $G_2$ is a carbon atom and $X_{a1}$ is a splitting-off group rather than a hydrogen atom, it is preferable that $R_{a1}$ is a tertiary alkyl group and $R_{a2}$ is a group represented by formula (BL-1), $R_{a3}$ is selected from among an acylamino group, a sulfonamido group, an ureido group, an alkoxy carbonylamino group, a sulfonyl group, a carbamoyl group a sulfamoyl group, a sulfamoylamino group, and an alkoxycarbonyl group, each of which is substituted with a substituted or unsubstituted alkyl group having not less than 4 total carbon atoms, or with a substituted or unsubstituted aryl group having not less than 6 total carbon atoms, and $X_{a1}$ is a chlorine atom.

Among compounds represented by formula (MC-I), in which $G_1$ is a carbon atom, $G_2$ is a nitrogen atom and $X_{a1}$ is a substituent other than a hydrogen atom, it is preferable that $R_{a1}$ is a tertiary alkyl group and $R_{a2}$ is a group represented by formula (BL-1) or (BL-2). Particularly preferably $R_{a2}$ is a group represented by formula (BL-2).

In the present invention, it is preferable that $G_1$ is a carbon atom, $G_2$ is a nitrogen atom, $R_{a1}$ is a tertiary alkyl group and $R_{a2}$ is a group represented by formula (BL-2) in which $G_4$ is —$SO_2$—, $R_{a9}$ is a phenyl group having at least one substituent that is composed of a group containing an alkyl group having 6 to 50 carbon atoms, and a is 1 or 2. $X_{a1}$ is especially preferably a hydrogen atom, a chlorine atom, or a substituted phenyloxy group.

Specific examples of the compound represented by formula (MC-I) are shown below. However, the present invention should not be construed as being limited to these compounds.

MC-1

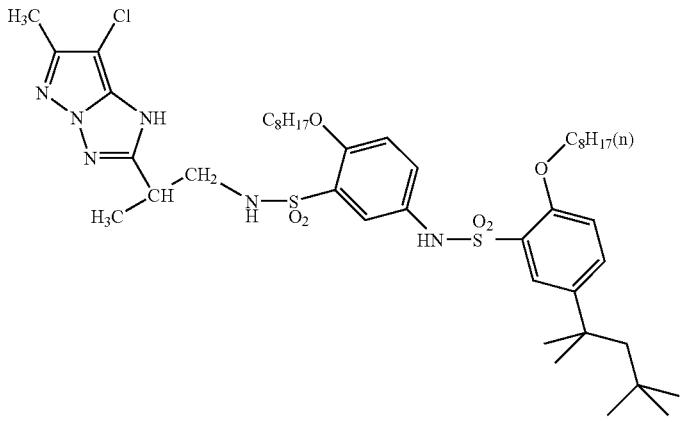

-continued
MC-2
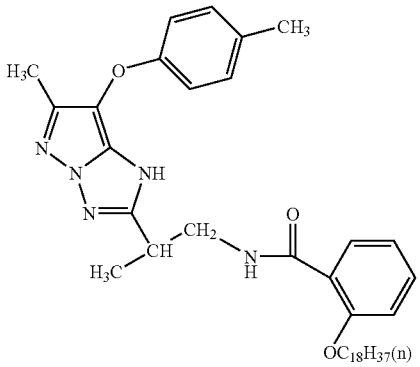
MC-3
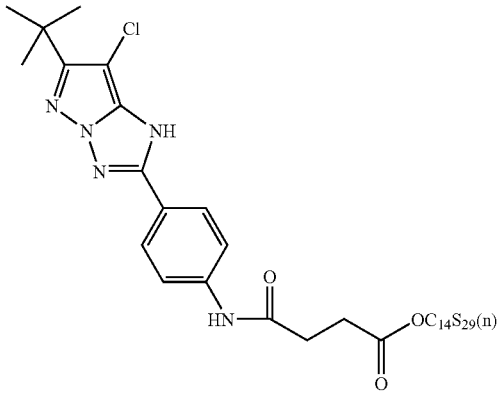
MC-4
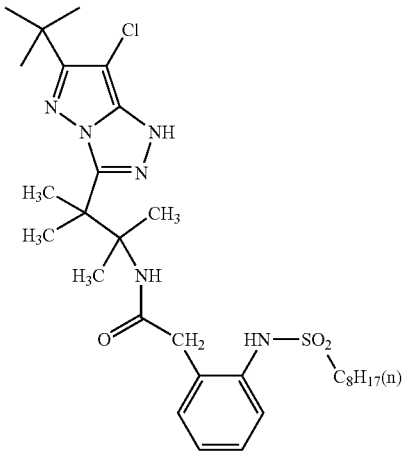
MC-5
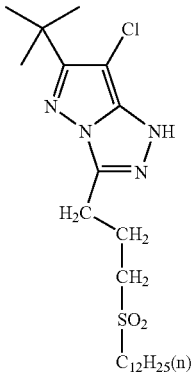

-continued
MC-6
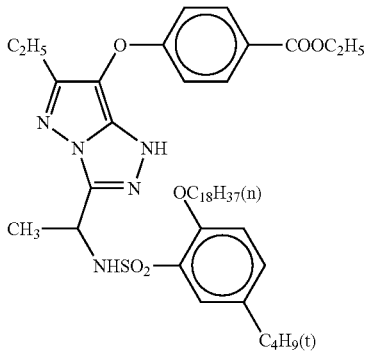
MC-7
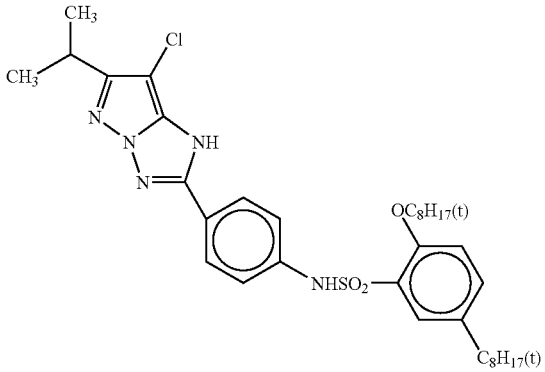
MC-8
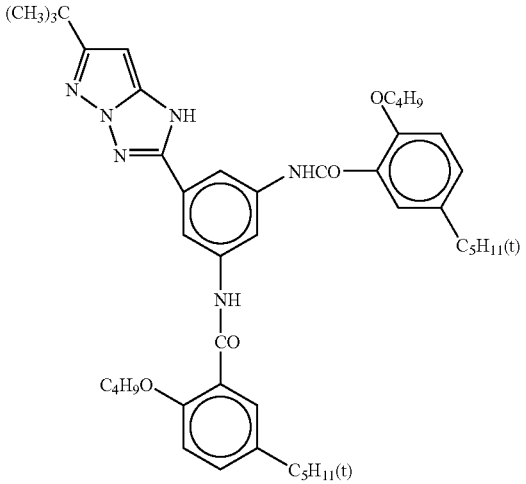
MC-9
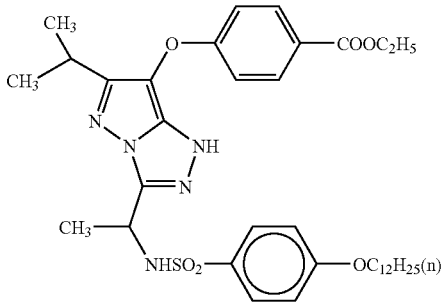

-continued
MC-10
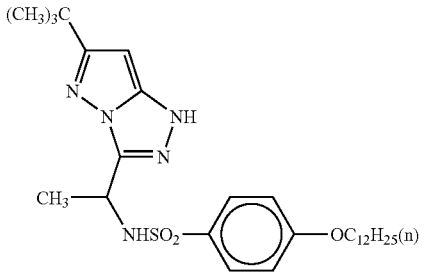
MC-11
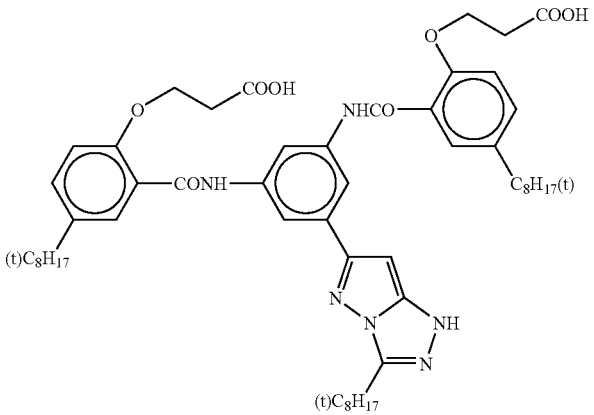
MC-12
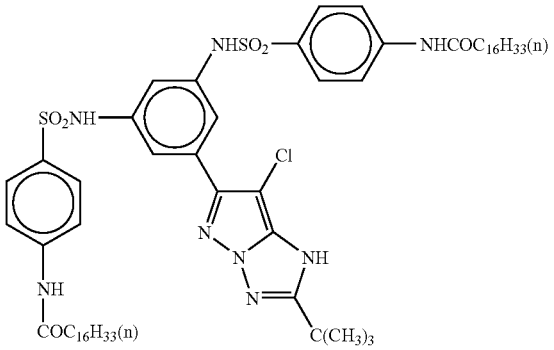
MC-13
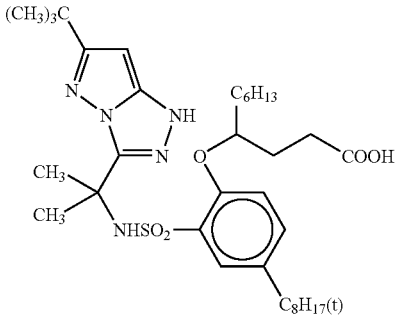

-continued
MC-14
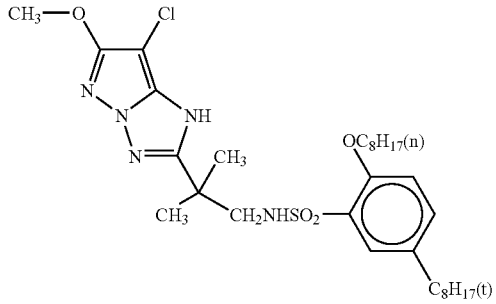
MC-15
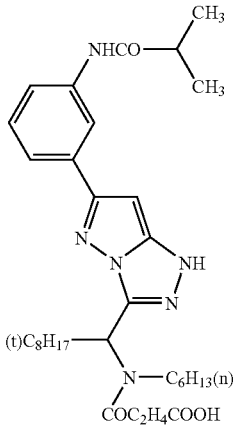
MC-16
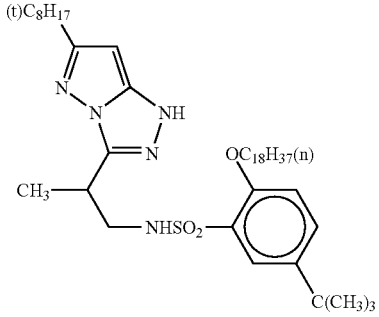
MC-17
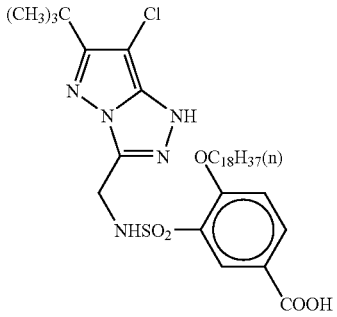

-continued
MC-18
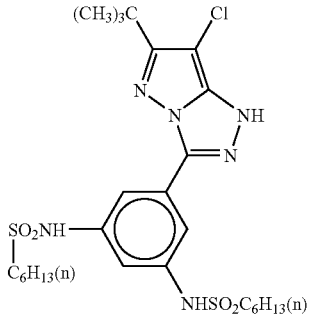
MC-19
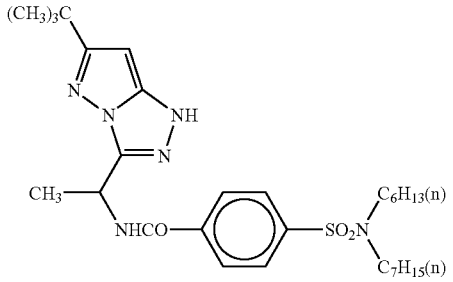
MC-20
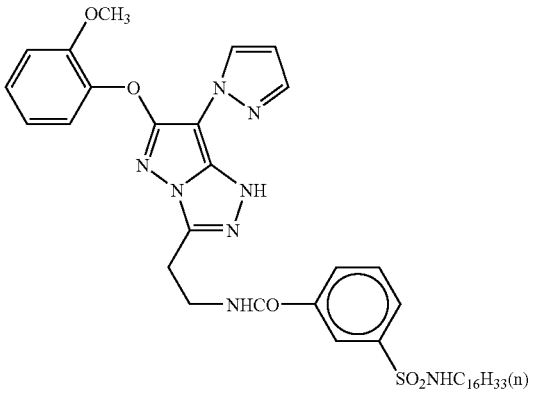
MC-21
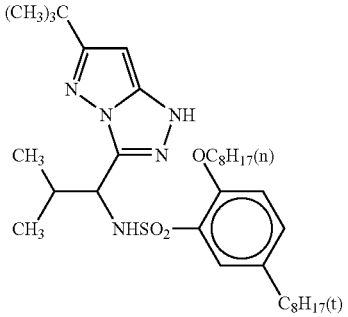

-continued
MC-22
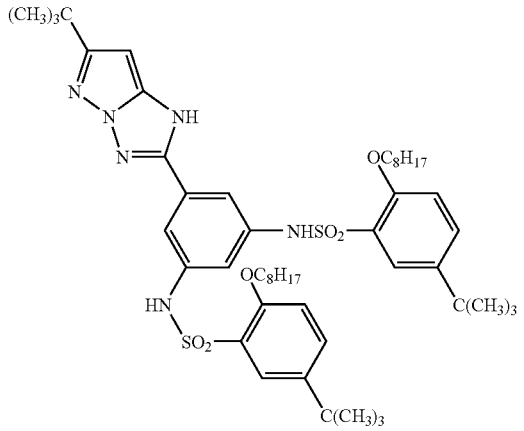
MC-23
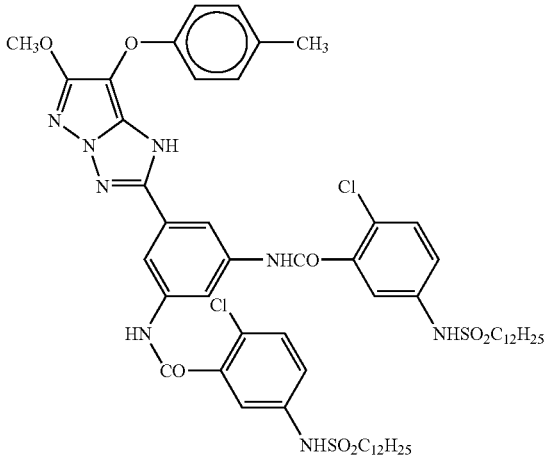
MC-24
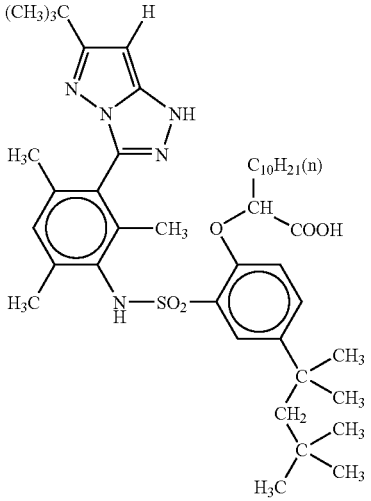

-continued
MC-25
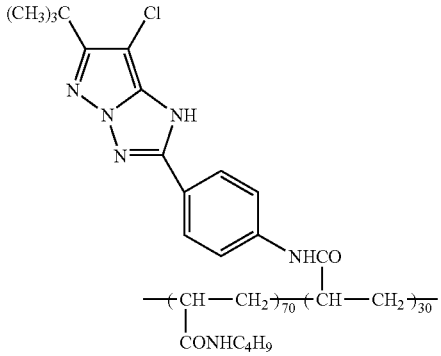
MC-26
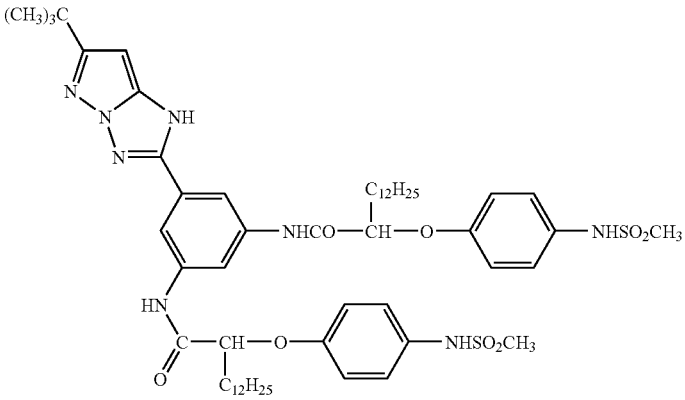
MC-27
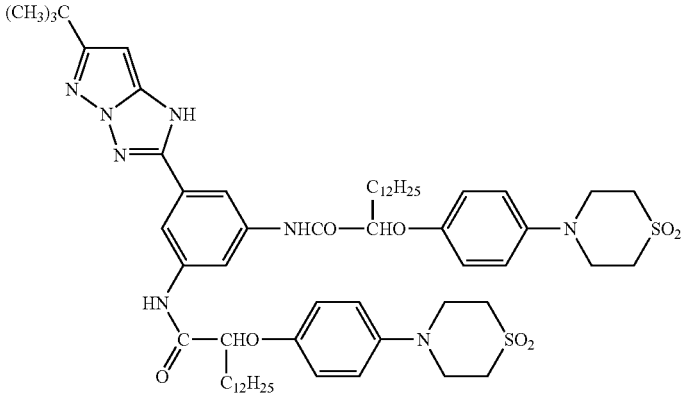
MC-28
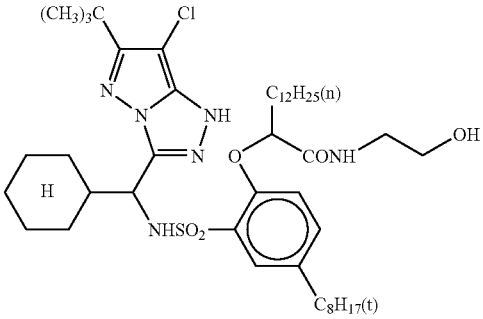

-continued
MC-29
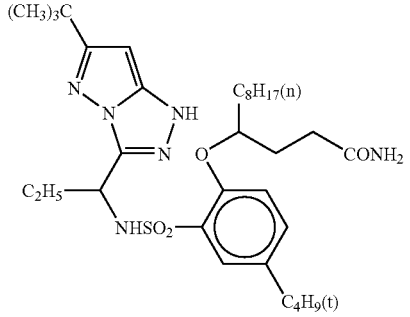
MC-30
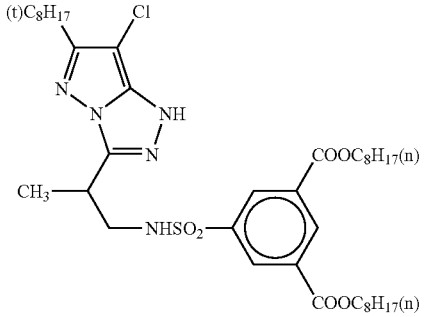
MC-31
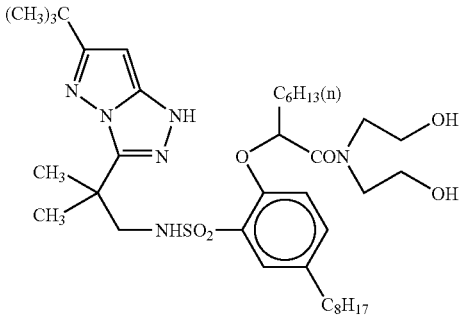
MC-32
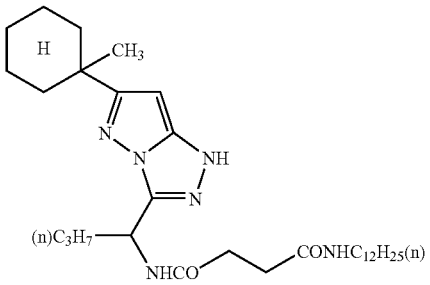

-continued
MC-33
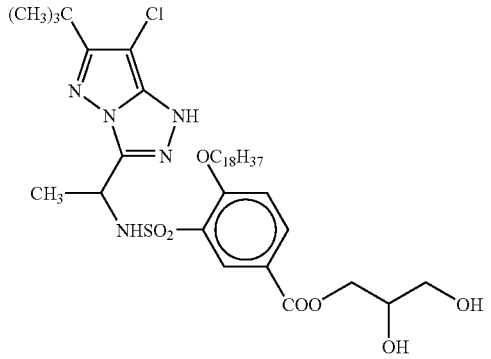
MC-34
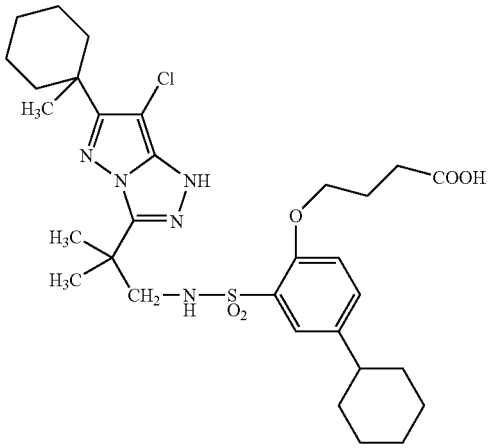
MC-35
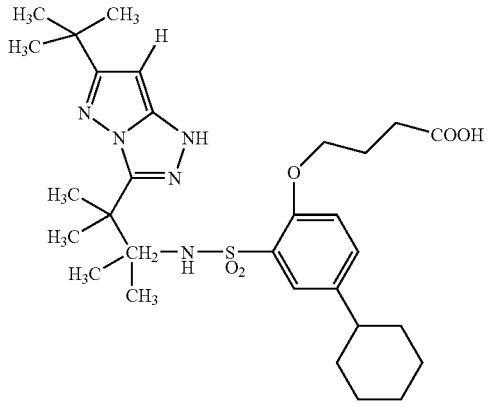
MC-36
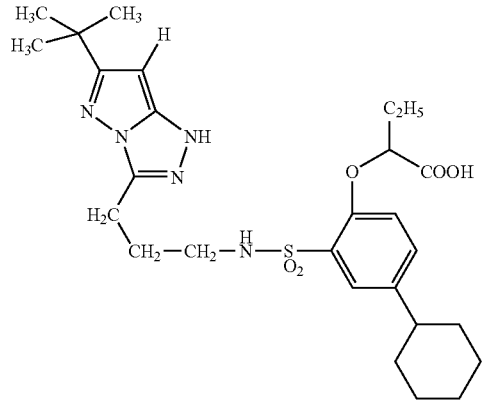

-continued
MC-37
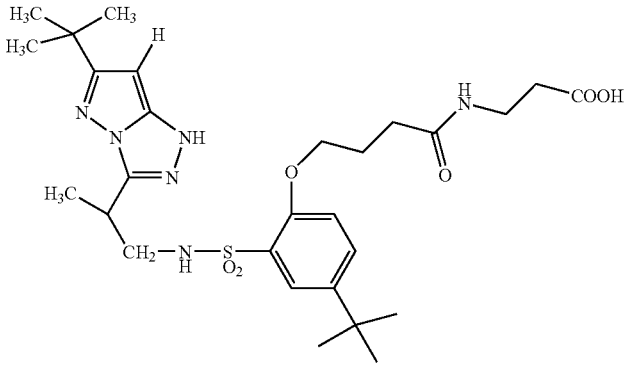
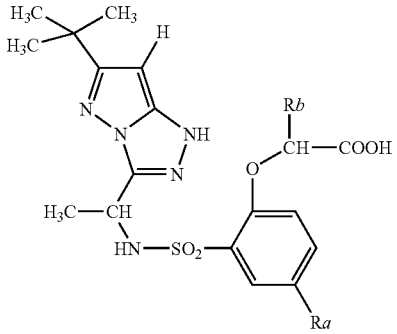
| Compound No. | Ra | Rb* |
|---|---|---|
| MC-38 | 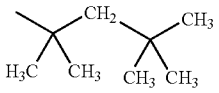 | $—C_{10}H_{21}$ |
| MC-39 | 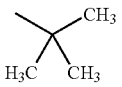 | $—C_8H_{17}$ |
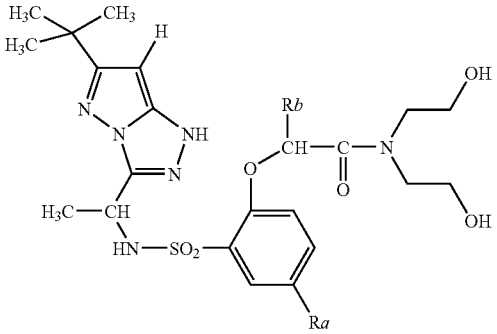
| Compound No. | Ra | Rb |
|---|---|---|
| MC-40 | 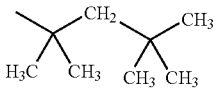 | $—C_8H_{17}$ |
| MC-41 | 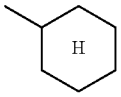 | $—C_8H_{17}$ |

-continued
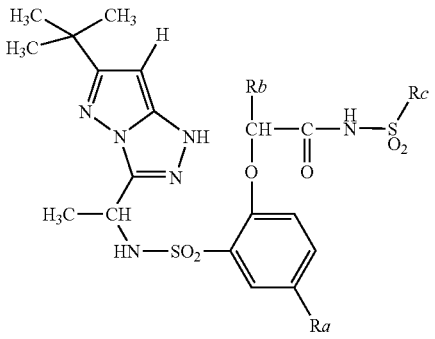
| Compound No. | Ra | Rb | Rc |
|---|---|---|---|
| MC-42 | 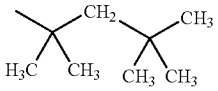 | —$C_{10}H_{21}$ | —$CH_3$ |
| MC-43 | 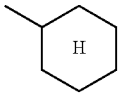 | —$C_8H_{17}$ | —$CH_3$ |
| MC-44 | 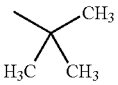 | —$C_{10}H_{21}$ | 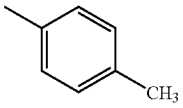 |
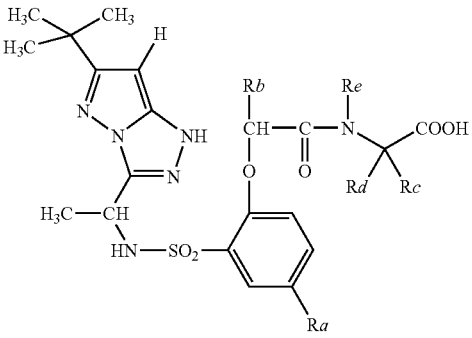
| Compound No. | Ra | Rb | Rc | Rd | Re |
|---|---|---|---|---|---|
| MC-45 | 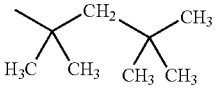 | —$C_{12}H_{25}$ | —$CH_3$ | —H | —H |

-continued
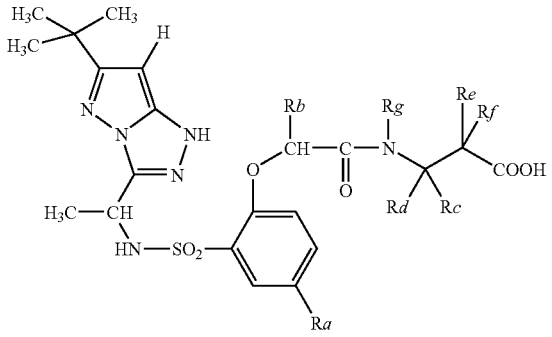
| Compound No. | Ra | Rb | Rc | Rd | Re | Rf | Rg |
|---|---|---|---|---|---|---|---|
| MC-46 | 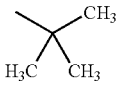 | $—C_{10}H_{21}$ | —H | —H | —H | —H | —H |
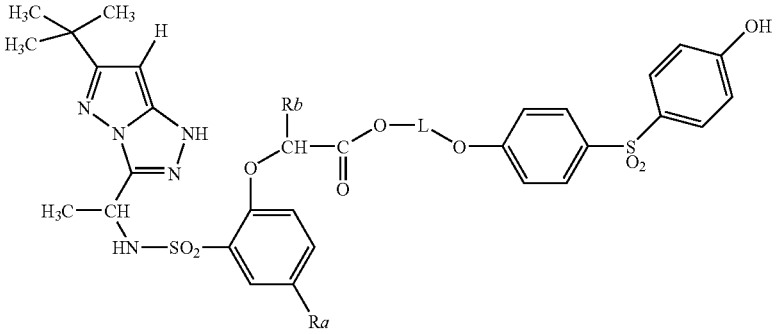
| Compound No. | Ra | Rb | L |
|---|---|---|---|
| MC-47 | 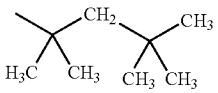 | $—C_{10}H_{21}$ | 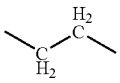 |
MC-48
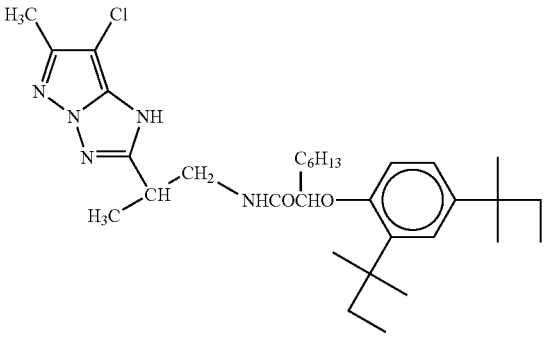

-continued

MC-49

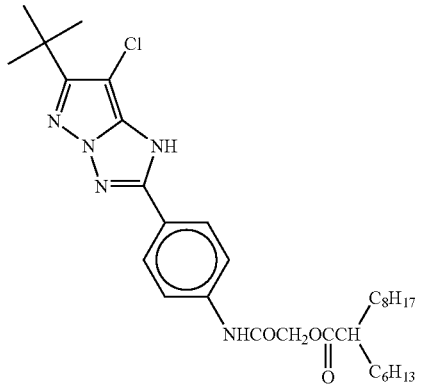

MC-50

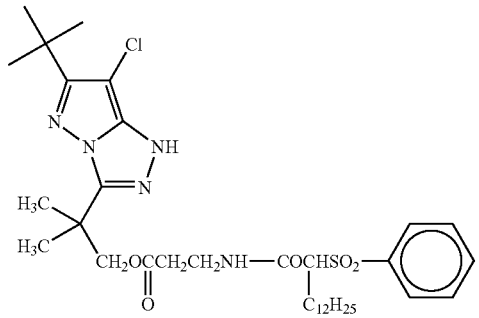

*Normal alkyl group, otherwise specially mentioned.

The couplers represented by formula (MC-I) that are used in the present invention can be synthesized according to a known method. For example, a synthesis of the compound is described in U.S. Pat. No. 4,540,654, No. 4,705,863, No. 5,451,501, JP-A-61-65245, JP-A-62-209457, JP-A-62-249155, JP-A-63-41851, JP-B-7-122744, JP-A-5-105682, JP-A-7-13309, JP-A-7-82252, U.S. Pat. No. 3,725,067, No. 4,777,121, JP-A-2-201442, JP-A-2-101077, JP-A-3-125143 and JP-A-4-242249.

In the silver halide color photographic light-sensitive material of the present invention, the coupler represented by formula (MC-I) are each added preferably in an amount of $1\times10^{-3}$ to 1 mole, more preferably in an amount of $2\times10^{-3}$ to $3\times10^{-2}$ mole, per mole of silver halide respectively.

The silver halide color photographic light-sensitive material (hereinafter sometimes referred to simply as "light-sensitive material") of the present invention is explained in detail, shown below.

The silver halide photographic light-sensitive material of the present invention may be a silver halide color photographic light-sensitive material and may be a silver halide monochrome (black and white) photographic light-sensitive material. The silver halide emulsion of the present invention is preferably used in the silver halide color photographic light-sensitive material.

The silver halide color photographic light-sensitive material that can be preferably used in the present invention is a silver halide color photographic light-sensitive material comprises a support having provided thereon at least one silver halide emulsion layer containing a yellow dye-forming coupler, at least one silver halide emulsion layer containing a magenta dye-forming coupler and at least one silver halide emulsion layer containing a cyan dye-forming coupler.

The silver halide color photographic light-sensitive material (hereinafter sometimes referred to simply as "light-sensitive material"), wherein the silver halide emulsion is preferably used shown above, may be a silver halide color photographic light-sensitive material comprising a support having provided thereon at least one silver halide emulsion layer containing a yellow dye-forming coupler, at least one silver halide emulsion layer containing a magenta dye-forming coupler and at least one silver halide emulsion layer containing a cyan dye-forming coupler, with proviso that at least one of the above-mentioned silver halide emulsion layers comprises the said silver halide emulsion.

In the present invention, the above-said silver halide emulsion layer containing a yellow dye-forming coupler acts as a yellow color-developable layer, the above-said silver halide emulsion layer containing a magenta dye-forming coupler acts as a magenta color-developable layer, and the above-said silver halide emulsion layer containing a cyan dye-forming coupler acts as a cyan color-developable layer. The silver halide emulsions that are incorporated in each of said yellow color-developable layer, said magenta color-developable layer, and said cyan color-developable layer preferably have photosensitivity to light in a different wavelength range from each other (such as three different light in a blue color range, a green color range and a red color range).

The light-sensitive material of the present invention may preferably have at least one light-insensitive and non-color-developable hydrophilic colloidal layer, in addition to the yellow color-developable layer, the magenta color-developable layer, and the cyan color-developable layer mentioned above. For examples, there may be the hydrophilic colloidal layer, an anti-halation layer, an interlayer and a coloring layer as described hereinafter.

The silver halide photographic light-sensitive material of the present invention can be used for a color negative film, a color positive film, a color reversal film, a color reversal photographic paper, a color photographic paper, a cinema color negative, a cinema color positive, a display light-sensitive material and a color proof (especially digital color proof) light-sensitive material.

The present invention is preferably applied to a light-sensitive material for direct view such as a color photographic paper (color paper), a display light-sensitive material, a color proof, a color reversal film (a color reversal), a color reversal photographic paper, and a cinema color positive. Among these light-sensitive materials, a color photographic paper and a color reversal film are preferable.

In the case that the present invention is applied to a color photographic paper, preferred is a light-sensitive material as described, for example, in JP-A-11-7109, the disclosures (particularly paragraph Nos. 0071 to 0087) of which are here incorporated by reference.

In the case that the present invention is applied to a color negative film, preferred is a light-sensitive material as described in JP-A-11-305396, the disclosures (particularly paragraph Nos. 0115 to 0217) of which are here incorporated by reference.

In the case that the present invention is applied to a color reversal film, preferred is a light-sensitive material as described in JP-A-2001-142181, the disclosures (particularly paragraph Nos. 0164 to 0188) of which are here incorporated by reference. In addition, the disclosures (particularly paragraph Nos. 0018 to 0021) of JP-A-11-84601 are also preferably applied and here incorporated by reference.

Further, there will be explained a coating amount of the yellow dye-forming coupler in the third embodiment of the present invention.

In the silver halide color photographic light-sensitive material of the third embodiment of the present invention, the composition described above is preferable from a purpose of providing a light-sensitive material that uses a high colored density characteristics of the color developed dye, whereby both coating amounts of a coupler and a silver halide emulsion can be lowered than the previous ones, resulting in lowering of a load of a development processing than previous ones. That is, in a reflection type light-sensitive material such as a color photographic paper, a coating amount of the yellow dye-forming coupler represented by the above-described formula (I) according to the present invention is in the range of 0.1 to 1.0 m mole/$m^2$, preferably in the range of 0.2 to 0.8 m mole/$m^2$, and most preferably in the range of 0.3 to 0.6 m mole/$m^2$. In a transmission type or semi-transmission type light-sensitive material for use in a display, said coating amount is in the range of 0.1 to 2.0 m mole/$m^2$, preferably in the range of 0.4 to 1.6 m mole/$m^2$ and most preferably in the range of 0.6 to 1.2 m mole/$m^2$. If the coating amount of the yellow coupler is lower than the range according to the present invention, it is difficult to obtain a substantially enough colored density. On the other hand, the coating amount above the range according to the present invention is not preferable because it is difficult to enhance an ultra-rapid processing suitability, and moreover a load of cost in the production of a light-sensitive material increases.

In a yellow coupler-containing blue-sensitive silver halide emulsion layer, the yellow coupler represented by the above-described formula (I) may be used solely or in combination with previously known yellow couplers. Even in such a combination use, it is also preferable to use the yellow coupler represented by the above-described formula (I) in the coating amount specified in the present invention.

The amount (for example, coating amount) in terms of silver of silver halide in the silver halide color photographic light-sensitive material of the present invention is in the range of 0.20 to 0.70 g/$m^2$, preferably in the range of 0.30 to 0.60 g/$m^2$, of a reflection type light-sensitive material, while in the range of 0.40 to 2.0 g/$m^2$, preferably in the range of 0.60 to 1.2 g/m 2, of a transmission type or semi-transmission type light-sensitive material.

The amount of silver halide used in a blue-sensitive silver halide emulsion layer among a plurality of silver halide emulsion layers is optionally determined in accordance with a coating amount of the yellow coupler according to the present invention. However, for obtaining effects attained by the composition of the present invention, it is preferable to use a smaller amount of silver halide than the case of using a yellow coupler outside the present invention. Specifically, the amount of silver halide used in a blue-sensitive silver halide emulsion layer is in the range of 0.10 to 0.27 g/$m^2$ preferably in the range of 0.12 to 0.24 g/m 2 furthermore preferably in the range of 0.12 to 0.22 g/$m^2$, in terms of silver of a reflection type light-sensitive material respectively, whereas in the range of 0.15 to 0.51 g/$m^2$ preferably in the range of 0.17 to 0.43 g/m 2 furthermore preferably in the range of 0.19 to 0.41 g/$m^2$, in terms of silver of a transmission type or semi-transmission type light-sensitive material respectively. These preferable amounts of silver halide used are suitable for a development processing method that has been generally carried out in the field of the art. In the case where a color development is carried out by another developing method (for example, a developing method of image magnification, i.e., intensification processing), the amount of silver halide is not limited to the above-mentioned range.

In the method in which a color image is generally obtained by the steps of image-wise exposure, and thereafter color development, bleach-fixing, washing and/or stabilization and drying among development processing that can be applied to the silver halide color photographic light-sensitive material of the present invention, a rapid processing, in which a time taken in each step is shortened, is preferable because effects of the present invention can be easily obtained. Specifically, each step of the processing is preferably carried out at the following time.

Color development step: 5 to 25 seconds, Bleach-fixing: 5 to 25 seconds, Washing and/or stabilization step: 10 to 45 seconds, Drying step: 5 to 15 seconds The yellow couplers for use in the present invention may be dispersed in the state of fine particles with a medium such as any kinds of high boiling point organic solvents or a polymer that is insoluble in water, but soluble in an organic solvent. Otherwise, the couplers may be singly dispersed in the state of fine particles to form a dispersion that is substantially free of a high boiling point organic solvent. In the case where the yellow couplers are dispersed in the state of fine particles with any kinds of high boiling point organic solvents or a polymer that is insoluble in water, but soluble in an organic solvent, a mass ratio of the above-mentioned dispersion medium to the yellow coupler is generally in the range of 0.1 to 10, preferably in the range of 0.2 to 5.0, and more preferably in the range of 0.5 to 3.0.

In the present invention, a ratio of an amount of the oil-soluble content to a hydrophilic binder in photographic constitutional layers can be optionally determined. A preferable ratio in the photographic constitutional layers other than a protective layer is in the range of 0.05 to 1.50, more preferably in the range of 0.10 to 1.40, and most preferably in the range of 0.20 to 1.30 in terms of mass ratio respectively. A layer-strength, a hurt-resistance, and a curl property can be controlled by optimalizing the ratio for each layer.

It is preferable for improving performance in a rapid processing to determine a total coating amount of gelatin in the silver halide color photographic light-sensitive material of the present invention. Specifically, the total coating amount of gelatin is generally in the range of 3.0 to 7.4 g/m$^2$, preferably 3.5 to 6.5 g/m in a reflection type light-sensitive material, while it is generally in the range of 5.0 to 25 g/m 2, preferably in the range of 8.0 to 18 g/m$^2$, in a transmission type or semi-transmission type light-sensitive material. Further, a coating amount of gelatin in the blue-sensitive silver halide emulsion layer according to the present invention is preferably in the range of 0.2 to 2.0 g/m 2, more preferably in the range of 0.4 to 1.2 g/m$^2$.

In the silver halide color photographic light-sensitive material of the present invention, gelatin is used as a hydrophilic binder, but if necessary, gelatin can be used in combination with a hydrophilic colloid other than gelatin, for example, synthetic hydrophilic polymer materials such as gelatin derivatives, graft polymers of gelatin and other polymers, proteins other than gelatin, sugar derivatives, cellulose derivatives, and homo- or co-polymers. The gelatin that can be used in the silver halide color photographic light-sensitive material of the present invention may be a lime-processed gelatin or an acid-processed gelatin. The gelatin may be made from any kinds of raw materials such as cattle bone, cattle skin, and pigskin. Among these gelatin preferred is a lime-processed gelatin made from cattle bone, or pigskin as a raw material.

A film thickness of the photographic constitutional layers according to the present invention is preferably 9.0 μm or less and 1.0 μm or greater, more preferably 8.0 μm or less and 2.0 μm or greater, and most preferably 7.0 μm or less and 3.5 μm or greater. The term "film thickness of the photographic constitutional layers" here used refers to a thickness of the photographic constitutional layers provided on a support at the unprocessed state. Specifically, the film thickness can be measured by the following method (1) or method (2).

(1) A silver halide color photographic light-sensitive material is cut-off vertically to a support. The cross-section is measured by means of electron microscope.
(2) A film thickness can be calculated based on a coating amount (g/m$^2$) of each of components in the photographic constitutional layers, and specific gravity of each component. The specific gravity of gelatin that is typically used in a photographic art is 1.34 g/ml, and also the specific gravity of silver chloride grains are 5.59 g/ml. Specific gravities of other hydrophobic additives also can be measured so that a film thickness can be measured according to the method (2).

Silver halide grains in the silver halide emulsion which can be used in the present invention, contain specific silver halide grains. These grains are not particularly limited in their shape but are preferably cubic or tetradecahedral crystal grains substantially having {100} planes (these grains may be rounded at the apexes thereof and further may have planes of higher order), or octahedral crystal grains. Alternatively, a silver halide emulsion in which the proportion of tabular grains having an aspect ratio of 2 or more and composed of {100} or {111} planes accounts for 50% or more in terms of the total projected area or having an aspect ratio of 3 or more and composed of {100} or {111} phases, can also be preferably used. The term "aspect ratio" refers to the value obtained by dividing the diameter of the circle having an area equivalent to the projected area of an individual grain by the thickness of the grain. In the present invention, cubic grains, or tabular grains having {100} planes as major faces, or tabular grains having {111} planes as major faces are preferably used.

As a silver halide emulsion which can be used in the first and second embodiments of the present invention, for example, silver chloride, silver bromide, silver iodobromide, or silver chloro(iodo)bromide emulsions may be used. It is preferable for a rapid processing to use a silver chloride, silver chlorobromide, silver chloroiodide, or silver chlorobromoiodide emulsions having a silver chloride content of 90 mol % or greater, more preferably said silver chloride, silver chlorobromide, silver chloroiodide, or silver chlorobromoiodide emulsions having a silver chloride content of 98 mol % or greater. As a silver halide emulsion which can be used in the third embodiment of the present invention, for example, silver chloride, silver bromide, silver iodobromide, or silver chloro(iodo)bromide emulsions may be used. It is general that at least one of silver halide emulsion layers contains a silver halide emulsion having a silver chloride content of 95 mol % or more. In the present invention, it is preferable that all silver halide emulsion layers are silver halide emulsions having each silver chloride content of 95 mol % or more. In the silver halide emulsion used in the present invention, from viewpoint of a rapid processing, it is preferable to use a silver chloride, silver chlorobromide, silver chloroiodide, or silver chlorobromoiodide emulsions having a silver chloride content of 95 mol % or greater, more preferably said silver chloride, silver chlorobromide, silver chloroiodide, or silver chlorobromoiodide emulsions having a silver chloride content of 98 mol % or greater.

Preferred of these silver halide emulsions are those having in the shell parts of silver halide grains a silver iodochloride phase of 0.01 to 0.50 mol %, more preferably 0.05 to 0.40 mol %, per mol of the total silver, in view of high sensitivity and excellent high illumination intensity exposure suitability. Further, especially preferred of these silver halide emulsions are those containing silver halide grains having on the surface thereof a silver bromide localized phase of 0.2 to 5 mol %, more preferably 0.5 to 3 mol %, per mol of the total silver, since both high sensitivity and stabilization of photographic properties are attained.

As a silver halide emulsion which can be used in the fourth embodiment of the present invention, there can be used an emulsion having specific silver halide grains. It is generally necessary that the emulsion composed of the silver halide grains has a silver chloride content of 90 mol % or more. From the viewpoint of rapid processing, the silver chloride content is preferably 93 mol % or more and further preferably 95 mole %. To obtain a high contrast image having an excellent latent stability, the silver bromide content is preferably 0.1 to 7 mole % and more preferably 0.5 to 5 mole %. For the purpose of obtaining a high contrast image having a high sensitivity at a high illumination exposure, the silver iodide content is preferably 0.02 to 1 mole %, more preferably 0.05 to 0.50 mole %, and 0.07 to 0.40 mole %.

As the specific silver halide grain used in the present invention, a silver chlorobromoiodide grain is preferable and the above-mentioned silver chlorobromoiodide grain having the composition as shown above is more preferable.

The silver halide emulsion for use in the present invention preferably contains silver iodide. In order to introduce iodide ions, an iodide salt solution may be added alone, or it may be added in combination with both a silver salt solution and a high chloride salt solution. In the latter case, the iodide salt solution and the high chloride salt solution may be added separately or as a mixture solution of these salts of iodide and high chloride. The iodide salt is generally added in the form of a soluble salt, such as alkali or alkali earth iodide salt. Alternatively, the iodide salt may be introduced by cleaving the iodide ions from an organic molecule, as described in U.S. Pat. No. 5,389,508. As another source of the iodide ion, fine silver iodide grains may be used.

The iodide salt solution may be added, concentrating in a time during grain formation, or otherwise over a certain period of time. The position of iodide ions introduced into the high chloride emulsion grains is limited for the purpose of imparting high speed and low fog to the emulsion. The more inside iodide ions are introduced into the emulsion grains, the smaller increase in sensitivity it is. Accordingly, the iodide salt solution is preferably added to the portion outer than 50%, more preferably outer than 70%, and most preferably outer than 80% of the grain volume. On the other hand, the addition of iodide salt solution is preferably finished up to the portion inner than 98%, most preferably inner than 96% of the grain volume. As mentioned above, the addition of iodide salt solution is finished at somewhat inside from the surface of grains, resulting in a high speed and low fog emulsion.

The specific silver halide grain of the silver halide emulsion used in the present invention has a silver bromide-containing phase and/or silver iodide-containing phase. Herein, a silver bromide- or iodide-containing layer implies a region where a content of silver bromide or silver iodide is higher than those in other regions, in the silver halide grains. The halogen compositions of the silver bromide-containing phase or the silver iodide-containing phase and of its periphery may vary either continuously or drastically. Such a silver bromide-containing phase or a silver iodide-containing phase may form a layer which has an approximately constant concentration and has a certain width at a certain portion in the grain, or it may form a maximum point having no spread. The local silver bromide content in the silver bromide-containing phase is preferably 5 mole % or more, more preferably from 10 to 80 mole %, and most preferably from 15 to 50 mole %. The local silver iodide content in the silver iodide-containing phase is preferably 0.3 mole % or more, more preferably from 0.5 to 8 mole %, and most preferably from 1 to 5 mole %. Such silver bromide- or silver iodide-containing phase may be present in plural numbers in layer form, within the grain. In this case, the phases may have different silver bromide or silver iodide contents from each other. The silver halide grain for use in the invention has generally at least one of the silver bromide-containing phase and silver iodide-containing phase.

The silver bromide-containing phase or silver iodide-containing phase in the silver halide grain in the invention is deserably present in a layer form surrounding the grain center. One preferred embodiment is that the silver bromide-containing phase or the silver iodide-containing phase formed in the layer form so as to surround the grain center has a uniform concentration distribution in the circumferential direction of the grain, in each phase. However, in the silver bromide-containing phase or silver iodide-containing phase formed in the layer form so as to surround the grain center, there may be the maximum point or the minimum point of the silver bromide or silver iodide concentration, in the circumferential direction of the grain to have a concentration distribution. For example, when a grain has a silver bromide-containing phase or silver iodide-containing phase formed in the layer form so as to surround the grain center in the vicinity of a surface of the grain, the silver bromide or silver iodide concentration of a corner portion or an edge of the grain can be different from that of a main surface of the grain. Further, aside from a silver bromide-containing phase or a silver iodide-containing phase formed in a layer form so as to surround the grain center, another silver bromide-containing phase or silver iodide-containing phase that exists in complete isolation at a specific portion of the surface of the grain, and does not surround the grain center, may exist.

When a silver halide grain for use in the present invention has a silver bromide-containing phase, the silver bromide-containing phase is preferably formed in a layer form so as to have a maximum silver bromide concentration inside the grain. Likewise, when the silver halide grain for use in the present invention has a silver iodide-containing phase, the silver iodide-containing phase is preferably formed in a layer form so as to form a maximum concentration at the surface of the grain. Such silver bromide-containing phase or silver iodide-containing phase is constituted preferably with a silver amount of 3% to 30% of the grain volume, and more preferably with a silver amount of 3% to 15%, in the meaning to increase the local concentration with a less silver bromide or silver iodide content.

The silver halide grain for use in the present invention preferably contains both a silver bromide-containing phase and a silver iodide-containing phase, and this is a preferable mode. In this mode, the silver bromide-containing phase and the silver iodide-containing phase may exist either at the same place in the grain or at different places thereof. However, it is preferred that they exist at different places, in a point that the control of grain formation may become easy. Further, a silver bromide-containing phase may contain silver iodide. Alternatively, a silver iodide-containing phase may contain silver bromide. In general, an iodide added during formation of high silver chloride grains is liable to ooze to the surface of the grain more than a bromide, so that the silver iodide-containing phase is liable to be formed at the vicinity of the surface of the grain. Accordingly, when a silver bromide-containing phase and a silver iodide-containing phase exist at different places in a grain, it is preferred that the silver bromide-containing phase is formed more internally than the silver iodide-containing phase. In such a case, another silver bromide-containing phase may be provided further outside the silver iodide-containing phase in the vicinity of the surface of the grain.

A silver bromide or silver iodide content necessary for exhibiting the effects of the present invention such as achievement of high sensitivity and realization of hard gradation, increases with the silver bromide-containing phase or silver iodide-containing phase is being formed inside a grain. This causes the silver chloride content to decrease to more than necessary, resulting in the possibility of impairing rapid processing suitability. Accordingly, for putting together these functions for controlling photographic actions, in the vicinity of the surface of the grain, it is preferred that the silver bromide-containing phase and the silver iodide-containing phase are placed adjacent to each other. From these points, it is preferred that the silver bromide-containing phase is formed at any of the position ranging from 50% to 100% of the grain volume measured from the inside, and that the silver iodide-containing phase is formed at any of the position ranging from 85% to 100% of the grain volume measured from the inside. Further, it is more preferred that the silver bromide-containing phase is formed at any of the position ranging from 70% to 95% of the grain volume measured from the inside, and that the silver iodide-containing phase is formed at any of the position ranging from 90% to 100% of the grain volume measured from the inside.

To a silver halide grain for use in the present invention, bromide ions or iodide ions are introduced to make the grain include silver bromide or silver iodide. In order to introduce bromide ions or iodide ions, a bromide or iodide salt solution may be added alone, or it may be added in combination with both a silver salt solution and a high chloride salt solution. In the latter case, the bromide or iodide salt solution and the high chloride salt solution may be added separately or as a mixture solution of these salts of bromide or iodide and high chloride. The bromide or iodide salt is generally added in the form of a soluble salt, such as an alkali or alkali earth bromide or iodide salt. Alternatively, bromide or iodide ions may be introduced by cleaving the bromide or iodide ions from an organic molecule, as described in U.S. Pat. No. 5,389,508. As another source of bromide or iodide ion, fine silver bromide grains or fine silver iodide grains may be used.

The addition of a bromide salt or iodide salt solution may be concentrated at one time of grain formation process or may be performed over a certain period of time. For obtaining an emulsion with high sensitivity and low fog, the position of the introduction of an iodide ion to a high silver chloride emulsion is restricted. The deeper in the emulsion grain the iodide ion is introduced, the smaller is the increment of sensitivity. Accordingly, the addition of an iodide salt solution is preferably started at 50% or outer side of the volume of a grain, more preferably 70% or outer side, and most preferably 85% or outer side. Moreover, the addition of an iodide salt solution is preferably finished at 98% or inner side of the volume of a grain, more preferably 96% or inner side. When the addition of an iodide salt solution is finished at a little inner side of the grain surface, thereby an emulsion having higher sensitivity and lower fog can be obtained.

On the other hand, the addition of a bromide salt solution is preferably started at 50% or outer side of the volume of a grain, more preferably 70% or outer side of the volume of an emulsion grain.

The distribution of bromide or iodide ion concentration to the depth direction inside an individual grain can be measured by means of, for example, TRIFT II type TOF-SIMS (trade name) manufactured by Phi Evans Company, in accordance with Etching/TOF-SIMS (Time of Flight-Secondary Ion Mass Spectrometry) process. The details of TOF-SIMS process are described in *Hyomen Bunseki Gijutsu Sensho Niji Ion Shitsuryobunsekiho*, editted by Nippon Hyomenkagaku Kai, Maruzen Co. Ltd. (1999). By analytical research of the emulsion grains according to the Etching/TOF-SIMS process, it is found that even though the addition of iodide salt solution has been completed up to the step of forming the inner part of final grains, there are iodide ions oozed toward the grain surface. In case where the emulsion for use in the present invention contains silver iodide, preferably, iodide ions have the maximum concentration at the grain surface, and in addition, iodide ion concentration decreases toward the inside of the grain, by analyzing with Etching/TOF-SIMS. On the other hand, preferably, bromide ions have the maximum concentration at the grain inside, and in addition, the localized bromide ion concentration can be measured by an X-ray analysis when there is a relatively high silver bromide content.

The silver halide emulsion grains to be used in the light-sensitive material of the present invention preferably have a silver bromide localized phase.

When the silver halide emulsion for use in the present invention contains a silver bromide localized phase, the silver bromide localized phase is preferably formed by epitaxial growth of the localized phase having a silver bromide content of at least 10 mol % on the grain surface. In addition, the emulsion grains preferably have the outermost shell portion having a silver bromide content of at least 1 mol % or more in the vicinity of the surface of the grains.

The silver bromide content of the silver bromide localized phase is preferably in the range of 1 to 80 mol %, and most preferably in the range of 5 to 70 mol %. The silver bromide localized phase is preferably composed of silver having population of 0.1 to 30 mol %, more preferably 0.3 to 20 mol %, to the molar amount of entire silver which constitutes silver halide grains for use in the present invention. The silver bromide localized phase is preferably doped with complex ions of a metal of the Group VIII, such as iridium ions. The amount of these compounds to be added can be varied in a wide range depending on the purposes, and it is preferably in the range of $10^{-9}$ to $10^{-2}$ mol per mol of silver halide.

In the present invention, ions of a transition metal are preferably added in the course of grain formation and/or growth of the silver halide grains, to include the metal ions in the inside and/or on the surface of the silver halide grains. The metal ions to be used are preferably ions of a transition metal. Preferable examples of the transition metal are iron, ruthenium, iridium, osmium, lead, cadmium or zinc. Further, 6-coordinated octahedral complex salts of these metal ions which have ligands are more preferably used. The ligand to be used may be an inorganic compound. Among the inorganic compounds, cyanide ion, halide ion, thiocyanato, hydroxide ion, peroxide ion, azide ion, nitrite ion, water, ammonia, nitrosyl ion, or thionitrosyl ion are preferably used. Such ligand is preferably coordinated to any one of metal ions selected from a group consisting of the above-mentioned iron, ruthenium, iridium, osmium, lead, cadmium and zinc. Two or more kinds of these ligands are also preferably used in one complex molecule.

For the purpose of improving the high intensity reciprocity law failure, the silver halide emulsion of the present invention has especially preferably an iridium ion having at least one organic ligand.

Further, an organic compound can also be preferably used as a ligand. Preferable examples of the organic compound include chain compounds having a main chain of 5 or less carbon atoms and/or heterocyclic compounds of 5- or 6-membered ring. This condition can be applied to the other transition metal than tridium. More preferable examples of the organic compound are those having at least a nitrogen, phosphorus, oxygen, or sulfur atom in a molecule as an atom which is capable of coordinating to a metal. Most preferred organic compounds are furan, thiophene, oxazole, isooxazole, thiazole, isothiazole, imidazole, pyrazole, triazole, furazane, pyran, pyridine, pyridazine, pyrimidine and pyrazine. Further, organic compounds which have a substituent introduced into a basic skeleton of the above-mentioned compounds are also preferred.

Among these compounds, as a preferable ligand which is coordinated to the iridium ion, there is particularly preferably used 5-methyl thiazole among thiazole ligands.

Preferable combinations of a metal ion and a ligand are those of the iron and/or ruthenium ion and the cyanide ion. Preferred of these compounds are those in which the number of cyanide ions accounts for the majority of the coordination number intrinsic to the iron or ruthenium that is the central metal. The remaining sites are preferably occupied by thiocyan, ammonia, water, nitrosyl ion, dimethylsulfoxide, pyridine, pyrazine, or 4,4'-bipyridine. Most preferably each of 6 coordination sites of the central metal is occupied by a cyanide ion, to form a hexacyano iron complex or a hexacyano ruthenium complex. Such metal complexes composed of these cyanide ion ligands are preferably added during grain formation in an amount of $1\times10^{-8}$ mol to $1\times10^{-2}$ mol, most preferably $1\times10^{-6}$ mol to $5\times10^{-4}$ mol, per mol of silver.

In case of the iridium complex, preferable ligands are fluoride, chloride, bromide and iodide ions as well as organic ligands mentioned above. Among these ligands, chloride and bromide ions are more preferably used. Specifically, preferable iridium complexes are $[IrCl_6]^{3-}$, $[IrCl_6]^{2-}$, $[IrCl_5(H_2O)]^{2-}$, $[IrCl_5(H_2O)]^{-}$, $[IrCl_4(H_2O)_2]^{-}$, $[IrCl_4(H_2O)_2]^{0}$, $[IrCl_3(H_2O)_3]^{0}$, $[IrCl_3(H_2O)_3]^{+}$, $[IrBr_6]^{3-}$, $[IrBr_6]^{2-}$, $[IrBr_5(H_2O)]^{2-}$, $[IrBr_5(H_2O)]^{-}$, $[IrBr_4(H_2O)_2]^{-}$, $[IrBr_4(H_2O)_2]^{0}$, $[IrBr_3(H_2O)_3]^{0}$, and $[IrBr_3(H_2O)_3]^{+}$ in addition to the above-mentioned organic ligands.

These iridium complexes are preferably added during grain formation in an amount of $1\times10^{-10}$ mol to $1\times10^{-3}$ mol, most preferably $1\times10^{-8}$ mol to $1\times10^{-5}$ mol, per mol of silver. In case of the ruthenium complex and the osmium complex, nitrosyl ion, thionitrosyl ion, water molecule and chloride ion ligands are preferably used singly or in combination. More preferably these ligands form a pentachloronitrosyl complex, a pentachlorothionitrosyl complex, or a pentachloroaquo complex. The formation of a hexachloro complex is also preferred. These complexes are preferably added during grain formation in an amount of $1\times10^{-10}$ mol to $1\times10^{-6}$ mol, more preferably $1\times10^{-9}$ mol to $1\times10^{-6}$ mol, per mol of silver.

In the present invention, the above-mentioned complexes are preferably added directly to the reaction solution at the time of silver halide grain formation, or indirectly to the grain-forming reaction solution via addition to an aqueous halide solution for forming silver halide grains or other solutions, so that they are doped to the inside of the silver halide grains. Further, these methods are preferably combined to incorporate the complex into the inside of the silver halide grains.

In case where these complexes are doped to the inside of the silver halide grains, they are preferably uniformly distributed in the inside of the grains. On the other hand, as disclosed in JP-A-4-208936, JP-A-2-125245 and JP-A-3-188437, they are also preferably distributed only in the grain surface layer. Alternatively they are also preferably distributed only in the inside of the grain while the grain surface is covered with a layer free from the complex. Further, as disclosed in U.S. Pat. Nos. 5,252,451 and 5,256,530, it is also preferred that the silver halide grains are subjected to physical ripening in the presence of fine grains having complexes incorporated therein to modify the grain surface phase. Further, these methods may be used in combination. Two or more kinds of complexes may be incorporated in the inside of an individual silver halide grain. The halogen composition at the position (portion) where the complexes are incorporated, is not particularly limited, but they are preferably incorporated in any of a silver chloride layer (phase), a silver chlorobromide layer (phase), a silver bromide layer (phase), a silver iodochloride layer (phase) and a silver iodobromide layer (phase).

The silver halide grains contained in the silver halide emulsion for use in the present invention have an average grain size (the grain size herein refers to the diameter of a circle equivalent to the projected area of an individual grain, and the number average is taken as the average grain size) of preferably from 0.1 μm to 2 μm.

With respect to the distribution of sizes of these grains, a so-called monodisperse emulsion having a variation coefficient (the value obtained by dividing the standard deviation of the grain size distribution by the average grain size) of 20% or less, more preferably 15% or less, and further preferably 10% or less, is preferred. The variation coefficient of the diameter of a circle equivalent is expressed by a percentage of the standard deviation of diameter of a circle equivalent of the individual grain relative to the average of diameters of a circle equivalent. For obtaining wide latitude, it is also preferred to blend the above-described monodisperse emulsions in the same layer or to form a multilayer structure by multilayer-coating of the monodisperse emulsions.

Various compounds or precursors thereof can be contained in the silver halide emulsion for use in the present invention to prevent fogging from occurring or to stabilize photographic performance during manufacture, storage or photographic processing of the photographic material. Specific examples of compounds useful for the above purposes are disclosed in JP-A-62-215272, pages 39 to 72, and they can be preferably used. In addition, 5-arylamino-1,2,3,4-thiatriazole compounds (in which the aryl residual group has at least one electron-attractive group), as disclosed in European Patent No. 0447647, are also preferably used.

Further, in the present invention, in order to enhance stability of the silver halide emulsion, it is preferable to use hydroxamic acid derivatives described in JP-A-11-109576; cyclic ketones having a double bond both ends of which are substituted with an amino group or a hydroxyl group, in adjacent to a carbonyl group, as described in JP-A-11-327094 (particularly those represented by formula (SI) and the descriptions of paragraph numbers 0036 to 0071 of JP-A-11-327094 can be incorporated herein by reference); catechols and hydroquinones each substituted with a sulfo group, as described in JP-A-11-143011 (e.g., 4,5-dihydroxy-1,3-benzenedisulfonic acid, 2,5-dihydroxy-1,4-benzenedisulfonic acid, 3,4-dihydroxybenzenesulfonic acid, 2,3-dihydroxybenzenesulfonic acid, 2,5-dihydroxybenzenesulfonic acid, 3,4,5-trihydroxybenzenesulfonic acid, and salts thereof); hydroxylamines represented by the formula (A) in U.S. Pat. No. 5,556,741 (the descriptions of column 4, line 56 to column 11, line 22 in the U.S. Pat. No. 5,556,741 can be preferably applied to the present invention, and incorporated herein by reference), and water-soluble reducing agents represented by any of formulae (I) to (III) of JP-A-11-102045.

Spectral sensitization is generally carried out, for the purpose of imparting spectral sensitivity in a desired light wavelength region to the light-sensitive emulsion in each layer of the photographic material of the present invention.

Further, the silver halide emulsion used in the present invention may contain a spectral sensitizing dye for the purpose of imparting the so-called spectral sensitivity which shows a light sensitivity to the desired light wavelength region.

Spectral sensitizing dyes which are used in the photographic material of the present invention for spectral sensitization of blue, green and red light regions, include, for example, those disclosed by F. M. Harmer, in *Heterocyclic Compounds—Cyanine Dyes and Related Compounds*, John Wiley & Sons, New York, London (1964). Specific examples of the compounds and spectral sensitization processes that are preferably used in the present invention include those described in the above JP-A-62-215272, from page 22, right upper column to page 38. In addition, the spectral sensitizing dyes described in JP-A-3-123340 are very preferred as red-sensitive spectral sensitizing dyes for silver halide emulsion grains having a high silver chloride content, from the viewpoint of stability, adsorption strength and the temperature dependency of exposure, and the like.

The amount of these spectral sensitizing dyes to be added can be varied in a wide range depending on the occasion, and it is preferably in the range of $0.5\times10^{-6}$ mole to $1.0\times10^{-2}$ mole, more preferably in the range of $1.0\times10^{-6}$ mole to $5.0\times10^{-3}$ mole, per mole of silver halide.

The diameter of circle equivalent of the silver halide grain contained in the silver halide emulsion used in the present invention is preferably 0.3 μm to 1.2 μm, more preferably 0.4 μm to 0.8 μm, and most preferably 0.4 μm to 0.6 μm. The silver halide emulsion used in the present invention may contain the other silver halide grain than the present-identified silver halide grain (namely, the specific silver halide grain) contained in the silver halide emulsion of the present invention. However, the silver halide emulsion identified in the present invention has preferably a silver halide grain defined in the present invention 50% or more, more preferably 80% or more, and most preferably 90%, in terms of the total projected area of all grains.

The time for electron slow-release of the silver halide emulsion used in the present invention is preferably $10^{-5}$ to 10 seconds. Here, the time for electron slow-release is time from a point of catching a photoelectron generated in silver halide crystal by an electron trap in the crystal to another point of re-releasing the photoelectron, when the silver halide emulsion is exposed. If the time for electron slow-release is less than $10^{-5}$ second, there can be hardly obtained a high contrast image having a high sensitivity at a high illumination intensity exposure. On the other hand, if the time for electron slow-release is more than 10 seconds, there arises a problem of latent sensitizing up to processing in a short time after the exposure. The time for electron slow-release is more preferably $10^{-4}$ to 10 seconds and most preferably $10^{-3}$ to 1 second.

The time for electron slow-release can be measured by a double plus photoconduction method. By a microwave photoconduction method or a radio wave photoconduction method, the first exposure for a short time is applied, and after a fixed period time, the second exposure for a short time is then applied. In the first exposure, (photo)electrons are trapped in an electron trap in silver halide crystals. If the second exposure is applied immediately after the first exposure, then, as the electron trap is filled with electrons, a second photoconduction signal is enlarged. In the case that the two exposures are conducted at a sufficient time interval and eventually electrons trapped in the electron trap by the first exposure are already released, the second photoconduction signal is returned to approximately the original size. When the exposure interval between the two exposures is changed to take an exposure interval dependence of the second photoconduction signal strength, it is possible to measure the decrease in the second photoconduction signal strength according to the exposure interval. This is defined as the time of slowly releasing photoelectrons from the electron trap. The electron slow-release is sometimes continued for a fixed period of time after exposure. The slow-release is measured preferably for $10^{-5}$ second to 10 seconds, more preferably for $10^{-4}$ second to 10 seconds, and further more preferably for $10^{-3}$ second to 1 second.

The specific silver halide grains in the silver halide emulsion for use in the present invention preferably contain iridium. As an iridium compound, a six-coordination complex having 6 ligands and containing iridium as a central metal is preferable for uniformly incorporating iridium in a silver halide crystal. As an example of iridium for use in the present invention, a six-coordination complex having Cl, Br or I as a ligand and containing iridium as a central metal is more preferable. There is more preferably a six-coordination complex wherein all ligands are composed of Cl, Br, and/or I and containing iridium as a central metal. In this case, the six ligands may be composed of only Br, Cl or I; combination of Br and Cl, Br and I, or Cl and I; or combination of Br, Cl and I. It is especially preferable that a six-coordination complex having Cl, Br or I as a ligand and containing iridium as a central metal is contained in a silver bromide-containing phase for obtaining a hard gradation in a high illumination intensity exposure.

Specific examples of the six-coordination complex in which all of 6 ligands are made of Cl, Br or I and iridium is a central metal are listed below. However, the iridium compound in the present invention is not limited thereto.

$[IrCl_6]^{2-}$
$[IrCl_6]^{3-}$
$[IrBr_6]^{2-}$
$[IrBr_6]^{3-}$
$[IrI_6]^{3-}$

As another example of iridium used in the present invention, a six-coordination complex having at least one ligand except for a halogen or a cyan and containing iridium as a central metal is preferable. A six-coordination complex having $H_2O$, OH, O, OCN, $N(CN)_2$, thiazole, substituted thiazoles, thiadiazole, substituted thiadiazole, thiatriazole, or substituted thiatriazole as a ligand and containing iridium as a central metal is preferable. A six-coordination complex in which at least one ligand is made of $H_2O$, OH, O, OCN, $N(CN)_2$, thiazole, substituted thiazoles, thiadiazole, substituted thiadiazole, thiatriazole, or substituted thiatrizoles and the remaining ligands are made of Cl, Br or I and iridium is a central metal is more preferable. A six-coordination complex in which one or two ligands are made of 5-methylthiazoles and the remaining ligands are made of Cl, Br or I and iridium is a central metal is most preferable.

Specific examples of the six-coordination complex in which at least one ligand is made of $H_2O$, OH, O, OCN, thiazole, or substituted thiazoles, and the remaining ligands are made of Cl, Br or I and iridium is a central metal are listed below. However, iridium in the present invention is not limited thereto.

$[Ir(H_2O)Cl_5]^{2-}$
$[Ir(H_2O)_2Cl_4]^{-}$
$[Ir(H_2O)Br_5]^{2-}$
$[Ir(H_2O)_2Br_4]^{-}$
$[Ir(OH)Cl_5]^{3-}$
$[Ir(OH)_2Cl_4]^{3-}$
$[Ir(OH)Br_5]^{3-}$
$[Ir(OH)_2Br_4]^{3-}$
$[Ir(O)Cl_5]^{4-}$
$[Ir(O)_2Cl_4]^{5-}$
$[Ir(O)Br_5]^{4-}$
$[Ir(O)_2Br_4]^{5-}$
$[Ir(OCN)Cl_5]^{3-}$
$[Ir(OCN)Br_5]^{3-}$
$[Ir(thiazole)Cl_5]^{2-}$
$[Ir(thiazole)_2C_4]^{-}$
$[Ir(thiazole)Br_5]^{2-}$
$[Ir(thiazole)_2Br_4]^{-}$
$[Ir(5\text{-methylthiazole})Cl_5]^{2-}$
$[Ir(5\text{-methylthiazole})_2Cl_4]^{-}$
$[Ir(5\text{-methylthiazole})Br_5]^{2-}$
$[Ir(5\text{-methylthiazole})_2Br_4]^{-}$ The above-mentioned object of the present invention is preferably attained by singly using either a six-coordination complex in which all of 6 ligands are made of Cl, Br or I and iridium is a central metal, or a six-coordination complex having at least one ligand except for a halogen or a cyan and containing iridium as a central metal. However, for more advance in the effect of the present invention, it is preferable to use a combination of a six-coordination complex in which all of 6 ligands are made of Cl, Br or I and iridium is a central metal, and a six-coordination complex having at least one ligand except for a halogen or a cyan and containing iridium as a central metal. Further, it is most preferable to use a combination of two kind of complexes selected from among six-coordination complexes in which at least one ligand is made of $H_2O$, OH, O, OCN, $N(CN)_2$, thiazole, substituted thiazoles, thiadiazole, substituted thiadiazoles, thiatriazole, or substituted thiatrizoles and the remaining ligands are made of Cl, Br or I and iridium is a central metal.

The foregoing metal complexes are anionic ions. When these are formed into salts with cationic ions, counter cationic ions are preferably soluble in water. Specifically, alkali metal ions such as a sodium ion, a potassium ion, a rubidium ion, a cesium ion and a lithium ion; an ammonium ion and an alkyl ammonium ion are preferable. These metal complexes can be used being dissolved in water or mixed solvents of water and appropriate water-miscible organic solvents (such as alcohols, ethers, glycols, ketones, ethers and amides). These iridium complexes are added in amounts of, preferably $1\times10^{-10}$ mole to $1\times10^{-3}$ mole, most preferably $1\times10^{-8}$ mole to $1\times10^{-5}$ mole, per mole of silver during grain formation.

In the present invention, it is preferable that the iridium complex is preferably incorporated into the silver halide grains by directly adding the same to a reaction solution for the formation of the silver halide grains, or by adding the same to an aqueous solution of the halide for the formation of the silver halide grains, or to another solution and then to the reaction solution for the grain formation. It is also preferable that the iridium complex is incorporated into the silver halide grains by physical aging with fine grains having the iridium complex previously incorporated therein. Further, it can be also contained into the silver halide grains by a combination of these methods.

When these complexes are incorporated into the silver halide grains, they may be uniformly present within the grains. It is also preferable, as disclosed in JP-A-4-208936, JP-A-2-125245 and JP-A-3-188437, that they are located on the surface layers of the grains, or that they are located only within the grains, but absent on the surfaces of the grains. Further, as disclosed in U.S. Pat. Nos. 5,252,451 and 5,256,530, it is also preferable that the surface phases of the grains are modified using physical aging with fine grains having the complexes previously incorporated therein. Still further, a combination of these methods is also available, and plural types of the complexes may be incorporated into the silver halide grains. The halogen composition in the position in which the complex is contained is not particularly limited. It is preferable that a six-coordination complex in which all of 6 ligands are made of Cl, Br or I and iridium is a central metal is contained in a position having a silver bromide concentration maximum.

In the present invention, metal ion other than iridium can be doped in the inside and/or on the surface of the silver halide grains. As the metal ion used, a transition metal is preferable, and iron, ruthenium, osmium, lead, cadmium or zinc is especially preferable. It is more preferable that these metal ions are used in the form of a six-coordinate octahedral complex having ligands. When an inorganic compound is used as a ligand, it is preferable to use a cyanide ion, a halide ion, a thiocyan ion, a hydroxide ion, a peroxide ion, an azide ion, a nitrite ion, water, ammonia, a nitrosyl ion or a thioanitrosyl ion. It is also preferably coordinated in the foregoing metal ion such as iron, ruthenium, osmium, lead, cadmium or zinc. It is also preferable to use plural ligands in one complex molecule. Moreover, an organic compound is also available as a ligand. As the organic compound, a chain compound having 5 or less carbon atoms in a main chain and/or a 5-membered or 6-membered heterocyclic compound is preferable. An organic compound having a nitrogen atom, a phosphorous atom, an oxygen atom or a sulfur atom in a molecule as a ligand atom to a metal is more preferable. Furan, thiophene, oxazole, isooxazole, thiazole, isothiazole, imidazole, pyrazole, triazole, furazane, pyran, pyridine, pyridazine, pyrimidine and pyrazine are especially preferable. Further, there are preferably substituted compounds having a basic skeleton derived from these compounds.

Preferable examples of the metal ion and the ligands include a combination of an iron ion and cyanide ions and a combination of a ruthenium ion and cyanide ions. In the present invention, the combined use of iridium and these compounds is preferable. In these combinations, it is preferable that the number of cyanide ions occupies more than half of the coordination number to iron or ruthenium as a central metal and the remaining coordination sites are occupied by thiocyan ion, ammonia, water, a nitrosyl ion, dimethyl sulfoxide, pyridine, pyrazine or 4,4-bipyridine. It is most preferable that the six coordination sites of the central metal are all occupied by cyanide ions to form a hexacyano iron complex or a hexacyano ruthenium complex. The complex having these cyanide ions as ligands is added in an amount of, preferably $1\times10^{-8}$ mole to $1\times10^{-2}$ mole, more preferably $1\times10^{-6}$ mole to $5\times10^{-4}$ mole per mole of silver during grain formation. When ruthenium or osmium is used as a central metal, it is preferable to use a nitrosyl ion, a thionitrosyl ion or a water molecule and a chloride ion as ligands in combination. It is more preferable to form a pentachloronitrosyl complex, a pentachlorothionitrosyl complex, or a pentachloroaquo complex and also to form a hexachloro complex. These complexes are added in amounts of, preferably $1\times10^{-10}$ mole to $1\times10^{-6}$ mole, more preferably $1\times10^{-9}$ mole to $1\times10^{-6}$ mole per mole of silver during grain formation.

The oxidation potential of the latent image of the silver halide emulsion for use in the present invention is preferably higher than 70 m V, more preferably higher than 100 m V. That the oxidation potential of the latent image is higher than 70 m V means that the oxidation resistance of the latent image is relatively high. The oxidation potential of the latent image can be measured by the method described in a known data, for example, *Photographic Sensitivity*, Oxford University Press, Tadaaki Tani, 1995, p. 103. Specifically, gradation exposure for 0.1 second is applied to a coating of a silver halide emulsion, and it is dipped in a redox bath having various potentials before development to measure a potential in which a latent image is bleached.

The silver halide emulsion that can be used in the present invention is generally chemically sensitized. Chemical sensitization can be performed by utilizing a sulfur sensitization, represented by the addition of an unstable sulfur compound, noble metal sensitization represented by gold sensitization, and reduction sensitization, each singly or in combination thereof. Compounds that are preferably used in chemical sensitization include those described in JP-A-62-

215272, from page 18, right lower column to page 22, right upper column. Among them, gold sensitized ones are preferable in particular, because, by subjecting to a gold sensitization, a vibration of photographic property at a scanning exposure with a laser light etc. can be smaller.

In order to conduct gold sensitization to the silver halide emulsion that can be used in the present invention, various inorganic gold compounds, gold (I) complexes having an inorganic ligand, and gold (I) compounds having an organic ligand may be used. Inorganic gold compounds, such as chloroauric acid or salts thereof; and gold (I) complexes having an inorganic ligand, such as dithiocyanato gold compounds (e.g., potassium dithiocyanatoaurate (I)), and dithiosulfato gold compounds (e.g., trisodium dithiosulfatoaurate (I)), are preferably used.

As the gold (I) compounds having an organic ligand, which are usable in the present invention, use can be made of bis-gold (I) methoion heterocyclic compounds, as described in JP-A-4-267249, such as bis(1,4,5-trimethyl-1,2,4-triazolium-3-thiolato)gold (I) tetrafluoroborate, organic mercapto gold (I) complexes as described in JP-A-11-218870, such as potassium bis(1-[3-2-sulfonatobenzamido]phenyl]-5-mercaptotetrazole potassium salt)aurate (I) pentahydrate, gold (I) compounds having a nitrogen compound anion coordinated thereto, as described in JP-A-4-268550, such as sodium bis(1-methylhydantoinato)aurate (I) tetrahydrate. Further, gold (I) thiolate compounds described in U.S. Pat. No. 3,503,749, gold compounds as described in JP-A-8-69074, JP-A-8-69075 and JP-A-9-269554, and compounds as described in U.S. Pat. Nos. 5,620,841, 5,912,112, 5,620,841, 5,939,245 and 5,912,111 may be also used.

The amount of these compounds to be added can be varied in a wide range depending on the occasion, and it is generally in the range of $5\times10^{-7}$ mol to $5\times10^{-3}$ mol, preferably in the range of $5\times10^{-6}$ mol to $5\times10^{-4}$ mol, per mol of silver halide.

The silver halide emulsion used in the present invention is preferably gold-sensitized with colloidal gold sulfide or a gold sensitizer having a complex stability constant log $\beta_2$ of gold within a range of 21 to 35. A method of producing the gold sensitizer is described in, for example, *Research Disclosure*, No. 37154, *Solid state Tonics*, Vol. 79, pp. 60 to 66 (1995), and *Compt. Rend. Hebt. Seances Acad. Sci. Sect*, B Vol. 263, p. 1328 (1996). Colloidal gold sulfide having various grain sizes are available, and even those having a grain diameter of 50 nm or less are also usable. The amount of these compounds to be added can be varied in a wide range depending on the occasion, and it is generally in the range of $5\times10^{-7}$ mol to $5\times10^{-3}$ mol, preferably in the range of $5\times10^{-6}$ mol to $5\times10^{-4}$ mol, in terms of gold atom, per mol of silver halide.

In the present invention, gold sensitization may be used in combination with other sensitizing methods, for example, sulfur sensitization, selenium sensitization, tellurium sensitization, reduction sensitization, or noble metal sensitization using a noble metal compound other than gold compounds.

The gold sensitizer having a complex stability constant log $\beta_2$ of gold within a range of from 21 to 35 is described below.

The measurement of the complex stability constant log $\beta_2$ of gold is described in *Comprehensive Coordination Chemistry*, chap. 55, p. 864, 1987; *Encyclopedia of Electrochemistry of the Elements*, chap. IV-3, 1975; Journal of The Royal Netherlands Chemical Society, vol. 101, p 164, 1982; and other references. According to applying the measuring method described in these documents, the complex stability constant log $\beta_2$ of gold is calculated from a gold potential which is measured at a measurement temperature of 25° C. with an ionic strength of 0.1 M (KBr) by adjacent pH to 6.0 with a potassium dihydrogenphosphate/disodium hydrogenphosphate buffer. In this measurement, log $\beta_2$ of a thiocyanate ion is 20.5 which is close to 20, a value described in a literature (*Comprehensive Coordination Chemistry*, chap. 55, p. 864, 1987, Table 2).

The gold sensitizer having the complex stability constant log $\beta_2$ of gold within a range of from 21 to 35 is preferably represented by formula (S).

$$\{(L^1)_x(Au)_y(L^2)_z \cdot Q_q\}_p \qquad \text{Formula(S)}$$

In formula (S), $L^1$ and $L^2$, independently from each other, represent a compound having log $\beta_2$ of 21 to 35. A compound having log $\beta_2$ of 22 to 31 is preferable, and a compound having log $\beta_2$ of 24 to 28 is more preferable.

Examples of L and L include a compound containing at least one unstable sulfur group capable of forming silver sulfide by reaction with a silver halide, a hydantoin compound, a thioether compound, a mesoionic compound, —SR', a heterocyclic compound, a phosphine compound, amino acid derivatives, sugar derivatives or a thiocyanato group. These may be the same as or different from each other. R' represents an aliphatic hydrocarbon group, an aryl group, a heterocyclic group, an acyl group, a carbamoyl group, a thiocarbamoyl group or a sulfonyl group.

Q represents a counter anion or a counter cation required for neutralizing a charge of a compound, x and z each represent an integer of 0 (zero) to 4, y and p each represent 1 or 2, and q represents a value of 0 (zero) to 1 including a decimal, provide that x and z are not zero at the same time.

With respect to preferable compounds represented by formula (S), L1 and L2 each represent a compound containing at least one unstable sulfur group capable of forming silver sulfide by reaction with a silver halide, a hydantoin compound, a thioether compound, a mesoionic compound, —SR', a heterocyclic compound or a phosphine compound, and x, y and z each represent 1.

With respect to more preferable compounds represented by formula (S), L and L each represent a compound containing at least one unstable sulfur group capable of forming silver sulfide by reaction with a silver halide, a mesoionic compound or —SR', and x, y and z each represent 1.

The gold compounds represented by formula (S) are described in more detail below.

In formula (S), examples of a compound containing at least one unstable sulfur group capable of forming silver sulfide by reaction with a silver halide as represented by L1 and L2 include thioketones (such as thioureas, thioamides and rhodanines), thiophosphates and thiosulfates.

Preferable examples of a compound containing at least one unstable sulfur group capable of forming silver sulfide by reaction with a silver halide include thioketones (preferably, thioureas and thioamides) and thiosulfates.

Next, in formula (S), examples of a hydantoin compound represented by L1 and L2 include unsubstituted hydantoin and N-methy hydantoin. Examples of a thioether compound include linear or cyclic thioethers having 1 to 8 thio groups that are bond with a substituted or unsubstituted linear or branched alkylene group (such as ethylene, or triethylene) or a phenylene group. Specific examples thereof include bishydroxyethyl thioether, 3,6-dithia-1,8-octanediol and 1,4,8,11-tetrathiacyclotetradecane. Examples of a mesoionic compound include mesoionic-3-mercapto-1,2,4-triazole (such as mesoionic-1,4,5-trimethyl-3-mercapto-1,2,4-triazole).

When L and L in formula (S) represent —SR', examples of an aliphatic hydrocarbon group represented by R' include a substituted or unsubstituted linear or branched alkyl group having 1 to 30 carbon atoms (such as methyl, ethyl, isopropyl, n-propyl, n-butyl, t-butyl, 2-pentyl, n-hexyl, n-octyl, t-octyl, 2-ethyhexyl, 1,5-dimethylhexyl, n-decyl, n-dodecyl, n-tetradecyl, n-hexadecyl, hydroxylethyl, hydroxypropyl, 2,3-dihydroxypropyl, carboxymethyl, carboxyethyl, sodiumsulfoethyl, diethylaminoethyl, diethylaminopropyl, butoxypropyl, ethoxyethoxyethyl or n-hexyloxypropyl), a substituted or unsubstituted cyclic alkyl group having 3 to 18 carbon atoms (such as cyclopropyl, cycropentyl, cyclohexyl, cyclooctyl, adamanthyl or cyclodecyl), an alkenyl group having 2 to 16 carbon atoms (such as allyl, 2-butenyl or 3-pentenyl), an alkinyl group having 2 to 10 carbon atoms (such as propargyl or 3-pentynyl) and an aralkyl group having 6 to 16 carbon atoms (such as benzyl). Examples of an aryl group include a substituted or unsubstituted phenyl and naphthyl groups having 6 to 20 carbon atoms (such as unsubstituted phenyl, unsubstituted naphthyl, 3,5-dimethyl phenyl, 4-butoxyphenyl, 4-dimethylaminophenyl and 2-carboxypheny). Examples of a heterocyclic group include a substituted or unsubstituted 5-membered nitrogen-containing heterocyclic ring (such as imidazolyl, 1,2,4-triazolyl, tetrazolyl, oxadiazolyl, thiazolyl, benzoimidazolyl or purinyl), a substituted or unsubstituted 6-membered nitrogen-containing heterocyclic ring (such as pyridyl, piperidyl, 1,3,5-triazino or 4,6-dimercapto-1,3,5-triazino), a furyl group and a thienyl group. Examples of an acyl group include acetyl and benzoyl. Examples of a carbamoyl group include dimethyl carbamoyl. Examples of a thiocarbamoyl group include diethylthio carbamoyl. Examples of a sulfonyl group include a substituted or unsubstituted alkylsulfonyl group having 1 to 10 carbon atoms (such as methanesulfonyl and ethanesulfonyl), and a substituted or unsubstituted phenylsulfonyl group having 6 to 16 carbon atoms (such as phenylsulfonyl).

With respect to —SR' represented by $L^1$ and $L^2$, R' is preferably an aryl group or a heterocyclic group, more preferably a heterocyclic group, further more preferably a 5- or 6-membered nitrogen-containing heterocyclic group, most preferably a nitrogen-containing heterocyclic group substituted with a water-soluble group (such as sulfo, carboxy, hydroxy or amino).

Examples of the heterocyclic compound represented by L1 and L2 in formula (S) include substituted or unsubstituted 5-membered nitrogen-containing heterocyclic compounds (such as pyrrols, imidazoles, pyrazoles, 1,2,3-triazoles, 1,2,4-triazoles, tetrazoles, oxazoles, isooxazoles, isothiazoles, oxadiazoles, thiadiazoles, pyrrolidines, pyrrolines, imidazolidines, imidazolines, pyrazolidines, pyrazolines and hydantoins), heterocyclic compounds containing a 5-membered ring (such as indoles, iso-indoles, indolidines, indazoles, benzoimidazoles, purines, benzotriazoles, carbazoles, tetraazaindenes, benzotriazoles and indolines), substituted or unsubstituted 6-membered nitrogen-containing heterocyclic compounds (such as pyridines, pyrazines, pyrimidines, pyridazines, triazines, thiadiazines, piperidines, piperazines and morpholines), heterocyclic compounds containing a 6-membered ring (such as quinolines, isoquinolines, phthaladines, naphthyridine, quinoxalines, quinazolines, pteridines, phenathridines, acridines, phenanthrolines and phenazines), substituted or unsubstituted furans, substituted or unsubstituted thiophenes and benzothiazoliums.

Preferable examples of the heterocyclic compound represented by L and L include 5- or 6-membered nitrogen-containing unsubstituted heterocyclic compounds and heterocyclic compounds containing the same. Specific examples thereof include pyrroles, imidazoles, pirazoles, 1,2,4-triazoles, oxadiazoles, thiadiazoles, imidazolines, indoles, indolidines, indazoles, benzoimidazoles, purines, carbazoles, tetraazaindenes, benzotiazoles, pyridines, pyrazines, pyrimidines, pyridazines, triazines, quinolines, isoquinolines and phthalazines. Further, heterocyclic compounds known to those skilled in the art as an anti-fogging agent (such as imidazoles, benzoimidazoles, benzotriazoles and tetraazaindenes) are preferable.

Examples of a phosphine compound represented by L and L in formula (S) include phosphines substituted with an aliphatic hydrocarbon group having 1 to 30 carbon atoms, an aryl group having 6 to 20 carbon atoms, a heterocyclic group (such as pyridyl), a substituted or unsubstituted amino group (such as dimethylamino), and/or an alkyloxy group (such as methyoxy, ethyloxy). Preferable are phosphines substituted with an alkyl group having 1 to 10 carbon atoms, an aryl group having 6 to 12 carbon atoms (such as triphenylphosphine and triethylphosphine).

Further, it is preferable that the mesoionic compound, —SR' and the heterocyclic compound represented by $L^1$ and $L^2$ are substituted with an unstable sulfur group capable of forming silver sulfide by a reaction with a silver halide (for example, a thioureido group).

Moreover, the compound represented by L and L2 in formula (S) may have as many substituents as possible. Examples of the substituent include a halogen atom (such as fluorine, chlorine, bromine), an aliphatic hydrocarbon group (such as methyl, ethyl, isopropyl, n-propyl, t-butyl, n-octyl, cyclopentyl or cyclohexyl), an alkenyl group (such as allyl, 2-butenyl or 3-pentenyl), an alkinyl group (such as propargyl or 3-pentynyl), an aralkyl group (such as benzyl, phenethyl), an aryl group (such as pheny, naphthyl or 4-methypheny), a heterocyclic group (such as pyridyl, furyl, imidazolyl, pyperidinyl or morphoryl), an alkoxy(alkyloxy) group (such as methoxy, ethoxy, butoxy, 2-ethylhexyloxy, ethoxyethoxy, or methoxyethoxy), an aryloxy group (such as phenoxy, or 2-naphthyloxy), an amino group (such as an unsubstituted amino, dimethylamino, diethylamino, dipropylamino, dibutyramino, ethylamino, dibenzylamino or anilino), an acylamino group (such as acethylamino or benzoylamino), an ureido group (such as unsubstituted ureido, N-methylureido or N-phenylureido), a thioureido group (such as unsubstituted thioureido, N-methylthioureido or N-phenylthioureido), a selenoureido group (such as unsubstituted selenoureido), a phosphineselenido group (such as diphenylphosphine selenido), a telluroureido group (such as unsubstituted telluroureido), a urethane group (such as methoxycarbonylamino or phenoxycarbonylamino), a sulfonamido group (such as methylsulfonamido or phenylsulfonamido), a sulfamoyl group (such as unsubstituted sulfamoyl, N,N-dimethylsulfamoyl or N-phenylsulfamoyl), a carbamoyl group (such as unsubstituted carbamoyl, N,N-diethylcarbamoyl or N-phenylcarbamoyl), a sulfonyl group (such as methanesulfonyl or p-toluenesulfonyl), a sulfinyl group (such as methyl sulfinyl or phenylsulfinyl), an alkyloxycarbonyl group (such as methoxycarbonyl, ethoxycarbonyl), an aryloxycarbonyl group (such as phenoxycarbonyl), an acyl group (such as acetyl, benzoyl, formy or pivaloyl), an acyloxy group (such as acetoxy or benzoyloxy), a phosphoric acid amide group (such as N,N-diethylphosphoric acid amide), an alkylthio group (such as methylthio or ethylthio), an arylthio group (such as phenylthio), a cyano group, a sulfo group, a thiosulfonic acid group, a sulfinic acid group, a carboxy group, a hydroxy group, a mercapto group, a phosphono group, a nitro group, a sulfino group, an ammonio group (such as trimethyammonio), a phosphonio group, a hydrazino group, a thiazolino group, and a silyloxy group (such as t-butyldimethylsilyloxy or t-butyldiphenylsilyloxy). When there are two or more substitutes, they are the same or different.

Q and q in formula (S) are described below.

Examples of a counter anion represented by Q in formula (S) include a halogenium ion (such as $F^-$, $Cl^-$, $Br^-$, or $I^-$), a tetrafluoroborate ion ($BF^-_4$), hexafluorophosphate ion ($PF^-_6$), a sulfate ion ($SO_4$), an arylsulfonate ion (such as p-toluenesulfonate ion or a naphthalene-2,5-disulphonate ion), and a carboxyl ion (such as acetate ion, a trifluoroacetate ion, an oxalate ion or a benzoate ion). Examples of a counter cation represented by Q include an alkali metal ion (such as a lithium ion, a sodium ion, a potassium ion, a rubidium ion or a cesium ion), an alkaline earth metal ion (such as a magnesium ion or calcium ion), a substituted or unsubstituted ammonium ion (such as an unsubstituted ammonium ion, a triethylammonium ion or tetramethylammonium ion), a substituted or unsubstituted pyridinium ion (such as an unsubstituted pyridinium ion or a 4-phenyl pyridinium ion), and a proton. Further, q is the number of Q for neutralizing a charge of a compound, and represents a value of 0 (zero) to 1, and its value may be a decimal.

Preferable examples of counter anion represented by Q include a halogenium ion (such as $Cl^-$ and $Br^-$), a tetrafluoroborate ion, hexafluorophosphate ion and a sulfate ion. Preferable examples of counter cation represented by Q include an alkali metal ion (such as a sodium ion, a potassium ion, a rubidium ion or a cesium ion), a substituted or unsubstituted ammonium ion (such as an unsubstituted ammonium ion, a triethylammonium (ion) or tetramethylammonium (ion)), or a proton.

Specific examples of the compound represented by L or L2 are listed below. However, the compound for use in the present invention is not limited thereto. The number in a parenthesis indicates a log $\beta_2$ value.

(L-1)

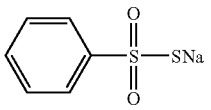

(22)

(L-2)

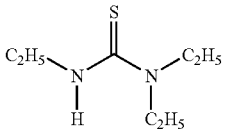

(24)

(L-3)

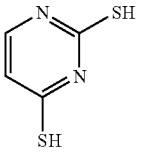

(25)

-continued (L-4)

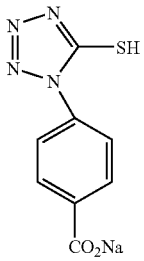

(25)

(L-5)

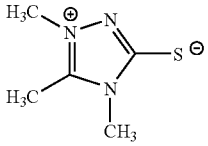

(26)

(L-6)

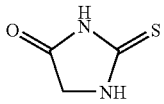

(27)

(L-7)

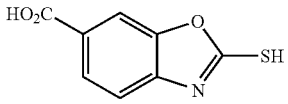

(27)

(L-8)

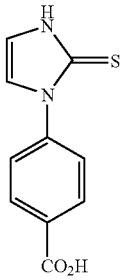

(27)

(L-9)

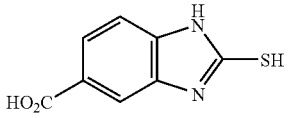

(27)

(L-10)

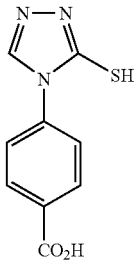

(27)

-continued (L-11)

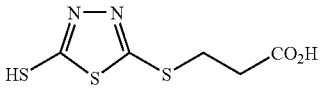

(27)

(L-12)

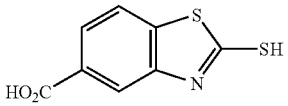

(27)

(L-13)

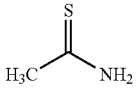

(28)

(L-14)

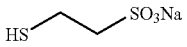

(28)

(L-15)

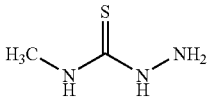

(29)

(L-16)

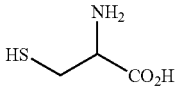

(29)

(L-17)

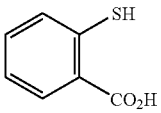

(30)

The compound represented by formula (S) can be synthesized with reference to a known method such as *Inorg. Nucl. Chem. Letters*, Vol. 10, p. 641 (1974); *Transition Met. Chem.*, Vol.1, p. 248 (1976); *Acta. Cryst.* B32, p. 3321 (1976), JP-A-8-69075, JP-B-45-8831, European Patent No. 915371A1, JP-A-6-11788, JP-A-6-501789, JP-A-4-267249 and JP-A-9-118685.

Specific examples of the compound represented by formula (S) are listed below. However, the compound for use in the present invention is not limited thereto.

(S-1)

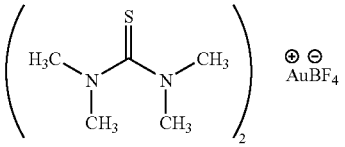

-continued (S-2)

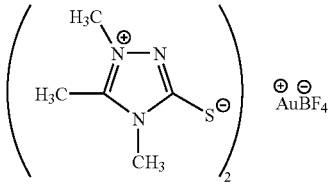

(S-3)

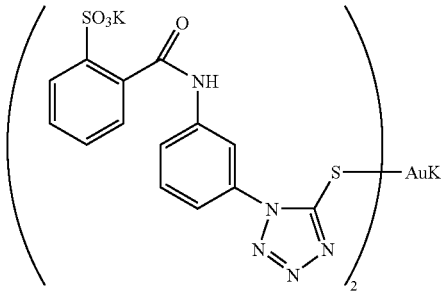

(S-4)

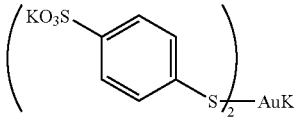

(S-5)

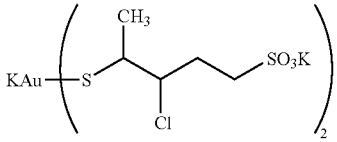

(S-6)

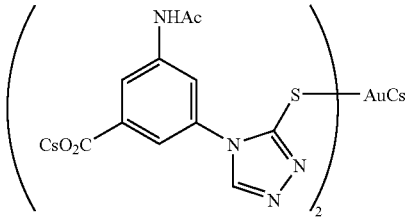

(S-7)

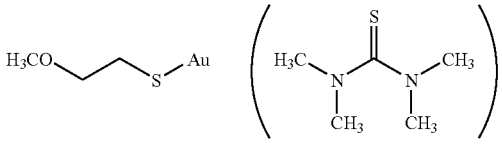

(S-8)

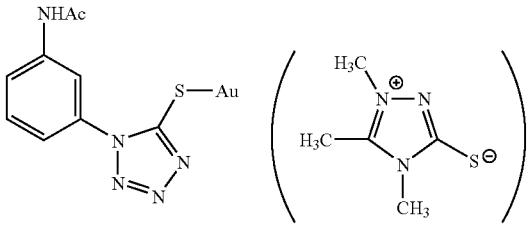

-continued (S-9)

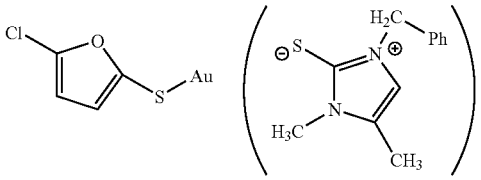

(S-10)

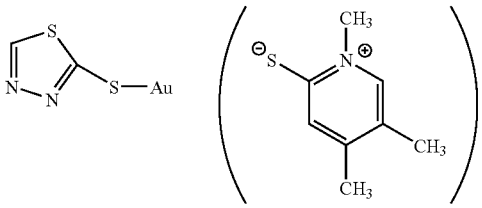

(S-11)

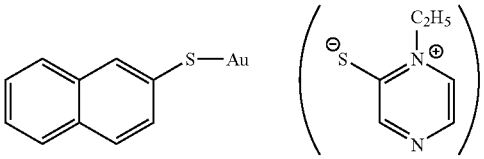

(S-12)

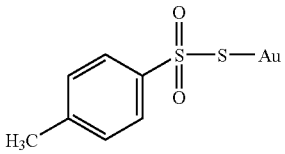

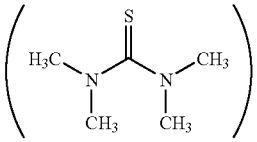

(S-13)

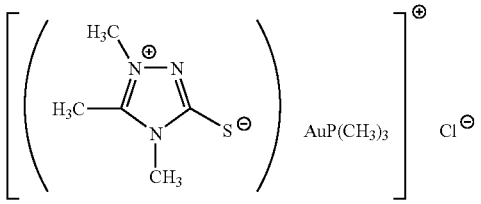

(S-14)

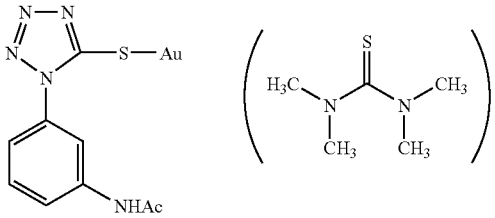

(S-15)

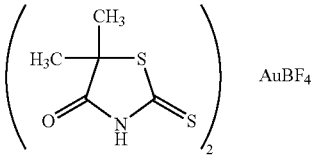

-continued (S-16)

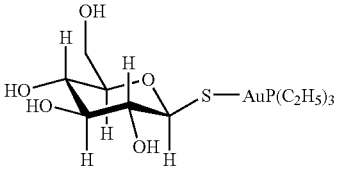

(S-17)

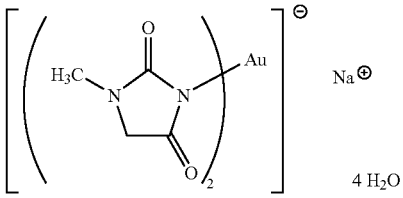

(S-18)

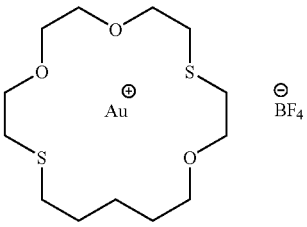

(S-19)

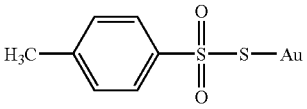

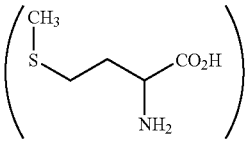

Gold sensitization in the present invention is usually carried out by addition of a gold sensitizer to an emulsion with stirring at a high temperature (preferably 40° C. or more) for a fixed period of time. The addition amount of the gold sensitizer varies depending on various conditions. However, as a standard, it is preferably $1\times10^{-7}$ mole or more and $1\times10^{-4}$ mole or less per mole of silver halide.

As the gold sensitizer in the present invention, the above-mentioned gold sensitizers may be used in combination with other gold compounds that are ordinarily used, such as chloro auric acid, potassium chloro aurate, auric trichloride, potassium auric thiocyanate, potassium iodo aurate, tetracyano auric acid, ammonium aurothiocyanate and pyridyltrichlorogold.

For chemical sensitization of the silver halide emulsion that is used in the present invention, the gold sensitization may be combined with other chemical sensitization. As said chemical sensitization that is used in combination, for example, sulfur sensitization, selenium sensitization, tellurium sensitization, noble metal sensitization using noble metals other than gold compounds, and reduction sensitization can be used either singly or in combination. As a compound used in the chemical sensitization, those described in JP-A-62-215272, page 18, right lower column to page 22, right upper column are preferably used.

Conventionally well known photographic materials and additives can be used in the light-sensitive material of the present invention.

For example, as the photographic support, a transmission type support and a reflection type support can be used. As the transmission type support, transparent films such as cellulose nitrate films and polyethylene terephthalate, polyesters of 2,6-naphthalenedicarboxylic acid (NDCA) with ethylene glycol (EG) and polyesters of NDCA with terephthalic acid and EG on which a data-recording layer such as a magnetic layer are provided are preferably used. In the present invention, the reflection type support is preferable. As the reflection type support, reflection supports laminated with a plurality of waterproof resin layers (laminated layers) such as a polyethylene layer and a polyester layer at least one of which contains white pigment, e.g., a titanium oxide, are particularly preferred.

A more preferred reflection support in the present invention is a paper substrate having a polyolefin layer on the side on which a silver halide emulsion layer is provided with minute voids. The polyolefin layer may be a plurality of layers, and in such a case, a paper substrate comprising a polyolefin layer adjacent to a gelatin layer on the silver halide emulsion layer side not having minute voids (e.g., polypropylene, polyethylene), and a polyolefin layer nearer to the paper substrate having minute voids (e.g., polypropylene, polyethylene) is more preferred. The density of these multi-layer or mono-layer polyolefin layer(s) provided between the paper substrate and photographic constitutional layers is preferably from 0.40 to 1.0 g/ml, more preferably from 0.50 to 0.70 g/ml. Further, the thickness of these multi-layer or mono-layer polyolefin layer(s) provided between the paper substrate and photographic constitutional layers is preferably from 10 to 100 μm, more preferably from 15 to 70 μm. Moreover, the thickness ratio of a polyolefin layer to a paper substrate is from 0.05 to 0.2, more preferably from 0.1 to 0.15.

On the opposite (back) surface of the photographic constituent layer of the above-mentioned paper substance, polyolefin layer is preferably provided from the viewpoint of increasing the rigidity of the reflection support. In this embodiment, the polyolefin layer on the back surface preferably comprises polyethylene or polypropylene, whose surface is dull-finished. Polypropylene is more preferred. A thickness of the polyolefin layer on the back surface is preferably in the range of 5 to 50 μm, and more preferably in the range of 10 to 30 μm. In addition, the density of the polyolefin layer is preferably in the range of 0.7 to 1.1 g/ml. In the reflective support for use in the present invention, preferable embodiments of the polyolefin layer applied on a paper substrate are described, for example, in JP-A-10-333277, JP-A-10-333278, JP-A-11-52513, JP-A-11-65024, EP 0 880 065 A1, and EP 0 880 066 A1.

It is preferred for the above waterproof resin layer to contain a fluorescent brightening agent. A fluorescent brightening agent may be dispersed in a hydrophilic colloid layer of a light-sensitive material. As fluorescent brightening agents, bezoxazole-based, coumarine-based and pyrazoline-based fluorescent brightening agents are preferably used, and more preferably bezoxazolylnaphthalene-based compounds and bezoxazolyl stilbene-based compounds are used.

The amount to be used is not particularly limited, but preferably it is 1 to 100 mg/m$^2$. When it is mixed with a water-resistant resin, preferably the mixing proportion is 0.0005 to 3% by mass, and more preferably 0.001 to 0.5% by mass, to the resin.

The reflective-type base may be one wherein a hydrophilic colloid layer containing a white pigment is applied on a transparent-type base or a reflective-type base described in the above.

Further, the reflective-type base may be a base having a mirror-faced reflective- or a second-type diffusion reflective metal surface.

As the support for the light-sensitive material according to the present invention, a white polyester-based support or a support having a layer containing a white pigment provided on the side of the support on which a silver halide emulsion layer is provided may be used for display. Further, for increasing sharpness, it is preferred to provide an anti-halation layer on the side on which a silver halide emulsion layer is coated or the back surface of the support. In particular, it is preferred to set the transmission density of the support in the range of from 0.35 to 0.8 so that a display can be observed with a reflected light or a transmitted light.

In the light-sensitive material of the present invention, in order to improve, e.g., sharpness of an image, a dye (particularly an oxonole-series dye) that can be discolored by processing, as described in European Patent No. 0337490 A2, pages 27 to 76, is preferably added to the hydrophilic colloid layer such that an optical reflection density at 680 nm in the light-sensitive material is 0.70 or more. It is also preferable to add 12% by mass or more (more preferably 14% by mass or more) of titanium oxide that is surface-treated with, for example, dihydric to tetrahydric alcohols (e.g., trimethylolethane) to a water-proof resin layer of the support.

The light-sensitive material of the present invention preferably contains, in their hydrophilic colloid layers, dyes (particularly oxonole dyes and cyanine dyes) that can be discolored by processing, as described in European Patent No. 0337490 A2, pages 27 to 76, in order to prevent irradiation or halation or to enhance safelight safety (immunity). Further, dyes described in European Patent No. 0819977 are also preferably used in the present invention.

Among these water-soluble dyes, some deteriorate color separation or safelight safety when used in an increased amount. Preferable examples of the dye which can be used and which does not deteriorate color separation include water-soluble dyes described in JP-A-5-127324, JP-A-5-127325 and JP-A-5-216185.

In the present invention, it is possible to use a colored layer that can be discolored during processing, in place of the water-soluble dye, or in combination with the water-soluble dye. The colored layer capable of being discolored with a processing to be used may contact with an emulsion layer directly, or indirectly through an interlayer containing an agent for preventing color-mixing during processing, such as hydroquinone and gelatin. The colored layer is preferably provided as a lower layer (closer to a support) with respect to the emulsion layer that develops the same primary color as the color of the colored layer. It is possible to provide colored layers independently, each corresponding to respective primary colors, at all. Alternatively, only one or some layer(s) selected optionally or arbitrarily from the above colored layers may be provided. In addition, it is possible to provide a colored layer subjected to coloring so as to match a plurality of primary-color regions. With respect to the optical reflection density of the colored layer, at the wavelength which provides the highest optical density in a range of wavelengths used for exposure (a visible light region from 400 nm to 700 nm for an ordinary printer exposure, and the wavelength of the light generated from the light source in the case of scanning exposure), the optical density at the wavelength showing a highest density of the optical densities is preferably within the range of 0.2 to 3.0, more preferably 0.5 to 2.5, and particularly preferably 0.8 to 2.0.

The colored layer described above may be formed by a known method. For example, there are a method in which a dye in a state of a dispersion of solid fine-particles is incorporated in a hydrophilic colloid layer, as described in JP-A-2-282244, from page 3, upper right column to page 8, and JP-A-3-7931, from page 3, upper right column to page 11, left under column; a method in which an anionic dye is mordanted in a cationic polymer; a method in which a dye is adsorbed onto fine grains of silver halide or the like and fixed in the layer; and a method in which a colloidal silver is used, as described in JP-A-1-239544. As to a method of dispersing fine-powder of a dye in solid state, for example, JP-A-2-308244, pages 4 to 13 describes a method in which solid fine-particles of dye which is at least substantially water-insoluble at the pH of 6 or less, but at least substantially water-soluble at the pH of 8 or more, are incorporated. The method of mordanting an anionic dye in a cationic polymer is described, for example, in JP-A-2-84637, pages 18 to 26. U.S. Pat. Nos. 2,688,601 and 3,459,563 disclose a method of preparing colloidal silver for use as a light absorber. Among these methods, preferred are the methods of incorporating fine-particles of dye and of using colloidal silver.

In the case that the present invention is applied to a color photographic paper, it is preferable that the color photographic paper has at least one yellow color-developable silver halide emulsion layer, at least one magenta color-developable silver halide emulsion layer, and at least one cyan color-developable silver halide emulsion layer. These silver halide emulsion layers are in general arranged in order of a yellow color-developable silver halide emulsion layer, a magenta color-developable silver halide emulsion layer, and a cyan color-developable silver halide emulsion layer from the side nearer to the support.

In the present invention, the silver halide color photographic light-sensitive material is preferably a reflective-type silver halide color photographic light-sensitive material and more preferably a color photographic paper.

However, it may have the layer constitution other than the above-mentioned one. In the light-sensitive material of the present invention, the silver halide emulsion layer containing a yellow coupler may be provided on any place of the support (preferably reflection support). In the case where silver halide tabular grains are contained in the yellow coupler-containing layer, it is preferable that the yellow coupler-containing layer is positioned more apart from a support than at least one of a magenta coupler-containing silver halide emulsion layer and a cyan coupler-containing silver halide emulsion layer. Further, it is preferable that the yellow coupler-containing silver halide emulsion layer is positioned most apart from a support of other silver halide emulsion layers, from the viewpoint of color-development acceleration, desilvering acceleration, and lowering of a residual color due to a sensitizing dye. Further, it is preferable that the cyan coupler-containing silver halide emulsion layer is positioned in the middle of other silver halide emulsion layers, from the viewpoint of reduction in a blix fading. On the other hand, it is preferable that the cyan coupler-containing silver halide emulsion layer is the lowest layer, from the viewpoint of reduction in a light fading. Further, each of a yellow-color-forming layer, a magenta-color-forming layer and a cyan-color-forming layer may be composed of two or three layers. It is also preferable that a color-forming layer is formed by disposing a silver halide emulsion-free layer containing a coupler, in adjacent to a silver halide emulsion layer, as described in, for example, JP-A-4-75055, JP-A-9-114035, JP-A-10-246940, and U.S. Pat. No. 5,576,159.

Preferred examples of silver halide emulsions and other materials (additives or the like) for use in the present invention, photographic constitutional layers (arrangement of the layers or the like), and processing methods for processing the photographic materials and additives for processing are disclosed in JP-A-62-215272, JP-A-2-33144 and European Patent No. 0355660 A2. Particularly, those disclosed in European Patent No. 0355660 A2 are preferably used. Further, it is also preferred to use silver halide color photographic light-sensitive materials and processing methods therefor disclosed in, for example, JP-A-5-34889, JP-A-4-359249, JP-A-4-313753, JP-A-4-270344, JP-A-5-66527, JP-A-4-34548, JP-A-4-145433, JP-A-2-854, JP-A-1-158431, JP-A-2-90145, JP-A-3-194539, JP-A-2-93641 and European Patent Publication No. 0520457 A2.

The support used in the present invention includes a reflective-type support and a transparent support.

In particular, as the above-described reflective support and silver halide emulsion, as well as the different kinds of metal ions to be doped in the silver halide grains, the storage stabilizers or antifogging agents of the silver halide emulsion, the methods of chemical sensitization (sensitizers), the methods of spectral sensitization (spectral sensitizing dyes), the cyan, magenta, and yellow couplers and the emulsifying and dispersing methods thereof, the dye stability-improving agents (stain inhibitors and discoloration inhibitors), the dyes (colored layers), the kinds of gelatin, the layer structure of the light-sensitive material, and the film pH of the light-sensitive material, those described in the patent publications as shown in the following Table 1 are preferably used in the present invention.

TABLE 1

| Element | JP-A-7-104448 | JP-A-7-77775 | JP-A-7-301895 |
|---|---|---|---|
| Reflective-type bases | Column 7, line 12 to Column 12, line 19 | Column 35, line 43 to Column 44, line 1 | Column 5, line 40 to Column 9, line 26 |
| Silver halide emulsions | Column 72, line 29 to Column 74, line 18 | Column 44, line 36 to Column 46, line 29 | Column 77, line 48 to Column 80, line 28 |
| Different metal ion species | Column 74, lines 19 to 44 | Column 46, line 30 to Column 47, line 5 | Column 80, line 29 to Column 81, line 6 |
| Storage stabilizers or antifoggants | Column 75, lines 9 to 18 | Column 47, lines 20 to 29 | Column 18, line 11 to Column 31, line 37 (Especially, mercaptoheterocyclic compounds) |
| Chemical sensitizing methods (Chemical sensitizers) | Column 74, line 45 to Column 75, line 6 | Column 47, lines 7 to 17 | Column 81, lines 9 to 17 |

TABLE 1-continued

| Element | JP-A-7-104448 | JP-A-7-77775 | JP-A-7-301895 |
|---|---|---|---|
| Spectrally sensitizing methods (Spectral sensitizers) | Column 75, line 19 to Column 76, line 45 | Column 47, line 30 to Column 49, line 6 | Column 81, line 21 to Column 82, line 48 |
| Cyan couplers | Column 12, line 20 to Column 39, line 49 | Column 62, line 50 to Column 63, line 16 | Column 88, line 49 to Column 89, line 16 |
| Yellow couplers | Column 87, line 40 to Column 88, line 3 | Column 63, lines 17 to 30 | Column 89, lines 17 to 30 |
| Magenta couplers | Column 88, lines 4 to 18 | Column 63, line 3 to Column 64, line 11 | Column 31, line 34 to Column 77, line 44 and column 88, lines 32 to 46 |
| Emulsifying and dispersing methods of couplers | Column 71, line 3 to Column 72, line 11 | Column 61, lines 36 to 49 | Column 87, lines 35 to 48 |
| Dye-image-preservability improving agents (antistaining agents) | Column 39, line 50 to Column 70, line 9 | Column 61, line 50 to Column 62, line 49 | Column 87, line 49 to Column 88, line 48 |
| Anti-fading agents | Column 70, line 10 to Column 71, line 2 | | |
| Dyes (coloring agents) | Column 77, line 42 to Column 78, line 41 | Column 7, line 14 to Column 19, line 42, and Column 50, line 3 to Column 51, line 14 | Column 9, line 27 to Column 18, line 10 |
| Gelatins | Column 78, lines 42 to 48 | Column 51, lines 15 to 20 | Column 83, lines 13 to 19 |
| Layer construction of light-sensitive materials | Column 39, lines 11 to 26 | Column 44, lines 2 to 35 | Column 31, line 38 to Column 32, line 33 |
| Film pH of light-sensitive materials | Column 72, lines 12 to 28 | | |
| Scanning exposure | Column 76, line 6 to Column 77, line 41 | Column 49, line 7 to Column 50, line 2 | Column 82, line 49 to Column 83, line 12 |
| Preservatives in developing solution | Column 88, line 19 to Column 89, line 22 | | |

In the silver halide color photographic light-sensitive material according to the invention, in a preferred embodiment at least one of the magenta dye-forming coupler(s) is a compound represented by the following formula (M-I):

Formula (M–I)

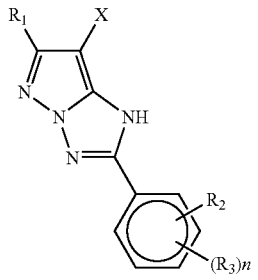

wherein, in formula (M-I), $R_1$ represents a group represented by the following formula (Q-1), (Q-2) or (Q-3); $R_2$ and $R_3$ each represent a substituent; n represents an integer of 0 to 4; X represents a hydrogen atom, or a group capable of being released by a coupling reaction with an oxidation product of a developing agent:

$$—C(R_4)(R_5)—(R_6) \qquad \text{Formula(Q-1)}$$

wherein $R_4$ represents an alkyl group, a cycloalkyl group, an aryl group or a heterocyclic group; $R_5$ and $R_6$ each represent a substituent; and at least two of $R_4$, $R_5$ and $R_6$ may be connected to form a 5- to 7-membered monocyclic or condensed ring;

$$—CH(R_7)—R8 \qquad \text{Formula(Q-2)}$$

wherein $R_7$ represents an alkyl group, a cycloalkyl group, an aryl group or a heterocyclic group; $R_8$ represents a substituent; and $R_7$ and $R_8$ may be connected to form a 5- to 7-membered monocyclic or condensed ring;

Formula (Q–3)

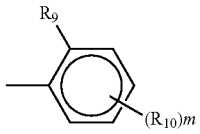

wherein $R_9$ and $R_{10}$ each represent a substituent; m represents an integer of 0 to 4; and when m is 2 or more, two or more of $R_{10}$ may be the same or different.

The compound represented by formula (M-I) is described in detail below.

$R_2$ represents an alkyl group, preferably a straight or branched alkyl group having 1 to 32 carbon atoms, such as methyl, ethyl, propyl, isopropyl, butyl, t-butyl, i-octyl, tridecyl; a cycloalkyl group, preferably having 3 to 32 carbon atoms, such as cyclopropyl, cyclopentyl, cycohexyl; an alkenyl group, preferably having 2 to 32 carbon atoms, such as vinyl, allyl, 3-butene-1-yl; an aryl group, preferably having 6 to 32 carbon atoms, such as phenyl, 1-naphthyl, 2-naphthyl; a heterocyclic group, preferably, having 1 to 32 carbon atoms, and being comprised of 5- to 8- membered ring, such as 2-thienyl, 4-pyridyl, 2-furyl, 2-pyrimidinyl, 1-pyridyl, 2-benzothiazolyl, 1-imidazolyl, 1-pyrazolyl, benzotriazole-2-yl; cyano group; a halogen atom, such as fluorine atom, chlorine atom, bromine atom; hydroxyl group; nitoro group; carboxy group; an alkoxy group, preferably having 1 to 32 carbon atoms, such as methoxy, ethoxy, 1

-butoxy, 2-butoxy, isopropoxy, t-butoxy, dodecylocy; a cycloalkyloxy group, preferably having 3 to 32 carbon atoms, such as cyclopentyloxy, cyclohexyloxy; an aryloxy group, preferably having 6 to 32 carbon atoms, such as phenoxy, 2-naphthoxy; a heterocyclic oxy group, preferably having 1 to 32 carbon atoms, such as 1 -phenyltetrazole-5-oxy, 2-tetrahydropyranyloxy, 2-furyloxy; a silyloxy group, preferably having 1 to 32 carbon atoms, such as trimethylsilyloxy, t-butyldimethylsilyloxy, diphenylmethylsilyloxy; an acyloxy group, preferably having 2 to 32 carbon atoms, such as acetoxy, pivaloyloxy, benzoyloxy, dodecanoyloxy; an alkoxycarbonyloxy group, preferably having 2 to 32 carbon atoms, such as ethoxycarbonyloxy, t-butoxycarbonyloxy; a cycloalkoxycarbonyloxy group, preferably having 4 to 32 carbon atoms, such as cyclohexyloxycarbonyloxy; an aryloxycarbonyloxy group, preferably having 7 to 32 carbon atoms, such as phenoxycarbonyloxy; a carbamoyloxy group, preferably having 1 to 32 carbon atoms, such as N,N-dimethylcarbamoyloxy, N-butylcarbamoyloxy; a sulfamoyloxy group, preferably having 1 to 32 carbon atoms, such as N,N-diethylsulfamoyloxy, N-propylsulfamoyloxy; an alkanesulfonyloxy group preferably having 1 to 32 carbon atoms, such as methanesulfonyloxy, hexadecanesulfonyloxy; an arenesulfonyloxy group, preferably having 6 to 32 carbon atoms, such as benzenesulfonyloxy; an acyl group, preferably having 1 to 32 carbon atoms, such as formyl, acetyl, pivaloyl, benzoyl, tetradecanoyl; an alkoxycarbonyl group, preferably having 2 to 32 carbon atoms, such as methoxycarbonyl, ethoxycarbonyl, octadecyloxycarbonyl; a cycloalkyloxycarbonyl group, preferably having 2 to 32 carbon atoms, such as cyclohexyloxycarbonyl; an aryloxycarbonyl group, preferably having 7 to 32 carbon atoms, such as phenoxycarbonyl; a carbamoyl group, preferably having 1 to 32 carbon atoms, such as carbamoyl, N,N-dibutylcarbamoyl, N-ethyl-N-octylcarbamoyl, N-propylcarbamoyl; an amino group, preferably having 32 carbon atoms or less, such as amino, methyamino, N,N-dioctylamino, tetradecylamino, octadecylamino; an anilino group, preferably having 6 to 32 carbon atoms, such as anilino, N-methylanilino; a heterocyclic amino group, preferably 1 to 32 carbon atoms, such as 4-pyridylamino; a carbonamido group, preferably having 2 to 32 carbon atoms, such as acetoamido, benzamido, tetradecanamido; a ureido group, preferably having 1 to 32 carbon atoms, such as ureido, N,N-dimethylureido, N-phenylureido; an imido group, preferably having 10 carbon atoms or less, such as N-succinimido, N-phthalimido; an alkoxycarbonylamino group, preferably having 2 to 32 carbon atoms, such as methoxycarbonylamino, ethoxycarbonylamino, t-butoxycarbonylamino, octadecyloxycarbonylamino; an aryloxycarbonylamino group, preferably having 7 to 32 carbon atoms, such as phenoxycarbonylamino; a sulfonamido group, preferably having 1 to 32 carbon atoms, such as methanesulfonamido, butanesulfonamido, benzenesulfonamido, hexadecanesulfonamido; a sulfamoylamino group, preferably having 1 to 32 carbon atoms, such as N,N-dipropylsulfamoylamino, N-ethyl-N-dodecylsulfamoylamino; an azo group, preferably having 1 to 32 carbon atoms, such as phenylazo; an alkylthio group, preferably having 1 to 32 carbon atoms, such as ethylthio, octylthio; an arylthio group, preferably having 6 to 32 carbon atoms, such as phenylthio; a heterocyclicthio group, preferably having 1 to 32 carbon atoms, such as 2-benzothiazolylthio, 2-pyridylthio, 1-phenyltetrazolylthio; an alkylsufinyl group, preferably having 1 to 32 carbon atoms, such as dodecanesulfinyl; an arenesulfinyl group, preferably having 6 to 32 carbon atoms, such as benzenesulfinyl; an alkanesulfonyl group, preferably having 1 to 32 carbon atoms, such as methanesulfonyl, octanesulfonyl; an arenesulfonyl group, preferably having 6 to 32 carbon atoms, such as benzenesulfonyl, 1-naphthlenesulfonyl; a sulfamoyl group, preferably having 32 carbon atoms or less, such as sulfamoyl, N,N-dipropylsulfamoyl, N-ethyl-N-dodecylsulfamoyl; a sulfo group; a phosphonyl group, preferably having 1 to 32 carbon atoms, such as phenoxyphosphonyl, octyloxyphosphonyl, phenylphosphonyl.

$R_3$ represents a group having the same meaning as that for $R_2$.

In the group represented by formula (Q-1), $R_4$ represents a straight or branched alkyl group having 1 to 32 carbon atoms, or an aryl group having 6 to 32 carbon atoms. The examples for the alkyl groups and the aryl groups are the same as those defined for $R_2$. $R_5$ and $R_6$ each represent the same groups as those for $R_2$. At least two groups of $R_4$, $R_5$ and $R_6$ may be connected to form 5- to 7-membered carbocyclic or heterocyclic ring (monocyclic or condensed ring) which is described later.

In the groups represented by the formula (Q-2), $R_7$ represents the same groups as those of $R_4$ in the formula (Q-1), $R_8$ represents the same groups as those of $R_2$, and $R_7$ and $R_8$ may be connected each other to form 5- to 7-membered carbocyclic or heterocyclic ring (monocyclic or condensed ring) which is described later.

In the groups represented by the formula (Q-3), $R_9$ has the same meanings as $R_{10}$.

X represents hydrogen atom or a group capable of being released by a reaction with an oxidized product of developing agent. Examples of the group capable of being released which is represented by X include halogen atom, an alkoxy group, an aryloxy group, an acyloxy group, a carbamoyloxy group, a sulfonyloxy group, a carbonamido group, a sulfonamido group, a carbamoylamino group, a heterocyclic group, an arylazo group, an alkylthio group, an arylthio group and a heterocyclicthio group. The preferable ranges and examples of the group represented by X are the same as those disclosed for $R_2$. Other than the groups, X may be a bis-type coupler connected to two molecules of 4-equivalent coupler via aldehyde or ketone group. Further, X may be a photographically effective group or precursor thereof, such as a group effective as a development accelerator, a group as a development inhibitor, a group as a desilvering accelerator, a group as a leuco dye, etc.

$R_1$, $R_2$, $R_3$ and X each may have a substituent. Preferable substituent thereof includes a halogen atom, an alkyl group, a cycloalkyl group, an alkenyl group, an aryl group, a heterocyclic group, cyano group, hydroxyl group, nitro group, an alkoxy group, an aryloxy group, a heterocyclic oxy group, silyloxy group, an acyloxy group, an alkoxycarbonyloxy group, cycloalkyloxycarbonyloxy group, an aryloxycarbonyloxy group, a carbamoyloxy group, sulfamoyloxy group, an alkanesulfonyloxy group, an arenesulfonyloxy group, carboxy group, an acyl group, an alkoxycarbonyl group, cycloalkyloxycarbonyl group, an aryloxycarbonyl group, carbamoyl group, amino group, anilino group, a heterocyclicamino group, carbonamido group, an alkoxycarbonylamino group, an aryloxycarbonylamino group, ureido group, sulfonamido group, sulfamoylamino group, imido group, an alkylthio group, an arylthio group, a heterocyclicthio group, sulfinyl group, sulfo group, an alkanesulfonyl group, arenesulfonyl group, sulfamoyl group, phosphonyl group.

The compound represented by the formula (M-I) may form dimers or other polymers via $R_1$, $R_2$, $R_3$ and X.

Preferable compounds represented by the formula (M-I) are disclosed in detail. In the formula (Q-1), $R_1$ is preferably an alkyl group. Of groups represented by $R_5$ and $R_6$, an alkyl group, a cycloalkyl group, an aryl group, hydroxyl group, an alkoxy group, an aryloxy group, amino group, anilino group, a carbonamido group, ureido group, sulfonamido group, sulfamoylamino group, imido group, an alkylthio group and an arylthio group are preferable. Of them, alkyl group, cycloalkyl group, and aryl group are more preferred, and alkyl group is most preferred.

In the formula (Q-2), $R_7$ is preferably an alkyl group, a cycloalkyl group or an aryl group. Of them, secondary or tertiary alkyl group and cycloalkyl group are more preferred. $R_8$ is preferably an alkyl group, a cycloalkyl group or an aryl group, and of them alkyl group and cycloalkyl group are more preferred.

In the formula (Q-3), $R_9$ and $R_{10}$ each are preferably a halogen atom, an alkyl group a cycloalkyl group, an aryl group, an alkoxy group, an aryloxy group, an acyl group, an alkoxycarbonyl group, a cycloalkyloxycarbonyl group, an aryloxycarbonyl group, carbamoyl group, amino group, anilino group, carbonamido group, an alkoxycarbonylamino group, an aryloxycarbonylamino group, ureido group, sulfonamido group, sufamoylamino group, imido group, an alkylthio group, an arylthio group, heterocyclicthio group, sulfinyl group, an alkanesulfonyl group, an arenesulfonyl group, sulfamoyl group, phosphonyl group. Of them, halogen atom, alkyl group, cycloalkyl group, aryl group, alkoxy group, aryloxy group, amino group, anilino group, carbonamido group, ureido group sufonamido group, sulfamoylamino group, alkylthio group, and arylthio group are more preferred, and alkyl group, cycloalkyl group, aryl group, alkoxy group, aryloxy group, alkylthio group and arylthio group are most preferred. m is preferably an integer of 0 to 3, and more preferably an integer of 1 or 2. $R_9$ is more preferably substituted at an ortho-position of phenyl group.

$R_1$ is preferably a group represented by the formula (Q-1) or (Q-3), and more preferably the formula (Q-1). Of them, $R_1$ is preferably a group in which $R_1$, $R_5$ and $R_6$ in the formula (Q-1) each are an alkyl group, and more preferably $R_1$ is t-butyl group. Preferable examples of the group represented by $R_1$ are given below. They are, however, by no means limitative of the scope of the present invention.

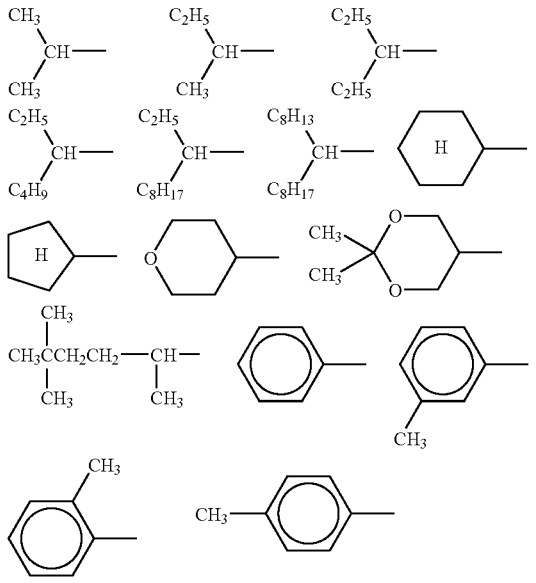

-continued

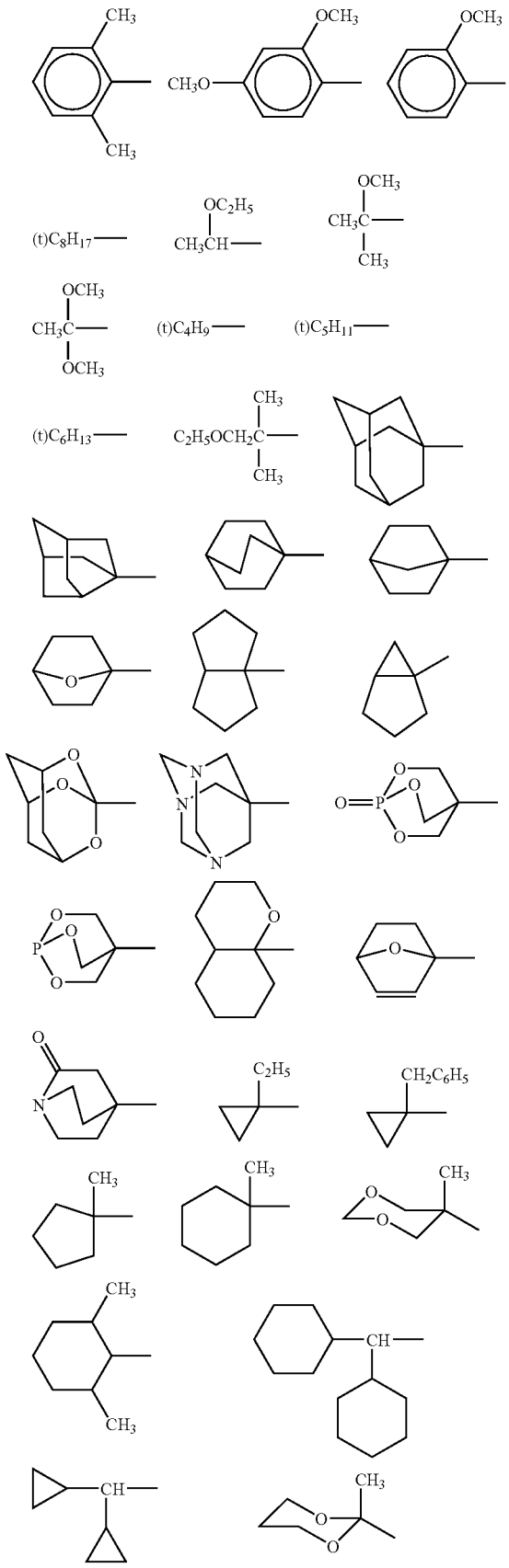

-continued

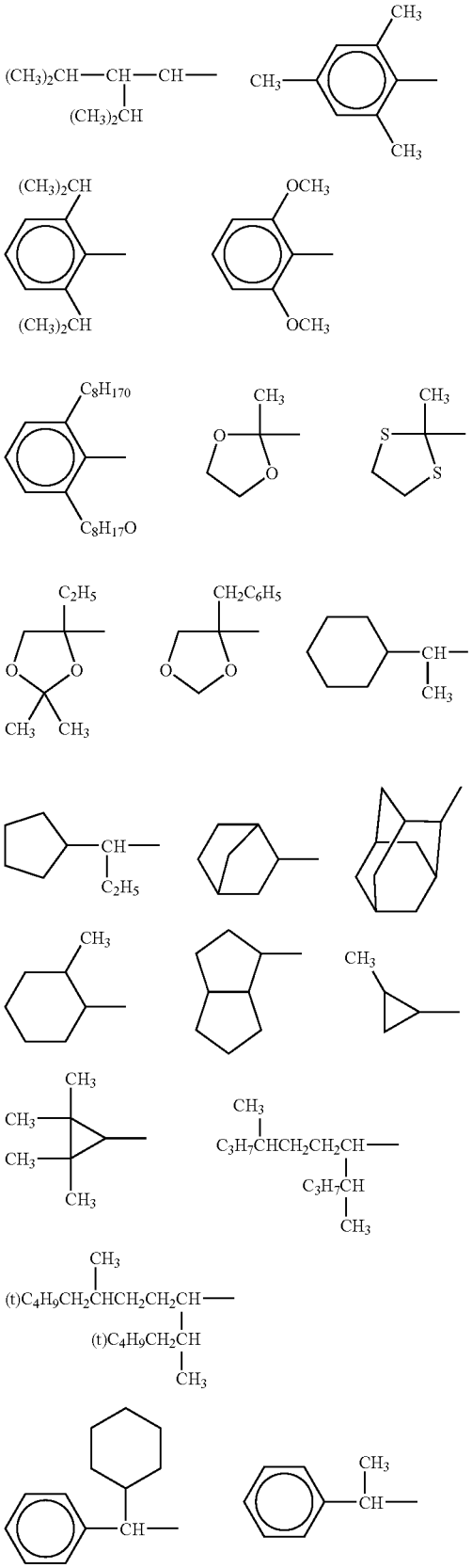

-continued

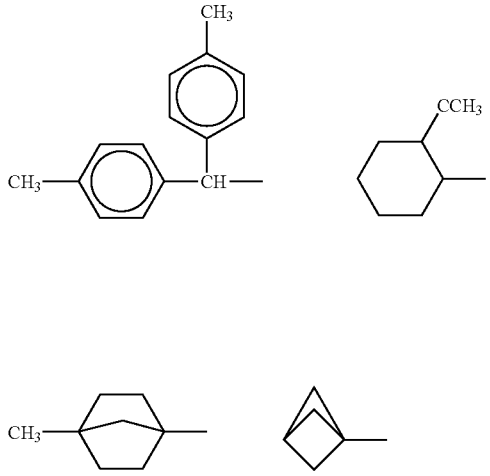

$R_2$ is preferably an alkoxy group, an aryloxy group, an acyloxy group, an alkoxycarbonyloxy group, a cycloalkyloxycarbonyloxy group, an aryloxycarbonyloxy group, carbamoyloxy group, sulfamoyloxy group, an alkanesufonyloxy group, an arenesulfonyloxy group, acyl group, an alkoxycarbonyl group, a cycloalkyloxycarbonyl group, an aryloxycarbonyl group, carbamoyl group, amino group, anilino group, carbonamido group, an alkoxycarbonylamino group, an aryloxycarbonylamino group, ureido group, sulfonamido group, sulfamoylamino group, imido group, an alkylthio group, an arylthio group, a heterocyclicthio group, an alkanesulfonyl group, an arenesulfonyl group or sulfamoyl group, and more preferably an alkoxy group, an aryloxy group, acyl group, an alkoxycarbonyl group, a cycloalkyloxycarbonyl group, an aryloxycarbonyl group, carbamoyl group, amino group, anilino group, carbonamido group, an alkoxycarbonylamino group, an aryloxycarbonylamino group, ureido group, sulfonamido group, sulfamoylamino group, imido group, an alkylthio group, an arylthio group or sulfamoyl group. $R_2$ is preferably substituted at meta- or para-position to a carbon atom connected to pyrazolotriazole ring, and more preferably at para-position $R_3$ is preferably fluorine atom, chlorine atom, bromine atom, an alkyl group, a cycloalkyl group, an aryl group, a heterocyclic group, cyano group, hydroxyl group, nitro group, an alkoxy group, an aryloxy group, carboxy group, an acyl group, an alkoxycarbonyl group, an cycloalkyloxycarbonyl group, an aryloxycarbonyl group, carbamoyl group, amino group, anilino group, carbonamido group, an alkoxycarbonylamino group, an aryloxycarbonylamino group, ureido group, sufonamido group, sufamoylainino group, imido group, an alkylthio group, an arylthio group, a heterocyclic thio group, sulfinyl group, sulfo group, an alkanesulfonyl group, an arenesulfonyl group, sulfamoyl group or phosphonyl group. n preferably represents an integer of 0 to 3, and more preferably 0 or 1.

X is preferably hydrogen atom, chlorine atom, bromine atom, an aryloxy group, an alkylthio group, an arylthio group, a heterocyclic thio group, or a heterocyclic group, more preferably chlorine atom, an aryloxy group, and most preferably chlorine atom. Preferable examples of the group represented by X are given below. They are, however, by no means limitative in the scope of the present invention.

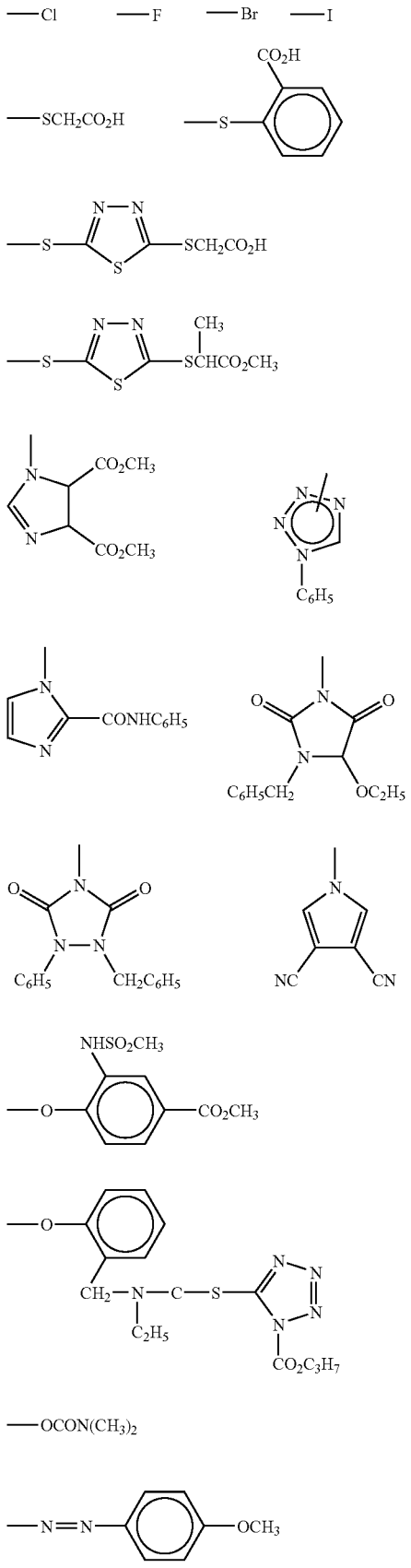
-continued
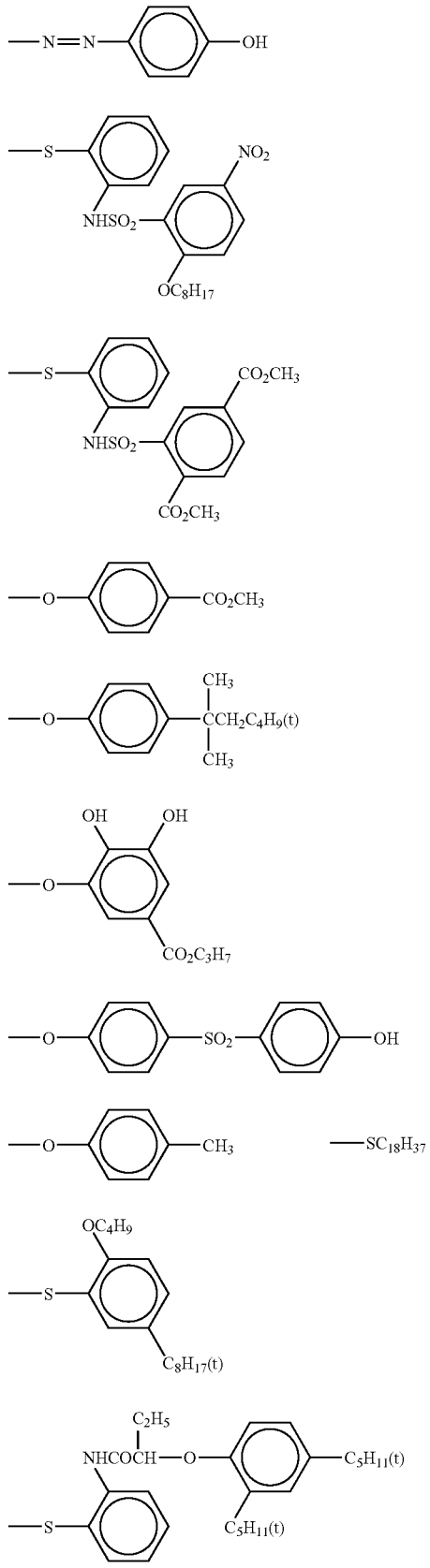

-continued

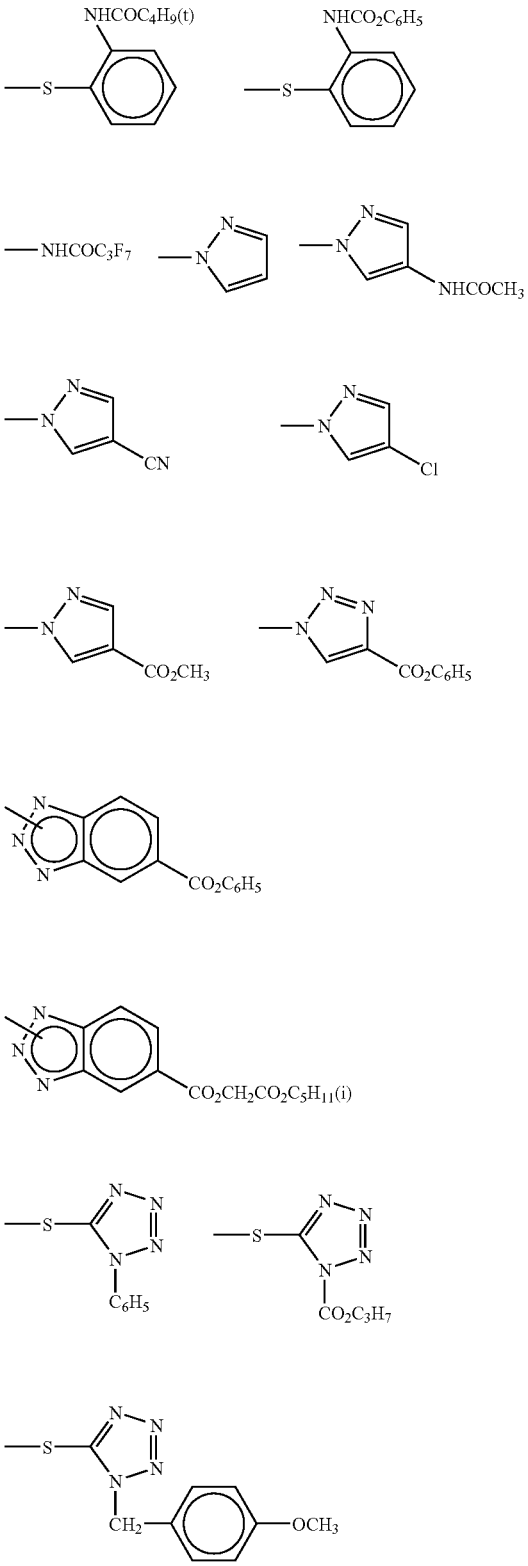

Of the compounds represented by the formula (M-I), compounds represented by the formula (M-II) are more preferred and compounds represented by the formula (M-III) are most preferred.

Formula (M–II)

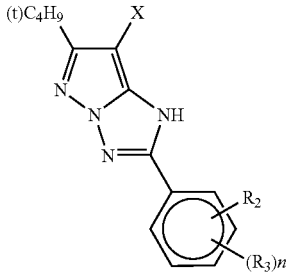

wherein $R_2$, $R_3$, n and X have the same meanings as those in the formula (M-I), respectively.

Formula (M–III)

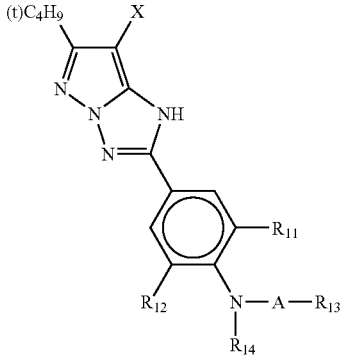

wherein $R_{11}$ and $R_{12}$ each represent hydrogen atom or a substituent, A represents —CO— or —$SO_2$-, $R_{13}$ represents an alkyl group, an aryl group, an alkoxy group, an alkylamino group, or anilino group, $R_{14}$ represents hydrogen atom, an alkyl group, an aryl group, an acyl group, an alkanesulfonyl group, or arenesulfonyl group, X represents hydrogen atom or a group capable of being released by a coupling reaction with an oxidation product of developing agent, and $R_{13}$ and $R_{14}$ may be connected each other to form a 5- to 7-membered ring.

In the formula (M-III), $R_{11}$ and $R_{12}$ each are preferably hydrogen atom, fluorine atom, chlorine atom, bromine atom, an alkyl group, a cyclolkyl group, an aryl group, a heterocylic group, cyano group, hydroxyl group, nitro group, an alkoxy group, an aryloxy group, carboxy group, an acyl group, an alkoxycarbonyl group, a cycloalkyloxycarbonyl group, an aryloxycarbonyl group, carbamoyl group, amino group, anilino group, carbonamido group, an alkoxycarbonylamino group, an aryloxycarbonylamino group, ureido group, sulfonamido group, sulfamoylamino group, imido group, an alkylthio group, an arylthio group, a heterocyclic thio group, sulfinyl group, sulfo group, an alkanesulfonyl group, an arenesulfonyl group, sulfamoyl group, or phosphonyl group. $R_{13}$ is preferably an alkyl group or an aryl group, and $R_{14}$ is hydrogen atom or an alkyl group. A is more preferably —CO—. X is preferably hydrogen atom, chlorine atom, bromine atom, an aryloxy group, an alkylthio group, an arylthio group, a heterocyclicthio group, or a heterocyclic group, more preferably chlorine atom or an aryloxy group, and most preferably chlorine atom.

Examples of the pyrazolotriazole magenta coupler of formula (M-I) that can used in the present invention are given below. They are, however, by no means limitative in the scope of the present invention.

M-1
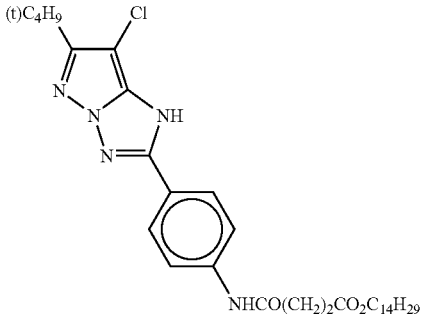
M-2
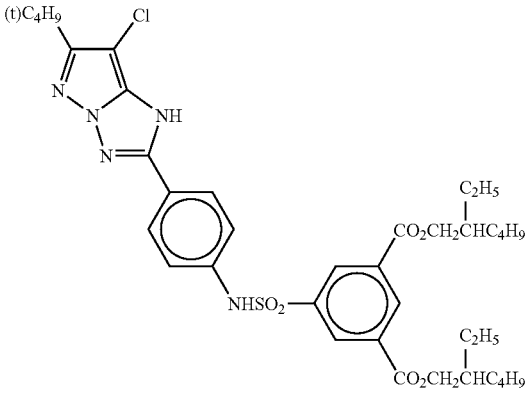
M-3
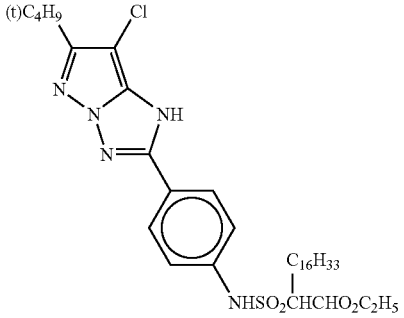
M-4
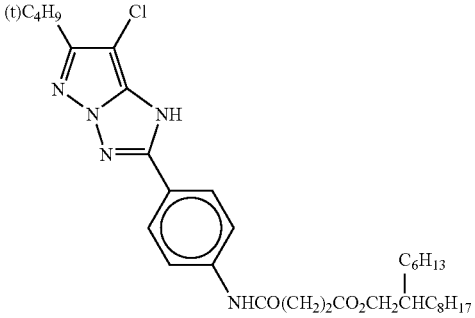
M-5
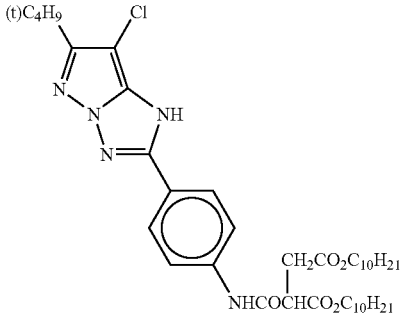
M-6
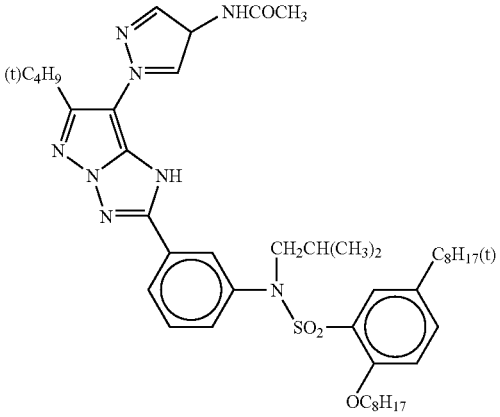
M-7
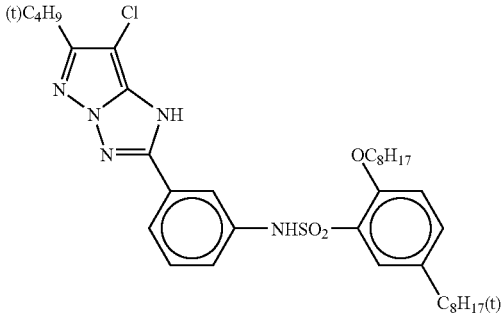
M-8
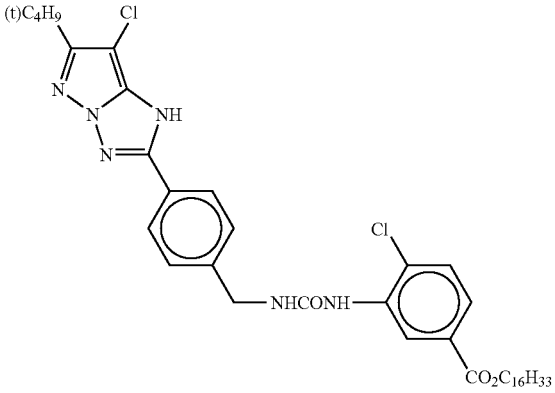

-continued
M-9
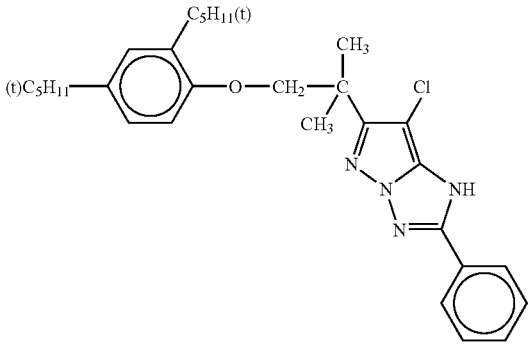
M-10
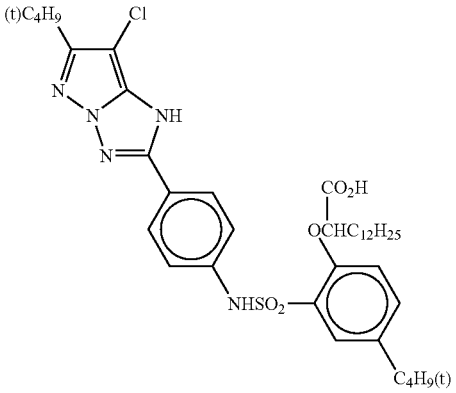
M-11
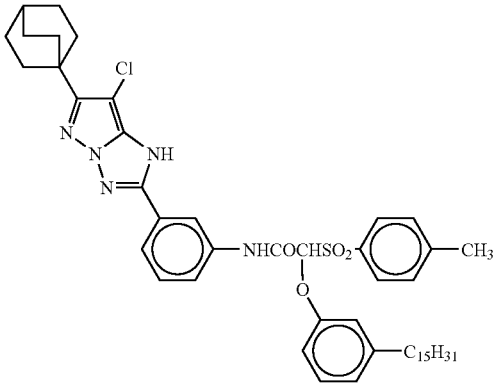
M-12
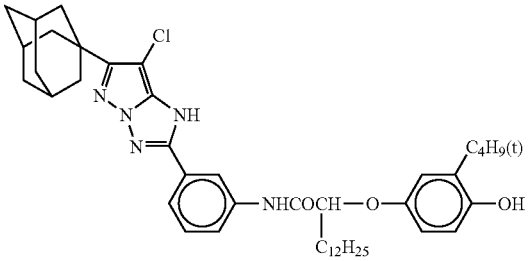
M-13
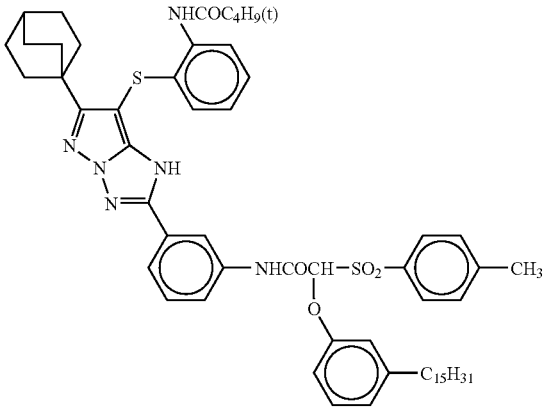
M-14
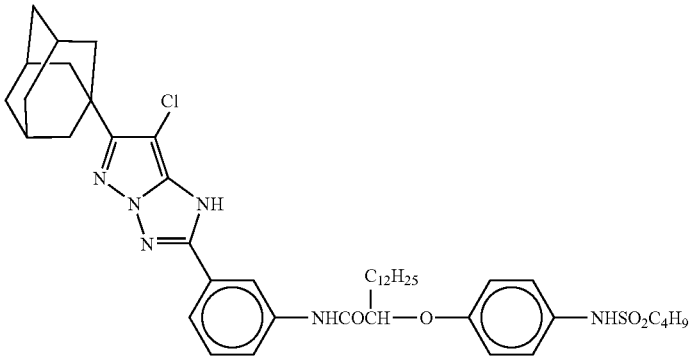

-continued
M-15
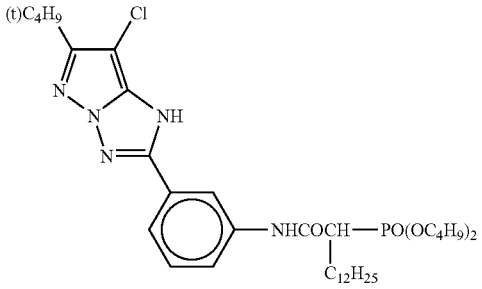
M-16
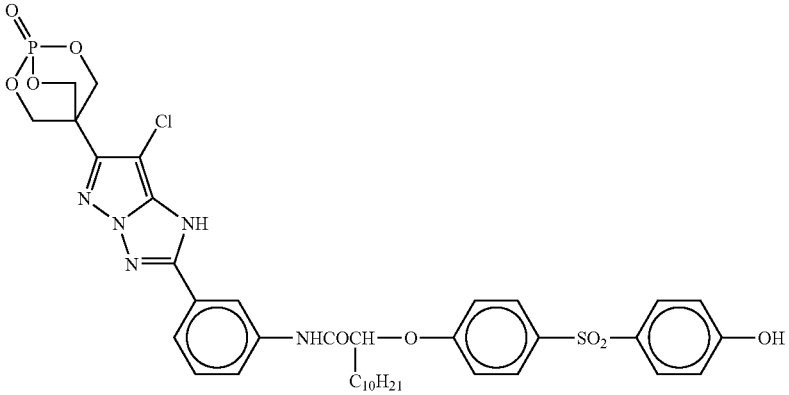
M-17
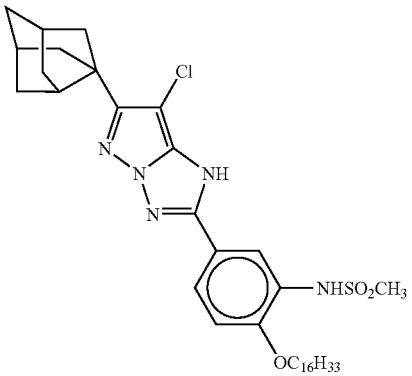
M-18
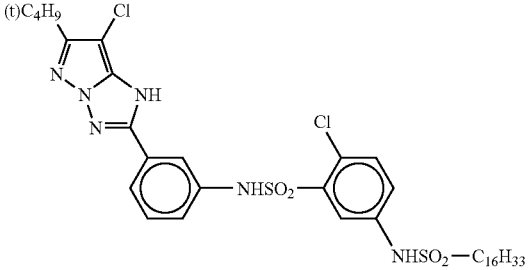

-continued
M-19
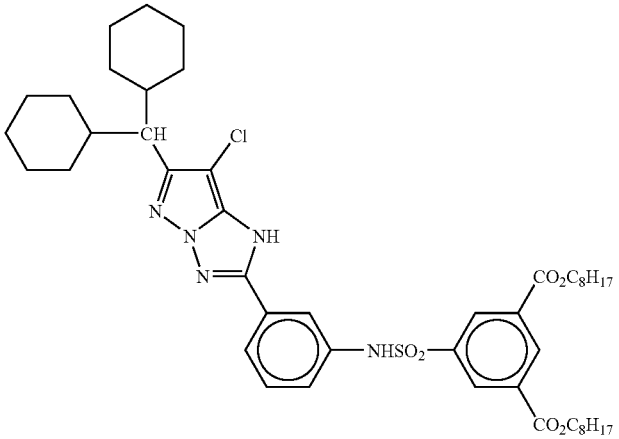
M-20
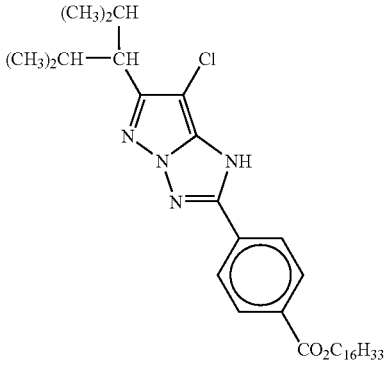
M-21
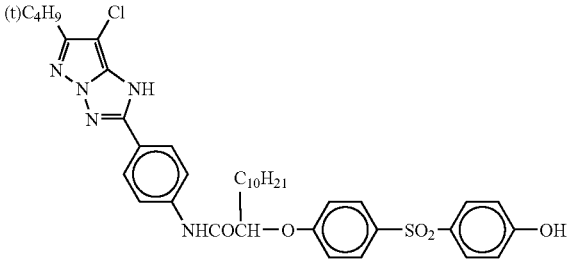
M-22
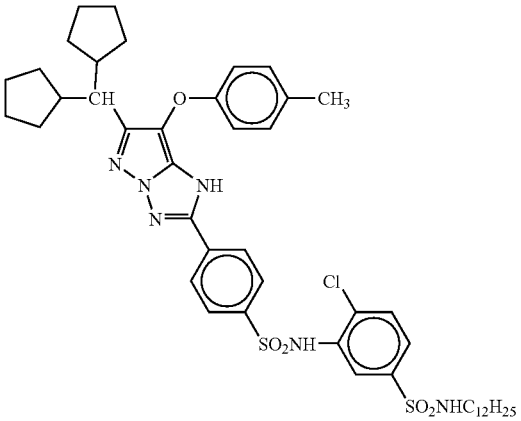

-continued
M-23
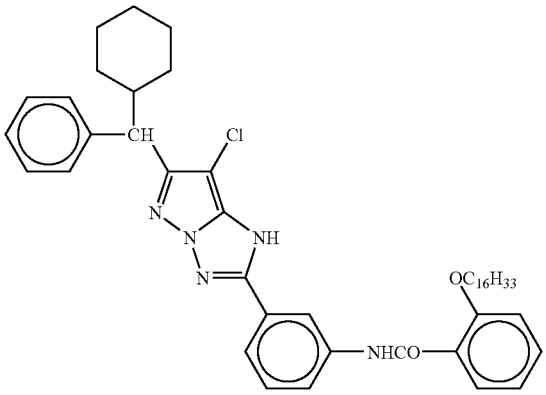
M-24
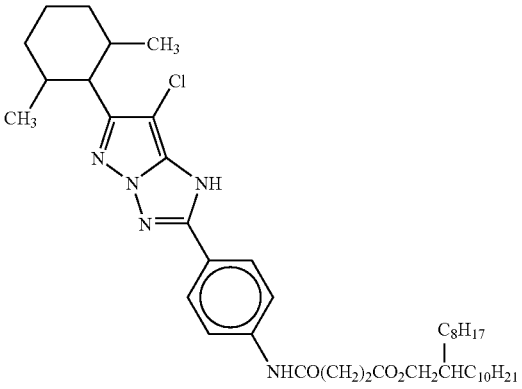
M-25
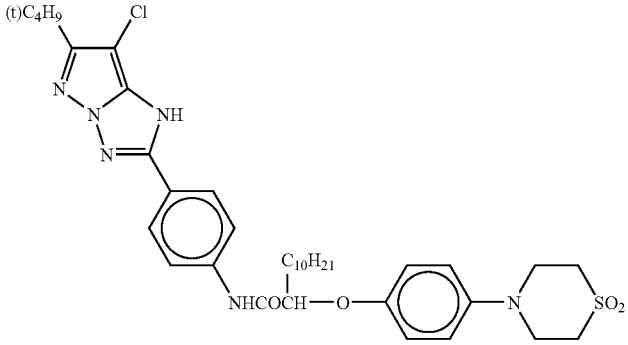
M-26
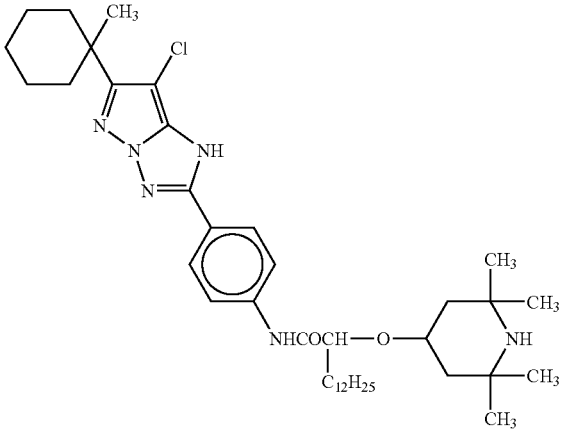
M-27
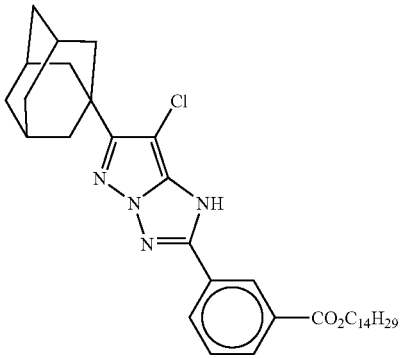
M-28
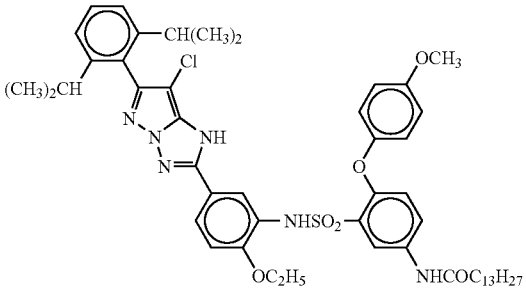

-continued
M-29
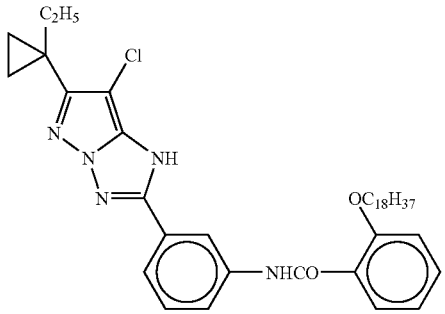
M-30
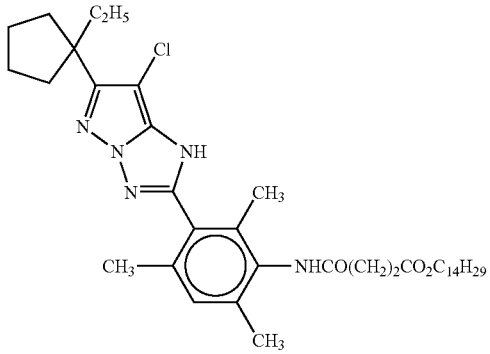
M-31
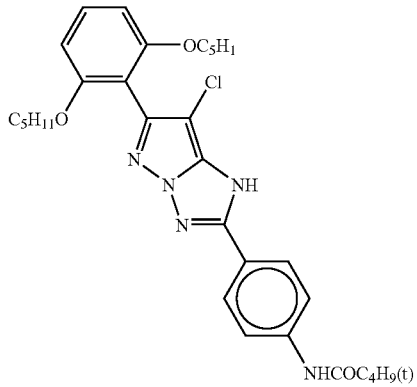
M-32
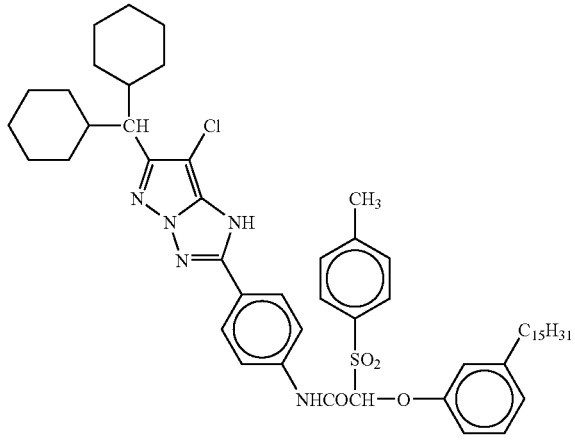

-continued
M-33
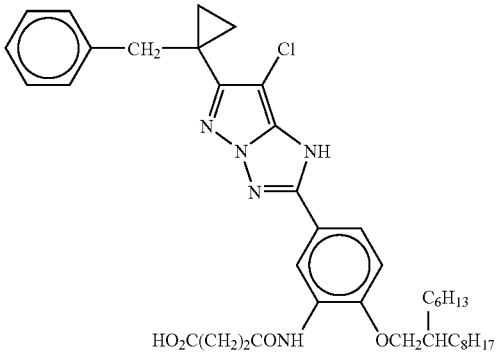
M-34
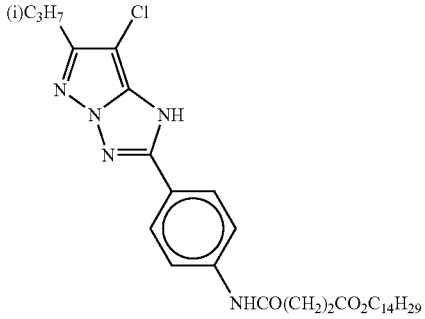
M-35
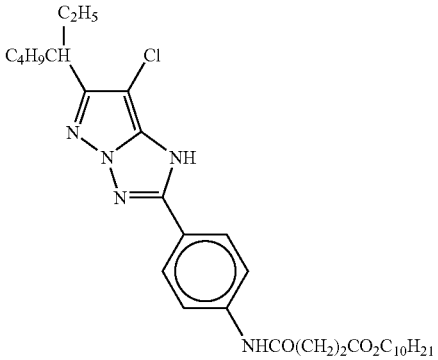
M-36
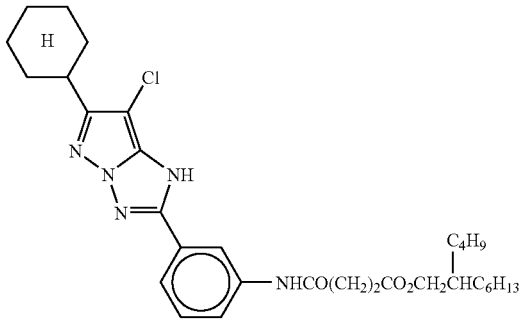
M-37
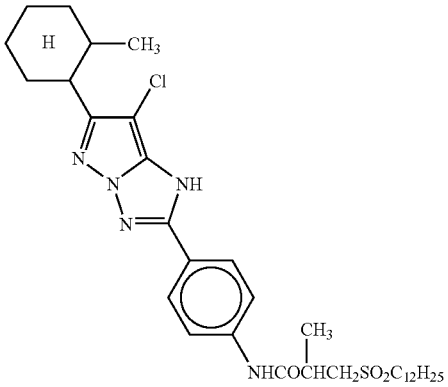
M-38
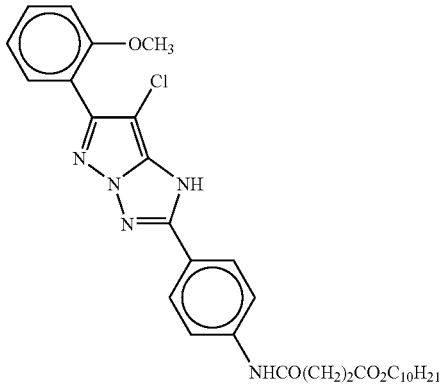
M-39
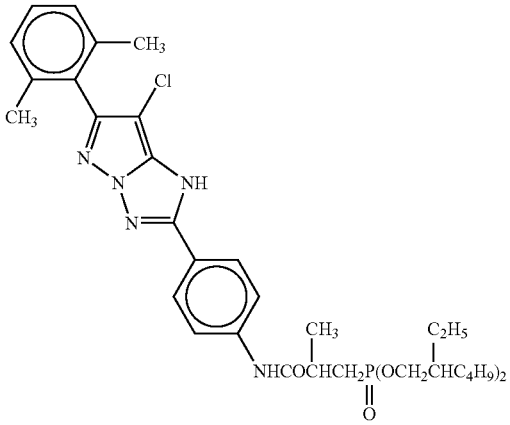
M-40
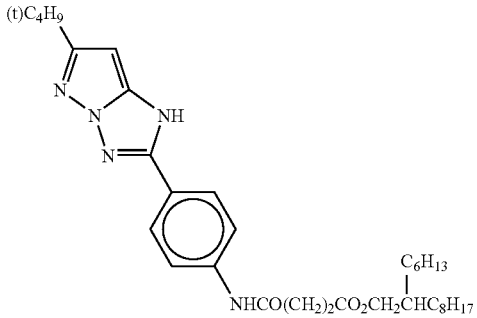

-continued

M-41

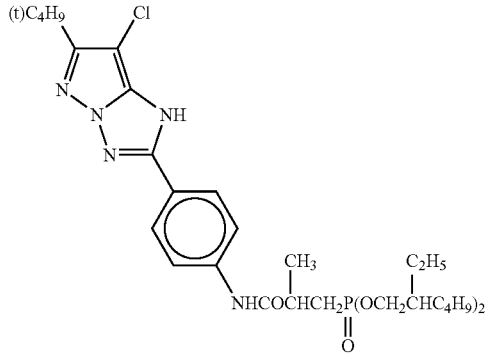

M-42

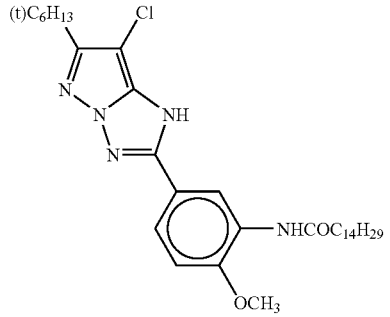

M-43

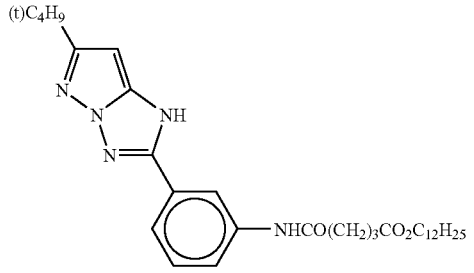

M-44

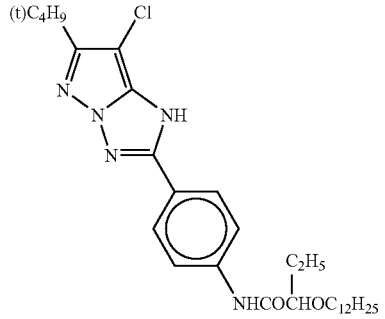

M-45

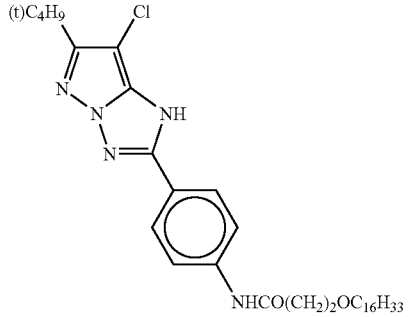

The pyrazolotriazole magenta coupler represented by the formula (M-I) is preferably contained in the silver halide emulsion layer containing high silver chloride content-emulsion grains having 95 mol % or more of silver chloride and compound represented by the formula (1). The coupler is preferably contained in an amount of about 0.1 mol to about 2 mol, and more preferably about 0.2 mol to about 1.2 mol per mol of silver halide in the same layer.

As magenta couplers that can be used together with the coupler of formula (M-I) disclosed above in the photographic material of the present invention, mentioned are 5-pyrazolone-series magenta couplers and pyrazoloazole-series magenta couplers, such as those described in the above-mentioned patent publications. In particular, especially preferred to be used are pyrazolotriazole couplers in which a secondary or tertiary alkyl group is directly bonded to the 2, 3 or 6-position of the pyrazototriazole ring, such as those described in JP-A 6 1-65245; pyrazoloazole couplers having a sulfonamido group in the molecule, such as those described in JP-A 61-65246; pyrazoloazole couplers having an alkoxyphenylsulfonamido ballast group, such as those described in JP-A 61-147254; and pyrazoloazole couplers having a 6-positioned alkoxy or aryloxy group, such as those described in European Patents 226,849A and 294,785A, in view of the color hue and the stability of images to be formed therefrom and of the coloring property of themselves.

As other yellow couplers which can be used in combination in the present invention, as other cyan couplers which can be used in combination in the first embodiment of the present invention or which can used in the second to fourth embodiments of the present invention, and as other magenta couplers which can be used in combination in the second embodiment of the present invention or which can be used in the first, third and fourth embodiments of the present invention, those disclosed in JP-A-62-215272, page 91, right upper column, line 4 to page 121, left upper column, line 6; JP-A-2-33144, page 3, right upper column, line 14 to page 18, left upper column, bottom line, and page 30, right upper column, line 6 to page 35, right under column, line 11 and; European Patent No. 0355,660 (A2), page 4, lines 15 to 27, page 5 line 30 to page 28, bottom line, page 45 lines 29 to 31, page 47, line 23 to page 63, line 50, are also advantageously used.

Further, it is preferred for the present invention to add compounds represented by formula (II) or (III) in WO 98/33760 or compounds represented by formula (D) described in JP-A-10-221825.

In the first embodiment of the present invention, as other cyan and yellow couplers which can be used in combination, and in the present invention, as other magenta couplers which can be used, those disclosed in JP-A-62-215272, page 91, right upper column, line 4 to page 121, left upper column, line 6; JP-A-2-33144, page 3, right upper column, line 14 to page 18, left upper column, bottom line, and page 30, right upper column, line 6 to page 35, right under column, line 11 and; European Patent No. 0355,660 (A2), page 4, lines 15 to 27, page 5, line 30 to page 28, bottom line, page 45, lines 29 to 31, page 47, line 23 to page 63, line 50, are also advantageously used.

Further, it is preferred for the present invention to add compounds represented by formula (II) or (III) in WO 98/33760 or compounds represented by formula (D) described in JP-A-10-221825.

The cyan color-forming coupler (sometimes referred to simply as "cyan coupler") represented by formula (A), used in the first embodiment of the present invention, can be used alone or in combination. The cyan color-forming coupler which can be used in combination in the first embodiment of the present invention or which can be used in the second to fourth embodiments is preferably pyrrolotriazole-series coupler, more preferably couplers represented by formula (I) or (II) in JP-A-5-313324 and formula (I) in JP-A-6-347960 and exemplified couplers described in these documents.

The cyan coupler used in the present invention is preferably a phenol-series or naphthol-series cyan coupler, or a heterocyclic coupler.

The phenol or naphthol coupler is preferably, for example, the cyan coupler represented by formula (ADF), as described in JP-A-10-333297, as well as any coupler in the above-mentioned table.

As the other cyan coupler than the above-mentioned, the followings are preferred: pyrroloazole-type cyan couplers described in EP 0488248 and EP 0491197A1, 2,5-diacylaminophenol coupler described in U.S. Pat. No. 5,888,716, and pyrazoloazole-type cyan couplers having a hydrogen bond group or an electron withdrawing group at its 6 position, as described in U.S. Pat. No. 4,873,183 and No. 4,916,051, particularly preferably pyrazoloazole-type cyan couplers having a carbamoyl group at its 6 position, as described in JP-A-8-171185, JP-A-8-311360 and JP-A-8-339060.

In addition, the coupler of the present invention can also be used in combination with a diphenylimidazole-series cyan coupler described in JP-A-2-33144; a 3-hydroxypyridine-series cyan coupler (particularly a 2-equivalent coupler formed by allowing a coupler (42) of a 4-equivalent coupler to have a chlorine splitting-off group, and couplers (6) and (9), enumerated as specific examples are preferable) described in EP 0333185 A2; a cyclic active methylene-series cyan coupler (particularly couplers 3, 8, and 34 enumerated as specific examples are preferable) described in JP-A-64-32260; a pyrrolopyrozole-type cyan coupler described in European Patent No. 0456226 A1; or a pyrroloimidazole-type cyan coupler described in European Patent No. 0484909.

Among these cyan couplers, pyrroloazole-series cyan couplers represented by formula (I), as described in JP-A-11-282138, are particularly preferred. The descriptions in paragraph Nos. 0012 to 0059 of this publication, as well as the exemplified cyan couplers (1) to (47), can be applied to the present invention, and are preferably incorporated herein by reference.

As the magenta coupler (the magenta color-forming coupler) that can be used in combination in the second embodiment of the present invention or that can be used in the first, third and fourth embodiment of the present invention, use can be made of a 5-pyrazolone-series magenta coupler or a pyrazoloazole-series magenta coupler, such as those described in the above-mentioned patent publications in the above Table. Among these, preferred are pyrazolotriazole couplers in which a secondary or tertiary alkyl group is directly bonded to the 2-, 3- or 6-position of the pyrazolotriazole ring, as described in JP-A-61-65245; pyrazoloazole couplers having a sulfonamido group in its molecule, as described in JP-A-61-65246; pyrazoloazole couplers having an alkoxyphenylsulfonamido ballasting group, as described in JP-A-61-147254; and pyrazoloazole couplers having an alkoxy or aryloxy group on its 6-position, as described in European Patent Nos. 0226849 A and 0294785 A, in view of the hue and stability of image to be formed therefrom and color-forming property of the couplers.

Particularly as the magenta coupler, pyrazoloazole couplers represented by formula (M-I), as described in JP-A-8-122984, are preferred. The descriptions of paragraph Nos. 0009 to 0026 of the patent publication can be entirely applied to the present invention and therefore are incorporated herein by reference.

In addition, pyrazoloazole couplers having a steric hindrance group at both the 3- and 6-positions, as described in European Patent Nos. 854384 and 884640, and JP-A-2000-147725 and JP-A-2001-356455, are also preferably used.

Further, the compounds represented by the formula (I) or (II) of the present invention may be used alone or in combination. As the yellow coupler (the yellow color-forming coupler) being able to use in combination, the following compounds can be used as necessary in addition to the compounds as described in the above Table. As the yellow coupler, there are also preferably acylacetamide-type yellow couplers in which the acyl group has a 3-membered to 5-membered cyclic structure, as described in European Patent No. 0 447 969 A1; malondianilide-type yellow couplers having a cyclic structure, as described in European Patent No. 0482552 A1; pyrrole-2 or 3-yl or indole-2 or 3-ylcarbonylacetic anilide-series couplers, as described in European Patent Nos. 953 870 A1, 953 871 A1, 953 872 A1, 953 873 A1, 953 874 A1 and 9 538 754 A1; acylacetamide-type yellow couplers having a dioxane structure, as described in U.S. Pat. No. 5,118,599, in addition to the compounds described in the above-mentioned table. Above all, acylacetamide-type yellow couplers in which the acyl group is a 1-alkylcyclopropane-1-carbonyl group, and malondianilide-type yellow couplers in which one of the anilido groups constitutes an indoline ring are especially preferably used. These couplers may be used singly or as combined.

It is preferred that the coupler for use in the present invention is also pregnated into a loadable latex polymer (described, for example, in U.S. Pat. No. 4,203,716) in the presence (or absence) of the above high boiling point organic solvent described in Table mentioned above, or the coupler is dissolved in the presence (or absence) of the foregoing high boiling point organic solvent with a polymer insoluble in water but soluble in an organic solvent, and then the resultant coupler is emulsified and dispersed into an aqueous hydrophilic colloid solution.

The water-insoluble but organic solvent-soluble polymers which can be preferably used, include the homo-polymers and co-polymers disclosed in U.S. Pat. No. 4,857,449, from column 7 to column 15, and WO 88/00723, from page 12 to page 30. The use of methacrylate-series or acrylamide-series polymers is more preferable, and especially the use of acrylamide-series polymers is further preferable, in view of color image stabilization and the like.

In the present invention, known color mixing-inhibitors may be used. Among these compounds, those described in the following patent publications are preferred.

For example, high-molecular-weight redox compounds described in JP-A-5-333501; phenidone- or hydrazine-series compounds as described in, for example, WO 98/33760 and U.S. Pat. No. 4,923,787; and white couplers as described in, for example, JP-A-5-249637, JP-A-10-282615 and German Patent No. 19629142 A1, may be used. Further, in order to accelerate developing speed by increasing the pH of a developing solution, redox compounds described in, for example, German Patent Nos. 19,618,786 A1 and 19,806, 846 A1, European Patent Nos. 0,839,623 A1 and 0,842,975 A1, and French Patent No. 2,760,460 A1, are also preferably used.

In the present invention, as an ultraviolet ray absorbent, it is preferred to use a compound having a high molar extinction coefficient. Examples of the compound include those having a triazine skeleton. These are preferably added to a light-sensitive and/or insensitive layer. Among these compounds, use can be made of those described, for example, in JP-A-46-3335, JP-A-55-152776, JP-A-5-197074, JP-A-5-232630, JP-A-5-307232, JP-A-6-211813, JP-A-8-53427, JP-A-8-234364, JP-A-8-239368, JP-A-9-31067, JP-A-10-115898, JP-A-10-147577, JP-A-10-182621, JP-T-8-501291 ("JP-T" means searched and published International patent application), European Patent No. 0,711,804 A and German Patent No. 19,739,797A.

As the binder or protective colloid that can be used in the light-sensitive material of the present invention, gelatin is used advantageously, but another hydrophilic colloid can be used singly or in combination with gelatin. It is preferable for the gelatin for use in the present invention that the content of heavy metals, such as Fe, Cu, Zn and Mn, as impurities therein, is reduced to 5 ppm or below, more preferably 3 ppm or below.

Further, the amount of calcium contained in the light-sensitive material is preferably 20 mg/m$^2$ or less, more preferably 10 mg/m$^2$ or less, and most preferably 5 mg/m$^2$ or less.

In the present invention, it is preferred to add an antibacterial (fungi-preventing) agent and antimold agent, as described in JP-A-63-271247, in order to destroy various kinds of molds and bacteria which propagate in a hydrophilic colloid layer and deteriorate the image.

Further, the pH of the film of the light-sensitive material is preferably in the range of 4.0 to 7.0, more preferably in the range of 4.0 to 6.5.

In the present invention, a surface-active agent may be added to the light-sensitive material, in view of improvement in coating-stability, prevention of static electricity from being occurred, and adjustment of the charge amount. As the surface-active agent, there are anionic, cationic, betaine and nonionic surfactants. Examples thereof include those described in JP-A-5-333492. As the surface-active agent for use in the present invention, a fluorine-containing surface-active agent is preferred. Especially, there is preferably used a fluorine-containing surface-active agent. This fluorine-containing surface-active agent may be used singly or in combination with a conventionally known surface-active agent other than these surface-active agents. Preferably, the fluorine-containing surface-active agent is used in combination with a conventionally known surface-active agent.

The amount of the surface-active agent to be added to the light-sensitive material is not particularly limited, but generally in the range of $1\times10^{-5}$ to 1 g/m$^2$, preferably in the range of $1\times10^{-4}$ to $1\times10^{-1}$ g/m$^2$ more preferably in the range of $1\times10^{-3}$ to $1\times10^{-2}$ g/m$^2$.

In the light-sensitive material of the present invention, an image can be formed by an exposure step in which light is irradiated in accordance with an image information, followed by a development step in which the exposed light-sensitive material is developed.

The light-sensitive material of the present invention can preferably be used, in addition to the printing system using a general negative printer, in a scanning exposure system using a cathode ray tube (CRT).

The cathode ray tube exposure apparatus is simpler and more compact, and therefore less expensive than a laser-emitting apparatus. Further, optical axis and color (hue) can easily be adjusted.

In a cathode ray tube that is used for image-wise exposure, various light-emitting substances which emit a light in the spectral region, are used as occasion demands. For example, any one of red-light-emitting substances, green-light-emitting substances, blue-light-emitting substances, or a mixture of two or more of these light-emitting substances may be used. The spectral regions are not limited to the above red, green and blue, and fluorophoroes which can emit a light in a region of yellow, orange, purple or infrared can be used. Particularly, a cathode ray tube that emits a white light by means of a mixture of these light-emitting substances is often used.

In the case where the light-sensitive material has a plurality of light-sensitive layers each having different spectral sensitivity distribution from each other and also the cathode ray tube has fluorescent substances which emit light in a plurality of spectral regions, exposure to a plurality of colors may be carried out at the same time. Namely, color image signals may be input into a cathode ray tube, to allow light to be emitted from the surface of the tube. Alternatively, a method in which an image signal of each of colors is successively input and light of each of colors is emitted in order, and then exposure is carried out through a film capable of cutting a color other than the emitted color, i.e., a surface successive exposure, may be used. Generally, among these methods the surface successive exposure is preferred from the viewpoint of high quality enhancement, because a cathode ray tube having high resolution can be used.

The light-sensitive material of the present invention can preferably be used in the digital scanning exposure system using monochromatic high density light, such as a gas laser, a light-emitting diode, a semiconductor laser, a second harmonic generation light source (SHG) comprising a combination of nonlinear optical crystal with a semiconductor or a solid state laser using a semiconductor laser as an excitation light source. It is preferred to use a semiconductor laser, or a second harmonic generation light source (SHG) comprising a combination of nonlinear optical crystal with a solid state laser or a semiconductor laser, to make a system more compact and inexpensive. In particular, to design a compact and inexpensive apparatus having a longer duration of life and high stability, use of a semiconductor laser is preferable; and it is preferred that at least one of exposure light sources should be a semiconductor laser.

When such a scanning exposure light source is used, the maximum spectral sensitivity wavelength of the light-sensitive material of the present invention can be arbitrarily set up in accordance with the wavelength of a scanning exposure light source to be used. Since oscillation wavelength of a laser can be made half, using a SHG light source obtainable by a combination of a nonlinear optical crystal with a semiconductor laser or a solid state laser using a semiconductor as an excitation light source, blue light and green light can be obtained. Accordingly, it is possible to have the spectral sensitivity maximum of a photographic material in normal three wavelength regions of blue, green and red.

The exposure time in such a scanning exposure is defined as the time necessary to expose the size of the picture element (pixel) with the density of the picture element being 400 dpi, and preferred exposure time is $10^{-4}$ sec or less and more preferably 106 sec or less.

The silver halide color photographic light-sensitive material of the present invention can be preferably used in combination with the exposure and development system described in the following publications:

Automatic printing and development system described in JP-A-10-333253;

Conveyor of light-sensitive materials, as described in JP-A-2000-10206;

Recording system including an image-reading apparatus, as described in JP-A-11-215312;

Exposure system including color image-recording system, as described in JP-A-11-88619 and JP-A-10-202950;

Digital photo-printing system including remote diagnostic system, as described in JP-A-10-210206; and Photo-printing system including an image-recording apparatus, as described in JP-A-2000-310822.

The preferable scanning exposure system which can be applied in the present invention are described in the publications mentioned above in the above Table, in detail.

It is preferred to use a band stop filter, as described in U.S. Pat. No. 4,880,726, when the photographic material of the present invention is subjected to exposure with a printer. Color mixing of light can be excluded and color reproducibility is remarkably improved by the above means.

In the present invention, a yellow microdot pattern may be previously formed by pre-exposure before giving an image information, to thereby perform copy restraint, as described in European Patent Nos. 0789270 A1 and 0789480 A1.

With respect to the processing of the photographic material of the present invention, processing materials and processing methods, as disclosed in JP-A-2-207250, from page 26, right under column, line 1 to page 34, right upper column, line 9, and JP-A-4-97355, from page 5, left upper column, line 17 to page 18, right under column, line 20, can be preferably applied. Further, as preservatives which are used in the developing solution, compounds described in the patent publications as shown in the above table can be preferably used.

As the chemicals of the processing agents, for example, CP45X, CP47L and CP48S (each trade name, manufactured by Fuji Photo Film Co., Ltd.) and RA-100 and RA-4 (each trade name, manufactured by Eastman Kodak Co.) can be used.

Diamino stilbene-based fluorescent brightening agents known or on the market may be used in a color developing solution. As the known bistriazinyl diaminostilbene disulfonic acid compound, for example, compounds described in JP-A-6-329936, JP-A-7-140625, or JP-A-10-104809 are preferable. Compounds on the market are described, for example, in *Sensyoku nouto* (*Dyeing Note*), the 19th edition (Irozome sha), pp. 165 to 168. Among articles described here, Blankophor Uwliq, Blankophor REU and Hakkol BRK (each trade name) are preferable. Further, the following compounds are also preferably used.

In the present invention, it is preferable to contain a halide ion such as Br and I particularly in a bleach-fixing solution from the points that unevenness of image occurring at the time when an exposed light-sensitive material enters to the bleach-fixing solution from a developing solution can be prevented, and that contamination owing to silver sulfide or the like on the white background at the unexposed portion can be prevented by enhancement of the fixing ability. As to the bleach-fixing solution for use in the present invention, it is preferable for prevention of contamination owing to a residual silver and achievement of the object of the present invention that a concentration of bromide ion is in the range of 0 to 1.0 mole/$m^2$, more preferably in the range of 0.01 to 0.3 mole/$m^2$. From the same reason, the bleach-fixing solution may contain iodide ions. A concentration of iodide ion preferably is in the range of 0 to 0.1 mole/$m^2$, more preferably in the range of 0.001 to 0.01 mole/$m^2$.

The present invention is preferably applied to the rapid processability-having light-sensitive material. In the present invention, the color-developing time is preferably 60 sec or less, more preferably from 50 sec to 6 sec, further preferably from 30 sec to 6 sec in case of carrying out rapid process. Likewise, the bleach-fixing (blix) time is preferably 60 sec or less, more preferably from 50 sec to 6 sec, further preferably from 30 sec to 6 sec. Further, the washing or stabilizing time is preferably 150 sec or less, more preferably from 130 sec to 6 sec.

The term "color-developing time" as used herein refers to a period of time required from the beginning of dipping a light-sensitive material into a color-developing solution until the light-sensitive material is dipped into a blix solution in the subsequent processing step. In the case where a processing is carried out using, for example, an autoprocessor, the color-developing time is the sum total of a time in which a light-sensitive material has been dipped in a color-developing solution (so-called "time in the solution") and a time in which the light-sensitive material has been conveyed in air toward a bleach-fixing bath in the step subsequent to color development (so-called "time in the air"). Likewise, the term "blix time" as used herein refers to a period of time required from the beginning of dipping a light-sensitive material into a blix solution until the light-sensitive material is dipped into a washing bath or a stabilizing bath in the subsequent processing step. Further, the term "washing or stabilizing time" as used herein refers to a period of time required from the beginning of dipping a light-sensitive material into a washing solution or a stabilizing solution until the end of the dipping toward a drying step (so-called "time in the solution").

Examples of a development method applicable to the photographic material of the present invention after exposure, include a conventional wet system, such as a development method using a developing solution containing an alkali agent and a developing agent, and a development method wherein a developing agent is incorporated in the photographic material and an activator solution, e.g., a developing agent-free alkaline solution is employed for the development, as well as a heat development system using no processing solution. In particular, the activator method is preferred over the other methods, because the processing solution contains no developing agent, thereby it enables easy management and handling of the processing solution, and reduction in waste disposal load to make for environmental preservation.

The preferable developing agents or their precursors to be incorporated in the photographic materials in the case of adopting the activator method include the hydrazine compounds described in, for example, JP-A-8-234388, JP-A-9-152686, JP-A-9-152693, JP-A-9-211814 and JP-A-9-160193.

Further, the processing method in which the photographic material reduced in the amount of silver to be applied undergoes the image amplification processing using hydrogen peroxide (intensification processing), can be employed preferably. In particular, it is preferably to apply this processing method to the activator method. Specifically, the image-forming methods utilizing an activator solution containing hydrogen peroxide, as disclosed in JP-A-8-297354 and JP-A-9-152695 can be preferably used.

The processing with an activator solution is generally followed by a desilvering step in the activator method, but the desilvering step can be omitted in the case of applying the image amplification processing method to photographic materials of a low silver amount. In such a case, washing or stabilization processing can follow the processing with an activator solution to result in simplification of the processing process. On the other hand, when the system of reading the image information from photographic materials by means of a scanner or the like is employed, the processing form requiring no desilvering step can be applied, even if the photographic materials are those of a high silver amount, such as photographic materials for shooting.

The activator solution, desilvering solution (bleach-fixinging solution), washing solution and stabilizing solution for use in the present invention can contain known ingredients and can be used in conventional manners. Preferably, those described in *Research Disclosure*, Item 36544, pp. 536-541 (September 1994), and JP-A-8-234388 can be used in the present invention.

The silver halide color photographic light-sensitive material of the present invention exhibits not only a superior color reproduction, image fastness property, and image storage stability, but also an excellent rapid processing suitability. As well as, the light-sensitive material of the present invention is suitable for improvement in productivity on development processing. Further, the light-sensitive material of the present invention has a stable performance by a color development processing even in an ultra-rapid processing, whereby an improvement in productivity on the development process and reduction of the cost can be realized. On the other hand, according to the present invention, there can be obtained a silver halide color photographic light-sensitive material that shows a high sensitivity and has the ultra-rapid processing suitability, whereby a stable photographic performance can be always obtained even in the ultra-rapid processing, can be provided with a low cost. Particularly, the silver halide color photographic light-sensitive material of the present invention is suitable for a color print using a color photographic paper.

The present invention will now be described in more detail with reference to the following examples, but the invention is not limited to those.

EXAMPLE

Example (1)-1

(Preparation of Blue-sensitive Layer Emulsion)

Silver halide cubic grains having the following characteristics were formed.

Halogen composition: AgCl 98.9 mole %, AgBr 1 mole %, AgI 0.1 mole %

Average side length: 0.7 μm

Variation coefficient of side length: 8%

Spectral sensitizing dyes-1 and 2 were added to the silver halide emulsion in an amount of $2.5\times10^{-4}$ mole/mole of Ag and $2.0\times10^{-4}$ mole/mole of Ag respectively. At the step of grain formation, $K_3IrCl_5(H_2O)$, $K_4Ru(CN)_6$, $K_4Fe(CN)_6$, thiosulfonic acid compound-1, sodium thiosulfate, gold sensitizer-1, mercapto compounds-1 and 2 were used in an optimal amount respectively. Thus, Emulsion A-1 for a high-sensitive layer was prepared.

Similarly, cubic grains having an average side length of 0.55 μm and a variation coefficient of 9% in terms of the side length were formed.

Spectral sensitization and chemical sensitization were carried out in an amount that was corrected so as to adjust the specific surface area, i.e., side length ratio 0.7/0.55=1.27 times. Thus, Emulsion A-2 for a low-sensitive layer was prepared.

Spectral sensitizing dye-1

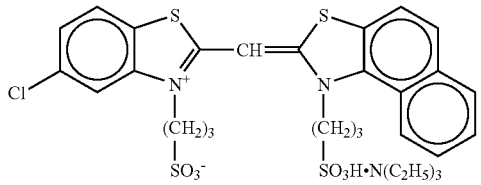

Spectral sensitizing dye-2

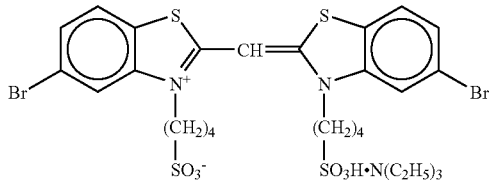

Thiosulfonic acid compound-1

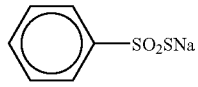

Mercapto compound-1

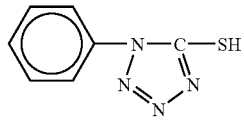

Mercapto compound-2

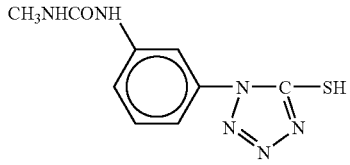

Gold sensitizer-1

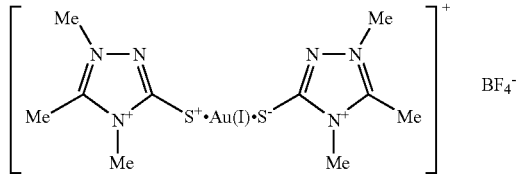

(Preparation of Green-sensitive Layer Emulsion C)

Green-sensitive high-speed emulsion C-1 and Green-sensitive low-speed emulsion C-2 were prepared by the same preparation conditions as with the above-mentioned emulsions A-1 and A-2, except that the temperature during grain formation was lowered and sensitizing dyes were changed as described below.

(Sensitizing dye D)

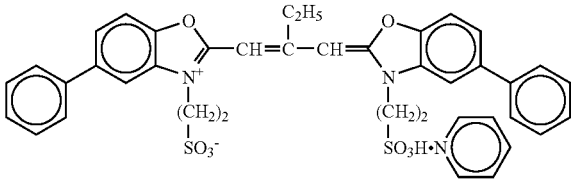

(Sensitizing dye E)

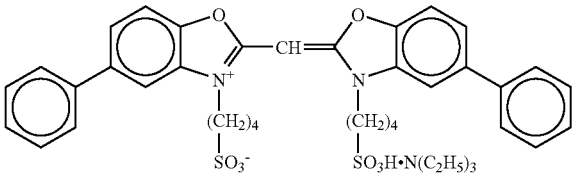

As to the grain size, average side length of the high-speed emulsion and average side length of the low-speed emulsion were 0.40 μm and 0.30 μm, respectively. The coefficient of variation of the side length of these emulsions was 8%, respectively.

Sensitizing dye D was added to the large grain size emulsion and the small grain size emulsion in an amount of $3.0\times10^{-4}$ mole and of $3.6\times10^{-4}$ mole, per mole of silver halide, respectively. Beside, Sensitizing dye E was added to the large grain size emulsion and the small grain size emulsion in an amount of $4.0\times10^{-5}$ mole and of $7.0\times10^{-5}$ mole, per mole of silver halide, respectively.

(Preparation of Red-sensitive Layer Emulsion E)

Red-sensitive high-speed emulsion E-1 and Red-sensitive low-speed emulsion E-2 were prepared by the same preparation conditions as with the above-mentioned emulsions A-1 and A-2, except that the temperature during grain formation was lowered and sensitizing dyes were changed as described below.

(Sensitizing dye G)

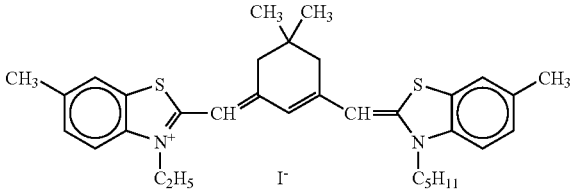

(Sensitizing dye H)

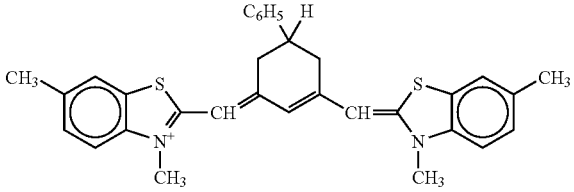

-continued

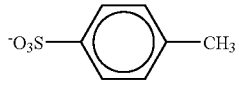

As to the grain size, average side length of the high-speed emulsion and average side length of the low-speed emulsion were 0.38 μm and 0.32 μm, respectively. The coefficient of variation of the side length of these emulsions was 9% and 10%, respectively.

Each of sensitizing dyes G and H was added to the large grain size emulsion in an amount of $8.0\times10^{-5}$ mole, and to the small grain size emulsion in an amount of $10.7\times10^{-5}$ mole, per mole of silver halide, respectively.

Further, $3.0\times10^{-3}$ mole of the following compound (I) was added to the red sensitive layer per mole of silver halide, respectively.

(Compound I)

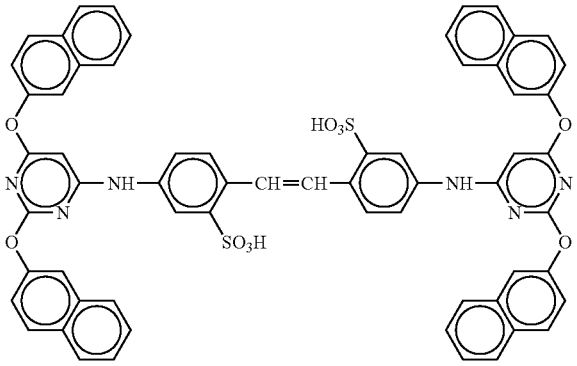

Preparation of Coating Solution for First Layer 57 g of a yellow coupler (ExY), 7 g of a dye image stabilizer (Cpd-1), 4 g of a dye image stabilizer (Cpd-2), 0.7 g of a dye image stabilizer (Cpd-3) and 2 g of a dye image stabilizer (Cpd-8) were dissolved in 21 g of a solvent (Solv-1) and 80 ml of ethyl acetate, and the resultant solution was added to 220 g of an aqueous 23.5% by mass gelatin solution containing 4 g of sodium dodecylbenzenesulfonate. The resultant mixture was emulsified and dispersed by a high speed stirring emulsifier (DISOLVER), followed by addition of water to prepare 900 g of emulsified dispersion A.

The emulsified dispersion A described above and the emulsions A-1 and A-2 were mixed and dissolved to prepare a coating solution of the first layer having the following composition. The coating amount of each emulsion is represented by the coating amount in terms of silver.

The coating solutions for the second to seventh layers were prepared following the same procedures as for the coating solution of the first layer. 1-oxy-3,5-dichloro-s-triazine sodium salts (H-1), (H-2), and (H-3) were used as gelatin hardeners in each layer. In addition, Ab-1, Ab-2, Ab-3 and Ab-4 were added to each layer such that their total amounts were 15.0 mg/m$^2$, 60.0 mg/m$^2$, 5.0 mg/m$^2$ and 10.0 mg/m$^2$, respectively.

(H-1) Hardener

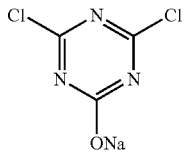

(used in an amount 1.4 mass % per gelatin)

(H-2) Hardener

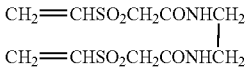

(H-3) Hardener

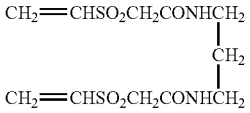

(Ab-1) Antiseptic

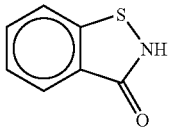

(Ab-2) Antiseptic

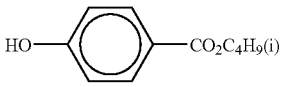

(Ab-3) Antiseptic

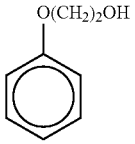

(Ab-4) Antiseptic

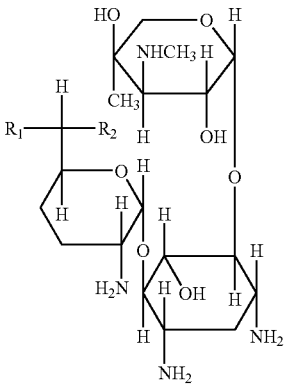

-continued

| | $R_1$ | $R_2$ |
|---|---|---|
| a | —$CH_3$ | —$NHCH_3$ |
| b | —$CH_3$ | —$NH_2$ |
| c | —H | —$NH_2$ |
| d | —H | —$NHCH_3$ |

A mixture in 1:1:1:1 (molar ratio) of a,b,c, and d

Further, 1-(3-methylureidophenyl)-5-mercaptotetrazole was added to the second layer, the forth layer, the sixth layer and the seventh layer in amounts of 0.2 mg/$m^2$, 0.2 mg/$m^2$, 0.6 mg/$m^2$ and 0.1 mg/$m^2$, respectively.

Also, 4-hydroxy-6-methyl-1,3,3a,7-tetrazaindene was added to the blue-, and green-sensitive emulsion layers in amounts of $1\times10^{-4}$ mole and $2\times10^{-4}$ mole, respectively, per mole of silver halide.

Further, a copolymer latex of methacrylic acid and butyl acrylate (ratio by mass, 1:1; average molecular weight, 200,000 to 400,000) was added to the red-sensitive emulsion layer in an amount of 0.05 g/$m^2$.

Further, disodium catechol-3,5-disulfonate was added to the second layer, the fourth layer and the sixth layer in an amount of 6 mg/$m^2$, 6 mg/$m^2$ and 18 mg/$m^2$, respectively.

Furthermore, to prevent irradiation, the following dyes (the number given in parenthesis represents the coating amount) were added.

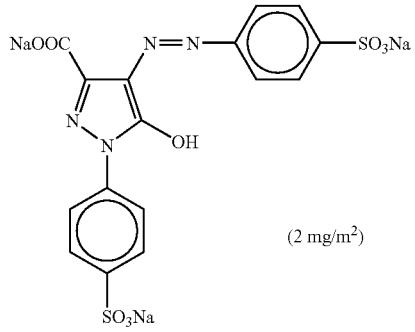

(2 mg/$m^2$)

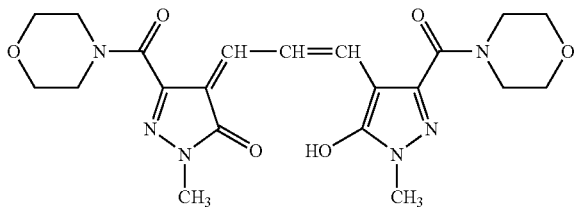

(2 mg/$m^2$)

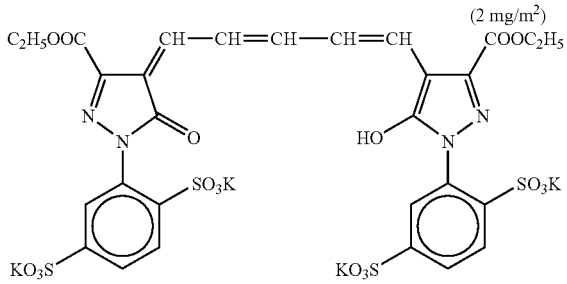

(24 mg/$m^2$)

-continued

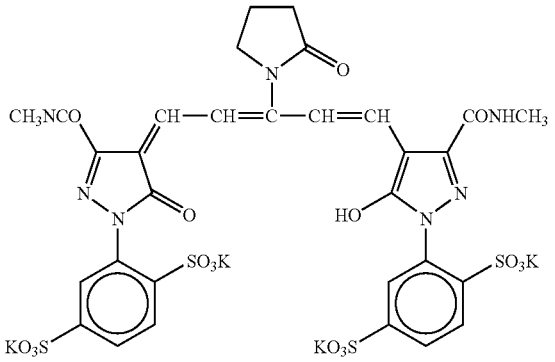

(3 mg/m$^2$)

(Layer Constitution)

The composition of each layer is shown below. The numbers show coating amounts (g/m 2). In the case of the silver halide emulsion, the coating amount is in terms of silver.

Support

Polyethylene Resin Laminated Paper

{The polyethylene resin on the first layer side contained a white pigment ($TiO_2$: content of 16 mass %, ZnO: content of 4 mass %), a fluorescent whitening agent (4,4'-bis(5-methylbenzoxazolyl)stilbene; content of 0.03 mass %) and a bluish dye (ultramarine; content of 0.33 mass %), an amount of polyethylene resin is 29.2 g/m$^2$}

| | |
|---|---|
| First Layer (Blue-Sensitive Emulsion Layer) | |
| A silver chlorobromoiodide emulsion A (gold and sulfur sensitized, cubic, a 3:7 mixture of a large-size emulsion A-1 and a small-size emulsion A-2 (in terms of mol of silver)) | 0.24 |
| Gelatin | 1.25 |
| Yellow coupler (ExY) | 0.57 |
| Color-image stabilizer (Cpd-1) | 0.07 |
| Color-image stabilizer (Cpd-2) | 0.04 |
| Color-image stabilizer (Cpd-3) | 0.07 |
| Color-image stabilizer (Cpd-8) | 0.02 |
| Solvent (Solv-1) | 0.21 |
| Second Layer (Color-Mixing Inhibiting Layer) | |
| Gelatin | 1.15 |
| Color-mixing inhibitor (Cpd-4) | 0.10 |
| Color-image stabilizer (Cpd-5) | 0.018 |
| Color-image stabilizer (Cpd-6) | 0.13 |
| Color-image stabilizer (Cpd-7) | 0.07 |
| Solvent (Solv-1) | 0.04 |
| Solvent (Solv-2) | 0.12 |
| Solvent (Solv-5) | 0.11 |
| Third Layer (Green-Sensitive Emulsion Layer) | |
| A silver chlorobromoiodide emulsion C (gold and sulfur sensitized, cubic, a 1:3 mixture of a large-size emulsion C-1 and a small-size emulsion C-2 (in terms of mol of silver)) | 0.14 |
| Gelatin | 1.21 |
| Magenta coupler (ExM) | 0.15 |
| Ultraviolet absorbing agent (UV-A) | 0.14 |
| Color-image stabilizer (Cpd-2) | 0.003 |
| Color-mixing inhibitor (Cpd-4) | 0.002 |
| Color-image stabilizer (Cpd-6) | 0.09 |
| Color-image stabilizer (Cpd-8) | 0.02 |
| Color-image stabilizer (Cpd-9) | 0.01 |

-continued

| | |
|---|---|
| Color-image stabilizer (Cpd-10) | 0.01 |
| Color-image stabilizer (Cpd-11) | 0.0001 |
| Solvent (Solv-3) | 0.09 |
| Solvent (Solv-4) | 0.18 |
| Solvent (Solv-5) | 0.10 |
| Solvent (Solv-6) | 0.07 |
| Fourth Layer (Color-Mixing Inhibiting Layer) | |
| Gelatin | 0.68 |
| Color-mixing inhibitor (Cpd-4) | 0.06 |
| Color-image stabilizer (Cpd-5) | 0.011 |
| Color-image stabilizer (Cpd-6) | 0.08 |
| Color-image stabilizer (Cpd-7) | 0.04 |
| Solvent (Solv-1) | 0.02 |
| Solvent (Solv-2) | 0.07 |
| Solvent (Solv-5) | 0.065 |
| Fifth Layer (Red-Sensitive Emulsion Layer) | |
| A silver chlorobromoiodide emulsion E (gold and sulfur sensitized, cubic, a 5:5 mixture of a large-size emulsion E-1 and a small-size emulsion E-2 (in terms of mol of silver)) | 0.16 |
| Gelatin | 0.95 |
| Cyan coupler (ExC-1) | 0.023 |
| Cyan coupler (ExC-2) | 0.05 |
| Cyan coupler (ExC-3) | 0.17 |
| Ultraviolet absorbing agent (UV-A) | 0.055 |
| Color-image stabilizer (Cpd-1) | 0.22 |
| Color-image stabilizer (Cpd-7) | 0.003 |
| Color-image stabilizer (Cpd-9) | 0.01 |
| Color-image stabilizer (Cpd-12) | 0.01 |
| Solvent (Solv-8) | 0.05 |
| Sixth Layer (Ultraviolet Absorbing Layer) | |
| Gelatin | 0.46 |
| Ultraviolet absorbing agent (UV-B) | 0.35 |
| Compound (S1-4) | 0.0015 |
| Solvent (Solv-7) | 0.18 |
| Seventh Layer (Protective Layer) | |
| Gelatin | 1.00 |
| Acryl-modified copolymer of polyvinyl alcohol (modification degree: 17%) | 0.4 |
| Liquid paraffin | 0.02 |
| Surface-active agent (Cpd-13) | 0.02 |

(ExY) Yellow coupler

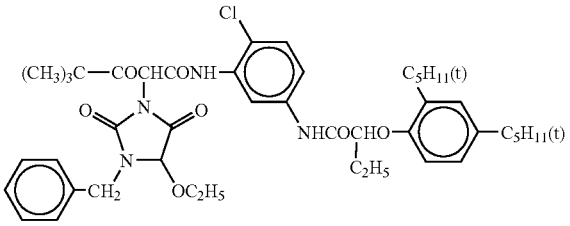

(ExM) Magenta coupler

A mixture in 40:40:20 (molar ratio) of

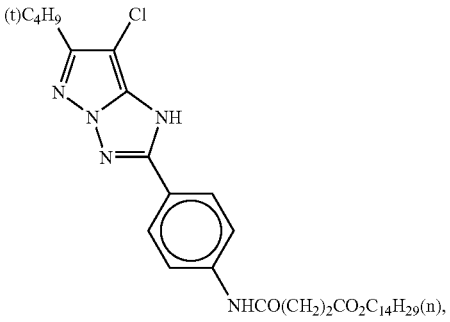

-continued

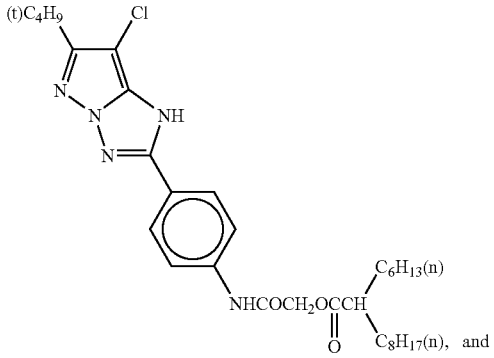

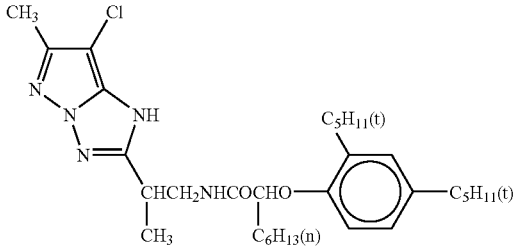

(ExC-1) Cyan coupler

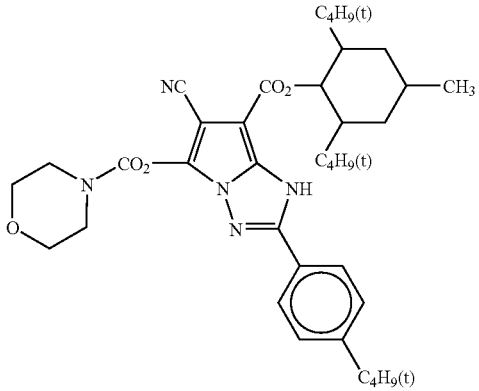

(ExC-2) Cyan coupler

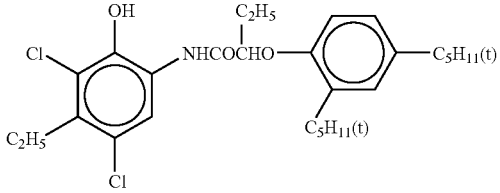

(ExC-3) Cyan coupler

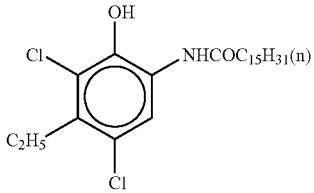

(Cpd-1) Color-image stabilizer

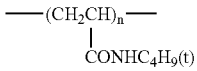

number-average molecular weight 60,000

-continued (Cpd-2) Color-image stabilizer

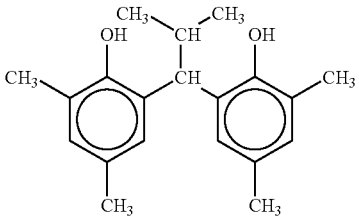

(Cpd-3) Color-image stabilizer

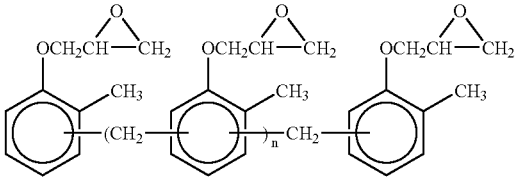

n = 7 ~ 8 (average value)

(Cpd-4) Color-mixing inhibitor

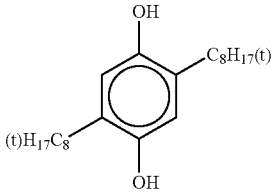

(Cpd-5) Color-image stabilizer

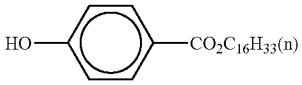

(Cpd-6) Color-image stabilizer

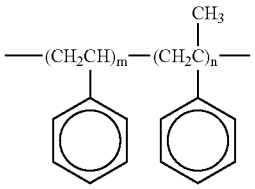

number-average molecular weight 600 m/n =10/90

(Cpd-7) Color-image stabilizer

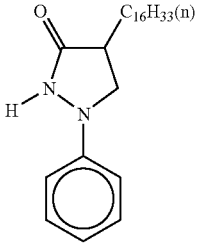

(Cpd-8) Color-image stabilizer

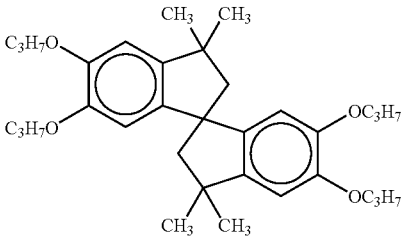

-continued
(Cpd-9) Color-image stabilizer
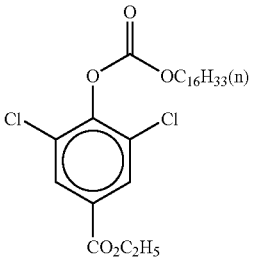
(Cpd-10) Color-image stabilizer
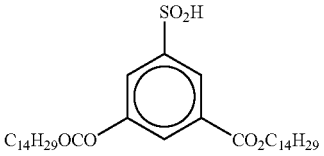
(Cpd-11)
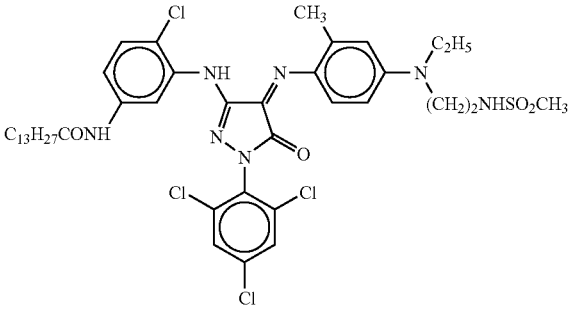
(Cpd-12)
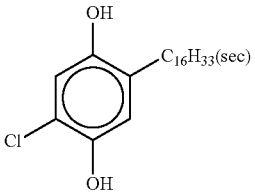
(Cpd-13) Surface-active agent
(a)
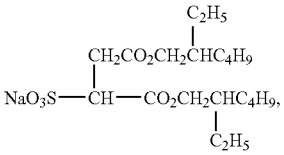
(b)
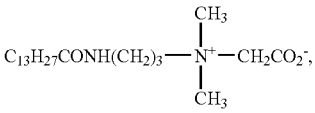
(c)
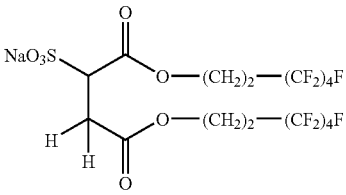
A mixture in 6:2:2(molar ratio) of (a)/(b)/(c)
-continued
(Cpd-14)
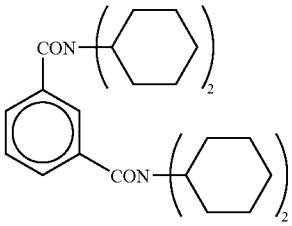
(Cpd-15)
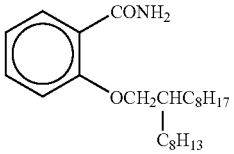
(Cpd-16)
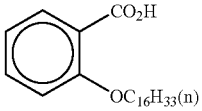
(Cpd-17)
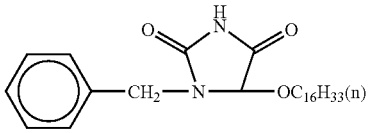
(Cpd-18)
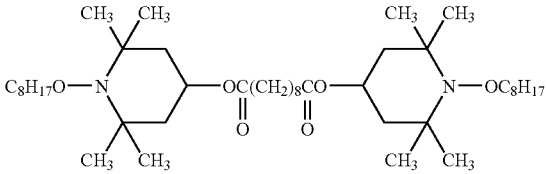
(Cpd-19) Color-mixing inhibitor
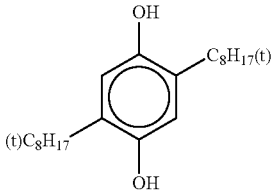
(Cpd-20)
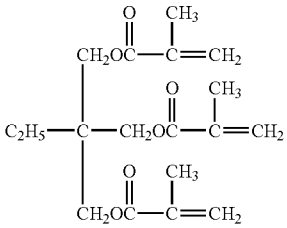
(Solv-1)
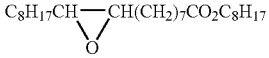
(Solv-2)
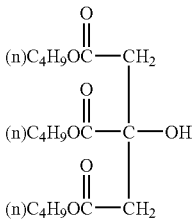

-continued (Solv-3)

$C_4H_9OC(=O)(CH_2)_8C(=O)OC_4H_9$ (Solv-4)

$O{=}P(OC_6H_{13}(n))_3$ (Solv-5)

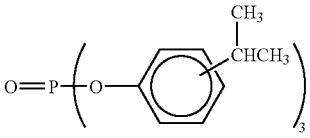

(Solv-6)

$C_8H_{17}CH{=}CHC_8H_{16}OH$ (Solv-7)

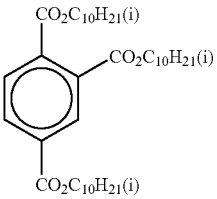

(Solv-8)

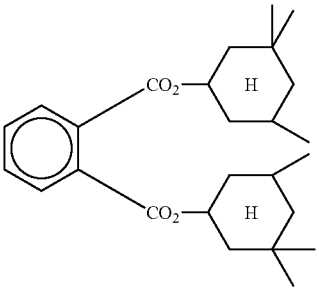

(Solv-9)

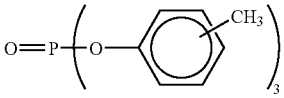

(S1-4)

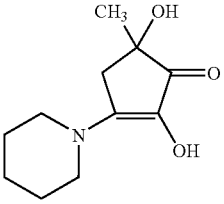

(UV-1) Ultraviolet absorbing agent

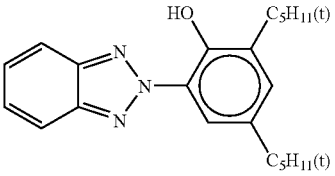

(UV-2) Ultraviolet absorbing agent

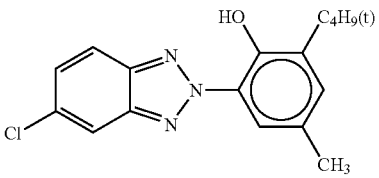

-continued (UV-3) Ultraviolet absorbing agent

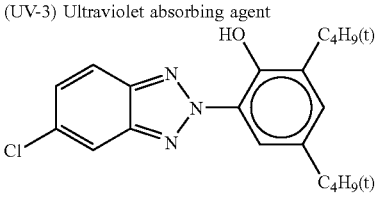

(UV-5) Ultraviolet absorbing agent

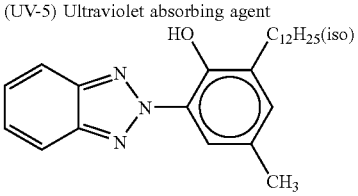

(UV-6) Ultraviolet absorbing agent

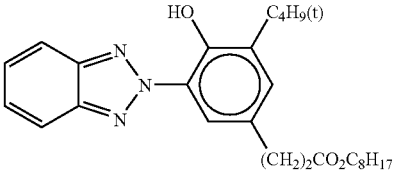

(UV-7) Ultraviolet absorbing agent

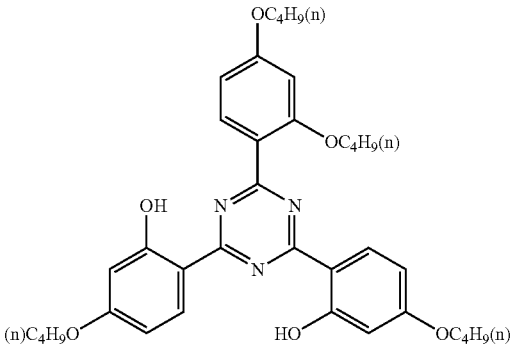

UV-A: A mixture of UV-1/UV-2/UV-3 =7/2/2 (mass ratio)

UV-B: A mixture of UV-1/UV-2/UV-3/UV-5/UV-6/UV-7 = 3/1/1/3/1/3 (mass ratio)

The first layer and the third layer of the thus-prepared sample 001 were replaced with BL-A to BL-E and GL-A to GL-G shown below respectively. Samples 101 to 114 were prepared using combinations of both a first layer and a third layer shown in Table 2.

| First Layer<br>Modified composition of Blue-sensitive emulsion layer | |
|---|---|
| BL-A: Silver halide emulsion layer having the same composition as the first layer of sample 001 (a comparative coupler Y1 was used) | |
| BL-B: Silver iodobromochloride emulsion A (gold-sulfur sensitized cubic form, a mixture in a ratio of 3:7 (Ag mole ratio) of a large grain size emulsion A-1 and a small grain size emulsion A-2 | 0.15 |
| Gelatin | 0.87 |
| Yellow Coupler (Exemplified compound (3)) | 0.30 |
| Color Image Stabilizer (Cpd-2) | 0.06 |
| Color Image Stabilizer (Cpd-8) | 0.07 |
| Color Image Stabilizer (Cpd-20) | 0.07 |
| Solvent (Solv-9) | 0.20 |
| BL-C: The same as BL-B except that the yellow coupler was replaced with the exemplified compound (24) in an equimolar amount | |
| . | |

-continued

| | |
|---|---|
| BL-D: The same as BL-B except that the yellow coupler was replaced with the exemplified compound (31) in an equimolar amount. | |
| BL-E: The same as BL-B except that the yellow coupler was replaced with the exemplified compound (36) in an equimolar amount. | |
| Third Layer | |
| Modified composition of Green-sensitive emulsion Layer | |
| GA-L: A silver chlorobromoiodide emulsion C (gold and sulfur sensitized, cubic, a 1:3 mixture of a large-size emulsion C-1 and a small-size emulsion C-2 (in terms of mol of silver)) | 0.20 |
| Gelatin | 1.21 |
| Magenta coupler (Coupler for comparison M1) | 0.26 |
| Ultraviolet absorbing agent (UV-A) | 0.14 |
| Color-image stabilizer (Cpd-2) | 0.003 |
| Color-mixing inhibitor (Cpd-4) | 0.002 |
| Color-image stabilizer (Cpd-6) | 0.09 |
| Color-image stabilizer (Cpd-8) | 0.02 |
| Color-image stabilizer (Cpd-9) | 0.01 |
| Color-image stabilizer (Cpd-10) | 0.01 |
| Color-image stabilizer (Cpd-11) | 0.0001 |
| Solvent (Solv-3) | 0.09 |
| Solvent (Solv-4) | 0.18 |
| Solvent (Solv-5) | 0.10 |
| Solvent (Solv-6) | 0.07 |
| GL-B: The magenta coupler in the third layer of sample 001 was replaced with the exemplified compound (MC-3) in an equimolar amount. | |
| GL-C: The magenta coupler in the third layer of sample 001 was replaced with the exemplified compound (MC-49) in an equimolar amount. | |
| GL-D: The magenta coupler in the third layer of sample 001 was replaced with the exemplified compound (MC-48) in an equimolar amount. | |
| GL-E: The magenta coupler in the third layer of sample 001 was replaced with the exemplified compound (MC-5) in an equimolar amount. | |
| GL-F: The magenta coupler in the third layer of sample 001 was replaced with the exemplified compound (MC-4) in an equimolar amount. | |
| GL-G: The magenta coupler in the third layer of sample 001 was replaced with the exemplified compound (MC-50) in an equimolar amount. | |

Coupler for comparison Y1

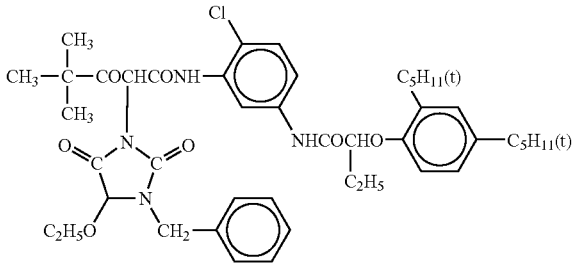

Coupler for comparison M1

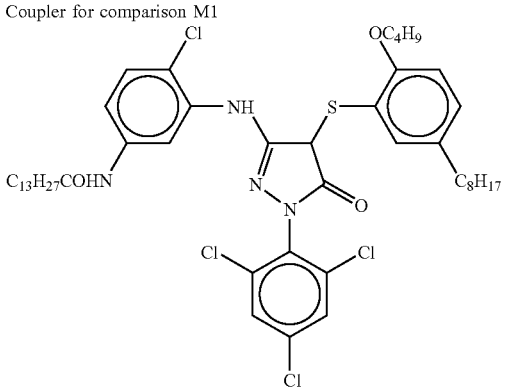

The above-described light-sensitive material sample 101 was processed to a 127 mm width roll-like form. Mini-lab printer processor PP350 (trade name) manufactured by Fuji Photo Film Co., Ltd. was used to subject the light-sensitive material sample to image-wise exposure through a negative film having an average density. A continuous processing (running test) was performed until an accumulated replenisher amount of color developer in the processing steps presented below reached two times the tank volume of a color developer. The following two processes having different processing solutions and running time from each other were carried out to evaluate the light-sensitive material.

Processing A

The processing with the resulting running processing solution was named processing A.

| Processing step | Temperature | Time | Replenisher amount* |
|---|---|---|---|
| Color development | 38.5° C. | 45 sec | 45 ml |
| Bleach-fixing | 38.0° C. | 45 sec | 35 ml |
| Rinse (1) | 38.0° C. | 20 sec | — |
| Rinse (2) | 38.0° C. | 20 sec | — |
| Rinse (3)** | 38.0° C. | 20 sec | — |
| Rinse (4)** | 38.0° C. | 20 sec | 121 ml |
| Drying | 80° C. | | |

(Note)

*Replenisher amount per $m^2$ of the light-sensitive material to be processed.

**A rinse cleaning system RC50D (trade name), manufactured by Fuji Photo Film Co., Ltd., was installed in the rinse (3), and the rinse solution was taken out from the rinse (3) and sent to a reverse osmosis membrane module (RC50D) by using a pump. The permeated water obtained in that tank was supplied to the rinse (4), and the concentrated water was returned to the rinse (3). Pump pressure was controlled such that the water to be permeated in the reverse osmosis module would be maintained in an amount of 50 to 300 ml/min, and the rinse solution was circulated under controlled temperature for 10 hours a day. The rinse was made in a four-tanked counter-current system from (1) to (4).

The composition of each processing solution was as follows.

| | (Tank solution) | (Replenisher) |
|---|---|---|
| (Color developer) | | |
| Water | 800 ml | 800 ml |
| Fluorescent whitening agent (FL-1) | 2.2 g | 5.1 g |
| Fluorescent whitening agent (FL-2) | 0.35 g | 1.75 g |
| Triisopropanolamine | 8.8 g | 8.8 g |
| Polyethylenegrycol (average molecular weight: 300) | 10.0 g | 10.0 g |
| Ethylenediamine tetraacetic acid | 4.0 g | 4.0 g |
| Sodium sulfite | 0.10 g | 0.20 g |
| Potassium chloride | 10.0 g | — |
| Sodium 4,5-dihydroxybenzene-1,3-disulfonate | 0.50 g | 0.50 g |
| Disodium-N,N-bis(sulfonatoethyl) hydroxylamine | 8.5 g | 14.0 g |
| 4-Amino-3-methyl-N-ethyl-N-(β-methanesulfonamidoethyl) aniline · 3/2 sulfate · monohydrate | 4.8 g | 14.0 g |
| Potassium carbonate | 26.3 g | 26.3 g |
| Water to make | 1000 ml | 1000 ml |
| pH (25° C./adjusted using sulfuric acid and potassium hydroxide) | 10.15 | |
| (Bleach-fixing solution) | | |
| Water | 800 ml | 800 ml |
| Ammonium thiosulfate (750 g/l) | 107 ml | 214 ml |

-continued

| | (Tank solution) | (Replenisher) |
|---|---|---|
| m-Carboxybenzenesulfinic acid | 8.3 g | 16.5 g |
| Ammonium iron (III) ethylenediaminetetraacetate | 47.0 g | 94.0 g |
| Ethylenediamine tetraacetic acid | 1.4 g | 2.8 g |
| Nitric acid (67%) | 16.5 g | 33.0 g |
| Imidazole | 14.6 g | 29.2 g |
| Ammonium sulfite | 16.0 g | 32.0 g |
| Potassium metabisulfite | 23.1 g | 46.2 g |
| Water to make | 1000 ml | 1000 ml |
| pH (25° C./adjusted using nitric acid and aqua ammonia) | 6.5 | 6.5 |
| (Rinse solution) | | |
| Sodium chlorinated-isocyanurate | 0.02 g | 0.02 g |
| Deionized water (conductivity: 5 μS/cm or less) | 1000 ml | 1000 ml |
| PH (25° C.) | 6.5 | 6.5 |

Processing Step B

Sample 001 was processed to a roll of 127 mm width and subjected to imagewise exposure through a negative film having an average density and continuous processing (running test) with a laboratory processor in which a mini-labo printer processor PP350 (trade name, manufacture by Fuji Photo Film Co., Ltd.) was remodeled so as to be able to arbitrarily change the processing time and processing temperature. The continuous processing was performed until the color developing replenisher used in the following step was replenished two times the amount of the color developing tank capacity. The processing with resulting running processing solution was named processing B.

| Processing step | Temperature | Time | Replenisher amount* |
|---|---|---|---|
| Color development | 45.0° C. | 17 sec | 45 ml |
| Bleach-fixing | 40.0° C. | 20 sec | 35 ml |
| Rinse (1) | 40.0° C. | 8 sec | — |
| Rinse (2) | 40.0° C. | 8 sec | — |
| Rinse (3)** | 40.0° C. | 8 sec | — |
| Rinse (4)** | 38.0° C. | 8 sec | 121 ml |
| Drying | 80° C. | 15 sec | |

(Note)

*Replenisher amount per $m^2$ of the light-sensitive material to be processed.

**A rinse cleaning system RC50D (trade name), manufactured by Fuji Photo Film Co., Ltd., was installed in the rinse (3), and the rinse solution was taken out from the rinse (3) and sent to a reverse osmosis membrane module (RC50D) by using a pump. The permeated water obtained in that tank was supplied to the rinse (4), and the concentrated water was returned to the rinse (3). Pump pressure was controlled such that the water to be permeated in the reverse osmosis module would be maintained in an amount of 50 to 300 ml/min, and the rinse solution was circulated under controlled temperature for 10 hours a day.

The rinse was made in a four-tanked counter-current system from (1) to (4).

The composition of each processing solution was as follows.

| | (Tank solution) | (Replenisher) |
|---|---|---|
| (Color developer) | | |
| Water | 800 ml | 800 ml |
| Fluorescent whitening agent (FL-3) | 4.0 g | 8.0 g |
| Residual color-reducing agent (SR-1) | 3.0 g | 5.5 g |
| Triisopropanolamine | 8.8 g | 8.8 g |
| Sodium p-toluene sulfonate | 10.0 g | 10.0 g |
| Ethylenediamine tetraacetic acid | 4.0 g | 4.0 g |
| Sodium sulfite | 0.10 g | 0.10 g |
| Potassium chloride | 10.0 g | — |
| Sodium 4,5-dihydroxybenzene-1,3-disulfonate | 0.50 g | 0.50 g |
| Disodium-N,N-bis(sulfonatoethyl) hydroxylamine | 8.5 g | 14.0 g |
| 4-Amino-3-methyl-N-ethyl-N-(β-methanesulfonamidoethyl) aniline · 3/2 sulfate · monohydrate | 7.0 g | 19.0 g |
| Potassium carbonate | 26.3 g | 26.3 g |
| Water to make | 1000 ml | 1000 ml |
| pH (25° C./adjusted using sulfuric acid and potassium hydroxide) | 10.25 | 12.6 |
| (Bleach-fixing solution) | | |
| Water | 800 ml | 800 ml |
| Ammonium thiosulfate (750 g/l) | 107 ml | 214 ml |
| Succinic acid | 29.5 g | 59.0 g |
| Ammonium iron (III) ethylenediaminetetraacetate | 47.0 g | 94.0 g |
| Ethylenediamine tetraacetic acid | 1.4 g | 2.8 g |
| Nitric acid (67%) | 17.5 g | 35.0 g |
| Imidazole | 14.6 g | 29.2 g |
| Ammonium sulfite | 16.0 g | 32.0 g |
| Potassium metabisulfite | 23.1 g | 46.2 g |

-continued

| | (Tank solution) | (Replenisher) |
|---|---|---|
| Water to make | 1000 ml | 1000 ml |
| pH (25° C./adjusted using nitric acid and aqua ammonia) | 6.00 | 6.00 |
| (Rinse solution) | | |
| Sodium chlorinated-isocyanate | 0.02 g | 0.02 g |
| Deionized water (conductivity: 5 μS/cm or less) | 1000 ml | 1000 ml |
| PH (25° C.) | 6.5 | 6.5 |

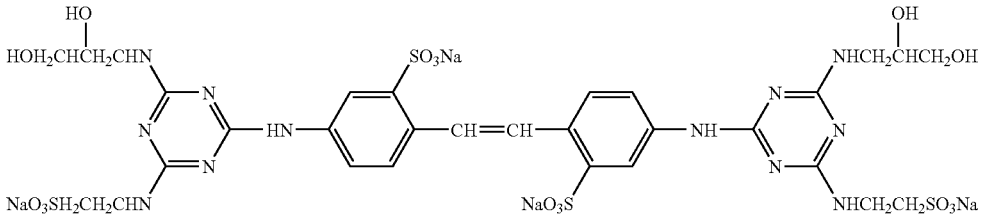

FL-1

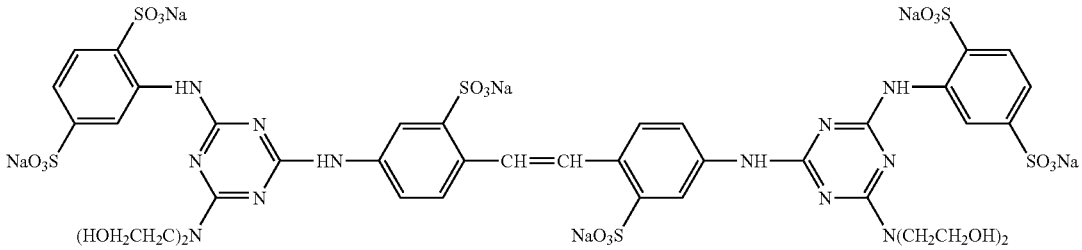

FL-2

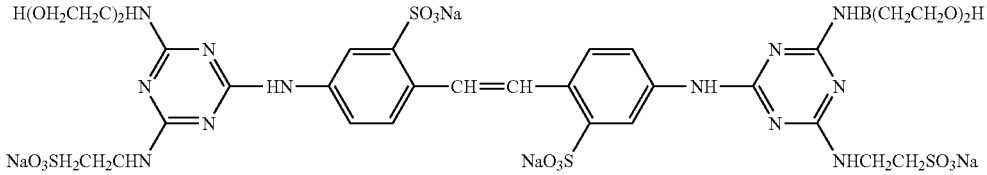

FL-3

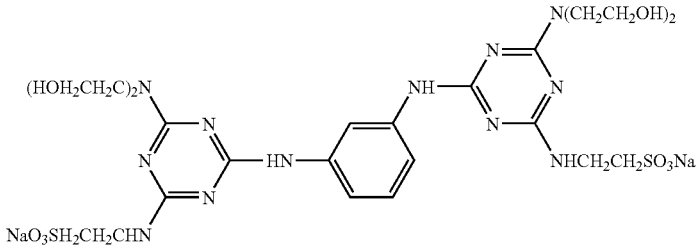

SR-1

Light-sensitive material samples 101 to 104 composed of a support having coated thereon each coating solution for each photographic constitutional layer were reserved for 10 days under the conditions of 25° C. and 55% RH to conduct the following evaluations.

(Evaluation 1 Color Reproduction)

Each sample was subject to three-color separation exposure. After exposure, each sample was color-developing processed according to the above-mentioned processing step A to obtain a mono-color developed sample of each of yellow, magenta and cyan.

Three types of semiconductor laser beams were used to obtain three light sources, i.e., a light source of 688 nm (R light), a light source of 532 nm (G light) using a semiconductor in combination with SHG, and a light source of 473 nm (B light). The amount of a red light was modulated using an external modulator, and scanning exposure to these laser beams reflected to a polygon mirror (rotating polyhedrons) was carried out using each sample moving in the direction vertical to the scanning direction. The scanning pitch was 400 dpi and the average exposure time per one pixel was $8\times10^{-8}$ second. For restraining the fluctuation of light amount due to the change of temperature, the temperature of a semiconductor laser was maintained constant using a Peltier element.

Using the thus-obtained samples, a (reproductive) volume of the Lab space was measured according to a method described in JP-A-2001-194755 (paragraph Nos. 0014 to 0019 and Example 1). A volume of space of each sample in which L* is 50 or more was measured setting at Dmax=2.2 under a light source of D50, and the results were expressed as a relative value (by percentage), assuming that the volume of sample 102 was taken as 100.

(Evaluation 2 Residual Color)

Each unexposed sample was processed according to Processing step B at 1.2 times carrier-speed. Yellow density of each sample after processing was measured using an X-rite 310 densitometer (Trade name, manufactured by X-rite Company) according to the status A. After each sample was additionally washed for 5 minutes using a large excessive amount of ion-exchanged (deionized) water at 40° C., a densitometry was again conducted. A change in yellow density (ΔY) between before and after the additional washing was measured, thereby a degree of residual color being evaluated.

(Evaluation 3 Processing Stability at Rapid Processing)

Using each sample with an exposure apparatus that was used in Evaluation 1, exposure conditions necessary to give a gray gradation according to the Processing step A were determined. Each sample was exposed under the thus-determined conditions and then it was processed according to the Processing step B so as to perform color development. In an exposure amount necessary to give a density of 2.0 according to the Processing step A, densities obtained by the Processing step B were measured. Fluctuation in density of each of yellow and magenta between the Processing step A and the Processing step B, i.e., ΔB, ΔG were measured. Similar to the above-mentioned Evaluation 2, measurement was carried out according to status A.

Results in evaluations are shown in Table 2

15th Layer (Low-sensitive Blue-sensitive Emulsion Layer)

| | | |
|---|---|---|
| Silver iodobromide emulsion L | Silver amount | 0.11 |
| Silver iodobromide emulsion M | Silver amount | 0.15 |
| Gelatin | | 0.80 |
| Yellow coupler (exemplified compound (43) according to the present invention) | | 0.30 |
| Compound Cpd-M | | 0.01 |
| High boiling point organic solvent (tricresyl phosphate) | | 0.05 |

16th Layer (Low-sensitive Blue-sensitive Emulsion Layer)

| | | |
|---|---|---|
| Silver iodobromide emulsion N | Silver amount | 0.15 |
| Silver iodobromide emulsion O | Silver amount | 0.15 |
| Gelatin | | 0.76 |
| Yellow coupler (exemplified compound (43) according to the present invention) | | 0.34 |
| Compound Cpd-N | | 0.002 |
| High boiling point organic solvent (tricresyl phosphate) | | 0.06 |

TABLE 2

| No. | First layer | Coupler in the first layer | Third layer | Coupler in the third layer | Color reproductivity (relative %) | Residual color ΔY | Stability on ultra-rapid processing ΔB | ΔG | Remarks |
|---|---|---|---|---|---|---|---|---|---|
| 101 | BL-A | Coupler for comparison Y1 | GL-A | Coupler for comparison M1 | 93.2 | 0.050 | −0.12 | −0.15 | Comparative example |
| 102 | BL-A | Coupler for comparison Y1 | GL-B | (MC-3) | 100.0 | 0.033 | −0.10 | −0.10 | Comparative example |
| 103 | BL-B | (3) | GL-A | Coupler for comparison M1 | 98.0 | 0.035 | −0.05 | −0.10 | Comparative example |
| 104 | BL-B | (3) | GL-B | (MC-3) | 106.2 | 0.010 | −0.03 | −0.03 | This invention |
| 105 | BL-B | (3) | GL-C | (MC-49) | 106.2 | 0.010 | −0.03 | −0.03 | This invention |
| 106 | BL-B | (3) | GL-D | (MC-48) | 108.0 | 0.012 | −0.03 | −0.06 | This invention |
| 107 | BL-B | (3) | GL-E | (MC-5) | 106.2 | 0.012 | −0.03 | −0.05 | This invention |
| 108 | BL-B | (3) | GL-F | (MC-4) | 107.0 | 0.012 | −0.03 | −0.05 | This invention |
| 109 | BL-B | (3) | GL-G | (MC-50) | 107.0 | 0.012 | −0.03 | −0.05 | This invention |
| 110 | BL-C | (24) | GL-C | (MC-49) | 106.0 | 0.010 | −0.04 | −0.03 | This invention |
| 111 | BL-D | (31) | GL-C | (MC-49) | 105.0 | 0.010 | −0.04 | −0.03 | This invention |
| 112 | BL-E | (36) | GL-C | (MC-49) | 106.0 | 0.010 | −0.04 | −0.03 | This invention |
| 113 | BL-D | (31) | GL-F | (MC-4) | 105.0 | 0.010 | −0.04 | −0.03 | This invention |
| 114 | BL-D | (31) | GL-G | (MC-50) | 105.0 | 0.010 | −0.04 | −0.03 | This invention |

It can be seen from the results in Table 2 that a combination of the yellow coupler and the magenta coupler according to the present invention considerably improves color reproduction, and also improves a residual color and processing stability during a rapid processing.

Example (1)-2

Sample 201 was prepared in the same manner as sample 109 described in Example 1 of JP-A-2001-142181 except that the composition of each of the 15th layer, the 16th layer and 17th layer was changed as described below respectively.

17th Layer (Low-sensitive Blue-sensitive Emulsion Layer)

| | | |
|---|---|---|
| Silver iodobromide emulsion O | Silver amount | 0.15 |
| Silver iodobromide emulsion P | Silver amount | 0.15 |
| Gelatin | | 1.10 |
| Yellow coupler (exemplified compound (43) according to the present invention) | | 0.92 |
| Compound Cpd-N | | 0.005 |
| Compound Cpd-Q | | 0.20 |
| High boiling point organic solvent (tricresyl phosphate) | | 0.17 |

The above-mentioned silver iodobromide emulsions L to Q, Compounds Cpd-M, N and Q are those compounds described in JP-A-2001-142181.

Yellow density of the thus-obtained sample 201 was evaluated according to Example 1 of JP-A-2001-142181. It was confirmed from the results that a combination use of the yellow coupler and the magenta coupler according to the present invention lessens a developing difference in yellow density owing to processing solutions, and the light-sensitive material of the present invention exhibits a superior rapid processing suitability. Further, it was confirmed that color reproduction was also considerably improved.

Example (1)-3

Samples were prepared in the same manner as in Example (1)-1 except that the silver halide emulsions were replaced as described below and evaluated according to Example (1)-1. It can be seen from the results that silver halide color photographic light-sensitive materials that are excellent in both rapid processing suitability and color reproduction can be obtained according to the present invention.

First layer: a blend in a ratio of 4:6 (Ag mole ratio) of (Emulsion B-H) and (Emulsion B-L)

Third layer: a blend in a ratio of 5:5 (Ag mole ratio) of (Emulsion G-H) and (Emulsion G-L)

Fifth layer: a blend in a ratio of 6:4 (Ag mole ratio) of (Emulsion R-H) and (Emulsion R-L)

(Preparation of Emulsion B-H)

According to an ordinary method of simultaneously adding silver nitrate and sodium chloride to an aqueous gelatin solution with stirring, and mixing them, a high silver chloride emulsion composed of cubic grains having an equivalent-sphere diameter of 0.55 μm and a variation coefficient of 10% was prepared. However, the following points were changed from the ordinary method. Namely, potassium bromide (3 mole % per mole of the finished silver halide) and $K_4[Ru(CN)_6]$ were added at the step of addition of from 80% to 90% of the entire silver nitrate amount. Potassium iodide (0.3 mole % per mole of the finished silver halide) was added at the time when addition of 90% of the entire silver nitrate amount was terminated. $K_2[Ir(5\text{-methylthiazole})Cl_5]$ and $K_2[Ir(H_2O)Cl_5]$ were added at the step of addition of from 92% to 98% of the entire silver nitrate amount. Thus-obtained emulsion was subjected to desalting and then re-dispersion with gelatin. To the emulsion, sodium thiosulfonate and sensitizing dyes A and B shown below were added. The resulting emulsion was optimally ripened with sodium thiosulfate penta-hydrate as a sulfur sensitizer and bis(1,4,5-trimethyl-1,2,4-triazolium-3-thiolate)aurate (I) tetrafluoroborate as a gold sensitizer. Further, 1-phenyl-5-mercaptotetrazole, and 1-(5-methylureidophenyl)-5-mercaptotetrazole were added. Thus-obtained emulsion was taken as Emulsion B-H.

(Preparation of Emulsion B-L)

A high silver chloride emulsion composed of cubic grains having an equivalent-sphere diameter of 0.45 μm and a variation coefficient of 10% was prepared in the same manner as Emulsion B-H, except for changing an addition rate of silver nitrate and sodium chloride. Thus-obtained emulsion was taken as Emulsion B-L.

(Sensitizing dye A)

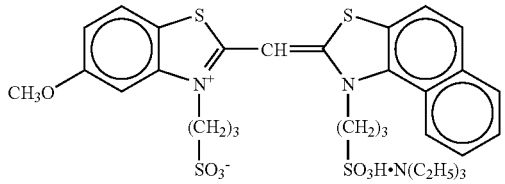

(Sensitizing dye B)

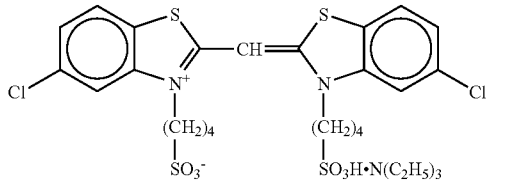

(Preparation of Emulsion G-H)

According to an ordinary method of simultaneously adding silver nitrate and sodium chloride to an aqueous gelatin solution with stirring, and mixing them, a high silver chloride emulsion composed of cubic grains having an equivalent-sphere diameter of 0.35 μm and a variation coefficient of 10% was prepared. However, the following points were changed from the ordinary method. Namely, $K_4[Ru(CN)_6]$ was added at the step of addition of from 80% to 90% of the entire silver nitrate amount. Potassium bromide (4 mole % per mole of the finished silver halide) was added at the step of addition of from 80% to 100% of the entire silver nitrate amount. Potassium iodide (0.2 mole % per mole of the finished silver halide) was added at the time when addition of 90% of the entire silver nitrate amount was terminated. $K_2[Ir(5\text{-methylthiazole})Cl_5]$ was added at the step of addition of from 92% to 95% of the entire silver nitrate amount. Further, $K_2[Ir(H_2O)Cl_5]$ was added at the step of addition of from 92% to 98% of the entire silver nitrate amount. Thus-obtained emulsion was subjected to desalting and then re-dispersion with gelatin. To the emulsion, sodium thiosulfonate was added. The resulting emulsion was optimally ripened with sodium thiosulfate penta-hydrate as a sulfur sensitizer and bis(1,4,5-trimethyl-1,2,4-triazolium-3-thiolate)aurate (I) tetrafluoroborate as a gold sensitizer. Further, a sensitizing dye D described below, 1-phenyl-5-mercaptotetrazole, 1-(5-methylureidophenyl)-5-mercaptotetrazole and potassium bromide were added. Thus-obtained emulsion was taken as Emulsion G-H.

(Preparation of Emulsion G-L)

A high silver chloride emulsion composed of cubic grains having an equivalent-sphere diameter of 0.28 μm and a variation coefficient of 10% was prepared in the same manner as Emulsion G-H, except for changing an addition rate of silver nitrate and sodium chloride. Thus-obtained emulsion was taken as Emulsion G-L.

(Sensitizing dye D)

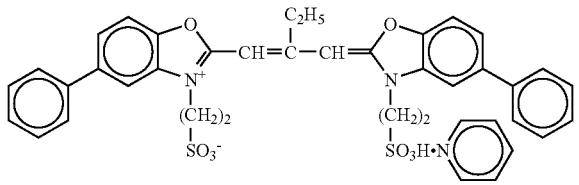

(Preparation of Emulsion R-H)

According to an ordinary method of simultaneously adding silver nitrate and sodium chloride to an aqueous gelatin solution with stirring, and mixing them, a high silver chloride emulsion composed of cubic grains having an equivalent-sphere diameter of 0.35 μm and a variation coefficient of 10% was prepared. However, the following points were changed from the ordinary method. Namely, $K_4[Ru(CN)_6]$ was added at the step of addition of from 80% to 90% of the entire silver nitrate amount. Potassium bromide (4.3 mole % per mole of the finished silver halide) was added at the step of addition of from 80% to 100% of the entire silver nitrate amount. Potassium iodide (0.15 mole % per mole of the finished silver halide) was added at the time when addition of 90% of the entire silver nitrate amount was terminated. $K_2[Ir(5\text{-methylthiazole})Cl_5]$ was added at the step of addition of from 92% to 95% of the entire silver nitrate amount. Further, $K_2[Ir(H_2O)Cl_5]$ was added at the step of addition of from 92% to 98% of the entire silver nitrate amount. Thus-obtained emulsion was subjected to desalting and then re-dispersion with gelatin. To the emulsion, sodium thiosulfonate was added. The resulting emulsion was optimally ripened with sodium thiosulfate penta-hydrate as a sulfur sensitizer and bis(1,4,5-trimethyl-1,2,4-triazolium-3-thiolate)aurate (I) tetrafluoroborate as a gold sensitizer. Further, a sensitizing dye H described below, 1-phenyl-5-mercaptotetrazole, 1-(5-methylureidophenyl)-5-mercaptotetrazole, compound I described below and potassium bromide were added. Thus-obtained emulsion was taken as Emulsion R-H.

(Preparation of Emulsion R-L)

A high silver chloride emulsion composed of cubic grains having an equivalent-sphere diameter of 0.28 μm and a variation coefficient of 10% was prepared in the same manner as Emulsion R-H, except for changing an addition rate of silver nitrate and sodium chloride. Thus-obtained emulsion was taken as Emulsion R-L.

(Sensitizing dye H)

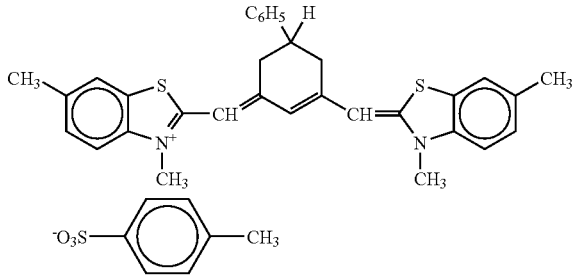

(Compound I)

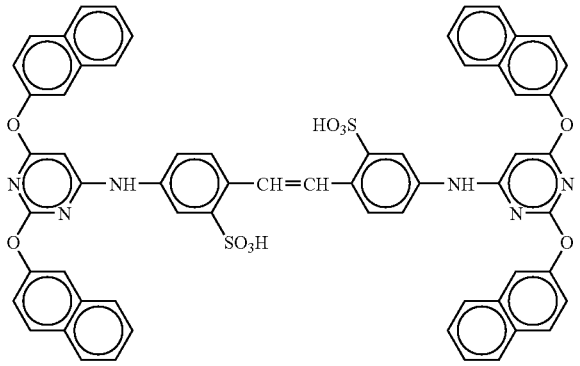

Example (2)-1

(Preparation of Blue-sensitive Layer Emulsion A, Green-sensitive Layer Emulsion C, and Red-sensitive Layer Emulsion E)

Blue-sensitive Layer Emulsion A, Green-sensitive Layer Emulsion C, and Red-sensitive Layer Emulsion E were prepared in the same manner as in the above-mentioned Example (1)-1, respectively.

In case of Examples (2)-1 to (2)-6, the same reference letters as in Examples (1)-1 to (1)-3 may have different chemical significance. Namely, if there is a special note, the note has a precedence than the other description.

Preparation of Coating Solution for First to Seventh Layers

First to Seventh layers were prepared in the same manner as in the above-mentioned Example (1)-1, respectively.

(Layer Constitution)

Each composition of this layer constitution herein was accorded with that of the above-mentioned layer constitution in Example (1)-1. However, in Examples (2)-1 to (2)-6 shown below, the compound called as Cpd-20 in Example (1)-1 was called as Cpd-14 and the solvent (Solv-8) used in Example (1)-1 was changed to the following.

(Solv-8)

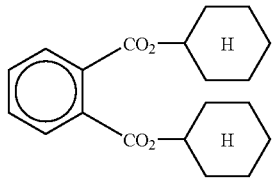

The first layer and the fifth layer of the thus-prepared sample 2-001 were replaced with BL-A to BL-E and RL-A to RL-H shown below respectively. Samples 2-101 to 2-114 were prepared using combinations of both a first layer and a fifth layer shown in Table 3.

| First Layer | |
|---|---|
| Modified composition of Blue-sensitive emulsion Layer BL-A: Silver chlorobromoiodide emulsion A (gold-sulfur sensitized cubic form, a mixture in a ratio of 3:7 (Ag mole ratio) of a large grain size emulsion A-1 and a small grain size emulsion A-2 | 0.24 |
| Gelatin | 1.20 |
| Yellow Coupler (Comparative coupler CY1) | 0.53 |
| Color Image Stabilizer (Cpd-2) | 0.06 |
| Color Image Stabilizer (Cpd-8) | 0.07 |
| Color Image Stabilizer (Cpd-14) | 0.07 |
| Solvent (Solv-9) | 0.20 |
| BL-B, BL-C, BL-D and BL-E: Modified compositions for BL-B, BL-C, BL-D and BL-E in Example (1)-1 mentioned above were applied to this Example. | |
| **Fifth Layer** | |
| Modified composition of Red-sensitive emulsion Layer RL-A: Silver chlorobromoiodide emulsion E (gold-sulfur sensitized cubic form, a mixture in a ratio of 5:5 (Ag mole ratio) of a large grain size emulsion E-1 and a small grain size emulsion E-2 | 0.17 |
| Gelatin | 1.30 |
| Cyan Coupler (Cyan coupler for comparison (CC1) | 0.30 |
| Solvent (Solv-3) | 0.44 |

-continued

| | |
|---|---|
| Solvent (Solv-10) | 0.15 |

RL-B: The same as RL-A except that the cyan coupler was replaced with the exemplified compound (C-22) in an equimolar amount.
RL-C: The same as RL-A except that the cyan coupler was replaced with the exemplified compound (C-22) in an equimolar amount, and the amount of chlorobromoiodide was increased up to 0.21 g/m$^2$.
RL-D: The same as RL-C except that the cyan coupler was replaced with the exemplified compound (C-2) in an equimolar amount.
RL-E: The same as RC-L except that the cyan coupler was replaced with the exemplified compound (C-4) in an equimolar amount.
RL-F: The same as RC-L except that the cyan coupler was replaced with the exemplified compound (C-21) in an equimolar amount.
RL-G: The same as RC-L except that the cyan coupler was replaced with the exemplified compound (C-55) in an equimolar amount.
RL-H: In RL-C, the cyan coupler was replaced with a 9:1 (by molar ratio) mixture of examplified compounds (C-22) and (C-55) in an equi-molar amount.

As same as in the above-mentioned (1)-1, they were subjected to the continuous treatment (running test) in order to the light-sensitive materials.

FL-1

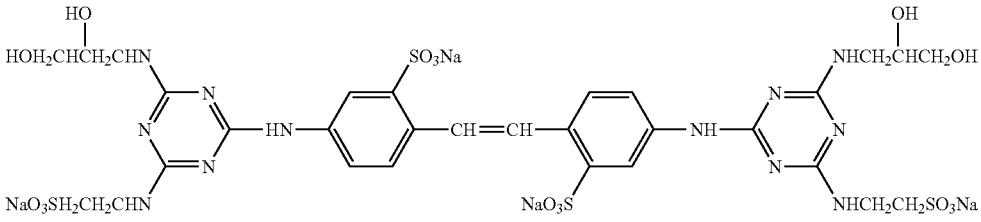

FL-2

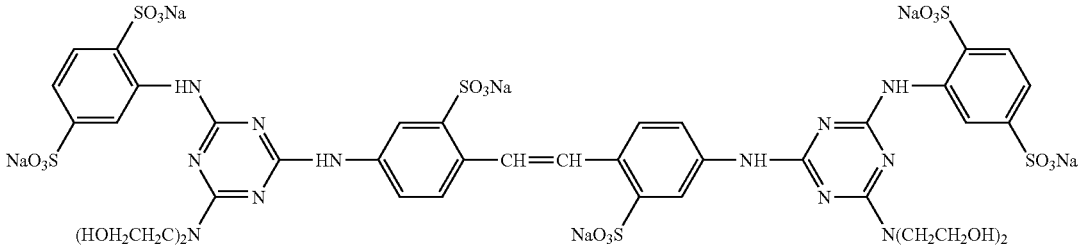

FL-3

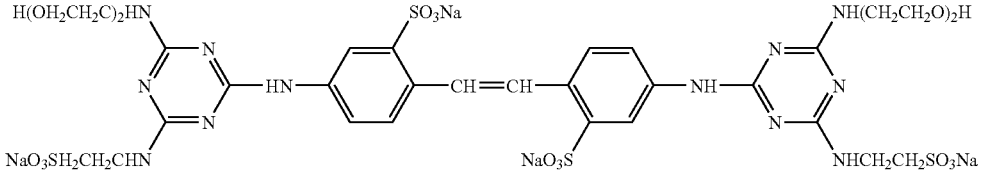

SR-1

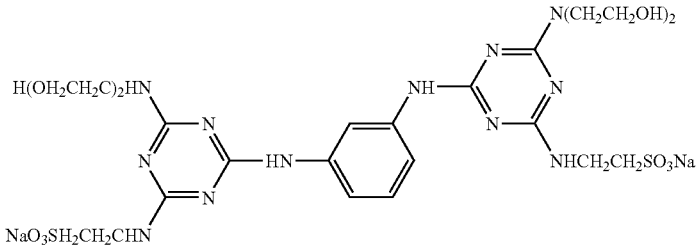

Yellow Coupler for comparison CY1

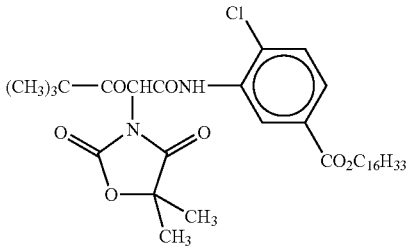

Cyan Coupler for comparison CC1

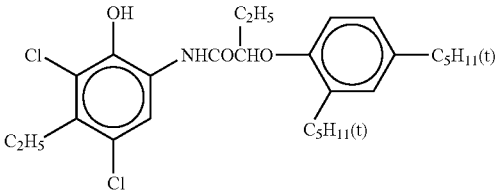

(Cyan Coupler same as ExC-2)

For samples 2-101 to 2-114, evaluations were carried out under the same conditions as in samples 101 to 104 in Example (1)-1.

(Evaluation 1 Color Reproduction)

Color Reproduction (Evaluation 1) was calculated in the same manner as in Example (1)-1, except that relative values (by percentage) to sample 2-101 were calculated.

(Evaluation 2 Processing Stability at Rapid Processing)

Fluctuation in density of each of yellow and cyan between the Processing step A and the Processing step B, i.e., AB, AR were measured, in the same manner as in Processing Stability at Rapid Processing (Evaluation 3) in Example (1)-1, basically.

(Evaluation 3 Desilvering)

Each sample was exposed to a white light having a color temperature of 48000 in an exposure amount of 500 CMS. The exposed samples were processed according to the processing step B except for 1.3 times of a conveyer speed. The residual silver amount of the processed sample was determined using fluorescent X-ray.

(Evaluation 4 Image Fastness Property)

The density of the sample previously processed for Evaluation 1 was measured before and after the preservation under the condition of 80° C. and 70% RH for 21 days. A ratio of the yellow density after preservation to initial density of 1.5 and a ratio of the cyan density after preservation to initial density of 1.5 were each calculated to obtain a relative residual rate.

The results obtained are shown in Table 3.

yellow couplers of the present invention, rapid processing suitability as the problem of the present invention can be improved and further the silver halide color photographic light-sensitive material excellent in color reproduction and image fastness was obtained.

Example (2)-2

Samples 2-201 to 2-214 were prepared in the same manner as in Example (2)-1, except that the first and fifth layers of samples 2-101 to 2-114 were exchanged for each other. Then, the evaluations were carried out according to Example (2)-1. As the result, improvements in the yellow and magenta color developing densities at graying processing were recognized in samples wherein the cyan coupler of the present invention was used. Furthermore, also in results of Evaluations 1 to 4, it was found that the effects of the invention was obtained when the yellow and cyan couplers of the present invention were combined and used as well as in Example (2)-1.

Example (2)-3

Samples were prepared in the same manner as in Examples (2)-1 and (2)-2 except that the magenta coupler in the third layer were replaced as described below and evaluated according to Examples (2)-1 and (2)-2. It can be seen from the results that silver halide color photographic light-sensitive materials that are excellent in both rapid processing suitability and color reproduction can be obtained according to the present invention.

TABLE 3

| No. | First layer | Coupler in the first layer | Fifth layer | Coupler in the fifth layer | Color reproductivity (relative %) | Stability on ultra-rapid processing ΔB | ΔR | Desilvering property ($g/m^2$) | Image fastness property (Residual ratio %) Yellow | Cyan | Remarks |
|---|---|---|---|---|---|---|---|---|---|---|---|
| 2-101 | BL-A | Coupler for comparison CY1 | RL-A | Coupler for comparison CC1 | 100.0 | −0.10 | −0.08 | 0.06 | 86 | 84 | Comparative example |
| 2-102 | BL-A | Coupler for comparison CY1 | RL-B | C-22 | 104.5 | −0.10 | −0.12 | 0.06 | 86 | 97 | Comparative example |
| 2-103 | BL-A | Coupler for comparison CY1 | RL-C | C-22 | 104.5 | −0.15 | −0.04 | 0.09 | 86 | 97 | Comparative example |
| 2-104 | BL-B | (3) | RL-A | Coupler for comparison CC1 | 105.0 | −0.03 | −0.08 | 0.01 | 97 | 84 | Comparative example |
| 2-105 | BL-B | (3) | RL-C | C-22 | 111.0 | −0.03 | −0.03 | 0.01 | 97 | 97 | This invention |
| 2-106 | BL-B | (3) | RL-D | C-2 | 110.0 | −0.03 | −0.03 | 0.01 | 97 | 95 | This invention |
| 2-107 | BL-B | (3) | RL-E | C-4 | 110.0 | −0.03 | −0.03 | 0.01 | 97 | 95 | This invention |
| 2-108 | BL-B | (3) | RL-F | C-21 | 110.0 | −0.03 | −0.03 | 0.01 | 97 | 95 | This invention |
| 2-109 | BL-B | (3) | RL-G | C-55 | 111.0 | −0.03 | −0.03 | 0.01 | 97 | 97 | This invention |
| 2-110 | BL-B | (3) | RL-H | C-22/C-55 | 111.0 | −0.03 | −0.03 | 0.01 | 97 | 97 | This invention |
| 2-111 | BL-C | (24) | RL-H | C-22/C-55 | 110.5 | −0.04 | −0.03 | 0.01 | 97 | 97 | This invention |
| 2-112 | BL-D | (31) | RL-H | C-22/C-55 | 110.0 | −0.03 | −0.03 | 0.01 | 98 | 97 | This invention |
| 2-113 | BL-E | (36) | RL-H | C-22/C-55 | 110.5 | −0.03 | −0.03 | 0.01 | 97 | 97 | This invention |
| 2-114 | BL-D | (31) | RL-F | C-21 | 110.0 | −0.03 | −0.03 | 0.01 | 98 | 97 | This invention |

By using the cyan coupler in the present invention, the color density at rapid processing lowered significantly as compared with a comparative cyan coupler. In order to improve the lowering, it was necessary that a silver halide emulsion be increased by about 24%. According to this, the desilvering property was deteriorated (Comparison between the samples 2-102 and 2-103).

The yellow coupler of the present invention can reduce the coating moles of the coupler and silver because molar absorptivity of the present yellow coupler is higher than that of the comparative coupler. By using a combination of two Third Layer Modified Composition of Green-sensitive Emulsion Layer GL-A: In the third layer in Example (2)-1, the magenta coupler was replaced with a 1.5 times molar amount of a magenta coupler M1.

GL-B: In the third layer in Example (2)-1, the magenta coupler was replaced with a 1.5 times molar amount of a magenta coupler M2.

Magenta coupler M1

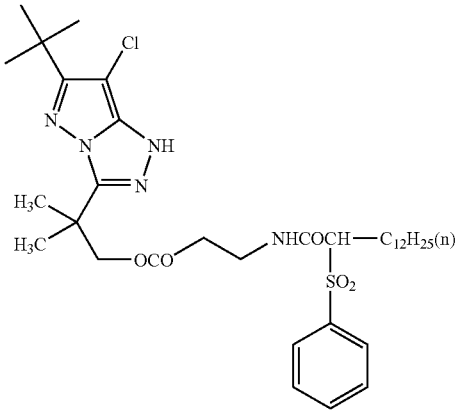

Magenta coupler M2

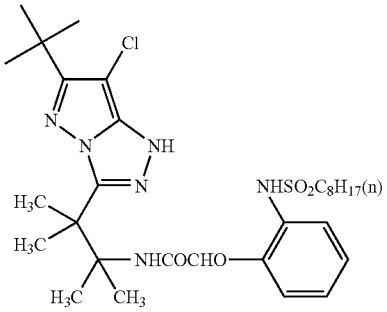

Example (2)-4

Samples were prepared in the same manner as in Example (2)-1 except that the silver halide emulsions were replaced as described below and evaluated according to Example (2)-1. It can be seen from the results that silver halide color photographic light-sensitive materials that are excellent in both rapid processing suitability and color reproduction can be obtained according to the present invention.

First layer: a blend in a ratio of 4:6 (Ag mole ratio) of (Emulsion B-H) and (Emulsion B-L)

Third layer: a blend in a ratio of 5:5 (Ag mole ratio) of (Emulsion G-H) and (Emulsion G-L)

Fifth layer: a blend in a ratio of 6:4 (Ag mole ratio) of (Emulsion R-H) and (Emulsion R-L)

(Preparation of Emulsions B-H, B-L, G-H, G-L, R-H, and R-L)

Emulsions B-H, B-L, G-H, G-L, R-H, and R-L were prepared in the same manner as in Example (1)-3.

Example (2)-5

The samples prepared in Examples (2)-1 to (2)-4 were subject to a scanning exposure by means of the apparatuses described below, and evaluated according to the Examples (2)-1 to (2)-4. From the results obtained in this evaluation, it is seen that the effects of the present invention, namely advantages in both color reproduction and rapid processing suitability can be obtained particularly considerably by the samples having the composition of the present invention. Digital minilabo FRONTIER (trade name, manufactured by Fuji Photo Film Co., Ltd.), Lambda 130 (trade name, manufactured by Durst Co.), LIGHTJET 5000 (trade name, manufactured by Gretag Co.)

Example (2)-6

Samples were prepared in the same manner as Sample 109 described in Example 1 of JP-A-2001-142181 except for the following alterations of (1) and (2):

(1) The compositions of the 15th layer, the 16th layer, and the 17th layer were each replaced with those described below.

(2) In the 4th layer, the 5th layer, and the 6th layer, only 50 mole % of C-1 and C-2 used in said sample 101 of Example 1 were each replaced with the exemplified compound C-22 according to the present invention. Specifically, a mixture of C-1 (the compound described in Example 1 of JP-A-2001-142181) and the exemplified compound C-22 was used in the 4th layer and the 5th layer, while a mixture of C-2 (the compound described in Example 1 of JP-A-2001-142181) and the exemplified compound C-22 was used in the 6th layer.

15th Layer (Low Sensitivity Blue-sensitive Emulsion Layer)

| | | |
|---|---|---|
| Silver iodobromide emulsion L | silver amount | 0.11 |
| Silver iodobromide emulsion M | silver amount | 0.15 |
| Gelatin | | 0.80 |
| Yellow coupler (Exemplified compound (43) according to the present invention) | | 0.30 |
| Compound Cpd-M | | 0.01 |
| High boiling point organic solvent (tricresyl phosphate) | | 0.05 |

16th Layer (Low Sensitivity Blue-sensitive Emulsion Layer)

| | | |
|---|---|---|
| Silver iodobromide emulsion N | silver amount | 0.15 |
| Silver iodobromide emulsion O | silver amount | 0.15 |
| Gelatin | | 0.76 |
| Yellow coupler (Exemplified compound (43) according to the present invention) | | 0.34 |
| Compound Cpd-N | | 0.002 |
| High boiling point organic solvent (tricresyl phosphate) | | 0.06 |

17th Layer (Low Sensitivity Blue-sensitive Emulsion Layer)

| | | |
|---|---|---|
| Silver iodobromide emulsion O | silver amount | 0.15 |
| Silver iodobromide emulsion P | silver amount | 0.15 |
| Gelatin | | 1.10 |
| Yellow coupler (Exemplified compound (43) according to the present invention) | | 0.92 |
| Compound Cpd-N | | 0.005 |
| High boiling point organic solvent (tricresyl phosphate) | | 0.17 |

Note that silver iodobromide emulsions L to P, Compound Cpd-M and Compound Cpd-N are those described in JP-A-2001-142181.

The thus-obtained samples were subjected to exposure and development processing (Development processing A) according to Example 1 of JP-A-2001-142181. From the results, the effects of the present invention were confirmed.

Example (3)-1

In case of Example (3)-1, the same reference letters as in Examples (1)-1 to (1)-3 and (2)-1 to (2)-6 may have different chemical significance. Namely, if there is a special note, the note has a precedence than the other description.

(Preparation of Blue-sensitive Layer Emulsion A)

To 1.06 liter of a deionized distilled water containing 5.7 mass % of deionized gelatin, 46.3 ml of a 10% aqueous solution of NaCl, 46.4 ml of $H_2SO_4$ (1N) and 0.012 g of a compound shown by (X) were added in this order. Thereafter, a temperature of the mixture solution was adjusted to 60° C., and immediately after that, 0.1 mole of silver nitrate and 0.1 mole of NaCl were added to a reactor with a high speed stirring over 10 minutes. Subsequently, an aqueous solution containing 1.5 mole of silver nitrate and an aqueous solution containing 1.5 mole of NaCl were added over 60 minutes according to a flow rate-accelerating method so that the final addition speed became 4 times as much as the initial speed. Thereafter, an aqueous solution containing 0.2 mole of silver nitrate and an aqueous solution containing 0.2 mole of NaCl were added over 6 minutes at the constant addition speed. At this step, $K_3IrCl_5$ ($H_2O$) was added to the NaCl solution in an amount so as to become $5\times10^{-7}$ mole as compared with the total silver amount, thereby to dope the aqua-iridium complex into the formed grains.

Further, an aqueous solution containing 0.2 mole of silver nitrate, an aqueous solution containing 0.18 mole of NaCl and an aqueous solution containing 0.02 mole of KBr were added over 6 minutes. At this step, $K_4Ru(CN)_6$ and $K_4Fe(CN)_6$ each corresponding to $0.5\times10^{-5}$ mole as compared with the total silver amount were dissolved in the aqueous halogen solution, so that they could be added into the silver halide grains.

Further, during growth of silver halide grains at this final stage, an aqueous solution of KI corresponding to 0.001 mole as compared with the total silver amount was added to a reactor over 1 minute. This addition started at the time when 93% of the entire grain formation was terminated.

Thereafter, a compound (Y) as a precipitating agent was added at 40° C., and pH was adjusted to around 3.5. The emulsion was desalte by washing with water.

Compound X

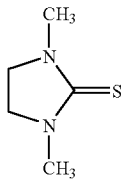

Compound Y

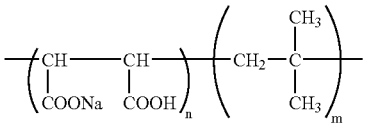

n and m each are an integer

To the emulsion desalted by washing with water, deionized gelatin, an aqueous solution of NaCl, and an aqueous solution of NaOH were added and temperature was elevated to 50° C. Then, pAg and pH were adjusted to 7.6 and 5.6 respectively. Thus, a gelatinous silver halide emulsion was obtained. The emulsion grains were revealed to be cubic and have a halogen composition of 98.9 mole % of silver chloride, 1 mole % of silver bromide and 0.1 mole % of silver iodide, an average side length of 0.70 μm and a variation coefficient of 8% in terms of the side length.

While keeping the above-mentioned emulsion grains at 60° C., spectral sensitizing dyes-1 and -2 were added in amount of $2.5\times10^{-4}$ mole/mole of Ag and $2.0\times10^{-4}$ mole/mole of Ag respectively. Further, a thiosulfonic acid compound-1 was added in amount of $1\times10^{-5}$ mole/mole of Ag, and an emulsion composed of fine grains having a halogen composition of 90 mole % of silver bromide and 10 mole % of silver chloride, and an average grain diameter of 0.05 μm, and further having a hexachloro iridium complex doped therein, was added and ripened for 10 minutes. Further, an emulsion composed of fine grains having a halogen composition of 40 mole % of silver bromide and 60 mole % of silver chloride, and an average grain diameter of 0.05 μm, therein was added and, repened for 10 minutes. By dissolution of these fine grains, the silver bromide content of the host cubic grains was increased up to 1.3 mole, and further having a hexachloro iridium complex doped therein in amount of $1\times10^{-7}$ mole per mole of Ag.

Subsequently, sodium thiosulfate and gold sensitizer-1 were added in amount of $1.5\times10^{-5}$ mole/mole of Ag and $2\times10^{-5}$ mole/mole of Ag respectively, and immediately after that, a temperature was elevated to 60° C. and then the emulsion was ripened for 40 minutes. Thereafter, the temperature was lowered to 50° C. Immediately after that, mercapto compounds-1 and -2 were added so as to become $6.4\times10^{4}$ mole/mole of Ag respectively. Thereafter, the emulsion was ripened for 10 minutes and then an aqueous solution of KBr was added so as to become 0.008 mole as compared with silver. After ripening for 10 minutes, the temperature was lowered and the emulsion was reserved.

Thus, Emulsion A-1 for a high-sensitive layer was prepared.

Cubic grains having an average side length of 0.55 μm and a variation coefficient of 9% in terms of the side length were prepared exactly in the same manner as in the above-mentioned preparation of the Emulsion A-1 except that temperature for forming grains was changed to 55° C.

Spectral sensitization and chemical sensitization were carried out in an amount that was corrected so as to adjust the specific surface area, i.e., side length ratio 0.7/0.55=1.27 times. Thus, Emulsion A-2 for a low-sensitive layer was prepared.

Here were used the same ones as the spectral sensitizing dyes-1 and -2, the thiosulfonic acid compound 1, mercapto compound-1 and -2, and gold sensitizer-1 in the above-mentioned Example (1)-1.

(Preparation of Green-sensitive Layer Emulsion C and Red-sensitive Layer Emulsion E)

Green-sensitive high-speed emulsion C-1 and Green-sensitive low-speed emulsion C-2 were prepared by the same preparation conditions as with the above-mentioned emulsions A-1 and A-2, except that the temperature during grain formation was lowered and sensitizing dyes were changed to sensitizing dyes D and E. Red-sensitive high-speed emulsion E-1 and Red-sensitive low-speed emulsion E-2 were prepared by the same preparation conditions as with the above-mentioned emulsions A-1 and A-2, except that the temperature during grain formation was lowered and sensitizing dyes were changed to sensitizing dyes G and H.

Here were used the same ones as the sensitizing dyes D, E, G and H, and Compound I to be added as in the above-mentioned Example (1)-1. Further, the added amounts thereof and grain sizes (average side lengths) were as same as in Example (1)-1.

Preparation of Coating Solution for First to Seventh Layers

First to Seventh layers were prepared in the same manner as in the above-mentioned Example (1)-1, respectively. Furthermore, to prevent irradiation, the following dyes (the number given in parenthesis represents the coating amount) were added.

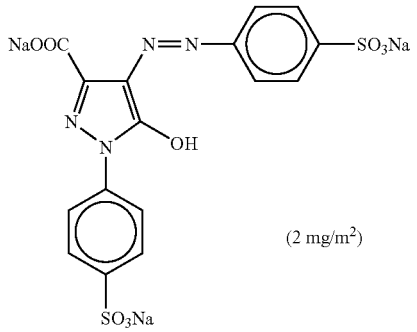

(2 mg/m$^2$)

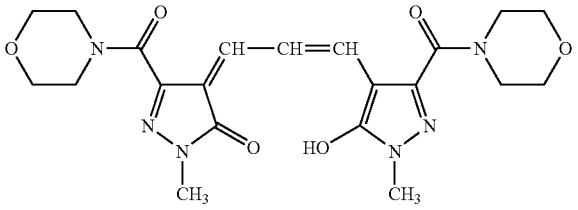

(2 mg/m$^2$)

-continued

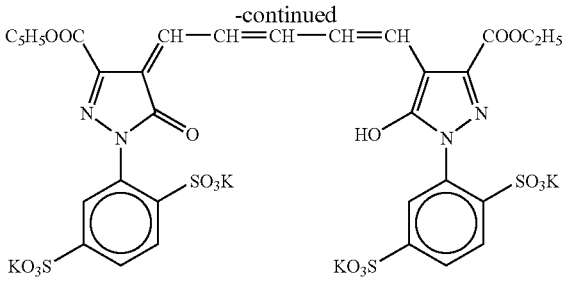

(3 mg/m$^2$)

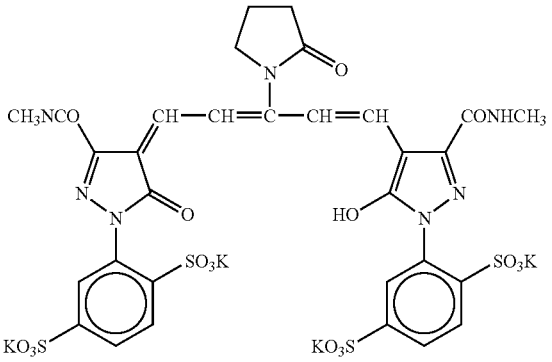

(7 mg/m$^2$)

(Layer Constitution)

The layer constitution herein was the same as that of Example (1)-1, except that the amounts of the yellow coupler ExY-1 in the first layer and gelatin, Solv-5 and Solv-6 in the third layer were changed to 0.56, 0.46, 0 (zero) and 0 (zero), respectively and except that the composition was changed to the following.

| Fifth Layer (Red-Sensitive Emulsion Layer) | |
|---|---|
| A silver chlorobromoiodide emulsion E (gold and sulfur sensitized, cubic, a 5:5 mixture of a large-size emulsion E-1 and a small-size emulsion E-2 (in terms of mol of silver)) | 0.10 |
| Gelatin | 1.11 |
| Cyan coupler (EXC-1) | 0.02 |
| Cyan coupler (EXC-3) | 0.01 |
| Cyan coupler (EXC-4) | 0.11 |
| Cyan coupler (EXC-5) | 0.01 |
| Color-image stabilizer (Cpd-1) | 0.01 |
| Color-mixing inhibitor (Cpd-6) | 0.06 |
| Color-image stabilizer (Cpd-7) | 0.02 |
| Color-image stabilizer (Cpd-9) | 0.04 |
| Color-image stabilizer (Cpd-10) | 0.01 |
| Color-image stabilizer (Cpd-14) | 0.01 |
| Color-image stabilizer (Cpd-15) | 0.12 |
| Color-image stabilizer (Cpd-16) | 0.01 |
| Color-image stabilizer (Cpd-17) | 0.01 |
| Color-image stabilizer (Cpd-18) | 0.07 |
| Color-image stabilizer (Cpd-20) | 0.01 |
| Ultraviolet absorbing agent (UV-7) | 0.01 |
| Solvent (Solv-5) | 0.15 |

-continued
Fifth Layer (Red-Sensitive Emulsion Layer)
(ExY-1) Yellow coupler
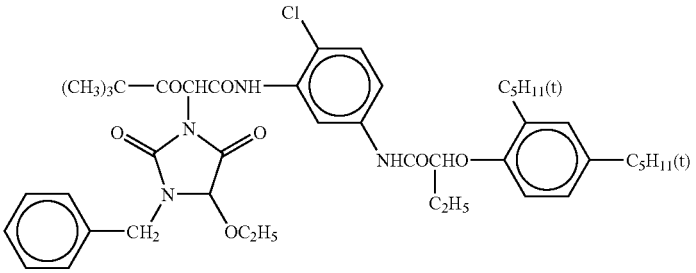
(ExY-2) Yellow coupler
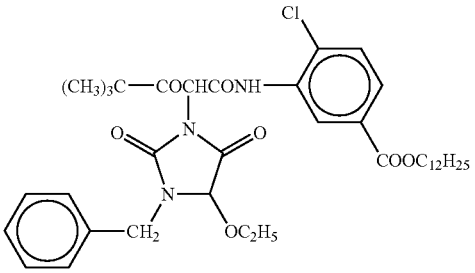
(ExY-3) Yellow coupler
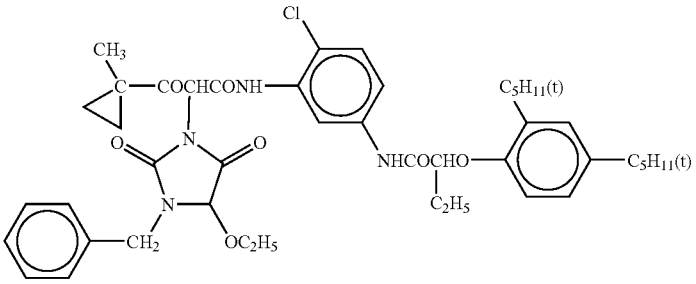
(ExC-4) Cyan coupler
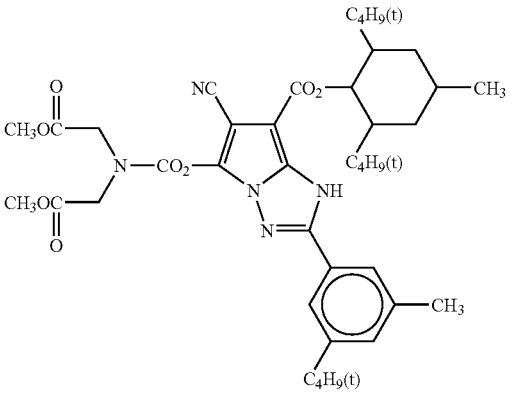

-continued
| Fifth Layer (Red-Sensitive Emulsion Layer) |
|---|
(ExC-5) Cyan coupler
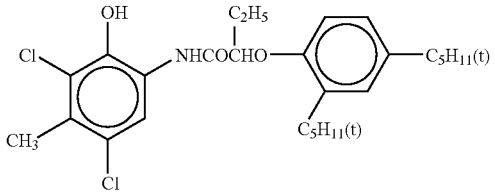
(Cpd-13) Surface-active agent
A mixture in 7:3 (molar ratio) of
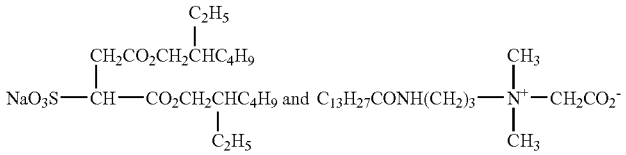
FS-3
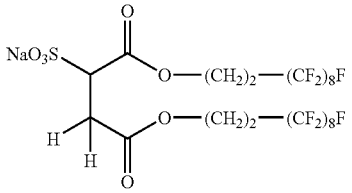
(Solv-8)
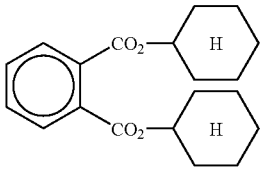
(Solv-9)
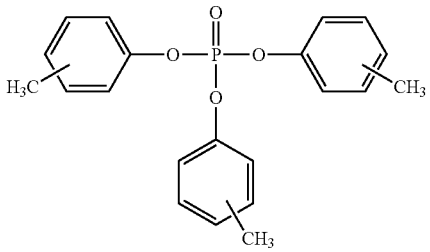
(UV-5) Ultraviolet absorbing agent
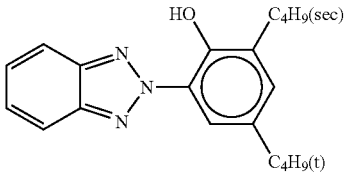
UV-B: A mixture of UV-1/UV-2/UV-3/UV-5/UV-6 = 13/3/3/5/3 (mass ratio)
UV-C: A mixture of UV-1/UV-3 = 9/1 (mass ratio)

Here were used the same ones as the magenta coupler ExM, the cyan couplers ExC-1, ExC-2 and ExC-3, the color image-stabilizers Cpd-1 to Cpd-12 and Cpd-20, the surface-active agents Cpd-14 to Cpd-18, the color-mixing inhibitor Cpd-19, the solvents Solv-1 to Solv-7, the compound S1-4, the ultraviolet absorbing agents UV-1 to UV-3, UV-6, UV-7 and UV-A as in Example (1)-1.

The processing method used in this example is described below.

Development Processing A

The above-mentioned light-sensitive material was subjected to the same continuous processing (running test) as in Example (1)-1. This processing with using the running processing solution was named as Process A. However, the drying at this continuous processing was carried out for 30 seconds, in this Example, pH in the tank solution was 10.15 and pH in the replenisher was 12.50. The fluorescent whitening agents FL-1 to FL-3 and the residual color reducing agent SR-1 used in this Example was the same as in Example (1)-1.

Developing Processing B

Thereafter, the above-mentioned light-sensitive material was subjected to the same processing B as in Example (1)-1, except that the color developing time was 20 seconds. This processing herein was also named as Processing B.

Next, sample 3-101 was prepared in the same manner as in sample 3-100 mentioned above, except that the composition of the first layer (blue-sensitive emulsion layer) was changed as follows.

Sample 3-101

The numerals represent the coating amount (g/m$^2$). The amount of a silver halide emulsion represents a coating amount in terms of silver.

First Layer (Blue-sensitive Emulsion Layer)

| | |
|---|---|
| A silver chlorobromoiodide emulsion A (gold and sulfur sensitized, cubic, a 3:7 mixture of a large-size emulsion A-1 and a small-size emulsion A-2 (in terms of mol of silver)) | 0.24 |
| Gelatin | 1.25 |
| Yellow coupler (ExY-1) | 0.56 (0.70 mmol/m$^2$) |
| Color-image stabilizer (Cpd-2) | 0.06 |
| Color-image stabilizer (Cpd-8) | 0.07 |
| Color-image stabilizer (Cpd-20) | 0.11 |
| Solvent (Solv-9) | 0.36 |

Samples 3-102 to 3-113 were prepared in the same manner as Sample 3-101 except that the coating amount of silver chlorobromoiodide emulsion A and the yellow coupler and its coating amount in the composition of the first layer were each changed as shown in Table 4.

TABLE 4

| Sample No. | Yellow coupler: Compound | Yellow coupler: Coating amount mmol/m$^2$ | Coating amount of emulsion in terms of silver g/m$^2$ | Remarks |
|---|---|---|---|---|
| 3-100 | ExY-1 | 0.70 | 0.24 | Comparative Example |
| 3-101 | ExY-1 | 0.70 | 0.24 | Comparative Example |
| 3-102 | ExY-2 | 0.60 | 0.21 | Comparative Example |
| 3-103 | ExY-3 | 0.55 | 0.19 | Comparative Example |
| 3-104 | Exemplified compound 1 | 0.40 | 0.15 | This invention |
| 3-105 | Exemplified compound 3 | 0.40 | 0.15 | This invention |
| 3-106 | Exemplified compound 14 | 0.50 | 0.15 | This invention |
| 3-107 | Exemplified compound 21 | 0.45 | 0.15 | This invention |
| 3-108 | Exemplified compound 24 | 0.40 | 0.15 | This invention |
| 3-109 | Exemplified compound 27 | 0.45 | 0.15 | This invention |
| 3-110 | Exemplified compound 29 | 0.50 | 0.15 | This invention |
| 3-111 | Exemplified compound 31 | 0.50 | 0.15 | This invention |
| 3-112 | Exemplified compound 33 | 0.45 | 0.15 | This invention |
| 3-113 | Exemplified compound 35 | 0.45 | 0.15 | This invention |

After reservation of thus-prepared Samples wherein each coating solution for the photographic constitution layer was coated to make a light-sensitive material for 10 days under the conditions of 25° C. and 55% RH, each sample was subjected to exposure and development processing. A continuous processing of each sample was carried out according to the above-described Development processing A and Development processing B, each of which was already subjected to a running test. A color print obtained from each sample was subjected to the following evaluation.

(Evaluation of Color Density)

The maximum yellow color density (Dmax1) obtained by the Development processing A and the maximum yellow color density (Dmax2) obtained by the Development processing B were measured. Further, a ratio of (Dmax2)/(Dmax1) was calculated. The closer to 1 the value of (Dmax2)/(Dmax1) is, the less the deterioration in a coloring property obtained by Development processing B whose processing time is shortened, as compared with the Development processing A. Specifically, the value of 0.97 or more is preferable in a practical use. In contrast, the value of less than 0.95 (it indicates substantially 5% or more of difference in density) is not deemed to be a preferable quality in a practical use.

(Evaluation of Color Reproduction)

From organoleptic evaluation with visual (eye) observation, it was confirmed that the samples containing the yellow coupler according to the present invention provide a hue that is high in saturation owing to a less magenta and/or cyan contamination in the yellow color.

(Evaluation of Fastness Property to Light)

To each sample having the above-mentioned cyan dye image, a xenon light was irradiated using a 100,000 lux xenon light irradiator through an ultraviolet radiation-cut filter having a transmittance of 50% at 370 nm and a heat-cut filter. A yellow density after irradiation to light for 14 days at the portion where the yellow density was 2.0 before irradiation to light was measured. The fastness property to light was indicated by a residual rate (%) of density.

(Evaluation of Fastness Property to Moisture and Heat)

The above-mentioned samples having a yellow dye image were preserved under the conditions of 80° C. and 70% RH. A yellow density after preservation for 28 days at the portion of the yellow density of 2.0 before preservation was measured. Such dark fastness property was indicated by a residual rate (%) of density.

TABLE 5

| Sample No. | Dmax 1 | (Dmax2)/(Dmax 1) | Fastness property to light | Fastness property to moisture and heat | Remarks |
|---|---|---|---|---|---|
| 3-100 | 2.17 | 0.91 | 88 | 82 | Comparative example |
| 3-101 | 2.23 | 0.92 | 86 | 80 | Comparative example |
| 3-102 | 2.16 | 0.93 | 75 | 76 | Comparative example |
| 3-103 | 2.25 | 0.95 | 77 | 88 | Comparative example |
| 3-104 | 2.18 | 0.99 | 86 | 96 | This invention |
| 3-105 | 2.24 | 0.98 | 88 | 98 | This invention |
| 3-106 | 2.03 | 0.97 | 87 | 94 | This invention |
| 3-107 | 2.22 | 0.98 | 90 | 98 | This invention |
| 3-108 | 2.20 | 0.99 | 89 | 97 | This invention |
| 3-109 | 2.13 | 0.98 | 93 | 98 | This invention |
| 3-110 | 2.26 | 0.97 | 92 | 96 | This invention |
| 3-111 | 2.08 | 0.98 | 89 | 97 | This invention |
| 3-112 | 2.14 | 0.99 | 91 | 96 | This invention |
| 3-113 | 2.16 | 0.98 | 93 | 98 | This invention |

As is apparent from Table 5, it is seen that samples of the present invention provide a sufficient Dmax, and in the case where an image is obtained according to an ultra-rapid processing, reduction in Dmax (ΔDmax) is considerably improved, as compared with comparative samples. Accordingly, a color print suitable for advances in rapid processing can be provided by the composition of the present invention.

Further, in the comparative samples using previous yellow couplers, coating amounts of the coupler and the silver halide emulsion are necessary from 1.3 to 1.6 times as much as the samples of the present invention, as compared with each other at almost the same level of colored density. Therefore, in the samples of the present invention, a coating amount of each of the coupler and the silver halide emulsion can be reduced to the level of 80% to 60% of the comparative samples. In other words, the samples of the present invention have more advantages than the comparative samples in the point of saving of resources such as couplers and silver.

Further, the samples of the present invention exhibit good image fastness properties to light and heat. Particularly, the samples of the present invention have advantages in much more excellent image fastness properties to moisture and heat, as compared with comparative samples.

Examples (3)-2

Samples 3-201 to 3-210 were prepared in the same manner as in Sample 3-101 in the above-mentioned Example 3-1 except that the coating amount of silver chlorobromoiodide emulsion A, the yellow coupler and its coating amount in the composition of the first layer were each changed as shown in Table 6.

The colored samples was obtained by being subject to the same exposure and developing process as in Example (3)-1. As the result, in all samples, a satisfied density was provided as the maximum density 2.0 or more. Further, the value of (Dmax2)/(Dmax1) was measured in the same manner as in Example (3)-1 and shown in Table 6.

TABLE 6

| Sample No. | Yellow coupler: Compound | Yellow coupler: Coating amount mmol/m$^2$ | Coating amount of emulsion in terms of silver g/m$^2$ | (Dmax2)/(Dmax1) | Remarks |
|---|---|---|---|---|---|
| 3-101 | ExY-1 | 0.70 | 0.24 | 0.92 | Comparative example |
| 3-201 | ExY-1<br>Exemplified compound 3 | 0.55<br>0.10 | 0.22 | 0.95 | This invention |
| 3-202 | ExY-1<br>Exemplified compound 3 | 0.18<br>0.30 | 0.17 | 0.98 | This invention |
| 3-203 | Exemplified compound 3 | 0.40 | 0.15 | 0.99 | This invention |
| 3-204 | Exemplified compound 3 | 0.50 | 0.13 | 0.99 | This invention |
| 3-205 | Exemplified compound 3 | 0.60 | 0.12 | 0.98 | This invention |
| 3-206 | ExY-2<br>Exemplified compound 26 | 0.54<br>0.10 | 0.22 | 0.95 | This invention |
| 3-207 | ExY-2<br>Exemplified compound 26 | 0.18<br>0.30 | 0.20 | 0.97 | This invention |
| 3-208 | Exemplified compound 26 | 0.40 | 0.15 | 0.98 | This invention |
| 3-209 | Exemplified compound 26 | 0.50 | 0.13 | 0.99 | This invention |

TABLE 6-continued

| Sample No. | Yellow coupler Compound | Yellow coupler Coating amount mmol/m$^2$ | Coating amount of emulsion in terms of silver g/m$^2$ | (Dmax2)/(Dmax1) | Remarks |
|---|---|---|---|---|---|
| 3-210 | Exemplified compound 26 | 0.60 | 0.12 | 0.98 | This invention |

As is apparent from Table 6, it is seen that the yellow coupler according to the present invention may be used in combination with a previous coupler, and for obtaining in this case an ultra-rapid suitability that is an effect of the present invention, the amount of the yellow coupler according to the present invention is preferably at least 0.1 mmol/m$^2$, more preferably 0.3 mmol/m$^2$ or more and 0.6 mmol/m$^2$ or less. The yellow coupler according to the present invention may be used in an amount of 0.6 mmol/m$^2$ or more. However, such amount is not preferable from the viewpoint of "effective use" for a coupler. Further, it is seen from the results obtained in this Example that the coating amount of the silver halide emulsion is preferable in the range of 0.12 to 0.22 g/m$^2$ in terms of silver, whereby an effect of the present invention can be substantially obtained.

Example (3)-3

A sample was prepared in the same manner as Sample 3-100 prepared above except that the composition of the first layer (blue-sensitive layer) was replaced as follows. The sample was named as 3-301.

Sample 3-301

The numerals represent the coating amount (g/m$^2$). The amount of a silver halide emulsion represents a coating amount in terms of silver.

First Layer (Blue-Sensitive Emulsion Layer)

| | |
|---|---|
| A silver chlorobromoiodide emulsion A (gold and sulfur sensitized, cubic, a 3:7 mixture of a large-size emulsion A-1 and a small-size emulsion A-2 (in terms of mol of silver)) | 0.19 |
| Gelatin | 1.00 |
| Yellow coupler (ExY-1) | 0.45 (0.56 mmol/m$^2$) |
| Color-image stabilizer (Cpd-2) | 0.048 |
| Color-image stabilizer (Cpd-8) | 0.056 |
| Color-image stabilizer (Cpd-20) | 0.088 |
| Solvent (Solv-9) | 0.29 |

Samples 3-302 to 3-310 were prepared in the same manner as Sample 3-101 except that the coating amount of silver chlorobromoiodide emulsion A and the yellow coupler and its coating amount in the composition of the first layer were each changed as shown in Table 7.

TABLE 7

| Sample No. | Yellow coupler Compound | Yellow coupler Coating amount mmol/m$^2$ | Coating amount of emulsion in terms of silver g/m$^2$ | Remarks |
|---|---|---|---|---|
| 3-100 | ExY-1 | 0.70 | 0.24 | Comparative example |
| 3-301 | ExY-1 | 0.56 | 0.19 | Comparative example |
| 3-302 | ExY-2 | 0.56 | 0.19 | Comparative example |
| 3-303 | ExY-3 | 0.45 | 0.17 | Comparative example |
| 3-304 | Exemplified compound 3 | 0.56 | 0.12 | This invention |
| 3-305 | Exemplified compound 3 | 0.40 | 0.12 | This invention |
| 3-306 | Exemplified compound 3 | 0.32 | 0.12 | This invention |
| 3-307 | Exemplified compound 3 | 0.56 | 0.11 | This invention |
| 3-308 | ExY-1<br>Exemplified compound 3 | 0.32<br>0.20 | 0.16 | This invention |
| 3-309 | Exemplified compound 27 | 0.32 | 0.13 | This invention |
| 3-310 | Exemplified compound 33 | 0.32 | 0.13 | This invention |

Each sample obtained as above was subjected to exposure and development processing in the same manner as in Example (3)-1, and the value of (Dmax2)/(Dmax1) was measured in the same manner as in Example 3-1. The results are shown in Table 8.

It is seen from the results in Table 8 that colored samples having the maximum colored density of from 1.7 to 1.9 were produced from samples 3-301 to 3-310 in this Example. These colored densities of these samples 3-301 to 3-310 are sufficient in practical use, even though they are somewhat insufficient for impression of visually strong yellow, as compared with sample 3-101 that gives the maximum colored density of 2.2.

As is apparent from the results in Table 8, similarly in Example (3)-1, the effects of the present invention were also obtained by the composition in this Example of the present invention. Further, it is seen from the results of Sample 3-308 in Table 8 that the yellow coupler according to the present invention is preferably used in an amount of at least 0.2 mmol/m$^2$ in order to obtain the effect of the present invention. Further, it is seen from the results of Sample 3-307 that the coating amount of a silver halide emulsion is preferable at least 0.11 g/m$^2$.

TABLE 8

| Sample No. | Dmax 1 | (Dmax2)/(Dmax1) | Remarks |
|---|---|---|---|
| 3-100 | 2.17 | 0.91 | Comparative example |
| 3-301 | 1.74 | 0.93 | Comparative example |
| 3-302 | 1.85 | 0.94 | Comparative example |
| 3-303 | 1.73 | 0.96 | Comparative example |
| 3-304 | 1.90 | 0.98 | This invention |
| 3-305 | 1.82 | 0.99 | This invention |
| 3-306 | 1.74 | 0.99 | This invention |
| 3-307 | 1.72 | 0.99 | This invention |
| 3-308 | 1.77 | 0.98 | This invention |
| 3-309 | 1.81 | 0.99 | This invention |
| 3-310 | 1.75 | 0.99 | This invention |

Example (3)-4

A sample was prepared in the same manner as Sample 3-101 in Example (3)-1 prepared above except that the composition of the first layer (blue-sensitive layer) was replaced as follows. The sample was named as 3-401.

Sample 3-401

The numerals represent the coating amount (g/m$^2$). The amount of a silver halide emulsion represents a coating amount in terms of silver.

First Layer (Blue-Sensitive Emulsion Layer)

| | |
|---|---|
| A silver chlorobromoiodide emulsion A (gold and sulfur sensitized, cubic, a 3:7 mixture of a large-size emulsion A-1 and a small-size emulsion A-2 (in terms of mol of silver)) | 0.24 |
| Gelatin | 1.10 |
| Yellow coupler (ExY-1) | 0.56 (0.70 mmol/m$^2$) |
| Color-image stabilizer (Cpd-2) | 0.03 |

-continued

| | |
|---|---|
| Color-image stabilizer (Cpd-8) | 0.04 |
| Color-image stabilizer (Cpd-20) | 0.10 |
| Solvent (Solv-9) | 0.30 |

Samples 3-402 to 3-411 were prepared in the same manner as Sample 3-401 except that the coating amount of silver chlorobromoiodide emulsion A, the yellow coupler, its coating amount and the gelatin coating amount in the composition of the first layer were each changed as shown in Table 9. In addition, a surface-active agent (Cpd-13) of the 7th layer in all samples in this Example was omitted and replaced with FS-3 (4 mg/m$^2$).

TABLE 9

| Sample No. | Yellow coupler Compound | Yellow coupler Coating amount mmol/m$^2$ | Coating amount of emulsion in terms of silver g/m$^2$ | Coating amount of gelatin in blue-sensitive layer g/m$^2$ | Remarks |
|---|---|---|---|---|---|
| 3-401 | ExY-1 | 0.70 | 0.24 | 1.10 | Comparative example |
| 3-402 | ExY-1 | 0.70 | 0.24 | 0.90 | Comparative example |
| 3-403 | ExY-1 | 0.70 | 0.24 | 0.70 | Comparative example |
| 3-404 | ExY-2 | 0.60 | 0.22 | 0.90 | Comparative example |
| 3-405 | ExY-2 | 0.60 | 0.22 | 0.70 | Comparative example |
| 3-406 | Exemplified compound 3 | 0.40 | 0.15 | 0.98 | This invention |
| 3-407 | Exemplified compound 3 | 0.40 | 0.15 | 0.95 | This invention |
| 3-408 | Exemplified compound 35 | 0.40 | 0.16 | 0.97 | This invention |
| 3-409 | Exemplified compound 35 | 0.40 | 0.16 | 0.98 | This invention |
| 3-410 | Exemplified compound 37 | 0.45 | 0.15 | 0.99 | This invention |
| 3-411 | Exemplified compound 37 | 0.45 | 0.15 | 0.98 | This invention |

Each sample obtained as above was subjected to exposure and development processing in the same manner as in Example 3-1, and the value of (Dmax2)/(Dmax1) was measured in the same manner as in Example 3-1. The results are shown in Table 10.

As is apparent from the results in Table 10, the values of (Dmax2)/(Dmax1) in Samples 3-406 to 3-411 were extremely close to 1, and high-quality prints were provided without reduction in Dmax even in a processing in which a development processing time is shortened (i.e., Development processing B). Turning to the comparative samples, the increase in the ratio of (Dmax2)/(Dmax1) is slightly recognized in Samples 3-403 and 3-405 wherein the gelatin amount was reduced. However, such slight increase in the ratio of the comparative samples did not provide a satisfactory improvement, as compared with the samples of the present invention. Further, after the Samples 3-403 and 3-405 in this Example were reserved for 1 week under the conditions of 80° C. and 70% RH, deterioration of the image obscurity was recognized, whereas such deterioration was not in the samples of the present invention.

TABLE 10

| Sample No. | Dmax1 | (Dmax2)/(Dmax1) | Remarks |
|---|---|---|---|
| 3-401 | 2.23 | 0.93 | Comparative example |
| 3-402 | 2.16 | 0.93 | Comparative example |
| 3-403 | 2.25 | 0.95 | Comparative example |
| 3-404 | 2.18 | 0.95 | Comparative example |
| 3-405 | 2.24 | 0.96 | Comparative example |
| 3-406 | 2.35 | 0.99 | This invention |
| 3-407 | 2.22 | 0.98 | This invention |
| 3-408 | 2.20 | 0.98 | This invention |
| 3-409 | 2.13 | 0.99 | This invention |
| 3-410 | 2.26 | 0.98 | This invention |
| 3-411 | 2.30 | 0.98 | This invention |

Example (3)-5

(Preparation of Emulsions B-H, B-L, G-H, G-L, R-H, and R-L)

Emulsions B-H, B-L, G-H, G-L, R-H, and R-L were prepared in the same manner as in Example (1)-3 mentioned above.

Preparation of the coating solution for the first layer to the 7th layer was carried out in the same manner as in Example (3)-1. Sample 3-501 having the same composition as in Example (3)-1 except for the layer constitution described below was prepared.

(Layer Constitution)

The composition of each layer is shown below. The numbers show coating amounts (g/m 2). In the case of the silver halide emulsion, the coating amount is in terms of silver.

Support

Polyethylene Resin Laminated Paper

{The polyethylene resin on the first layer side contained a white pigment ($TiO_2$: content of 16 mass %, ZnO: content of 4 mass %), a fluorescent whitening agent (4,4'-bis(5-methylbenzoxazolyl)stilbene: content of 0.03 mass %) and a bluish dye (ultramarine: content of 0.33 mass %), an amount of polyethylene resin is 29.2 g/$m^2$}

First Layer (Blue-Sensitive Emulsion Layer)

| | |
|---|---|
| A silver chlorobromoiodide emulsion (gold and sulfur sensitized, cubic, a 3:7 mixture of a large-size emulsion B-H and a small-size emulsion B-L (in terms of mol of silver)) | 0.24 |
| Gelatin | 1.10 |
| Yellow coupler (ExY-1) | 0.56 (0.70 mmol/$m^2$) |
| Color-image stabilizer (Cpd-2) | 0.03 |
| Color-image stabilizer (Cpd-8) | 0.04 |
| Color-image stabilizer (Cpd-20) | 0.10 |
| Solvent (Solv-9) | 0.30 |

Second Layer (Color-Mixing Inhibiting Layer)

The same constitution as the second layer described in Example (3)-1.

Third Layer (Green-Sensitive Emulsion Layer)

| | |
|---|---|
| A silver chlorobromoiodide emulsion (gold and sulfur sensitized, cubic, a 1:3 mixture of a large-size emulsion G-H and a small-size emulsion G-L (in terms of mol of silver)) | 0.14 |
| Gelatin | 0.46 |
| Magenta coupler (ExM) | 0.15 |
| Ultraviolet absorbing agent (UV-A) | 0.14 |
| Color-image stabilizer (Cpd-2) | 0.003 |
| Color-mixing inhibitor (Cpd-4) | 0.002 |
| Color-image stabilizer (Cpd-6) | 0.09 |
| Color-image stabilizer (Cpd-8) | 0.02 |
| Color-image stabilizer (Cpd-9) | 0.01 |
| Color-image stabilizer (Cpd-10) | 0.01 |
| Color-image stabilizer (Cpd-11) | 0.0001 |
| Solvent (Solv-3) | 0.09 |
| Solvent (Solv-4) | 0.18 |
| Solvent (Solv-5) | 0.17 |

Fourth Layer (Color-Mixing Inhibiting Layer)

The same constitution as the fourth layer described in Example (3)-1.

Fifth Layer (Red-Sensitive Emulsion Layer)

| | |
|---|---|
| A silver chlorobromoiodide emulsion (gold and sulfur sensitized, cubic, a 5:5 mixture of a large-size emulsion R-H and a small-size emulsion R-L (in terms of mol of silver)) | 0.10 |
| Gelatin | 1.11 |
| Cyan coupler (ExC-1) | 0.02 |
| Cyan coupler (ExC-3) | 0.01 |
| Cyan coupler (ExC-4) | 0.11 |
| Cyan coupler (ExC-5) | 0.01 |
| Color-image stabilizer (Cpd-1) | 0.01 |
| Color-image stabilizer (Cpd-6) | 0.06 |
| Color-image stabilizer (Cpd-7) | 0.02 |
| Color-image stabilizer (Cpd-9) | 0.04 |
| Color-image stabilizer (Cpd-10) | 0.01 |
| Color-image stabilizer (Cpd-14) | 0.01 |
| Color-image stabilizer (Cpd-15) | 0.12 |
| Color-image stabilizer (Cpd-16) | 0.01 |
| Color-image stabilizer (Cpd-17) | 0.01 |
| Color-image stabilizer (Cpd-18) | 0.07 |
| Color-image stabilizer (Cpd-20) | 0.01 |
| Ultraviolet absorbing agent (UV-7) | 0.01 |
| Solvent (Solv-5) | 0.15 |

Sixth Layer (Ultraviolet Absorbing Layer)

The same constitution as the sixth layer described in Example (3)-1.

Seventh Layer (Protective Layer)

The same constitution as the seventh layer described in Example (3)-1.

Samples 3-502 to 3-511 were prepared in the same manner as Sample 3-501 except that the coating amount of silver chlorobromoiodide emulsion, the yellow coupler and its coating amount in the composition of the first layer were each changed as shown in Table 11.

The same evaluation as in Example 3-1 was carried out. Then, the same effects of the present invention as in Example (3)-1 were also obtained in Samples 3-502 to 3-511 of the present invention.

TABLE 11

| Sample No. | Yellow coupler Compound | Coating amount mmol/m$^2$ | Coating amount of emulsion in terms of silver g/m$^2$ | Remarks |
|---|---|---|---|---|
| 3-501 | ExY-1 | 0.70 | 0.24 | Comparative example |
| 3-502 | Exemplified compound 1 | 0.40 | 0.15 | This invention |
| 3-503 | Exemplified compound 3 | 0.40 | 0.15 | This invention |
| 3-504 | Exemplified compound 14 | 0.50 | 0.15 | This invention |
| 3-505 | Exemplified compound 21 | 0.45 | 0.15 | This invention |
| 3-506 | Exemplified compound 24 | 0.40 | 0.15 | This invention |
| 3-507 | Exemplified compound 27 | 0.45 | 0.15 | This invention |
| 3-508 | Exemplified compound 29 | 0.50 | 0.15 | This invention |
| 3-509 | Exemplified compound 31 | 0.50 | 0.15 | This invention |
| 3-510 | Exemplified compound 33 | 0.45 | 0.15 | This invention |
| 3-511 | Exemplified compound 35 | 0.45 | 0.15 | This invention |

Example (4)-1

In Examples (4)-1 and (4)-2, the compound having the same reference letter as in Example (1)-1 shows the same chemical significance as in Example (1)-1, otherwise specially noticed.

(Preparation of Emulsion B-1)

1000 ml of a 3% aqueous solution of lime-processed gelatin was prepared, and pH and pCl were adjusted to 5.5 and 1.7 respectively. An aqueous solution containing 2.12 mole of silver nitrate and an aqueous solution containing 2.2 mole of sodium chloride were simultaneously added thereto with a vigorous stirring at 55° C. (according to the double jet method). At the step of the addition of from 80% to 90% of the entire silver nitrate amount, aqueous solution of $K_4[Ru(CN)_6]$ was added so that the Ru amount became $3\times10^{-5}$ mole per mole of the finished silver halide. After the mixture was subjected to desalting at 40° C., 168 g of a lime-processed gelatin was added, and then pH and pCl were adjusted to 5.5 and 1.8 respectively. The obtained emulsion grains were revealed to be cubic silver chloride having an equivalent-sphere diameter of 0.55 μm and a variation coefficient of 11%.

To the emulsion melted at 40° C., sodium thiosulfonate was added in an amount of $2\times10^{-5}$ mole per mole of the silver halide, and the emulsion was optimally ripened at 60° C. with a sulfur sensitizer (sodium thiosulfate penta-hydrate) and a gold sensitizer (S-2). After the temperature was lowered to 40° C., a spectral sensitizing dye A, a spectral sensitizing dye B, 1-phenyl-5-mercaptotetrazole, 1-(5-methylureidophenyl)-5-mercaptotetrazole and potassium bromide were added thereto in an amount of $2.7\times10^{-4}$ mole, $1.4\times10^{-4}$ mole, $2.7\times10^{-4}$ mole, $2.7\times10^{-4}$ mole, and $2.7\times10^{-3}$ mole, per mole of the silver halide respectively. The thus-obtained emulsion was taken as Emulsion B-1.

In this Example, here were used the same ones as sensitizing dyes A and B in Example (1)-3.

(Preparation of Emulsion B-2)

An emulsion was prepared in the same manner as in the preparation of Emulsion B-1 except that potassium bromide was added so as to become 3 mole % per mole of the finished silver halide at the step of the addition of from 80% to 90% of the entire silver nitrate amount. The thus-obtained emulsion was taken as Emulsion B-2.

(Preparation of Emulsion B-3)

An emulsion was prepared in the same manner as in the preparation of Emulsion B-1 except that potassium iodide was added so as to become 0.3 mole % of Ir content per mole of the finished silver halide when the addition of 90% of the entire silver nitrate amount was terminated. The thus-obtained emulsion was taken as Emulsion B-3.

(Preparation of Emulsion B-4)

An emulsion was prepared in the same manner as in the preparation of Emulsion B-1 except that potassium bromide was added so as to become 3 mole % per mole of the finished silver halide at the step of the addition of from 80% to 90% of the entire silver nitrate amount, and further when the addition of 90% of the entire silver nitrate amount was terminated, an aqueous solution of potassium iodide was added so that the I amount became 0.3 mole % per mole of the finished silver halide. The thus-obtained emulsion was taken as Emulsion B-4.

(Preparation of Emulsion B-5)

An emulsion was prepared in the same manner as in the preparation of Emulsion B-1 except that an aqueous solution of $K_2[Ir(5\text{-methythiazole})Cl_5]$ was added at the step of the addition of from 92% to 98% of the entire silver nitrate amount, so that the Ir amount became $1.0\times10^{-6}$ mole per mole of the finished silver halide. The thus-obtained emulsion was taken as Emulsion B-5.

(Preparation of Emulsion B-6)

An emulsion was prepared in the same manner as in the preparation of Emulsion B-4 except that an aqueous solution of $K_2[IrCl_6]$ was added at the step of the addition of from 82% to 88% of the entire silver nitrate amount, so that the Ir amount became $5.3\times10^{-8}$ mole per mole of the finished silver halide. The thus-obtained emulsion was taken as Emulsion B-6.

(Preparation of Emulsion B-7)

An emulsion was prepared in the same manner as in the preparation of Emulsion B-4 except that an aqueous solution of $K_2[Ir(5\text{-methythiazole})Cl_5]$ was added at the step of the addition of from 92% to 98% of the entire silver nitrate amount, so that the Ir amount became $1.0\times10^{-6}$ mole per mole of the finished silver halide. The thus-obtained emulsion was taken as Emulsion B-7.

(Preparation of Emulsion B-8)

An emulsion was prepared in the same manner as in the preparation of Emulsion B-4 except that an aqueous solution of $K_2[IrCl_6]$ was added at the step of the addition of from 82% to 88% of the entire silver nitrate amount so that the Ir amount became $4.3\times10^{-8}$ mole per mole of the finished silver halide, and further an aqueous solution of $K_2[Ir(5\text{-methythiazole})Cl_5]$ was added at the step of the addition of from 92% to 98% of the entire silver nitrate amount, so that the Ir amount became $8.0\times10^{-7}$ mole per mole of the finished silver halide, and further an aqueous solution of $K_2(H_2O)Cl_5]$ was added so that the Ir amount became $1.6\times10^{-6}$ mole per mole of the finished silver halide. The thus-obtained emulsion was taken as Emulsion B-8.

(Preparation of Emulsion G-1)

1000 ml of a 3% aqueous solution of lime-processed gelatin was prepared, and pH and pCl were adjusted to 5.5 and 1.7 respectively. An aqueous solution containing 2.12 mole of silver nitrate and an aqueous solution containing 2.2 mole of sodium chloride were simultaneously added thereto with a vigorous stirring at 45° C. Potassium bromide was added with a vigorous stirring so as to become 4.3 mole % per mole of the finished silver halide at the step of the addition of from 80% to 100% of the entire silver nitrate amount. At the step of the addition of from 80% to 90% of the entire silver nitrate amount, aqueous solution of $K_4[Ru(CN)_6]$ was added so that the Ru amount became $3\times10^{-5}$ mole per mole of the finished silver halide. Further, at the step of the addition of from 83% to 88% of the entire silver nitrate amount, an aqueous solution of $K_2[IrCl_6]$ was added so that the Ir amount became $5\times10^{-8}$ mole per mole of the finished silver halide. Further, when the addition of 90% of the entire silver nitrate amount was terminated, an aqueous solution of potassium iodide was added with a vigorous stirring so that the I amount became 0.15 mole % per mole of the finished silver halide. An aqueous solution of $K_2[Ir(5\text{-methythiazole})Cl_5]$ was added at the step of the addition of from 92% to 95% of the entire silver nitrate amount, so that the Ir amount became $5\times10^{-7}$ mole per mole of the finished silver halide. Further, at the step of the addition of from 95% to 98% of the entire silver nitrate amount, an aqueous solution of $K_2[Ir(H_2O)Cl_5]$ was added so that the Ir amount became $5\times10^{-7}$ mole per mole of the finished silver halide. After the mixture was subjected to desalting at 40° C., 168 g of a lime-processed gelatin was added, and then pH and pCl were adjusted to 5.5 and 1.8 respectively. The obtained emulsion grains were revealed to be cubic silver chloride having an equivalent-sphere diameter of 0.35 μm and a variation coefficient of 10%.

To the emulsion melted at 40° C., sodium thiosulfonate was added in an amount of $2\times10^{-5}$ mole per mole of the silver halide, and the emulsion was optimally ripened at 60° C. with a sulfur sensitizer (sodium thiosulfate penta-hydrate) and a gold sensitizer (S-2). After the temperature was lowered to 40° C., a spectral sensitizing dye D, 1-phenyl-5-mercaptotetrazole, 1-(5-methylureidophenyl)-5-mercaptotetrazole and potassium bromide were added thereto in an amount of $6\times10^{-4}$ mole, $2\times10^{-4}$ mole, $8\times10^{-4}$ mole, and $7\times10^{-3}$ mole, per mole of the finished silver halide respectively. The thus-obtained emulsion was taken as Emulsion G-1.

Here were used the same ones as the sensitizing dyes D and E in the Example (1)-1.

(Preparation of Emulsion R-1)

1000 ml of a 3% aqueous solution of lime-processed gelatin was prepared, and pH and pCl were adjusted to 5.5 and 1.7 respectively. An aqueous solution containing 2.12 mole of silver nitrate and an aqueous solution containing 2.2 mole of sodium chloride were simultaneously added thereto with a vigorous stirring at 45° C. Potassium bromide was added with a vigorous stirring so as to become 4.3 mole % per mole of the finished silver halide at the step of the addition of from 80% to 100% of the entire silver nitrate amount. At the step of the addition of from 80% to 90% of the entire silver nitrate amount, aqueous solution of $K_4[Ru(CN)_6]$ was added so that the Ru amount became $3\times10^{-5}$ mole per mole of the finished silver halide. Further, at the step of the addition of from 83% to 88% of the entire silver nitrate amount, an aqueous solution of $K_2[IrCl_6]$ was added so that the Ir amount became $5\times10^{-8}$ mole per mole of the finished silver halide. Further, when the addition of 90% of the entire silver nitrate amount was terminated, an aqueous solution of potassium iodide was added with a vigorous stirring so that the I amount became 0.1 mole % per mole of the finished silver halide. An aqueous solution of $K_2[Ir(5\text{-methythiazole})Cl_5]$ was added at the step of the addition of from 92% to 95% of the entire silver nitrate amount, so that the Ir amount became $5\times10^{-7}$ mole per mole of the finished silver halide. Further, at the step of the addition of from 95% to 98% of the entire silver nitrate amount, an aqueous solution of $K_2[Ir(H_2O)Cl_5]$ was added so that the Ir amount became $5\times10^{-7}$ mole per mole of the finished silver halide. After the mixture was subjected to desalting at 40° C., 168 g of a lime-processed gelatin was added, and then pH and pCl were adjusted to 5.5 and 1.8 respectively. The obtained emulsion grains were revealed to be cubic silver iodobromochloride having an equivalent-sphere diameter of 0.35 μm and a variation coefficient of 10%.

To the emulsion melted at 40° C., sodium thiosulfonate was added in an amount of $2\times10^{-5}$ mole per mole of the silver halide, and the emulsion was optimally ripened at 60° C. with a sulfur sensitizer (sodium thiosulfate penta-hydrate) and a gold sensitizer (S-2). After the temperature was lowered to 40° C., a spectral sensitizing dye H, 1-phenyl-5-mercaptotetrazole, 1-(5-methylureidophenyl)-5-mercaptotetrazole, compound I and potassium bromide were added thereto in an amount of $2\times10^{-4}$ mole, $2\times10^{-4}$ mole, $8\times10^{-4}$ mole, $1\times10^{-3}$ mole, and $7\times10^{-3}$ mole, per mole of the silver halide respectively. The thus-obtained emulsion was taken as Emulsion R-1.

Here were used the same ones as the sensitizing dyes G and H and Compound I in Example (1)-1.

The surface of a paper support laminated on both sides with a polyethylene resin was corona discharged. The support was provided with a gelatin undercoat layer containing sodium dodecylbenzenesulfonate and, further, the first to seventh photographic constitutional layers were coated in order on the undercoat layer to prepare a silver halide color photographic light-sensitive material having the following composition. The coating solution of each photographic constitutional layer was prepared as follows.

(Sensitizing dye F)

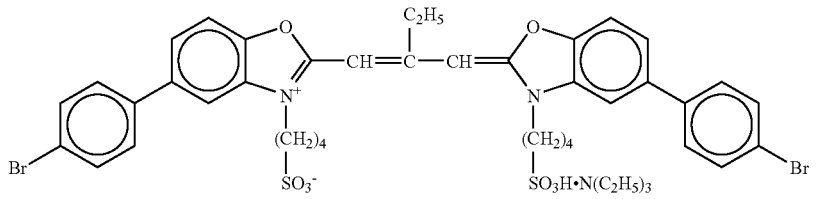

Preparation of Coating Solution for First Layer 57 g of a yellow coupler (ExY), 7 g of a color image stabilizer (Cpd-1), 4 g of a color image stabilizer (Cpd-2), 7 g of a color image stabilizer (Cpd-3), and 2 g of a color image stabilizer (Cpd-8) were dissolved in 21 g of a solvent (Solv-1) and 80 ml of ethyl acetate. This solution was emulsified and dispersed by means of a high velocity stirring emulsifier (dissolver) in 220 g of a 23.5 mass % aqueous gelatin solution containing 4 g of sodium dodecylbenzenesulfonate, and water was added thereto to obtain 900 g of Emulsified Dispersion A.

On the other hand, the above Emulsified Dispersion A and Emulsion B-1 were mixed and dissolved to prepare a coating solution for the first layer having the composition shown below. The coating amount of the emulsion is indicated in terms of silver.

The coating solution for the second to seventh layers were prepared in the same manner as the coating solution for the first layer. I-Oxy-3,5-dichloro-s-triazine sodium salts H-1, H-2 and H-3 were used as gelatin hardening agents in each layer. Further, Ab-1, Ab-2, Ab-3 and Ab-4 were added to each layer in an amount of 15.0 mg/m$^2$, 60.0 mg/m$^2$, 5.0 mg/m$^2$ and 10.0 mg/m$^2$ respectively.

Here were used the same ones as the hardening agents H-1 to H-3 and antispetics Ab-1 to Ab-4 in Example (1)-1.

Further, 1-phenyl-5-mercaptotetrazole was added to the green-sensitive emulsion layer, and the red-sensitive emulsion layer, in respective amounts of $1.0\times10^{-3}$ mole and $5.9\times10^{-4}$ mole, per mole of silver halide. Further, 1-phenyl-5-mercaptotetrazole was added to the second layer, the fourth layer and the sixth layer, in respective amounts of 0.2 mg/m$^2$, 0.2 mg/m$^2$, 0.6 mg/m$^2$.

To the red-sensitive emulsion layer, was added a copolymer latex of methacrylic acid and butyl acrylate (1:1 in mass ratio; average molecular weight, 200,000 to 400,000) in an amount of 0.05 g/m$^2$.

Further, to the second layer, the fourth layer, and the sixth layer, was added disodium catechol-3,5-disulfonate in amounts of 6 mg/m$^2$, 6 mg/m$^2$, and 18 mg/m$^2$ respectively.

Further, to neutralize irradiation, the following dyes were added (the coating amounts are shown in parentheses).

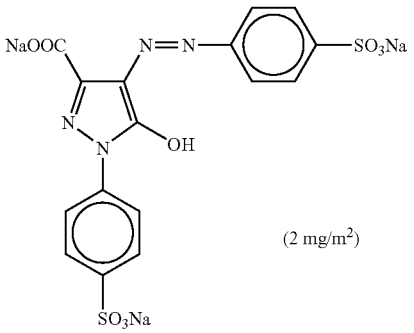

(2 mg/m$^2$)

-continued

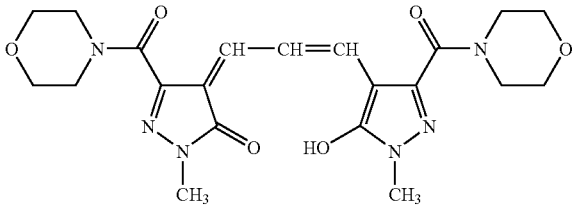

(2 mg/m$^2$)

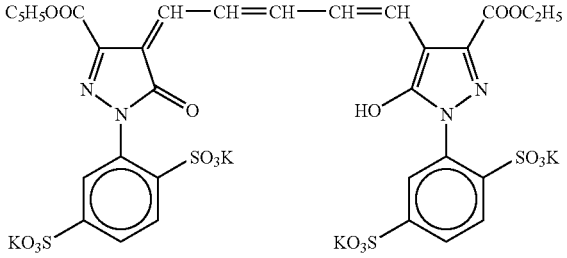

(3 mg/m$^2$)

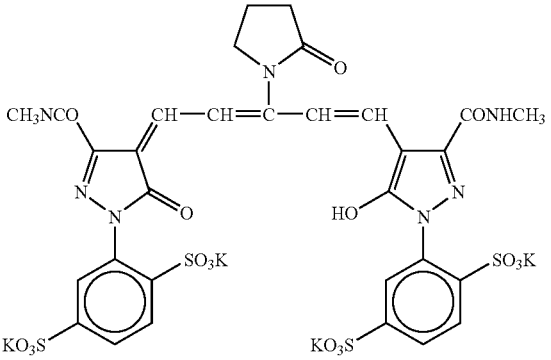

(7 mg/m$^2$)

(Layer Constitution)

The composition of each layer is shown below. The numbers show coating amounts (g/m 2). In the case of the silver halide emulsion, the coating amount is in terms of silver.

Support

Polyethylene Resin Laminated Paper

{The polyethylene resin on the first layer side contained a white pigment ($TiO_2$: content of 16 mass %, ZnO: content of 4 mass %), a fluorescent whitening agent (4,4'-bis(5-methylbenzoxazolyl)stilbene: content of 0.03 mass %) and a bluish dye (ultramarine)}

| First Layer (Blue-Sensitive Emulsion Layer) | |
|---|---|
| Emulsion B-1 | 0.24 |
| Gelatin | 1.25 |
| Yellow coupler (ExY) | 0.57 |
| Color-image stabilizer (Cpd-1) | 0.07 |
| Color-image stabilizer (Cpd-2) | 0.04 |

-continued

| | |
|---|---|
| Color-image stabilizer (Cpd-3) | 0.07 |
| Color-image stabilizer (Cpd-8) | 0.02 |
| Solvent (Solv-1) | 0.21 |
| Second Layer (Color-Mixing Inhibiting Layer) | |
| Gelatin | 0.99 |
| Color-mixing inhibitor (Cpd-4) | 0.09 |
| Color-image stabilizer (Cpd-5) | 0.018 |
| Color-image stabilizer (Cpd-6) | 0.13 |
| Color-image stabilizer (Cpd-7) | 0.01 |
| Solvent (Solv-1) | 0.06 |
| Solvent (Solv-2) | 0.022 |
| Third Layer (Green-Sensitive Emulsion Layer) | |
| Emulsion G-1 | 0.15 |
| Gelatin | 1.36 |
| Magenta coupler (ExM) | 0.15 |
| Ultraviolet absorbing agent (UV-A) | 0.14 |
| Color-image stabilizer (Cpd-2) | 0.02 |
| Color-mixing inhibitor (Cpd-4) | 0.002 |
| Color-image stabilizer (Cpd-6) | 0.09 |
| Color-image stabilizer (Cpd-8) | 0.02 |
| Color-image stabilizer (Cpd-9) | 0.03 |
| Color-image stabilizer (Cpd-10) | 0.01 |
| Color-image stabilizer (Cpd-11) | 0.0001 |
| Solvent (Solv-3) | 0.11 |
| Solvent (Solv-4) | 0.22 |
| Solvent (Solv-5) | 0.20 |
| Fourth Layer (Color-Mixing Inhibiting Layer) | |
| Gelatin | 0.71 |
| Color-mixing inhibitor (Cpd-4) | 0.06 |
| Color-image stabilizer (Cpd-5) | 0.013 |
| Color-image stabilizer (Cpd-6) | 0.10 |
| Color-image stabilizer (Cpd-7) | 0.007 |
| Solvent (Solv-1) | 0.04 |
| Solvent (Solv-2) | 0.16 |
| Fifth Layer (Red-Sensitive Emulsion Layer) | |
| Emulsion R-1 | 0.13 |
| Gelatin | 1.11 |
| Cyan coupler (ExC-2) | 0.13 |
| Cyan coupler (ExC-3) | 0.03 |
| Color-image stabilizer (Cpd-1) | 0.05 |
| Color-image stabilizer (Cpd-6) | 0.06 |
| Color-image stabilizer (Cpd-7) | 0.02 |
| Color-image stabilizer (Cpd-9) | 0.04 |
| Color-image stabilizer (Cpd-10) | 0.01 |
| Color-image stabilizer (Cpd-14) | 0.01 |
| Color-image stabilizer (Cpd-15) | 0.12 |
| Color-image stabilizer (Cpd-16) | 0.03 |
| Color-image stabilizer (Cpd-17) | 0.09 |
| Color-image stabilizer (Cpd-18) | 0.07 |
| Solvent (Solv-5) | 0.15 |
| Solvent (Solv-8) | 0.05 |
| Sixth Layer (Ultraviolet Absorbing Layer) | |
| Gelatin | 0.46 |
| Ultraviolet absorbing agent (UV-B) | 0.45 |
| Compound (S1–4) | 0.0015 |
| Solvent (Solv-7) | 0.25 |
| Seventh leyer | |
| Gelatin | 1.00 |
| Acryl-modified copolymer of polyvinyl alcohol (modification degree: 17%) | 0.4 |
| Liquid paraffin | 0.02 |
| Surface-active agent (Cpd-13) | 0.01 |

-continued
(ExY) Yellow coupler
A mixture in 70:30 (molar ratio) of
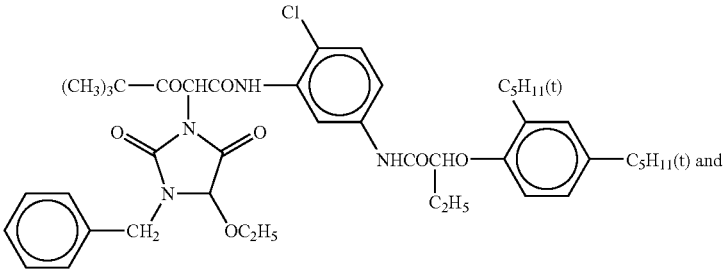
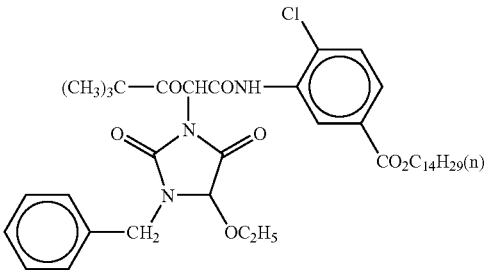
(ExM) Magenta coupler
A mixture in 40:40:20 (molar ratio) of
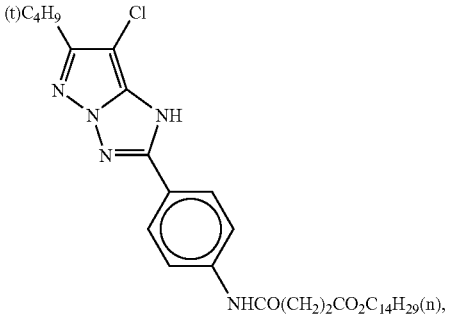
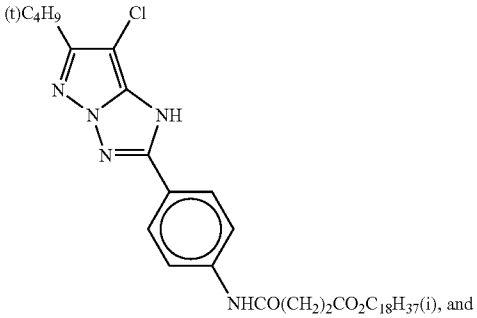
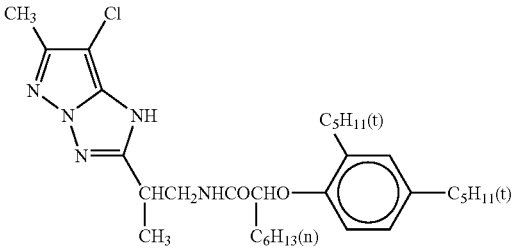

-continued
(ExC-2) Cyan coupler
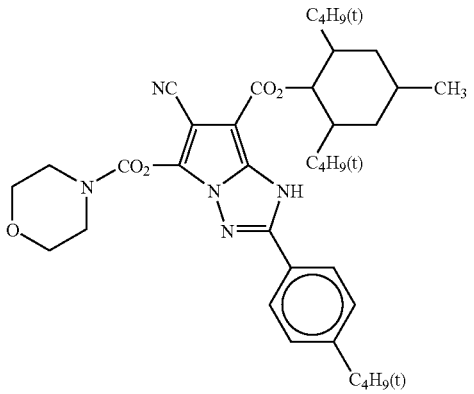
(ExC-3) Cyan coupler
A mixture in 50:25:25 (molar ratio) of
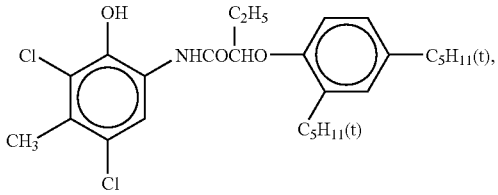
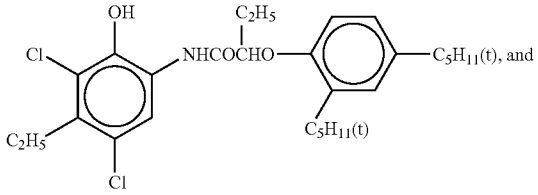
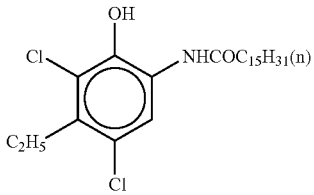
(Cpd-4) Color-mixing inhibitor
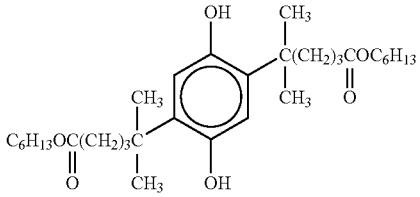
(Cpd-10) Color-image stabilizer
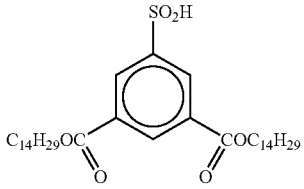

-continued
(Cpd-11)
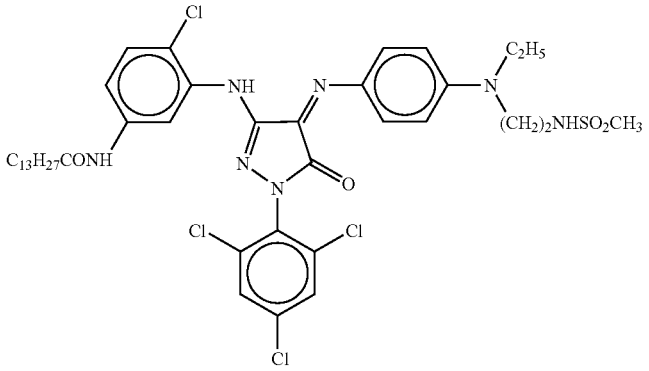
(Cpd-13) Surface-active agent
A mixture in 7:3 (molar ratio) of
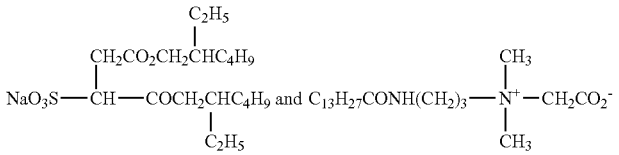
(UV-4) Ultraviolet absorbing agent
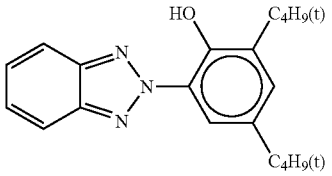
(UV-5) Ultraviolet absorbing agent
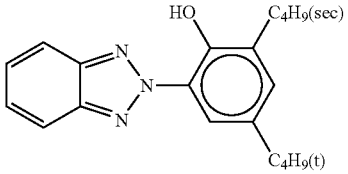
UV-A: A mixture of UV-1/UV-2/UV-3/UV-4 = 4/2/2/3 (mass ratio)
UV-B: A mixture of UV-1/UV-2/UV-3/UV-4/UV-5/UV-6 = 9/3/3/4/5/3 (mass ratio)
UV-C: A mixture of UV2/UV-3/UV-6/UV-07 = 1/1/1/2 (mass ratio)
(Solv-2)
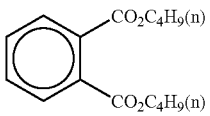
(Solv-8)
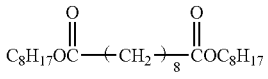

The cyan coupler ExC-2 named in this Example was called as ExC-1 in Example (1)-1. Here were used the same ones as the color image-stabilizers Cpd-1 to Cpd-3, Cpd-5 to Cpd-9 and Cpd-14 to Cpd-18, the color-mixing inhibitor Cpd-19, the ultraviolet absorbing agent UV-1 to UV-3, UV-6 and UV-7, the solvents Solv-1, Solv-3 to Solv-7, and the compound S1-4 as in Example (1)-1.

The thus-obtained sample was called as sample 4-101. Further, samples 4-102 to 4-108 were prepared in the same manner as in the sample 4-101, except that each emulsion in the blue-sensitive emulsion layers was changed as follows, as in Table 12.

TABLE 12

| Sample | Yellow coupler | Blue-sensitive emulsion No. | Br layer | I layer | Ir | Sensitivity | Fluctuation in sensitivity | Fluctuation in gradation | Remarks |
|---|---|---|---|---|---|---|---|---|---|
| 4-101 | ExY | B-1 | X | X | X | 100 | 0.24 | 0.30 | Comparative example |
| 4-102 | ExY | B-2 | ○ | X | X | 120 | 0.22 | 0.28 | Comparative example |
| 4-103 | ExY | B-3 | X | ○ | X | 135 | 0.30 | 0.30 | Comparative example |
| 4-104 | ExY | B-4 | ○ | ○ | X | 135 | 0.25 | 0.29 | Comparative example |
| 4-105 | ExY | B-5 | X | X | ○ | 115 | 0.27 | 0.29 | Comparative example |
| 4-106 | ExY | B-6 | ○ | ○ | ○ | 130 | 0.28 | 0.28 | Comparative example |
| 4-107 | ExY | B-7 | ○ | ○ | ○ | 140 | 0.28 | 0.28 | Comparative example |
| 4-108 | ExY | B-8 | ○ | ○ | ○ | 140 | 0.28 | 0.28 | Comparative example |
| 4-111 | Exemplified 103 | B-1 | X | X | X | 155 | 0.36 | 0.40 | Comparative example |
| 4-112 | Exemplified 103 | B-2 | ○ | X | X | 170 | 0.23 | 0.30 | This invention |
| 4-113 | Exemplified 103 | B-3 | X | ○ | X | 190 | 0.22 | 0.31 | This invention |
| 4-114 | Exemplified 103 | B-4 | ○ | ○ | X | 190 | 0.20 | 0.28 | This invention |
| 4-115 | Exemplified 103 | B-5 | X | X | ○ | 170 | 0.22 | 0.28 | This invention |
| 4-116 | Exemplified 103 | B-6 | ○ | ○ | ○ | 180 | 0.19 | 0.25 | This invention |
| 4-117 | Exemplified 103 | B-7 | ○ | ○ | ○ | 180 | 0.18 | 0.24 | This invention |
| 4-118 | Exemplified 103 | B-8 | ○ | ○ | ○ | 190 | 0.17 | 0.23 | This invention |
| 4-121 | Exemplified 162 | B-1 | X | X | X | 158 | 0.40 | 0.41 | Comparative example |
| 4-128 | Exemplified 162 | B-8 | ○ | ○ | ○ | 195 | 0.18 | 0.21 | This invention |
| 4-131 | Exemplified 165 | B-1 | X | X | X | 160 | 0.38 | 0.42 | Comparative example |
| 4-138 | Exemplified 165 | B-8 | ○ | ○ | ○ | 195 | 0.20 | 0.21 | This invention |

The mark "○" shows "implying (doping), and the mark "X" shows "free".

A sample was prepared in the same manner as Sample 4-101 prepared above except that the composition of the first layer (blue-sensitive emulsion layer) was replaced with the following one. The sample was taken as 4-111.

First Layer (Blue-Sensitive Emulsion Layer)

| | |
|---|---|
| Emulsion B-1 | 0.15 |
| Gelatin | 1.25 |
| Yellow coupler (Exemplified coupler 103) | 0.30 |
| Color-image stabilizer (Cpd-2) | 0.06 |
| Color-image stabilizer (Cpd-3) | 0.07 |
| Color-image stabilizer (Cpd-20) | 0.11 |
| Solvent (Solv-9) | 0.36 |

Here were used the same ones as Cpd-20 and Solv-9 in Example (1)-1.

Samples 4-112 to 4-118 were prepared in the same manner as in the preparation of Sample 4-111 except that the blue-sensitive emulsion layer was replaced as described in Table 12 respectively.

Sample 4-121 was prepared in the same manner as in the preparation of Sample 4-111 except that the yellow coupler in the first layer (the blue-sensitive emulsion layer) was replaced with the exemplified coupler (162) in an equimolar amount. Similarly, Sample 4-128 was prepared in the same manner as in the preparation of Sample 4-121 except that the emulsion in the blue-sensitive emulsion layer was replaced with Emulsion B-8.

Sample 4-131 was prepared in the same manner as in the preparation of Sample 4-111 except that the yellow coupler in the first layer (the blue-sensitive emulsion layer) was replaced with the exemplified coupler (165) in an equimolar amount. Similarly, Sample 4-138 was prepared in the same manner as in the preparation of Sample 4-131 except that the emulsion in the blue-sensitive emulsion layer was replaced with Emulsion B-8.

For examining photographic characteristics of these samples, the following experiment was performed.

Further, each sample was subjected to gradation exposure for sensitometry developing gray color using a sensitometer for high illumination intensity exposure (model HIE manufactured by Yamashita Denso Co., Ltd.), by high illumination intensity exposure of $10^{-6}$ second.

After exposure, each sample was processed according to the following color development process A.

Processing A is shown as follows.

Processing A

The above-described light-sensitive material sample was processed to a 127 mm width roll-like form. Mini-lab printer processor PP1258AR (trade name) manufactured by Fuji Photo Film Co., Ltd. was used to subject the light-sensitive material sample to image-wise exposure. A continuous processing (running test) was performed until an accumulated replenisher amount of color developer in the following processing steps presented below reached two times the tank volume of a color developer. The processing with the resulting running processing solution was named processing A.

| Processing step | Temperature | Time | Replenisher amount* |
|---|---|---|---|
| Color development | 38.5° C. | 45 sec | 45 ml |
| Bleach-fixing | 38.0° C. | 45 sec | 35 ml |
| Rinse (1) | 38.0° C. | 20 sec | — |
| Rinse (2) | 38.0° C. | 20 sec | — |

-continued

| Processing step | Temperature | Time | Replenisher amount* |
|---|---|---|---|
| Rinse (3)** | 38.0° C. | 20 sec | — |
| Rinse (4)** | 38.0° C. | 30 sec | 121 ml |

(Note)
*Replenisher amount per $m^2$ of the light-sensitive material to be processed.
**A rinse cleaning system RC50D (trade name), manufactured by Fuji Photo Film Co., Ltd., was installed in the rinse (3), and the rinse solution was taken out from the rinse (3) and sent to a reverse osmosis membrane module (RC50D) by using a pump. The permeated water obtained in that tank was supplied to the rinse (4), and the concentrated water was returned to the rinse (3). Pump pressure was controlled such that the water to be permeated in the reverse osmosis module would be maintained in an amount of 50 to 300 ml/min, and the rinse solution was circulated under controlled temperature for 10 hours a day. The rinse was made in a tank counter-current system from (1) to (4).

The composition of each processing solution was as follows.

| | (Tank solution) | (Replenisher) |
|---|---|---|
| (Color developer) | | |
| Water | 800 ml | 800 ml |
| Dimethylpolysiloxane-series surfactant (Silicone KF351A (trade name) manufactured by Shin-Etsu Chemical Co., Ltd.) | 0.1 g | 0.1 g |
| Tri(isopropanol) amine | 8.8 g | 8.8 g |
| Ethylenediamine tetraacetic acid | 4.0 g | 4.0 g |
| Polyethylenegrycol (Molecular weight: 300) | 10.0 g | 10.0 g |
| Sodium 4,5-dihydroxybenzene-1,3-disulfonate | 0.5 g | 0.5 g |
| Potassium chloride | 10.0 g | — |
| Potassium bromide | 0.040 g | 0.010 g |
| Triazinylaminostilbene-series fluorescent brightening agent (Hakkol FWA-SF (trade name) manufactured by Showa Chemical Co., Ltd.) | 2.5 g | 5.0 g |
| Sodium sulfite | 0.1 g | 0.1 g |
| Disodium-N,N-bis(sulfonatoethyl) hydroxylamine | 8.5 g | 11.1 g |
| N-Ethyl-N-(β-methanesulfonamidoethyl)-3-methyl-4-amino-4-aminoaniline · 3/2 sulfuric acid · $1H_2O$ | 5.0 g | 15.7 g |
| Potassium carbonate | 26.3 g | 26.3 g |
| Water to make | 1000 ml | 1000 ml |
| pH (25° C./adjusted using sulfuric acid and potassium hydroxide) | 10.15 | 12.50 |
| (Bleach-fixing solution) | | |
| Water | 700 ml | 600 ml |
| Ammonium iron (III) ethylenediaminetetraacetate | 47.0 g | 94.0 g |
| Ethylenediamine tetraacetic acid | 1.4 g | 2.8 g |
| m-Carboxybenzenesulfinic acid | 8.3 g | 16.5 g |
| Nitric acid (67%) | 16.5 g | 33.0 g |
| Imidazole | 14.6 g | 29.2 g |
| Ammonium thiosulfate (750 g/l) | 107.0 ml | 214.0 ml |
| Ammonium sulfite | 16.0 g | 32.0 g |
| Ammonium bisulfite | 23.1 g | 46.2 g |
| Water to make | 1000 ml | 1000 ml |
| pH (25° C./adjusted using acetic acid and aqua ammonia) | 6.0 | 6.0 |
| (Rinse solution) | | |

Here was used the same rinse solution as in Example (1)-1 except that the temperature at measuring pH was not limited.

Yellow density of each sample after processing was measured, and characteristic curves by high illumination intensity exposure of $10^{-6}$ second were obtained. The sensitivity is defined as an antilogarithm of the reciprocal of the exposure amount giving the developed color density +0.7, which is higher than the minimum density of developed color by 0.7, and expressed as a relative value, assuming that the sensitivity of Sample 4-101 is 100. The larger the value is, the higher the sensitivity is and it is preferable. The fluctuation in sensitivity is expressed as a logarithm of a difference between an exposure amount giving the developed color density +0.7 in the color developing time of 30 seconds and an exposure amount giving the developed color density +0.7 in the color developing time of 60 seconds. The smaller the value is, the more stable photographic performance can be obtained and it is preferable. The fluctuation in gradation is expressed as a difference between a gradient of a straight line connecting the point of density 1.0 and the point of density 2.0 in the color developing time of 30 seconds and a gradient of a straight line connecting the point of density 1.0 and the point of density 2.0 in the color developing time of 60 seconds. Still, the smaller the value is, the more stable photographic performance can be obtained and it is preferable. These results are shown in Table 12 described above.

As apparent from the results in Table 12, it is seen that Samples 4-112 to 4-118, 4-128 and 4-138 of the present invention each showed a high sensitivity. Particularly, it is seen that Samples 4-116 to 4-118, 4-128 and 4-138, each of which contains blue-sensitive silver halide emulsion having a silver bromide content of 0.1 mole % or more, and 7 mole % or less, and a silver iodide content of 0.02 mole % or more, and 1 mole % or less, and further containing a six-coordinate complex having Ir as a central metal each showed a low fluctuation in sensitivity and gradation due to the color developing time variation, resulting in a stable photographic performance.

Example (4)-2

For examining photographic characteristics by laser scanning exposure with each sample in Example 4-1, the following experiment was performed.

Three types of semiconductor laser were used as laser light sources, i.e., a blue semiconductor laser having a wavelength of about 440 nm (reported by NICHIA Corporation in the 48th symposium of Applied physics-relating Federation (March 2001)), a green semiconductor laser having a wavelength of about 530 nm taken out by changing the wavelength of a semiconductor laser (the emitting wavelength: about 1064 nm) by an SHG crystal of a wave guide-like $LiNbO_3$ having an inverting domain structure, and a red semiconductor laser having a wavelength of about 650 nm (HITACHI Type No. HL 6501 MG).

Each of three-color laser beams was made to be able to transfer vertically to scanning direction by a polygonal mirror and successively scanning exposure the sample. For restraining the fluctuation of light amount due to the change of temperature, the temperature of a semiconductor laser was maintained constant using Peltier element. The effective beam diameter was 80 μm, the scanning pitch was 42.3 μm (600 dpi) and the average exposure time per one pixel was $1.7\times10^{-7}$ second. According to this exposure process, a gradation exposure for sensitometry developing gray color was given.

After exposure, each sample was subjected to an ultra-rapid processing in accordance with the development processing shown below.

Processing

The continuous processing was carried out in the same manner as in Processing B of Example (1)-1, except that the color developing replenisher amount was not two times but half of the amount of the color developing tank capacity.

| Processing step | Temperature | Time | Replenisher amount* |
|---|---|---|---|
| Color development | 45.0° C. | 20 sec | 45 ml |
| Bleach-fixing | 40.0° C. | 20 sec | 35 ml |
| Rinse (1) | 40.0° C. | 10 sec | — |
| Rinse (2) | 40.0° C. | 10 sec | — |
| Rinse (3)** | 40.0° C. | 10 sec | — |
| Rinse (4) | 38.0° C. | 10 sec | 121 ml |
| Drying | 80.0° C. | 20 sec | |

(Note)
*Replenisher amount per $m^2$ of the light-sensitive material to be processed.
**A rinse cleaning system RC50D (trade name), manufactured by Fuji Photo Film Co., Ltd., was installed in the rinse (3), and the rinse solution was taken out from the rinse (3) and sent to a reverse osmosis module (RC50D) by using a pump. The permeated water obtained in that tank was supplied to the rinse, and the concentrated water was returned to the rinse (3). Pump pressure was controlled such that the water to be permeated in the reverse osmosis module would be maintained in an amount of 50 to 300 ml/min, and the rinse solution was circulated under controlled temperature for 10 hours a day. The rinse was made in a four-tanked counter-current system from (1) to (4).

The composition of each processing solution was as follows.

| (Color developer) | (Tank solution) | (Replenisher) |
|---|---|---|
| Water | 800 ml | 600 ml |
| Fluorescent whitening agent (FL-1) | 5.0 g | 8.5 g |
| Triisopropanolamine | 8.8 g | 8.8 g |
| Sodium p-toluenesulfonate | 20.0 g | 20.0 g |
| Ethylenediamine tetraacetic acid | 4.0 g | 4.0 g |
| Sodium sulfite | 0.10 g | 0.50 g |
| Potassium chloride | 10.0 g | — |
| Sodium 4,5-dihydroxybenzene-1,3-disulfonate | 0.50 g | 0.50 g |

-continued

| (Color developer) | (Tank solution) | (Replenisher) |
|---|---|---|
| Disodium-N,N-bis(sulfonatoethyl) hydroxylamine | 8.5 g | 14.5 g |
| 4-Amino-3-methyl-N-ethyl-N-(β-methanesulfonamidoethyl) aniline · 3/2 sulfate · monohydrate | 10.0 g | 22.0 g |
| Potassium carbonate | 26.3 g | 26.3 g |
| Water to make | 1000 ml | 1000 ml |
| pH (25° C./adjusted using sulfuric acid and potassium hydroxide) | 10.35 | 12.6 |

Here were used the same ones as the beach-fixing solution and rinse solution in Example (1)-1. However, FL-1 called in this Example was named FL-3 in Example (1)-1.

Yellow color developed density of sample after processing was measured, and characteristic curves by a laser exposure and an ultra-rapid processing were obtained. The sensitivity is defined as an antilogarithm of the reciprocal of the exposure amount giving the developed color density +0.7, which is higher than the minimum density of developed color by 0.7, and expressed as a relative value, assuming that the sensitivity of Sample 4-101 is 100. The larger the value is, the higher the sensitivity is and it is preferable. The fluctuation in sensitivity is expressed as a logarithm of a difference between an exposure amount giving the developed color density +0.7 in the color developing time of 15 seconds and an exposure amount giving the developed color density +0.7 in the color developing time of 25 seconds. The smaller the value is, the more stable photographic performance can be obtained and it is preferable. The fluctuation in gradation is expressed as a difference between a gradient of a straight line connecting the point of density 1.0 and the point of density 2.0 in the color developing time of 15 seconds and a gradient of a straight line connecting the point of density 1.0 and the point of density 2.0 in the color developing time of 25 seconds. Still, the smaller the value is, the more stable photographic performance can be obtained and it is preferable. These results are shown in Table 13.

TABLE 13

| Sample | Yellow coupler | Blue-sensitive emulsion No. | Br layer | I layer | Ir | Sensitivity | Fluctuation in sensitivity | Fluctuation in gradation | Remarks |
|---|---|---|---|---|---|---|---|---|---|
| 4-101 | ExY | B-1 | X | X | X | 100 | 0.36 | 0.40 | Comparative example |
| 4-105 | ExY | B-5 | X | X | ○ | 118 | 0.38 | 0.37 | Comparative example |
| 4-108 | ExY | B-8 | ○ | ○ | ○ | 135 | 0.36 | 0.38 | Comparative example |
| 4-111 | Exemplified 103 | B-1 | X | X | X | 150 | 0.45 | 0.55 | Comparative example |
| 4-115 | Exemplified 103 | B-5 | X | X | ○ | 180 | 0.22 | 0.31 | This invention |
| 4-118 | Exemplified 103 | B-8 | ○ | ○ | ○ | 210 | 0.19 | 0.30 | This invention |
| 4-121 | Exemplified 162 | B-1 | X | X | X | 150 | 0.48 | 0.52 | Comparative example |
| 4-128 | Exemplified 162 | B-8 | ○ | ○ | ○ | 210 | 0.17 | 0.24 | This invention |
| 4-131 | Exemplified 165 | B-1 | X | X | X | 150 | 0.43 | 0.52 | Comparative example |
| 4-138 | Exemplified 165 | B-8 | ○ | ○ | ○ | 205 | 0.18 | 0.24 | This invention |

The mark "○" shows "implying (doping)", and the mark "X" shows "free".

As apparent from the results in Table 13, it is seen that Samples 4-115, 4-118, 4-128 and 4-138 of the present invention also each showed a high sensitivity, even by the laser exposure and the ultra-rapid processing. Particularly, it is seen that Samples 4-118, 4-128 and 4-138, each of which contains blue-sensitive silver halide emulsion having a silver bromide content of 0.1 mole % or more, and 7 mole % or less, and a silver iodide content of 0.02 mole % or more, and 1 mole % or less, and further containing a six-coordinate complex having Ir as a central metal each showed a low fluctuation in sensitivity and gradation due to the color developing time variation, resulting in a stable photographic performance.

Having described our invention as related to the present embodiments, it is our intention that the invention not be limited by any of the details of the description, unless otherwise specified, but rather be construed broadly within its spirit and scope as set out in the accompanying claims.

What is claimed is:

1. A silver halide color photographic light-sensitive material comprising a support having thereon at least one yellow color developable light-sensitive silver halide emulsion layer, at least one magenta color developable light-sensitive silver halide emulsion layer, and at least one cyan color developable light-sensitive silver halide emulsion layer: which comprises at least one yellow dye-forming coupler represented by formula (I) and at least one magenta dye-forming coupler represented by formula (MC-I) each set forth below;

formula (I)

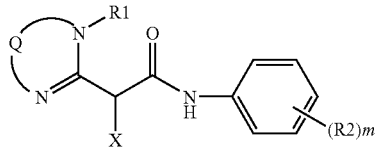

wherein Q represents a group of non-metal atoms that form a 5- to 7-membered ring in combination with —N═C—N(R1 )—, R1 represents a substituent, R2 represents a substituent, m represents an integer of 0 to 5, when m is 2 or more, R2s may be the same or different, or R2s may bond each other to form a ring, and X represents a hydrogen atom or a group capable of being split-off upon a coupling reaction with an oxidized product of a developing agent; formula (MC-1)

formula (MC-1)

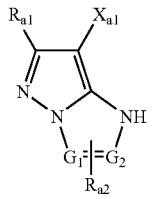

wherein $R_{a1}$ represents a hydrogen atom or a substituent, one of $G_1$ and $G_2$ represents a carbon atom and the other one thereof represents a nitrogen atom, $R_{a2}$ represents a substituent and bonds to the carbon atom represented by $G_1$ or $G_2$, the substituent of $R_{a1}$ or $R_{a2}$ may further have a substituent, a polymer of the unit derived from formula (MC-I) may be formed via $R_{a1}$ or $R_{a2}$, alternatively, the unit derived from formula (MC-I) may bond to a high molecular chain via $R_{a1}$ or $R_{a2}$, and $X_{a1}$ represents a hydrogen atom or a group that can split off through a coupling reaction with the oxidized product of an aromatic primary amine color-developing agent;

wherein the silver halide color photographic light-sensitive material satisfies any of the condition 1) or 2) described below:

Condition 1), in which silver halide emulsion to be contained in any of the light-sensitive silver halide emulsion layers contains an iridium ion compound having at least one ligand of a 5-membered or 6-membered heterocyclic compound; and Condition 2), in which the silver halide color photographic light-sensitive material comprises at least one cyan dye-forming coupler represented by formula (A);

formula (A)

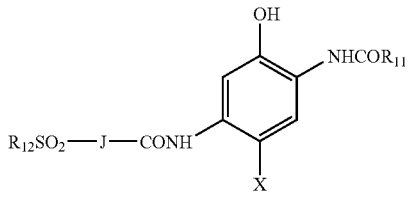

wherein $R_{11}$ and $R_{12}$ each independently represent an alkyl group or an aryl group, J represents an alkylene group, and X represents a hydrogen atom or a group that can split off upon a reaction with an oxidized color developing agent.

2. The silver halide color photographic light-sensitive material according to claim 1, wherein the silver halide color photographic light-sensitive satisfies the condition (2).

3. The silver halide color photographic light-sensitive material according to claim 1, comprising a support having thereon at least one blue-sensitive silver halide emulsion layer containing a yellow dye-forming coupler, at least one green-sensitive silver halide emulsion layer containing a magenta dye-forming coupler, and at least one red sensitive silver halide emulsion layer containing a cyan dye-forming coupler, wherein at least one of said silver halide emulsion layers contains a silver halide emulsion whose silver chloride content is 95 mole % or more, and wherein a coating amount of said yellow dye-forming coupler represented by formula (I) is in the range of 0.1 to 1.0 milli-mole per $m^2$ of the light-sensitive material.

4. The silver halide color photographic light-sensitive material according to claim 3, wherein a coating amount of the silver halide used in a blue-sensitive silver halide emulsion layer is in the range of 0.12 to 0.22 g (amount in terms of silver) per $m^2$ of the light-sensitive material.

5. The silver halide color photographic light-sensitive material according to claim 1, comprising a support having thereon at least one yellow color developable blue-sensitive silver halide emulsion layer, at least one magenta color developable green-sensitive silver halide emulsion layer, and at least one cyan color developable red-sensitive silver halide emulsion layer, wherein said yellow color developable blue-sensitive silver halide emulsion layer comprises at least one yellow dye-forming coupler represented by formula (I) and a blue-sensitive silver halide emulsion comprising silver halide grains having a silver chloride content of 90 mole % or more and a silver bromide content of from 0.1 mole % to 7 mole %, and wherein said blue-sensitive silver halide emulsion comprises silver halide grains having a layered silver bromide-containing phase.

6. The silver halide color photographic light-sensitive material according to claim 1, comprising a support having thereon at least one yellow color developable blue-sensitive silver halide emulsion layer, at least one magenta color developable green-sensitive silver halide emulsion layer, and at least one cyan color developable red-sensitive silver halide emulsion layer, wherein said yellow color developable blue-sensitive silver halide emulsion layer comprises at least one yellow dye-forming coupler represented by formula (I) and a blue-sensitive silver halide emulsion comprising silver halide grains having a silver chloride content of 90 mole % or more and a silver iodide content of from 0.02 mole % to 1 mole %, and wherein said blue-sensitive silver halide emulsion comprises silver halide grains having a layered silver iodide-containing phase.

7. The silver halide color photographic light-sensitive material according to claim 1, comprising a support having thereon at least one yellow color developable blue-sensitive silver halide emulsion layer, at least one magenta color developable green-sensitive silver halide emulsion layer, and at least one cyan color developable red-sensitive silver halide emulsion layer, wherein said yellow color developable blue-sensitive silver halide emulsion layer comprises at least one yellow dye forming coupler represented by formula (I) and a blue-sensitive silver halide emulsion comprising silver halide grains having a silver chloride content of 90 mole % or more, and wherein said blue-sensitive silver halide emulsion comprises silver halide grains containing a six-coordinate complex having Ir as a central metal.

8. The silver halide color photographic light-sensitive material according to claim 5, wherein said blue-sensitive silver halide emulsion comprises silver halide grains having a silver chloride content of 90 mole % or more, a silver bromide content of from 0.1 mole % to 7 mole % and a silver iodide content of from 0.02 mole % to 1 mole % and said silver halide grains in the blue-sensitive silver halide emulsion each have a layered silver bromide-containing phase and a layered silver iodide-containing phase.

9. The silver halide color photographic light-sensitive material according to claim 5, wherein said silver halide grains in the blue-sensitive silver halide emulsion are cubic or tetradecahedral grains.

10. The silver halide color photographic light-sensitive material according to claim 6, wherein said silver halide grains in the blue-sensitive silver halide emulsion are cubic or tetradecahedral grains.

11. The silver halide color photographic light-sensitive material according to claim 7, wherein said silver halide grains in the blue-sensitive silver halide emulsion are cubic or tetradecahedral claims.

12. The silver halide color photographic light-sensitive material according to claim 5, wherein said silver halide grains in the blue-sensitive silver halide emulsion are tabular grains having an average aspect ratio of 3 or more.

13. The silver halide color photographic light-sensitive material according to claim 6, wherein said silver halide grains in the blue-sensitive silver halide emulsion are tabular grains having an average aspect ratio of 3 or more.

14. The silver halide color photographic light-sensitive material according to claim 7, wherein said silver halide grains in the blue-sensitive silver halide emulsion are tabular grains having an average aspect ratio of 3 or more.

15. The silver halide color photographic light-sensitive material according to claim 2, wherein the yellow dye-forming coupler represented by formula (I) is a yellow dye-forming coupler represented by formula (II):

formula (II)

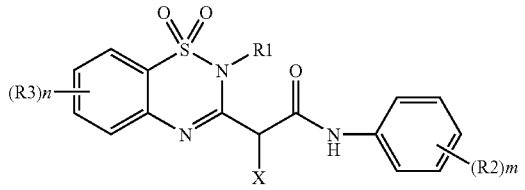

wherein R1 represents a substituent; R2 represents a substituent; m represents an integer of 0 to 5; when m is 2 or more, the multiple R2s may be the same or different, and the R2s may bond each other to form a ring; R3 represents a substituent; n represents an integer of 0 to 4; when n is 2 or more, the multiple R3s may be the same or different, and the R3s may bond each other to form a ring; and X represents a hydrogen atom or a group capable of being split-off upon a coupling reaction with an oxidized product of a developing agent.

16. The silver halide color photographic light-sensitive material according to claim 1, wherein the yellow dye-forming coupler represented by formula (I) is a yellow dye-forming coupler represented by formula (II):

formula (II)

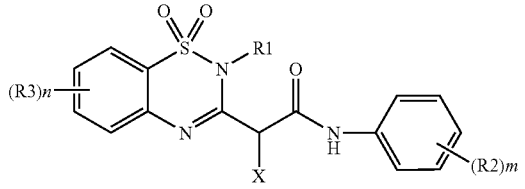

wherein R1 represents a substituent; R2 represents a substituent; m represents an integer of 0 to 5; when m is 2 or more, the multiple R2s may be the same or different, and the R2s may bond each other to form a ring; R3 represents a substituent; n represents an integer of 0 to 4; when n is 2 or more, the multiple R3s may be the same or different, and the R3s may bond each other to form a ring; and X represents a hydrogen atom or a group capable of being split-off upon a coupling reaction with an oxidized product of a developing agent.

17. The silver halide color photographic light-sensitive material according to claim 3, wherein the yellow dye-forming coupler represented by formula (I) is a yellow dye-forming coupler represented by formula (II):

formula (II)

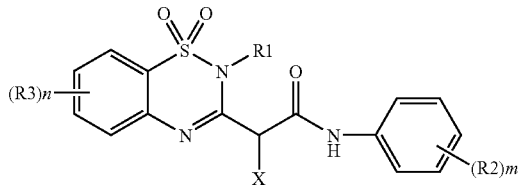

wherein R1represents a substituent; R2 represents a substituent; m represents an integer of 0 to 5; when m is 2 or more, the multiple R2s may be the same or different, and the R2s may bond each other to form a ring; R3 represents a substituent; n represents an integer of 0 to 4; when n is 2 or more, the multiple R3s may be the same or different, and the R3s may bond each other to form a ring; and X represents a hydrogen atom or a group capable of being split-off upon a coupling reaction with an oxidized product of a developing agent.

18. The silver halide color photographic light-sensitive material according to claim 5, wherein the yellow dye-forming coupler represented by formula (I) is a yellow dye-forming coupler represented by formula (II):

formula (II)

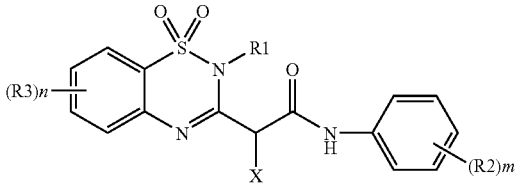

wherein R1 represents a substituent; R2 represents a substituent; m represents an integer of 0 to 5; when m is 2 or more, the multiple R2s may be the same or different, and the R2s may bond each other to form a ring; R3 represents a substituent; n represents an integer of 0 to 4; when n is 2 or more, the multiple R3s may be the same or different, and the R3s may bond each other to form a ring; and X represents a hydrogen atom or a group capable of being split-off upon a coupling reaction with an oxidized product of a developing agent.

19. The silver halide color photographic light-sensitive material according to claim 6, wherein the yellow dye-forming coupler represented by formula (I) is a yellow dye-forming coupler represented by formula (II):

formula (II)

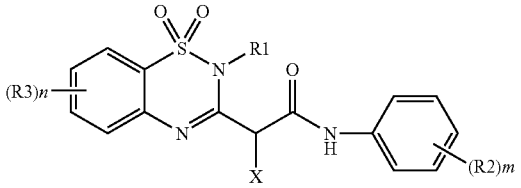

wherein R1 represents a substituent; R2 represents a substituent; m represents an integer of 0 to 5; when m is 2 or more, the multiple R2s may be the same or different, and the R2s may bond each other to form a ring; R3 represents a substituent; n represents an integer of 0 to 4; when n is 2 or more, the multiple R3s may be the same or different, and the R3s may bond each other to form a ring; and X represents a hydrogen atom or a group capable of being split-off upon a coupling reaction with an oxidized product of a developing agent.

20. The silver halide color photographic light-sensitive material according to claim 7, wherein the yellow dye-forming coupler represented by formula (I) is a yellow dye-forming coupler represented by formula (II):

formula (II)

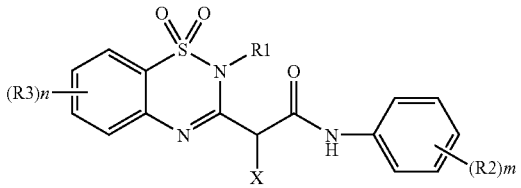

wherein R1 represents a substituent; R2 represents a substituent; m represents an integer of 0 to 5; when m is 2 or more, the multiple R2s may be the same or different, and the R2s may bond each other to form a ring; R3 represents a substituent; n represents an integer of 0 to 4; when n is 2 or more, the multiple R3s may be the same or different, and the R3s may bond each other to form a ring; and X represents a hydrogen atom or a group capable of being split-off upon a coupling reaction with an oxidized product of a developing agent.

21. A silver halide color photographic light-sensitive material comprising a support having thereon at least one yellow color developable light-sensitive silver halide emulsion layer, at least one magenta color developable light-sensitive silver halide emulsion layer, and at least one cyan color developable light-sensitive silver halide emulsion layer: which comprises at least one yellow dye-forming coupler represented by formula (I) and at least one magenta dye-forming coupler represented by formula (M-I) each set forth below;

formula (I)

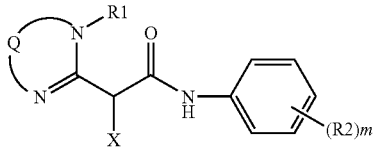

wherein Q represents a group of non-metal atoms that form a 5- to 7-membered ring in combination with —N═C—N(R1)—, R1 represents a substituent, R2 represents a substituent, m represents an integer of 0 to 5, when m is 2 or more, R2s may be the same or different, or R2s may bond each other to form a ring, and X represents a hydrogen atom or a group capable of being split-off upon a coupling reaction with an oxidized product of a developing agent;

Formula (M–I)

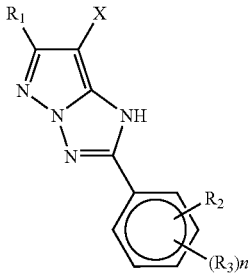

wherein $R_1$ represents a group represented by the following formula (Q-1), (Q-2) or (Q-3); $R_2$ and $R_3$ each represent a substituent; n represents an integer of 0 to 4; X represents a hydrogen atom, or a group capable of being released by a coupling reaction with an oxidation product of a developing agent:

$$—C(R_4)(R_5)(R_6) \qquad \text{Formula(Q-1)}$$

wherein $R_4$ represents an alkyl group, a cycloalkyl group, an aryl group or a heterocyclic group; $R_5$ and $R_6$ each represent a substituent; and at least two of $R_1$, $R_5$ and $R_6$ may be connected to form a 5- to 7-membered monocyclic or condensed ring;

$$—CH(R_7)—R8 \qquad \text{Formula(Q-2)}$$

wherein $R_7$ represents an alkyl group, a cycloalkyl group, an aryl group or a heterocyclic group; $R_8$ represents a substituent; and $R_7$ and $R_8$ may be connected to form a 5- to 7-membered monocyclic or condensed ring;

Formula (Q–3)

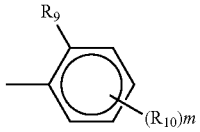

wherein $R_9$ and $R_{10}$ each represent a substituent; m represents an integer of 0 to 4; and when m is 2 or more, two or more of R10 may be the same or different.

* * * * *